US009208658B2

(12) United States Patent
Kato et al.

(10) Patent No.: US 9,208,658 B2
(45) Date of Patent: Dec. 8, 2015

(54) SLOT MACHINE INCLUDING A PLURALITY OF VIDEO REEL STRIPS

(71) Applicants: Universal Entertainment Corporation, Tokyo (JP); Aruze Gaming America, Inc., Las Vegas, NV (US)

(72) Inventors: Yoichi Kato, Tokyo (JP); Hiroaki Kashima, Tokyo (JP); Naoya Shirai, Tokyo (JP); Masumi Fujisawa, Tokyo (JP); Hiroki Nakamura, Tokyo (JP); Takeshi Aoki, Tokyo (JP); Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 0 days.

(21) Appl. No.: 14/534,451

(22) Filed: Nov. 6, 2014

(65) Prior Publication Data

US 2015/0065225 A1 Mar. 5, 2015

Related U.S. Application Data

(63) Continuation of application No. 14/018,804, filed on Sep. 5, 2013.

(30) Foreign Application Priority Data

Oct. 1, 2012 (JP) ..... 2012-219783
Dec. 27, 2012 (JP) ..... 2012-285521

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3262* (2013.01); *G07F 17/3267* (2013.01)

(58) Field of Classification Search
USPC ..... 463/20
See application file for complete search history.

(56) References Cited

U.S. PATENT DOCUMENTS

| | | | |
|---|---|---|---|
| 2006/0030390 | A1 | 2/2006 | Okada |
| 2008/0113739 | A1 | 5/2008 | Visser |
| 2008/0113757 | A1 | 5/2008 | Sakuma |
| 2009/0042636 | A1 | 2/2009 | Taylor |

(Continued)

FOREIGN PATENT DOCUMENTS

| | | |
|---|---|---|
| CN | 1733344 | 2/2006 |
| CN | 101061523 | 10/2007 |

OTHER PUBLICATIONS

Macau Office Action of MO Patent Application No. I/ 001243, Dated Jan. 21, 2015.

*Primary Examiner* — Pierre E Elisca
(74) *Attorney, Agent, or Firm* — Lex IP Meister, PLLC

(57) ABSTRACT

Provided is a slot machine capable of reducing unfairness which may result between a player who has made an investment and a player who has not made an investment and allowing a player to proceed with a game by making an investment in expectation of a jackpot at ease. Each money amount which is constant is accumulated independently of a number of bets each time betting is conducted, and upon winning a jackpot, a money amount calculated by multiplying a money amount accumulated until then by a multiplying factor based on the number of bets is provided.

8 Claims, 106 Drawing Sheets

(56) References Cited

U.S. PATENT DOCUMENTS

| | | | | |
|---|---|---|---|---|
| 2012/0172106 | A1 | 7/2012 | Caputo | |
| 2014/0094250 | A1* | 4/2014 | Inamura et al. | 463/20 |
| 2014/0135096 | A1* | 5/2014 | Aida et al. | 463/20 |
| 2014/0179401 | A1 | 6/2014 | Taylor | |
| 2014/0228092 | A1* | 8/2014 | Inamura et al. | 463/20 |
| 2014/0274300 | A1* | 9/2014 | Fujisawa et al. | 463/20 |
| 2014/0342802 | A1* | 11/2014 | Itagaki et al. | 463/20 |
| 2015/0099569 | A1* | 4/2015 | Suda | 463/20 |
| 2015/0213692 | A1* | 7/2015 | Itagaki et al. | 463/20 |
| 2015/0235511 | A1* | 8/2015 | Zoble et al. | 463/20 |

* cited by examiner

FIG. 5

BASE GAME REEL STRIPS

| CODE NO. | REEL 1 | REEL 2 | REEL 3 | REEL 4 | REEL 5 |
|---|---|---|---|---|---|
| 0 | LION | LION | LION | LION | LION |
| 1 | LION | LION | LION | LION | LION |
| 2 | LION | LION | LION | LION | LION |
| 3 | LION | LION | LION | LION | LION |
| 4 | CHEETAH | CHEETAH | CHEETAH | CHEETAH | CHEETAH |
| 5 | CHEETAH | CHEETAH | CHEETAH | CHEETAH | CHEETAH |
| 6 | CHEETAH | CHEETAH | CHEETAH | CHEETAH | CHEETAH |
| 7 | CHEETAH | CHEETAH | CHEETAH | CHEETAH | CHEETAH |
| 8 | WLEOPARD | WILD | WLEOPARD | WLEOPARD | WLEOPARD |
| 9 | WLEOPARD | WLEOPARD | WLEOPARD | WLEOPARD | WLEOPARD |
| 10 | WLEOPARD | WLEOPARD | WLEOPARD | WLEOPARD | WLEOPARD |
| 11 | WLEOPARD | WLEOPARD | WLEOPARD | WLEOPARD | WLEOPARD |
| 12 | BLEOPARD | WLEOPARD | BLEOPARD | BLEOPARD | BLEOPARD |
| 13 | BLEOPARD | WILD | BLEOPARD | BLEOPARD | BLEOPARD |
| 14 | BLEOPARD | BLEOPARD | BLEOPARD | BLEOPARD | BLEOPARD |
| 15 | BLEOPARD | BLEOPARD | BLEOPARD | BLEOPARD | BLEOPARD |
| 16 | TIGER | BLEOPARD | TIGER | TIGER | TIGER |
| 17 | TIGER | BLEOPARD | TIGER | TIGER | TIGER |
| 18 | TIGER | WILD | TIGER | TIGER | TIGER |
| 19 | TIGER | TIGER | TIGER | TIGER | TIGER |
| 20 | LION | TIGER | WILD | WILD | WILD |
| 21 | LION | TIGER | LION | LION | LION |
| 22 | LION | TIGER | LION | LION | LION |
| 23 | LION | WILD | LION | LION | LION |
| 24 | LION | LION | LION | LION | LION |
| 25 | LION | LION | LION | LION | LION |
| 26 | LION | LION | LION | LION | LION |
| 27 | LION | LION | LION | LION | LION |
| 28 | ACE | LION | LION | LION | LION |
| 29 | ACE | LION | FEATURE | FEATURE | WILD |
| 30 | ACE | LION | QUEEN | QUEEN | WLEOPARD |
| 31 | ACE | LION | QUEEN | QUEEN | WLEOPARD |
| 32 | WLEOPARD | FEATURE | QUEEN | QUEEN | WLEOPARD |
| 33 | WLEOPARD | QUEEN | QUEEN | QUEEN | WLEOPARD |
| 34 | WLEOPARD | QUEEN | WILD | WILD | QUEEN |
| 35 | WLEOPARD | QUEEN | TIGER | TIGER | QUEEN |
| 36 | WLEOPARD | QUEEN | TIGER | TIGER | QUEEN |
| 37 | WLEOPARD | WILD | TIGER | TIGER | QUEEN |
| 38 | WLEOPARD | TIGER | TIGER | TIGER | WILD |
| 39 | WLEOPARD | TIGER | FEATURE | JACK | TIGER |
| 40 | TEN | TIGER | JACK | JACK | TIGER |

FIG. 6

BASE GAME REEL STRIPS

| CODE NO. | REEL 1 | REEL 2 | REEL 3 | REEL 4 | REEL 5 |
|---|---|---|---|---|---|
| 41 | TEN | TIGER | JACK | JACK | TIGER |
| 42 | TEN | FEATURE | JACK | JACK | TIGER |
| 43 | TEN | JACK | JACK | WILD | NINE |
| 44 | CHEETAH | JACK | WILD | BLEOPARD | NINE |
| 45 | CHEETAH | JACK | BLEOPARD | BLEOPARD | NINE |
| 46 | CHEETAH | JACK | BLEOPARD | BLEOPARD | NINE |
| 47 | CHEETAH | WILD | BLEOPARD | BLEOPARD | WILD |
| 48 | JACK | BLEOPARD | BLEOPARD | NINE | BLEOPARD |
| 49 | JACK | BLEOPARD | NINE | NINE | BLEOPARD |
| 50 | JACK | BLEOPARD | NINE | NINE | BLEOPARD |
| 51 | JACK | BLEOPARD | NINE | NINE | BLEOPARD |
| 52 | BLEOPARD | WILD | NINE | WILD | ACE |
| 53 | BLEOPARD | NINE | WILD | WLEOPARD | ACE |
| 54 | BLEOPARD | NINE | WLEOPARD | WLEOPARD | ACE |
| 55 | BLEOPARD | NINE | WLEOPARD | WLEOPARD | ACE |
| 56 | BLEOPARD | NINE | WLEOPARD | WLEOPARD | WILD |
| 57 | BLEOPARD | WILD | WLEOPARD | FEATURE | BLEOPARD |
| 58 | BLEOPARD | WLEOPARD | FEATURE | TEN | BLEOPARD |
| 59 | BLEOPARD | WLEOPARD | TEN | TEN | BLEOPARD |
| 60 | QUEEN | WLEOPARD | TEN | TEN | BLEOPARD |
| 61 | QUEEN | WLEOPARD | TEN | TEN | KING |
| 62 | QUEEN | FEATURE | TEN | FEATURE | KING |
| 63 | QUEEN | TEN | FEATURE | KING | KING |
| 64 | CHEETAH | TEN | KING | KING | KING |
| 65 | CHEETAH | TEN | KING | KING | WILD |
| 66 | CHEETAH | TEN | KING | KING | TIGER |
| 67 | CHEETAH | FEATURE | KING | WILD | TIGER |
| 68 | NINE | KING | WILD | CHEETAH | TIGER |
| 69 | NINE | KING | CHEETAH | CHEETAH | TIGER |
| 70 | NINE | KING | CHEETAH | CHEETAH | TEN |
| 71 | NINE | KING | CHEETAH | CHEETAH | TEN |
| 72 | TIGER | WILD | CHEETAH | ACE | TEN |
| 73 | TIGER | CHEETAH | ACE | ACE | TEN |
| 74 | TIGER | CHEETAH | ACE | ACE | WILD |
| 75 | TIGER | CHEETAH | ACE | ACE | WLEOPARD |
| 76 | TIGER | CHEETAH | ACE | WILD | WLEOPARD |
| 77 | TIGER | WILD | WILD | BLEOPARD | WLEOPARD |
| 78 | TIGER | ACE | BLEOPARD | BLEOPARD | WLEOPARD |
| 79 | TIGER | ACE | BLEOPARD | BLEOPARD | CHEETAH |
| 80 | KING | ACE | BLEOPARD | BLEOPARD | CHEETAH |

FIG. 7

BASE GAME REEL STRIPS

| CODE NO. | REEL 1 | REEL 2 | REEL 3 | REEL 4 | REEL 5 |
|---|---|---|---|---|---|
| 81 | KING | ACE | BLEOPARD | NINE | CHEETAH |
| 82 | KING | WILD | NINE | NINE | CHEETAH |
| 83 | KING | BLEOPARD | NINE | NINE | WILD |
| 84 | | BLEOPARD | NINE | NINE | JACK |
| 85 | | BLEOPARD | NINE | FEATURE | JACK |
| 86 | | BLEOPARD | FEATURE | KING | JACK |
| 87 | | WILD | KING | KING | JACK |
| 88 | | NINE | KING | KING | CHEETAH |
| 89 | | NINE | KING | KING | CHEETAH |
| 90 | | NINE | KING | CHEETAH | CHEETAH |
| 91 | | NINE | WILD | CHEETAH | CHEETAH |
| 92 | | FEATURE | CHEETAH | CHEETAH | WILD |
| 93 | | KING | CHEETAH | CHEETAH | WILD |
| 94 | | KING | CHEETAH | WILD | WILD |
| 95 | | KING | CHEETAH | TEN | WILD |
| 96 | | KING | FEATURE | TEN | |
| 97 | | WILD | TEN | TEN | |
| 98 | | CHEETAH | TEN | TEN | |
| 99 | | CHEETAH | TEN | WILD | |
| 100 | | CHEETAH | TEN | WLEOPARD | |
| 101 | | CHEETAH | WILD | WLEOPARD | |
| 102 | | FEATURE | WLEOPARD | WLEOPARD | |
| 103 | | TEN | WLEOPARD | WLEOPARD | |
| 104 | | TEN | WLEOPARD | WILD | |
| 105 | | TEN | WLEOPARD | JACK | |
| 106 | | TEN | JACK | JACK | |
| 107 | | WILD | JACK | JACK | |
| 108 | | WLEOPARD | JACK | JACK | |
| 109 | | WLEOPARD | JACK | FEATURE | |
| 110 | | WLEOPARD | WILD | QUEEN | |
| 111 | | WLEOPARD | QUEEN | QUEEN | |
| 112 | | FEATURE | QUEEN | QUEEN | |
| 113 | | JACK | QUEEN | QUEEN | |
| 114 | | JACK | QUEEN | FEATURE | |
| 115 | | JACK | FEATURE | ACE | |
| 116 | | JACK | ACE | ACE | |
| 117 | | WILD | ACE | ACE | |
| 118 | | QUEEN | ACE | ACE | |
| 119 | | QUEEN | ACE | FEATURE | |
| 120 | | QUEEN | TIGER | TIGER | |

FIG. 8

BASE GAME REEL STRIPS

| CODE NO. | REEL 1 | REEL 2 | REEL 3 | REEL 4 | REEL 5 |
|---|---|---|---|---|---|
| 121 | | QUEEN | TIGER | TIGER | |
| 122 | | FEATURE | TIGER | TIGER | |
| 123 | | ACE | TIGER | TIGER | |
| 124 | | ACE | WILD | WILD | |
| 125 | | ACE | WILD | WILD | |
| 126 | | ACE | WILD | WILD | |
| 127 | | WILD | WILD | WILD | |
| 128 | | TIGER | | | |
| 129 | | TIGER | | | |
| 130 | | TIGER | | | |
| 131 | | TIGER | | | |
| 132 | | WILD | | | |
| 133 | | WILD | | | |
| 134 | | WILD | | | |
| 135 | | WILD | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 9

FG_A REEL STRIPS

| CODE NO. | REEL 1 | REEL 2 | REEL 3 | REEL 4 | REEL 5 |
|---|---|---|---|---|---|
| 0 | LION | LION | LION | LION | LION |
| 1 | LION | LION | LION | LION | LION |
| 2 | LION | LION | LION | LION | LION |
| 3 | LION | LION | LION | LION | LION |
| 4 | LION | LION | LION | LION | LION |
| 5 | LION | LION | LION | LION | LION |
| 6 | LION | LION | LION | LION | LION |
| 7 | LION | LION | LION | LION | LION |
| 8 | LION | LION | LION | LION | LION |
| 9 | LION | LION | LION | LION | LION |
| 10 | LION | LION | LION | LION | LION |
| 11 | LION | LION | LION | LION | LION |
| 12 | LION | LION | LION | LION | LION |
| 13 | LION | LION | LION | LION | LION |
| 14 | LION | LION | LION | LION | LION |
| 15 | LION | LION | LION | LION | LION |
| 16 | LION | LION | LION | LION | LION |
| 17 | LION | LION | LION | LION | LION |
| 18 | LION | LION | LION | LION | LION |
| 19 | LION | LION | LION | LION | LION |
| 20 | LION | LION | LION | LION | LION |
| 21 | LION | LION | LION | LION | LION |
| 22 | LION | LION | LION | LION | LION |
| 23 | LION | LION | LION | LION | LION |
| 24 | LION | LION | LION | LION | LION |
| 25 | LION | LION | LION | LION | LION |
| 26 | LION | LION | LION | LION | LION |
| 27 | LION | LION | LION | LION | LION |
| 28 | LION | LION | LION | LION | LION |
| 29 | LION | LION | LION | LION | LION |
| 30 | LION | LION | LION | LION | LION |
| 31 | LION | LION | LION | LION | LION |
| 32 | LION | LION | LION | LION | LION |
| 33 | LION | LION | LION | LION | LION |
| 34 | LION | LION | LION | LION | LION |
| 35 | LION | LION | LION | LION | LION |
| 36 | ACE | ACE | ACE | ACE | ACE |
| 37 | ACE | ACE | ACE | ACE | ACE |
| 38 | ACE | ACE | ACE | ACE | ACE |
| 39 | ACE | ACE | ACE | ACE | ACE |
| 40 | KING | JACK | JACK | JACK | KING |

FIG. 10

FG_A REEL STRIPS

| CODE NO. | REEL 1 | REEL 2 | REEL 3 | REEL 4 | REEL 5 |
|---|---|---|---|---|---|
| 41 | KING | JACK | JACK | JACK | KING |
| 42 | KING | JACK | JACK | JACK | KING |
| 43 | KING | JACK | JACK | JACK | KING |
| 44 | QUEEN | FEATURE | FEATURE | FEATURE | QUEEN |
| 45 | QUEEN | NINE | NINE | NINE | QUEEN |
| 46 | QUEEN | NINE | NINE | NINE | QUEEN |
| 47 | QUEEN | NINE | NINE | NINE | QUEEN |
| 48 | JACK | NINE | NINE | NINE | JACK |
| 49 | JACK | TEN | TEN | TEN | JACK |
| 50 | JACK | TEN | TEN | TEN | JACK |
| 51 | JACK | TEN | TEN | TEN | JACK |
| 52 | TEN | TEN | TEN | TEN | TEN |
| 53 | TEN | FEATURE | FEATURE | FEATURE | TEN |
| 54 | TEN | KING | KING | KING | TEN |
| 55 | TEN | KING | KING | KING | TEN |
| 56 | NINE | KING | KING | KING | NINE |
| 57 | NINE | KING | KING | KING | NINE |
| 58 | NINE | QUEEN | QUEEN | QUEEN | NINE |
| 59 | NINE | QUEEN | QUEEN | QUEEN | NINE |
| 60 | | QUEEN | QUEEN | QUEEN | |
| 61 | | QUEEN | QUEEN | QUEEN | |
| 62 | | NINE | NINE | NINE | |
| 63 | | NINE | NINE | NINE | |
| 64 | | NINE | NINE | NINE | |
| 65 | | NINE | NINE | NINE | |
| 66 | | FEATURE | FEATURE | FEATURE | |
| 67 | | KING | KING | KING | |
| 68 | | KING | KING | KING | |
| 69 | | KING | KING | KING | |
| 70 | | KING | KING | KING | |
| 71 | | TEN | TEN | TEN | |
| 72 | | TEN | TEN | TEN | |
| 73 | | TEN | TEN | TEN | |
| 74 | | TEN | TEN | TEN | |
| 75 | | FEATURE | FEATURE | FEATURE | |
| 76 | | JACK | JACK | JACK | |
| 77 | | JACK | JACK | JACK | |
| 78 | | JACK | JACK | JACK | |
| 79 | | JACK | JACK | JACK | |
| 80 | | QUEEN | QUEEN | QUEEN | |

FIG. 11

FG_A REEL STRIPS

| CODE NO. | REEL 1 | REEL 2 | REEL 3 | REEL 4 | REEL 5 |
|---|---|---|---|---|---|
| 81 | | QUEEN | QUEEN | QUEEN | |
| 82 | | QUEEN | QUEEN | QUEEN | |
| 83 | | QUEEN | QUEEN | QUEEN | |
| 84 | | FEATURE | FEATURE | FEATURE | |
| 85 | | ACE | ACE | ACE | |
| 86 | | ACE | ACE | ACE | |
| 87 | | ACE | ACE | ACE | |
| 88 | | ACE | ACE | ACE | |
| 89 | | | | | |
| 90 | | | | | |
| 91 | | | | | |
| 92 | | | | | |
| 93 | | | | | |
| 94 | | | | | |
| 95 | | | | | |
| 96 | | | | | |
| 97 | | | | | |
| 98 | | | | | |
| 99 | | | | | |
| 100 | | | | | |
| 101 | | | | | |
| 102 | | | | | |
| 103 | | | | | |
| 104 | | | | | |
| 105 | | | | | |
| 106 | | | | | |
| 107 | | | | | |
| 108 | | | | | |
| 109 | | | | | |
| 110 | | | | | |
| 111 | | | | | |
| 112 | | | | | |
| 113 | | | | | |
| 114 | | | | | |
| 115 | | | | | |
| 116 | | | | | |
| 117 | | | | | |
| 118 | | | | | |
| 119 | | | | | |
| 120 | | | | | |

FIG. 12

FG_A REEL STRIPS

| CODE NO. | REEL 1 | REEL 2 | REEL 3 | REEL 4 | REEL 5 |
|---|---|---|---|---|---|
| 121 | | | | | |
| 122 | | | | | |
| 123 | | | | | |
| 124 | | | | | |
| 125 | | | | | |
| 126 | | | | | |
| 127 | | | | | |
| 128 | | | | | |
| 129 | | | | | |
| 130 | | | | | |
| 131 | | | | | |
| 132 | | | | | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 13

FG_B REEL STRIPS

| CODE NO. | REEL 1 | REEL 2 | REEL 3 | REEL 4 | REEL 5 |
|---|---|---|---|---|---|
| 0 | TIGER | TIGER | TIGER | TIGER | TIGER |
| 1 | TIGER | TIGER | TIGER | TIGER | TIGER |
| 2 | TIGER | TIGER | TIGER | TIGER | TIGER |
| 3 | TIGER | TIGER | TIGER | TIGER | TIGER |
| 4 | TIGER | TIGER | TIGER | TIGER | TIGER |
| 5 | TIGER | TIGER | TIGER | TIGER | TIGER |
| 6 | TIGER | TIGER | TIGER | TIGER | TIGER |
| 7 | TIGER | TIGER | TIGER | TIGER | TIGER |
| 8 | TIGER | TIGER | TIGER | TIGER | TIGER |
| 9 | TIGER | TIGER | TIGER | TIGER | TIGER |
| 10 | TIGER | TIGER | TIGER | TIGER | TIGER |
| 11 | TIGER | TIGER | TIGER | TIGER | TIGER |
| 12 | TIGER | TIGER | TIGER | TIGER | TIGER |
| 13 | TIGER | TIGER | TIGER | TIGER | TIGER |
| 14 | TIGER | TIGER | TIGER | TIGER | TIGER |
| 15 | TIGER | TIGER | TIGER | TIGER | TIGER |
| 16 | TIGER | TIGER | TIGER | TIGER | TIGER |
| 17 | TIGER | TIGER | TIGER | TIGER | TIGER |
| 18 | TIGER | TIGER | TIGER | TIGER | TIGER |
| 19 | TIGER | TIGER | TIGER | TIGER | TIGER |
| 20 | TIGER | TIGER | TIGER | TIGER | TIGER |
| 21 | TIGER | TIGER | TIGER | TIGER | TIGER |
| 22 | TIGER | TIGER | TIGER | TIGER | TIGER |
| 23 | TIGER | TIGER | TIGER | TIGER | TIGER |
| 24 | TIGER | TIGER | TIGER | TIGER | TIGER |
| 25 | TIGER | TIGER | TIGER | TIGER | TIGER |
| 26 | TIGER | TIGER | TIGER | TIGER | TIGER |
| 27 | TIGER | TIGER | TIGER | TIGER | TIGER |
| 28 | TIGER | TIGER | TIGER | TIGER | TIGER |
| 29 | TIGER | TIGER | TIGER | TIGER | TIGER |
| 30 | TIGER | TIGER | TIGER | TIGER | TIGER |
| 31 | TIGER | TIGER | TIGER | TIGER | TIGER |
| 32 | TIGER | TIGER | TIGER | TIGER | TIGER |
| 33 | TIGER | TIGER | TIGER | TIGER | TIGER |
| 34 | TIGER | TIGER | TIGER | TIGER | TIGER |
| 35 | TIGER | TIGER | TIGER | TIGER | TIGER |
| 36 | ACE | ACE | ACE | ACE | ACE |
| 37 | ACE | ACE | ACE | ACE | ACE |
| 38 | ACE | ACE | ACE | ACE | ACE |
| 39 | ACE | ACE | ACE | ACE | ACE |
| 40 | KING | JACK | JACK | JACK | KING |

FIG. 14

FG_B REEL STRIPS

| CODE NO. | REEL 1 | REEL 2 | REEL 3 | REEL 4 | REEL 5 |
|---|---|---|---|---|---|
| 41 | KING | JACK | JACK | JACK | KING |
| 42 | KING | JACK | JACK | JACK | KING |
| 43 | KING | JACK | JACK | JACK | KING |
| 44 | QUEEN | FEATURE | FEATURE | FEATURE | QUEEN |
| 45 | QUEEN | NINE | NINE | NINE | QUEEN |
| 46 | QUEEN | NINE | NINE | NINE | QUEEN |
| 47 | QUEEN | NINE | NINE | NINE | QUEEN |
| 48 | JACK | NINE | NINE | NINE | JACK |
| 49 | JACK | TEN | TEN | TEN | JACK |
| 50 | JACK | TEN | TEN | TEN | JACK |
| 51 | JACK | TEN | TEN | TEN | JACK |
| 52 | TEN | TEN | TEN | TEN | TEN |
| 53 | TEN | FEATURE | FEATURE | FEATURE | TEN |
| 54 | TEN | KING | KING | KING | TEN |
| 55 | TEN | KING | KING | KING | TEN |
| 56 | NINE | KING | KING | KING | NINE |
| 57 | NINE | KING | KING | KING | NINE |
| 58 | NINE | QUEEN | QUEEN | QUEEN | NINE |
| 59 | NINE | QUEEN | QUEEN | QUEEN | NINE |
| 60 | | QUEEN | QUEEN | QUEEN | |
| 61 | | QUEEN | QUEEN | QUEEN | |
| 62 | | NINE | NINE | NINE | |
| 63 | | NINE | NINE | NINE | |
| 64 | | NINE | NINE | NINE | |
| 65 | | NINE | NINE | NINE | |
| 66 | | FEATURE | FEATURE | FEATURE | |
| 67 | | KING | KING | KING | |
| 68 | | KING | KING | KING | |
| 69 | | KING | KING | KING | |
| 70 | | KING | KING | KING | |
| 71 | | TEN | TEN | TEN | |
| 72 | | TEN | TEN | TEN | |
| 73 | | TEN | TEN | TEN | |
| 74 | | TEN | TEN | TEN | |
| 75 | | FEATURE | FEATURE | FEATURE | |
| 76 | | JACK | JACK | JACK | |
| 77 | | JACK | JACK | JACK | |
| 78 | | JACK | JACK | JACK | |
| 79 | | JACK | JACK | JACK | |
| 80 | | QUEEN | QUEEN | QUEEN | |

FIG. 15

FG_B REEL STRIPS

| CODE NO. | REEL 1 | REEL 2 | REEL 3 | REEL 4 | REEL 5 |
|---|---|---|---|---|---|
| 81 | | QUEEN | QUEEN | QUEEN | |
| 82 | | QUEEN | QUEEN | QUEEN | |
| 83 | | QUEEN | QUEEN | QUEEN | |
| 84 | | FEATURE | FEATURE | FEATURE | |
| 85 | | ACE | ACE | ACE | |
| 86 | | ACE | ACE | ACE | |
| 87 | | ACE | ACE | ACE | |
| 88 | | ACE | ACE | ACE | |
| 89 | | | | | |
| 90 | | | | | |
| 91 | | | | | |
| 92 | | | | | |
| 93 | | | | | |
| 94 | | | | | |
| 95 | | | | | |
| 96 | | | | | |
| 97 | | | | | |
| 98 | | | | | |
| 99 | | | | | |
| 100 | | | | | |
| 101 | | | | | |
| 102 | | | | | |
| 103 | | | | | |
| 104 | | | | | |
| 105 | | | | | |
| 106 | | | | | |
| 107 | | | | | |
| 108 | | | | | |
| 109 | | | | | |
| 110 | | | | | |
| 111 | | | | | |
| 112 | | | | | |
| 113 | | | | | |
| 114 | | | | | |
| 115 | | | | | |
| 116 | | | | | |
| 117 | | | | | |
| 118 | | | | | |
| 119 | | | | | |
| 120 | | | | | |

FIG. 16

FG_B REEL STRIPS

| CODE NO. | REEL 1 | REEL 2 | REEL 3 | REEL 4 | REEL 5 |
|---|---|---|---|---|---|
| 121 | | | | | |
| 122 | | | | | |
| 123 | | | | | |
| 124 | | | | | |
| 125 | | | | | |
| 126 | | | | | |
| 127 | | | | | |
| 128 | | | | | |
| 129 | | | | | |
| 130 | | | | | |
| 131 | | | | | |
| 132 | | | | | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 17

FG_C REEL STRIPS

| CODE NO. | REEL 1 | REEL 2 | REEL 3 | REEL 4 | REEL 5 |
|---|---|---|---|---|---|
| 0 | BLEOPARD | BLEOPARD | BLEOPARD | BLEOPARD | BLEOPARD |
| 1 | BLEOPARD | BLEOPARD | BLEOPARD | BLEOPARD | BLEOPARD |
| 2 | BLEOPARD | BLEOPARD | BLEOPARD | BLEOPARD | BLEOPARD |
| 3 | BLEOPARD | BLEOPARD | BLEOPARD | BLEOPARD | BLEOPARD |
| 4 | BLEOPARD | BLEOPARD | BLEOPARD | BLEOPARD | BLEOPARD |
| 5 | BLEOPARD | BLEOPARD | BLEOPARD | BLEOPARD | BLEOPARD |
| 6 | BLEOPARD | BLEOPARD | BLEOPARD | BLEOPARD | BLEOPARD |
| 7 | BLEOPARD | BLEOPARD | BLEOPARD | BLEOPARD | BLEOPARD |
| 8 | BLEOPARD | BLEOPARD | BLEOPARD | BLEOPARD | BLEOPARD |
| 9 | BLEOPARD | BLEOPARD | BLEOPARD | BLEOPARD | BLEOPARD |
| 10 | BLEOPARD | BLEOPARD | BLEOPARD | BLEOPARD | BLEOPARD |
| 11 | BLEOPARD | BLEOPARD | BLEOPARD | BLEOPARD | BLEOPARD |
| 12 | BLEOPARD | BLEOPARD | BLEOPARD | BLEOPARD | BLEOPARD |
| 13 | BLEOPARD | BLEOPARD | BLEOPARD | BLEOPARD | BLEOPARD |
| 14 | BLEOPARD | BLEOPARD | BLEOPARD | BLEOPARD | BLEOPARD |
| 15 | BLEOPARD | BLEOPARD | BLEOPARD | BLEOPARD | BLEOPARD |
| 16 | BLEOPARD | BLEOPARD | BLEOPARD | BLEOPARD | BLEOPARD |
| 17 | BLEOPARD | BLEOPARD | BLEOPARD | BLEOPARD | BLEOPARD |
| 18 | BLEOPARD | BLEOPARD | BLEOPARD | BLEOPARD | BLEOPARD |
| 19 | BLEOPARD | BLEOPARD | BLEOPARD | BLEOPARD | BLEOPARD |
| 20 | BLEOPARD | BLEOPARD | BLEOPARD | BLEOPARD | BLEOPARD |
| 21 | BLEOPARD | BLEOPARD | BLEOPARD | BLEOPARD | BLEOPARD |
| 22 | BLEOPARD | BLEOPARD | BLEOPARD | BLEOPARD | BLEOPARD |
| 23 | BLEOPARD | BLEOPARD | BLEOPARD | BLEOPARD | BLEOPARD |
| 24 | BLEOPARD | BLEOPARD | BLEOPARD | BLEOPARD | BLEOPARD |
| 25 | BLEOPARD | BLEOPARD | BLEOPARD | BLEOPARD | BLEOPARD |
| 26 | BLEOPARD | BLEOPARD | BLEOPARD | BLEOPARD | BLEOPARD |
| 27 | BLEOPARD | BLEOPARD | BLEOPARD | BLEOPARD | BLEOPARD |
| 28 | BLEOPARD | BLEOPARD | BLEOPARD | BLEOPARD | BLEOPARD |
| 29 | BLEOPARD | BLEOPARD | BLEOPARD | BLEOPARD | BLEOPARD |
| 30 | BLEOPARD | BLEOPARD | BLEOPARD | BLEOPARD | BLEOPARD |
| 31 | BLEOPARD | BLEOPARD | BLEOPARD | BLEOPARD | BLEOPARD |
| 32 | BLEOPARD | BLEOPARD | BLEOPARD | BLEOPARD | BLEOPARD |
| 33 | BLEOPARD | BLEOPARD | BLEOPARD | BLEOPARD | BLEOPARD |
| 34 | BLEOPARD | BLEOPARD | BLEOPARD | BLEOPARD | BLEOPARD |
| 35 | BLEOPARD | BLEOPARD | BLEOPARD | BLEOPARD | BLEOPARD |
| 36 | ACE | ACE | ACE | ACE | ACE |
| 37 | ACE | ACE | ACE | ACE | ACE |
| 38 | ACE | ACE | ACE | ACE | ACE |
| 39 | ACE | ACE | ACE | ACE | ACE |
| 40 | KING | JACK | JACK | JACK | KING |

FIG. 18

FG_C REEL STRIPS

| CODE NO. | REEL 1 | REEL 2 | REEL 3 | REEL 4 | REEL 5 |
|---|---|---|---|---|---|
| 41 | KING | JACK | JACK | JACK | KING |
| 42 | KING | JACK | JACK | JACK | KING |
| 43 | KING | JACK | JACK | JACK | KING |
| 44 | QUEEN | FEATURE | FEATURE | FEATURE | QUEEN |
| 45 | QUEEN | NINE | NINE | NINE | QUEEN |
| 46 | QUEEN | NINE | NINE | NINE | QUEEN |
| 47 | QUEEN | NINE | NINE | NINE | QUEEN |
| 48 | JACK | NINE | NINE | NINE | JACK |
| 49 | JACK | TEN | TEN | TEN | JACK |
| 50 | JACK | TEN | TEN | TEN | JACK |
| 51 | JACK | TEN | TEN | TEN | JACK |
| 52 | TEN | TEN | TEN | TEN | TEN |
| 53 | TEN | FEATURE | FEATURE | FEATURE | TEN |
| 54 | TEN | KING | KING | KING | TEN |
| 55 | TEN | KING | KING | KING | TEN |
| 56 | NINE | KING | KING | KING | NINE |
| 57 | NINE | KING | KING | KING | NINE |
| 58 | NINE | QUEEN | QUEEN | QUEEN | NINE |
| 59 | NINE | QUEEN | QUEEN | QUEEN | NINE |
| 60 | | QUEEN | QUEEN | QUEEN | |
| 61 | | QUEEN | QUEEN | QUEEN | |
| 62 | | NINE | NINE | NINE | |
| 63 | | NINE | NINE | NINE | |
| 64 | | NINE | NINE | NINE | |
| 65 | | NINE | NINE | NINE | |
| 66 | | FEATURE | FEATURE | FEATURE | |
| 67 | | KING | KING | KING | |
| 68 | | KING | KING | KING | |
| 69 | | KING | KING | KING | |
| 70 | | KING | KING | KING | |
| 71 | | TEN | TEN | TEN | |
| 72 | | TEN | TEN | TEN | |
| 73 | | TEN | TEN | TEN | |
| 74 | | TEN | TEN | TEN | |
| 75 | | FEATURE | FEATURE | FEATURE | |
| 76 | | JACK | JACK | JACK | |
| 77 | | JACK | JACK | JACK | |
| 78 | | JACK | JACK | JACK | |
| 79 | | JACK | JACK | JACK | |
| 80 | | QUEEN | QUEEN | QUEEN | |

FIG. 19

FG_C REEL STRIPS

| CODE NO. | REEL 1 | REEL 2 | REEL 3 | REEL 4 | REEL 5 |
|---|---|---|---|---|---|
| 81 | | QUEEN | QUEEN | QUEEN | |
| 82 | | QUEEN | QUEEN | QUEEN | |
| 83 | | QUEEN | QUEEN | QUEEN | |
| 84 | | FEATURE | FEATURE | FEATURE | |
| 85 | | ACE | ACE | ACE | |
| 86 | | ACE | ACE | ACE | |
| 87 | | ACE | ACE | ACE | |
| 88 | | ACE | ACE | ACE | |
| 89 | | | | | |
| 90 | | | | | |
| 91 | | | | | |
| 92 | | | | | |
| 93 | | | | | |
| 94 | | | | | |
| 95 | | | | | |
| 96 | | | | | |
| 97 | | | | | |
| 98 | | | | | |
| 99 | | | | | |
| 100 | | | | | |
| 101 | | | | | |
| 102 | | | | | |
| 103 | | | | | |
| 104 | | | | | |
| 105 | | | | | |
| 106 | | | | | |
| 107 | | | | | |
| 108 | | | | | |
| 109 | | | | | |
| 110 | | | | | |
| 111 | | | | | |
| 112 | | | | | |
| 113 | | | | | |
| 114 | | | | | |
| 115 | | | | | |
| 116 | | | | | |
| 117 | | | | | |
| 118 | | | | | |
| 119 | | | | | |
| 120 | | | | | |

FIG. 20

FG_C REEL STRIPS

| CODE NO. | REEL 1 | REEL 2 | REEL 3 | REEL 4 | REEL 5 |
|---|---|---|---|---|---|
| 121 | | | | | |
| 122 | | | | | |
| 123 | | | | | |
| 124 | | | | | |
| 125 | | | | | |
| 126 | | | | | |
| 127 | | | | | |
| 128 | | | | | |
| 129 | | | | | |
| 130 | | | | | |
| 131 | | | | | |
| 132 | | | | | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 21

FG_D REEL STRIPS

| CODE NO. | REEL 1 | REEL 2 | REEL 3 | REEL 4 | REEL 5 |
|---|---|---|---|---|---|
| 0 | WLEOPARD | WLEOPARD | WLEOPARD | WLEOPARD | WLEOPARD |
| 1 | WLEOPARD | WLEOPARD | WLEOPARD | WLEOPARD | WLEOPARD |
| 2 | WLEOPARD | WLEOPARD | WLEOPARD | WLEOPARD | WLEOPARD |
| 3 | WLEOPARD | WLEOPARD | WLEOPARD | WLEOPARD | WLEOPARD |
| 4 | WLEOPARD | WLEOPARD | WLEOPARD | WLEOPARD | WLEOPARD |
| 5 | WLEOPARD | WLEOPARD | WLEOPARD | WLEOPARD | WLEOPARD |
| 6 | WLEOPARD | WLEOPARD | WLEOPARD | WLEOPARD | WLEOPARD |
| 7 | WLEOPARD | WLEOPARD | WLEOPARD | WLEOPARD | WLEOPARD |
| 8 | WLEOPARD | WLEOPARD | WLEOPARD | WLEOPARD | WLEOPARD |
| 9 | WLEOPARD | WLEOPARD | WLEOPARD | WLEOPARD | WLEOPARD |
| 10 | WLEOPARD | WLEOPARD | WLEOPARD | WLEOPARD | WLEOPARD |
| 11 | WLEOPARD | WLEOPARD | WLEOPARD | WLEOPARD | WLEOPARD |
| 12 | WLEOPARD | WLEOPARD | WLEOPARD | WLEOPARD | WLEOPARD |
| 13 | WLEOPARD | WLEOPARD | WLEOPARD | WLEOPARD | WLEOPARD |
| 14 | WLEOPARD | WLEOPARD | WLEOPARD | WLEOPARD | WLEOPARD |
| 15 | WLEOPARD | WLEOPARD | WLEOPARD | WLEOPARD | WLEOPARD |
| 16 | WLEOPARD | WLEOPARD | WLEOPARD | WLEOPARD | WLEOPARD |
| 17 | WLEOPARD | WLEOPARD | WLEOPARD | WLEOPARD | WLEOPARD |
| 18 | WLEOPARD | WLEOPARD | WLEOPARD | WLEOPARD | WLEOPARD |
| 19 | WLEOPARD | WLEOPARD | WLEOPARD | WLEOPARD | WLEOPARD |
| 20 | WLEOPARD | WLEOPARD | WLEOPARD | WLEOPARD | WLEOPARD |
| 21 | WLEOPARD | WLEOPARD | WLEOPARD | WLEOPARD | WLEOPARD |
| 22 | WLEOPARD | WLEOPARD | WLEOPARD | WLEOPARD | WLEOPARD |
| 23 | WLEOPARD | WLEOPARD | WLEOPARD | WLEOPARD | WLEOPARD |
| 24 | WLEOPARD | WLEOPARD | WLEOPARD | WLEOPARD | WLEOPARD |
| 25 | WLEOPARD | WLEOPARD | WLEOPARD | WLEOPARD | WLEOPARD |
| 26 | WLEOPARD | WLEOPARD | WLEOPARD | WLEOPARD | WLEOPARD |
| 27 | WLEOPARD | WLEOPARD | WLEOPARD | WLEOPARD | WLEOPARD |
| 28 | WLEOPARD | WLEOPARD | WLEOPARD | WLEOPARD | WLEOPARD |
| 29 | WLEOPARD | WLEOPARD | WLEOPARD | WLEOPARD | WLEOPARD |
| 30 | WLEOPARD | WLEOPARD | WLEOPARD | WLEOPARD | WLEOPARD |
| 31 | WLEOPARD | WLEOPARD | WLEOPARD | WLEOPARD | WLEOPARD |
| 32 | WLEOPARD | WLEOPARD | WLEOPARD | WLEOPARD | WLEOPARD |
| 33 | WLEOPARD | WLEOPARD | WLEOPARD | WLEOPARD | WLEOPARD |
| 34 | WLEOPARD | WLEOPARD | WLEOPARD | WLEOPARD | WLEOPARD |
| 35 | WLEOPARD | WLEOPARD | WLEOPARD | WLEOPARD | WLEOPARD |
| 36 | ACE | ACE | ACE | ACE | ACE |
| 37 | ACE | ACE | ACE | ACE | ACE |
| 38 | ACE | ACE | ACE | ACE | ACE |
| 39 | ACE | ACE | ACE | ACE | ACE |
| 40 | KING | JACK | JACK | JACK | KING |

FIG. 22

FG_D REEL STRIPS

| CODE NO. | REEL 1 | REEL 2 | REEL 3 | REEL 4 | REEL 5 |
|---|---|---|---|---|---|
| 41 | KING | JACK | JACK | JACK | KING |
| 42 | KING | JACK | JACK | JACK | KING |
| 43 | KING | JACK | JACK | JACK | KING |
| 44 | QUEEN | FEATURE | FEATURE | FEATURE | QUEEN |
| 45 | QUEEN | NINE | NINE | NINE | QUEEN |
| 46 | QUEEN | NINE | NINE | NINE | QUEEN |
| 47 | QUEEN | NINE | NINE | NINE | QUEEN |
| 48 | JACK | NINE | NINE | NINE | JACK |
| 49 | JACK | TEN | TEN | TEN | JACK |
| 50 | JACK | TEN | TEN | TEN | JACK |
| 51 | JACK | TEN | TEN | TEN | JACK |
| 52 | TEN | TEN | TEN | TEN | TEN |
| 53 | TEN | FEATURE | FEATURE | FEATURE | TEN |
| 54 | TEN | KING | KING | KING | TEN |
| 55 | TEN | KING | KING | KING | TEN |
| 56 | NINE | KING | KING | KING | NINE |
| 57 | NINE | KING | KING | KING | NINE |
| 58 | NINE | QUEEN | QUEEN | QUEEN | NINE |
| 59 | NINE | QUEEN | QUEEN | QUEEN | NINE |
| 60 | | QUEEN | QUEEN | QUEEN | |
| 61 | | QUEEN | QUEEN | QUEEN | |
| 62 | | NINE | NINE | NINE | |
| 63 | | NINE | NINE | NINE | |
| 64 | | NINE | NINE | NINE | |
| 65 | | NINE | NINE | NINE | |
| 66 | | FEATURE | FEATURE | FEATURE | |
| 67 | | KING | KING | KING | |
| 68 | | KING | KING | KING | |
| 69 | | KING | KING | KING | |
| 70 | | KING | KING | KING | |
| 71 | | TEN | TEN | TEN | |
| 72 | | TEN | TEN | TEN | |
| 73 | | TEN | TEN | TEN | |
| 74 | | TEN | TEN | TEN | |
| 75 | | FEATURE | FEATURE | FEATURE | |
| 76 | | JACK | JACK | JACK | |
| 77 | | JACK | JACK | JACK | |
| 78 | | JACK | JACK | JACK | |
| 79 | | JACK | JACK | JACK | |
| 80 | | QUEEN | QUEEN | QUEEN | |

FIG. 23

FG_D REEL STRIPS

| CODE NO. | REEL 1 | REEL 2 | REEL 3 | REEL 4 | REEL 5 |
|---|---|---|---|---|---|
| 81 | | QUEEN | QUEEN | QUEEN | |
| 82 | | QUEEN | QUEEN | QUEEN | |
| 83 | | QUEEN | QUEEN | QUEEN | |
| 84 | | FEATURE | FEATURE | FEATURE | |
| 85 | | ACE | ACE | ACE | |
| 86 | | ACE | ACE | ACE | |
| 87 | | ACE | ACE | ACE | |
| 88 | | ACE | ACE | ACE | |
| 89 | | | | | |
| 90 | | | | | |
| 91 | | | | | |
| 92 | | | | | |
| 93 | | | | | |
| 94 | | | | | |
| 95 | | | | | |
| 96 | | | | | |
| 97 | | | | | |
| 98 | | | | | |
| 99 | | | | | |
| 100 | | | | | |
| 101 | | | | | |
| 102 | | | | | |
| 103 | | | | | |
| 104 | | | | | |
| 105 | | | | | |
| 106 | | | | | |
| 107 | | | | | |
| 108 | | | | | |
| 109 | | | | | |
| 110 | | | | | |
| 111 | | | | | |
| 112 | | | | | |
| 113 | | | | | |
| 114 | | | | | |
| 115 | | | | | |
| 116 | | | | | |
| 117 | | | | | |
| 118 | | | | | |
| 119 | | | | | |
| 120 | | | | | |

FIG. 24

FG_D REEL STRIPS

| CODE NO. | REEL 1 | REEL 2 | REEL 3 | REEL 4 | REEL 5 |
|---|---|---|---|---|---|
| 121 | | | | | |
| 122 | | | | | |
| 123 | | | | | |
| 124 | | | | | |
| 125 | | | | | |
| 126 | | | | | |
| 127 | | | | | |
| 128 | | | | | |
| 129 | | | | | |
| 130 | | | | | |
| 131 | | | | | |
| 132 | | | | | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 25

FG_E REEL STRIPS

| CODE NO. | REEL 1 | REEL 2 | REEL 3 | REEL 4 | REEL 5 |
|---|---|---|---|---|---|
| 0 | CHEETAH | CHEETAH | CHEETAH | CHEETAH | CHEETAH |
| 1 | CHEETAH | CHEETAH | CHEETAH | CHEETAH | CHEETAH |
| 2 | CHEETAH | CHEETAH | CHEETAH | CHEETAH | CHEETAH |
| 3 | CHEETAH | CHEETAH | CHEETAH | CHEETAH | CHEETAH |
| 4 | CHEETAH | CHEETAH | CHEETAH | CHEETAH | CHEETAH |
| 5 | CHEETAH | CHEETAH | CHEETAH | CHEETAH | CHEETAH |
| 6 | CHEETAH | CHEETAH | CHEETAH | CHEETAH | CHEETAH |
| 7 | CHEETAH | CHEETAH | CHEETAH | CHEETAH | CHEETAH |
| 8 | CHEETAH | CHEETAH | CHEETAH | CHEETAH | CHEETAH |
| 9 | CHEETAH | CHEETAH | CHEETAH | CHEETAH | CHEETAH |
| 10 | CHEETAH | CHEETAH | CHEETAH | CHEETAH | CHEETAH |
| 11 | CHEETAH | CHEETAH | CHEETAH | CHEETAH | CHEETAH |
| 12 | CHEETAH | CHEETAH | CHEETAH | CHEETAH | CHEETAH |
| 13 | CHEETAH | CHEETAH | CHEETAH | CHEETAH | CHEETAH |
| 14 | CHEETAH | CHEETAH | CHEETAH | CHEETAH | CHEETAH |
| 15 | CHEETAH | CHEETAH | CHEETAH | CHEETAH | CHEETAH |
| 16 | CHEETAH | CHEETAH | CHEETAH | CHEETAH | CHEETAH |
| 17 | CHEETAH | CHEETAH | CHEETAH | CHEETAH | CHEETAH |
| 18 | CHEETAH | CHEETAH | CHEETAH | CHEETAH | CHEETAH |
| 19 | CHEETAH | CHEETAH | CHEETAH | CHEETAH | CHEETAH |
| 20 | CHEETAH | CHEETAH | CHEETAH | CHEETAH | CHEETAH |
| 21 | CHEETAH | CHEETAH | CHEETAH | CHEETAH | CHEETAH |
| 22 | CHEETAH | CHEETAH | CHEETAH | CHEETAH | CHEETAH |
| 23 | CHEETAH | CHEETAH | CHEETAH | CHEETAH | CHEETAH |
| 24 | CHEETAH | CHEETAH | CHEETAH | CHEETAH | CHEETAH |
| 25 | CHEETAH | CHEETAH | CHEETAH | CHEETAH | CHEETAH |
| 26 | CHEETAH | CHEETAH | CHEETAH | CHEETAH | CHEETAH |
| 27 | CHEETAH | CHEETAH | CHEETAH | CHEETAH | CHEETAH |
| 28 | CHEETAH | CHEETAH | CHEETAH | CHEETAH | CHEETAH |
| 29 | CHEETAH | CHEETAH | CHEETAH | CHEETAH | CHEETAH |
| 30 | CHEETAH | CHEETAH | CHEETAH | CHEETAH | CHEETAH |
| 31 | CHEETAH | CHEETAH | CHEETAH | CHEETAH | CHEETAH |
| 32 | CHEETAH | CHEETAH | CHEETAH | CHEETAH | CHEETAH |
| 33 | CHEETAH | CHEETAH | CHEETAH | CHEETAH | CHEETAH |
| 34 | CHEETAH | CHEETAH | CHEETAH | CHEETAH | CHEETAH |
| 35 | CHEETAH | CHEETAH | CHEETAH | CHEETAH | CHEETAH |
| 36 | ACE | ACE | ACE | ACE | ACE |
| 37 | ACE | ACE | ACE | ACE | ACE |
| 38 | ACE | ACE | ACE | ACE | ACE |
| 39 | ACE | ACE | ACE | ACE | ACE |
| 40 | KING | JACK | JACK | JACK | KING |

FIG. 26

FG_E REEL STRIPS

| CODE NO. | REEL 1 | REEL 2 | REEL 3 | REEL 4 | REEL 5 |
|---|---|---|---|---|---|
| 41 | KING | JACK | JACK | JACK | KING |
| 42 | KING | JACK | JACK | JACK | KING |
| 43 | KING | JACK | JACK | JACK | KING |
| 44 | QUEEN | FEATURE | FEATURE | FEATURE | QUEEN |
| 45 | QUEEN | NINE | NINE | NINE | QUEEN |
| 46 | QUEEN | NINE | NINE | NINE | QUEEN |
| 47 | QUEEN | NINE | NINE | NINE | QUEEN |
| 48 | JACK | NINE | NINE | NINE | JACK |
| 49 | JACK | TEN | TEN | TEN | JACK |
| 50 | JACK | TEN | TEN | TEN | JACK |
| 51 | JACK | TEN | TEN | TEN | JACK |
| 52 | TEN | TEN | TEN | TEN | TEN |
| 53 | TEN | FEATURE | FEATURE | FEATURE | TEN |
| 54 | TEN | KING | KING | KING | TEN |
| 55 | TEN | KING | KING | KING | TEN |
| 56 | NINE | KING | KING | KING | NINE |
| 57 | NINE | KING | KING | KING | NINE |
| 58 | NINE | QUEEN | QUEEN | QUEEN | NINE |
| 59 | NINE | QUEEN | QUEEN | QUEEN | NINE |
| 60 | | QUEEN | QUEEN | QUEEN | |
| 61 | | QUEEN | QUEEN | QUEEN | |
| 62 | | NINE | NINE | NINE | |
| 63 | | NINE | NINE | NINE | |
| 64 | | NINE | NINE | NINE | |
| 65 | | NINE | NINE | NINE | |
| 66 | | FEATURE | FEATURE | FEATURE | |
| 67 | | KING | KING | KING | |
| 68 | | KING | KING | KING | |
| 69 | | KING | KING | KING | |
| 70 | | KING | KING | KING | |
| 71 | | TEN | TEN | TEN | |
| 72 | | TEN | TEN | TEN | |
| 73 | | TEN | TEN | TEN | |
| 74 | | TEN | TEN | TEN | |
| 75 | | FEATURE | FEATURE | FEATURE | |
| 76 | | JACK | JACK | JACK | |
| 77 | | JACK | JACK | JACK | |
| 78 | | JACK | JACK | JACK | |
| 79 | | JACK | JACK | JACK | |
| 80 | | QUEEN | QUEEN | QUEEN | |

FIG. 27

FG_E REEL STRIPS

| CODE NO. | REEL 1 | REEL 2 | REEL 3 | REEL 4 | REEL 5 |
|---|---|---|---|---|---|
| 81 | | QUEEN | QUEEN | QUEEN | |
| 82 | | QUEEN | QUEEN | QUEEN | |
| 83 | | QUEEN | QUEEN | QUEEN | |
| 84 | | FEATURE | FEATURE | FEATURE | |
| 85 | | ACE | ACE | ACE | |
| 86 | | ACE | ACE | ACE | |
| 87 | | ACE | ACE | ACE | |
| 88 | | ACE | ACE | ACE | |
| 89 | | | | | |
| 90 | | | | | |
| 91 | | | | | |
| 92 | | | | | |
| 93 | | | | | |
| 94 | | | | | |
| 95 | | | | | |
| 96 | | | | | |
| 97 | | | | | |
| 98 | | | | | |
| 99 | | | | | |
| 100 | | | | | |
| 101 | | | | | |
| 102 | | | | | |
| 103 | | | | | |
| 104 | | | | | |
| 105 | | | | | |
| 106 | | | | | |
| 107 | | | | | |
| 108 | | | | | |
| 109 | | | | | |
| 110 | | | | | |
| 111 | | | | | |
| 112 | | | | | |
| 113 | | | | | |
| 114 | | | | | |
| 115 | | | | | |
| 116 | | | | | |
| 117 | | | | | |
| 118 | | | | | |
| 119 | | | | | |
| 120 | | | | | |

FIG. 28

FG_E REEL STRIPS

| CODE NO. | REEL 1 | REEL 2 | REEL 3 | REEL 4 | REEL 5 |
|---|---|---|---|---|---|
| 121 | | | | | |
| 122 | | | | | |
| 123 | | | | | |
| 124 | | | | | |
| 125 | | | | | |
| 126 | | | | | |
| 127 | | | | | |
| 128 | | | | | |
| 129 | | | | | |
| 130 | | | | | |
| 131 | | | | | |
| 132 | | | | | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 30

BASE GAME

| SYMBOL | 1 | 2 | 3 | 4 | 5 |
|---|---|---|---|---|---|
| WILD | 0 | 0 | 0 | 0 | 0 |
| LION | 0 | 2 | 10 | 40 | 100 |
| TIGER | 0 | 1 | 9 | 30 | 70 |
| BLEOPARD | 0 | 1 | 8 | 25 | 50 |
| WLEOPARD | 0 | 1 | 7 | 20 | 40 |
| CHEETAH | 0 | 1 | 6 | 15 | 30 |
| ACE | 0 | 0 | 5 | 10 | 15 |
| KING | 0 | 0 | 4 | 9 | 14 |
| QUEEN | 0 | 0 | 3 | 8 | 13 |
| JACK | 0 | 0 | 2 | 7 | 12 |
| TEN | 0 | 0 | 1 | 6 | 11 |
| NINE | 0 | 0 | 1 | 6 | 11 |
| FEATURE | 0 | 0 | 2 | 0 | 0 |

* EXCEPT SCATTER.

LINE PAYOUT

* SCATTER PAY.

※SYMBOLS OTHER THAN SCATTER SYMBOLS ARE SUBSTITUTED FOR WILD SYMBOLS.

FIG. 31

FREE GAMES

| SYMBOL | 1 | 2 | 3 | 4 | 5 |
|---|---|---|---|---|---|
| WILD | 0 | 0 | 0 | 0 | 0 |
| LION | 0 | 2 | 10 | 40 | 100 |
| TIGER | 0 | 1 | 9 | 30 | 70 |
| BLEOPARD | 0 | 1 | 8 | 25 | 50 |
| WLEOPARD | 0 | 1 | 7 | 20 | 40 |
| CHEETAH | 0 | 1 | 6 | 15 | 30 |
| ACE | 0 | 0 | 5 | 10 | 15 |
| KING | 0 | 0 | 4 | 9 | 14 |
| QUEEN | 0 | 0 | 3 | 8 | 13 |
| JACK | 0 | 0 | 2 | 7 | 12 |
| TEN | 0 | 0 | 1 | 6 | 11 |
| NINE | 0 | 0 | 1 | 6 | 11 |
| FEATURE | 0 | 0 | 2 | 0 | 0 |

* EXCEPT SCATTER.

LINE PAYOUT

* SCATTER PAY.

※SYMBOLS OTHER THAN SCATTER SYMBOLS ARE SUBSTITUTED FOR WILD SYMBOLS.

FIG. 61

| REEL 1 | REEL 2 | REEL 3 | REEL 4 | REEL 5 |
|---|---|---|---|---|
| 32 | 32 | 32 | 32 | 32 |
| 33 | 33 | 33 | 33 | 33 |
| 34 | 34 | 34 | 34 | 34 |
| 35 | 35 | 35 | 35 | 35 |

FIG. 73

| | REEL 1 | REEL 2 | REEL 3 | REEL 4 | REEL 5 |
|---|---|---|---|---|---|
| 33 | TIGER | TIGER | TIGER | TIGER | TIGER |
| 34 | TIGER | TIGER | TIGER | TIGER | TIGER |
| 35 | TIGER | TIGER | TIGER | TIGER | TIGER |
| 36 | ACE | ACE | ACE | ACE | ACE |
| 37 | ACE | ACE | ACE | ACE | ACE |
| 38 | ACE | ACE | ACE | ACE | ACE |
| 39 | ACE | ACE | ACE | ACE | ACE |
| 40 | KING | JACK | JACK | JACK | KING |
| 41 | KING | JACK | JACK | JACK | KING |
| 42 | KING | JACK | JACK | JACK | KING |

FIG. 74

| REEL 1 | REEL 2 | REEL 3 | REEL 4 | REEL 5 | WEIGHT | PROBABILITY |
|---|---|---|---|---|---|---|
| FROM 35 | FROM 35 | FROM 35 | FROM 35 | FROM 35 | 1 | 11.11% |
| FROM 37 | FROM 37 | FROM 37 | FROM 37 | FROM 37 | 1 | 11.11% |
| FROM 39 | FROM 39 | FROM 39 | FROM 39 | FROM 39 | 1 | 11.11% |
| NO REWRITING | NO REWRITING | NO REWRITING | NO REWRITING | NO REWRITING | 6 | 66.67% |
| | | | | | 9 | 100.00% |

FIG. 86

| | GAMBLE ON | GAMBLE OFF |
|---|---|---|
| CASH OUT | TAKE WIN | TAKE WIN |
| GAMBLE | GAMBLE START | — |
| MAX BET | INACTIVE | GAMBLE START |
| SPIN | TO BASE GAME | TO BASE GAME |

FIG. 90

| No | SCREEN | CONTROL PANEL | OPERATION |
|---|---|---|---|
| ① | EXIT | HELP | SHIFT TO A BASE GAME SCREEN |
| ② | PREV. | BET ×1 | SHIFT TO A PREVIOUS PAGE |
| ③ | NEXT | BET ×2 | SHIFT TO THE NEXT PAGE |

FIG. 93

| KIND OF BUTTON | DURING IDLING | DURING A GAME | DURING AN ERROR | DURING AUDITING | TAKE WIN OR GAMBLE |
|---|---|---|---|---|---|
| HELP | LIGHTING-UP | LIGHTING-DOWN | LIGHTING-DOWN | LIGHTING-DOWN | LIGHTING-UP |
| LANGUAGE SWITCH | LIGHTING-UP | LIGHTING-DOWN | LIGHTING-DOWN | LIGHTING-DOWN | LIGHTING-DOWN |
| VOLUME | LIGHTING-UP | LIGHTING-UP | LIGHTING-DOWN | LIGHTING-DOWN | LIGHTING-UP |
| LINE NUMBER | LIGHTING-UP (WHEN POSSIBLE) | LIGHTING-DOWN | LIGHTING-DOWN | LIGHTING-DOWN | LIGHTING-DOWN |
| BET NUMBER | LIGHTING-UP | LIGHTING-DOWN | LIGHTING-DOWN | LIGHTING-DOWN | LIGHTING-DOWN |
| PAY TABLE | LIGHTING-UP | LIGHTING-DOWN | LIGHTING-DOWN | LIGHTING-DOWN | LIGHTING-UP |

FIG. 99

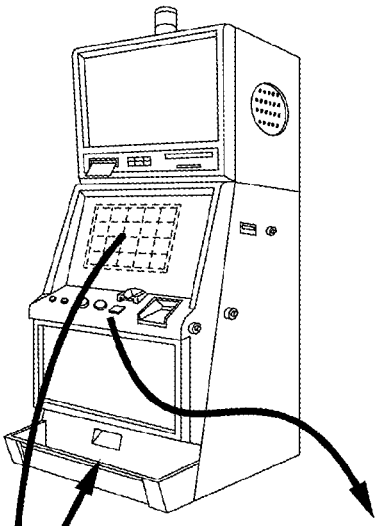

| | LION | TIGER | PANTHER | LEOPARD | CHEETAH |
|---|---|---|---|---|---|
| 1 BET | AAA | BBB | CCC | DDD | EEE |
| 2 BET | AAA | BBB | CCC | DDD | EEE |
| 3 BET | AAA | BBB | CCC | DDD | EEE |
| 5 BET | AAA | BBB | CCC | DDD | EEE |
| 10 BET | AAA | BBB | CCC | DDD | EEE |

EACH SAME MONEY AMOUNT IS ACCUMULATED EACH TIME BETTING IS CONDUCTED.

(a)

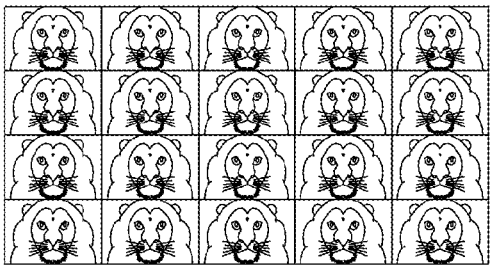

SYMBOLS OF ONE OF ANIMALS ARE STOPPED AND DISPLAYED (REARRANGED).

(b)

(BASE MONEY AMOUNT + ACCUMULATED MONEY AMOUNT) × THE NUMBER OF BETS

MULTIPLICATION BY THE NUMBER OF BETS IS PERFORMED AND PAYING-OUT IS CONDUCTED.

(c)

FIG. 101A

| | | PERCENTAGE | | | |
|---|---|---|---|---|---|
| | | 0.3% | 0.6% | 0.9% | 1.2% |
| BET CONFIG | 1,2,3,4,5 | × | ○ | × | ○ |
| | 1,2,3,5,10 | ○ | ○ | ○ | ○ |
| | 1,2,5,10,15 | ○ | ○ | ○ | ○ |
| | 1,2,5,10,20 | × | ○ | × | ○ |

FIG. 101B

| | | BET CONFIG | | | | | | | |
|---|---|---|---|---|---|---|---|---|---|
| | | 1 | 2 | 3 | 4 | 5 | 10 | 15 | 20 |
| PERCENTAGE | 0.3% | 0.300 | 0.150 | 0.100 | 0.075 | 0.060 | 0.030 | 0.020 | 0.015 |
| | 0.6% | 0.600 | 0.300 | 0.200 | 0.150 | 0.120 | 0.060 | 0.040 | 0.030 |
| | 0.9% | 0.900 | 0.450 | 0.300 | 0.225 | 0.180 | 0.090 | 0.060 | 0.045 |
| | 1.2% | 1.200 | 0.600 | 0.400 | 0.300 | 0.240 | 0.120 | 0.080 | 0.060 |

FIG. 102

| | MAX BET VALUE OF BET CONFIG. | | | |
|---|---|---|---|---|
| | 5 | 10 | 15 | 20 |
| LION | 50,000 | 100,000 | 150,000 | 200,000 |
| TIGER | 17,500 | 35,000 | 52,500 | 70,000 |
| PANTHER | 12,500 | 25,000 | 37,500 | 50,000 |
| LEOPARD | 10,000 | 20,000 | 30,000 | 40,000 |
| CHEETAH | 7,500 | 15,000 | 22,500 | 30,000 |

SLOT MACHINE INCLUDING A PLURALITY OF VIDEO REEL STRIPS

CROSS REFERENCE TO RELATED APPLICATIONS

This application is a Continuation application of U.S. patent application Ser. No. 14/018,804 filed on Sep. 5, 2013, which claims priority of Japanese Patent Application No. 2012-219783 filed on Oct. 1, 2012 and Japanese Patent Application No. 2012-285521 filed on Dec. 27, 2012. The contents of these applications are incorporated herein by reference in their entirety.

BACKGROUND OF THE INVENTION

1. Field of the Invention

The present invention relates to a slot machine which includes a plurality of video reel strips.

2. Description of the Background Art

Conventionally, as a slot machine including a plurality of video reel strips, for example, there is a model which has the below-mentioned technology. In the technology which such a model has, since a game is subsequently initiated by the occurrence of triggering, the plurality of video reel strips are upgraded. When the plurality of video reel strips are upgraded, it becomes easy for a player to obtain a winning combination (for example, refer to US patent application publication 2012/0172106).

However, as a method of upgrading the plurality of video reel strips, for example, a method in which the number of wild symbols which can be substituted with any symbols is increased is adopted. Then, since it is easy for a player to recognize the increase in the number of the wild symbols, a player can soon perceive that the plurality of video reel strips have been upgraded.

Accordingly, a new design for upgrading the plurality of video reel strips has been desired by players.

Therefore, in view of the above-described respect, the present invention was made. An object of the present invention is to provide a slot machine which realizes a new design for upgrading the plurality of video reel strips.

In addition, there also is a slot machine equipped with a jackpot function. The jackpot function serves such that each predetermined money amount is accumulated each time betting is conducted and when a jackpot is won, a money amount based on the money amounts accumulated until then is paid out to a player. In the conventional slot machine, money amounts to be accumulated can be determined in accordance with the number of bets placed when betting is conducted, and when the number of bets placed is large, the accumulated money amounts is large whereas the number of bets placed is small, the accumulated money amounts is small.

Therefore, a player who expects winning of a jackpot increases the number of BETs and proceeds with a game. Accordingly, while such a player is playing the game, upon the occurrence of the winning of the jackpot, a benefit in accordance with the investment made by the player can be provided.

However, while such a player is playing the game, without the occurrence of the jackpot, any benefit cannot be provided despite the investment made by the player. Furthermore, another player starting a game thereafter may to be provided with a benefit awarded by the jackpot. Therefore, unfairness results between a player who has made an investment and a player who has not made an investment. This leads to an increase in the number of players who each decreases the number of BETs placed to proceed with a game, and as a result, the consumption of coins is decreased, resulting in a likelihood of a decrease in a profit of a shop such as a casino.

Given this situation, a slot machine which can reduce the unfairness among players and allows a player to proceed with a game in expectation of a jackpot has been desired.

SUMMARY OF THE INVENTION

According to the present invention made to solve the above-mentioned problem, provided is a slot machine in which in a feature game including a set of a plurality of free games shifted from a base game, a screen on which a plurality of kinds of character symbols composed of images of, for example, heads of particular animals or the like to be selected are set face down is displayed; a selection of one kind from the plurality of kinds of character symbols is made by using a selection device such as the later-described touch panel; and a processor performs control such that video reel strips which are changed so as to have character symbols of the one kind selected from the plurality of kinds of character symbols are used, a number of the symbols of the selected one kind being larger than a number of symbols of the selected one kind used in the base game.

In the present specification, the later-described bonus game and the feature game are used in the same meaning.

When the number of character symbols of the one kind selected by using the selection device is increased, the number of symbols of each of the plurality of kinds of symbols including the character symbols displayed on one video reel strip may be made constant by decreasing the numbers of character symbols of the kinds other than the one kind.

In other words, when the processor performs control such that in the feature game shifted from the base game, each of the video reel strips, on which the number of the character symbols corresponding to the character symbols of the one kind selected by using the selection device is increased, is changed so as to have the increased number of character symbols of the selected one kind. Since each of the video reel strips is changed so as to have the same number of symbols by decreasing the number of the other symbols which corresponds to the increased number of the character symbols, it is likely to easily make a design which allows a control program of the processor in the feature game to serve a double purpose.

The invention according to claim 1 is a slot machine including: a selection device operated by a player; a first display for displaying a part of a plurality of video reel strips having different kinds of symbols arranged thereon, the symbols including a plurality of kinds of character symbols; and a processor for causing a slot game including a base game and free games to proceed on the first display, the processor being programmed to execute processes (A) to (C) described below.

(A) A process in which upon causing the base game to proceed, used are base game reel strips on which on all of the plurality of video reel strips, symbols whose each kind is the same are arranged in succession.

(B) A process in which immediately after shifting from the base game to the free games, a selection game in which a player selects one kind of character symbols from the plurality of kinds of character symbols by using the selection device is caused to proceed.

(C) A process in which upon causing the free games to proceed, used are free game reel strips on which on all of the plurality of video reel strips, the symbols whose each kind is the same are arranged in succession and only in a case of the one kind of character symbols selected in the selection game, symbols of the selected one kind are arranged in succession, a number of the symbols of the selected one kind being larger than a number of symbols of the selected one kind displayed on the base game reel strips.

The slot machine according to claim 1 has the above-described configuration, thereby causing the slot game including the base game and the free games to proceed on the display. While the base game is proceeding, the base game video reel strips are used. On the base game video reel strips, on all of the plurality of video reel strips, the symbols whose each kind is the same are arranged in succession. Immediately after shifting from the base game to the free games, the selection game in which a player selects the one kind of character symbols from the plurality of kinds of character symbols by using the selection device is caused to proceed. While each of the free games is proceeding, the free game video reel strips are used. On the free game video reel strips, on all of the plurality of video reel strips, the symbols whose each kind is the same are arranged in succession and only in the case of the one kind of character symbols selected in the selection game, the symbols of the selected one kind are arranged in succession, the number of the symbols of the selected one kind being larger than the number of symbols of the selected one kind displayed on the base game reel strips.

In other words, on the base game reel strips and the free game reel strips, the mode in which on all of the plurality of video reel strips, the symbols whose each kind is the same are arranged in succession is common to each other. In addition, by the mode in which on the free game video reel strips, only in the case of the character symbols of the one kind selected in the selection game which proceeds immediately after shifting from the base game to the free games, the symbols of the selected one kind are arranged in succession, the number of the symbols of the selected one kind being larger than the number of symbols of the selected one kind displayed on the base game reel strips, the plurality of video reel strips are upgraded.

In addition, the invention according to claim 2 is the slot machine according to claim 1 includes a second display for displaying free game payout tables during progress of the free games, the plurality of kinds of character symbols having the free game payout tables which are different from one another, the processor being programmed to execute a processes (D) described below.

(D) A process in which during the progress of the free games, a background image related to the one kind of character symbols selected in the selection game is displayed on the first display and the second display.

The slot machine according to claim 2 has the above-described configuration, whereby while each of the free games is proceeding, the free game payout tables of the plurality of character symbols, which are respectively different from one another, are displayed on the second display and the background image related to the one kind of character symbols selected in the selection game is displayed on the first display and the second display.

In other words, on the second display on which while each of the free games is proceeding, the free game payout tables of the plurality of character symbols, which are respectively different from one another, are displayed, the background image related to the one kind of character symbols selected in the selection game is displayed. Further, on the first display, while each of free games is proceeding by using the free game video reel strips having the mode in which only in the case of the one kind of character symbols selected in the selection game, the symbols of the selected one kind are arranged in succession, the number of the symbols of the selected one kind being larger than the number of symbols of the selected one kind displayed on the base game reel strips, the background image related to the one kind of character symbols selected in the selection game is displayed.

Accordingly, the background image related to the character symbols used upon upgrading the plurality of video reel strips is displayed on the first display and the second display during the progress of the free games.

Further, the invention according to claim 3 has a payout table in which payouts provided in accordance with winning when in the free games executed after the process (C), the character symbols of the one kind selected in the selection game are displayed on the first display and winning is determined are respectively different from one another depending on the plurality of kinds of character symbols.

By employing this configuration, brought about are a case where the video reel strips are changed such that on the video reel strips, character symbols whose payout is the largest, as compared with a payout of the character symbols of any one selected by a player from the plurality of kinds of character symbols by using the selection device, are displayed; and a case where the video reel strips are changed such that on the video reel strips, character symbols whose payout is the lowest, as compared with a payout of the character symbols of any one selected by a player from the plurality of kinds of character symbols by using the selection device, are displayed, thereby allowing the free games to have a variety of game elements.

In this case, the memory has stored therein data including: weighting data for determining a probability with which character symbols, whose payout is large, associated with video reel strips on which a number of character symbols with a large payout is increased, appear on the first display: and weighting data for determining a probability with which character symbols, whose payout is small, associated with video reel strips on which a number of character symbols with a small payout is increased, appear on the first display, which are different from each other, thereby allowing the weighting data to be changed in accordance with selected character symbols. By employing the above-described configuration in which the weighting data is changed in accordance with each of the plurality of kinds of character symbols with the large payouts and the small payouts, a likelihood with which the character symbols with the large payout, as compared with the character symbols with the small payout, are displayed on the first display and winning is determined is set to be low, whereby it is likely to easily make a design which avoids a likelihood with which a payout percentage may largely vary depending on a selected kind of character symbols.

In other words, in the invention according to claim 4, the processor sets data to perform control such that in the free games, a probability with which winning determined when character symbols, whose payout is large, among the plurality of kinds of character symbols are displayed on the first display occurs is lower than a probability with which winning determined when character symbols, whose payout is small, among the plurality of kinds of character symbols are displayed on the first display occurs.

In addition, in the invention according to claim 5, the processor is configured to perform control such that in the process (C), all of the free game video reel strips associated with each of the plurality of kinds of character symbols have the same total numbers of symbols by decreasing a number of the other symbols by an increased number of each of the plurality of the kinds of the character symbols, the decreased number of the other symbols being the same as the increased number of each of the plurality of the kinds of the character symbols.

Further, the present embodiment is characterized in that the processor is programmed to execute processes (E) and (F) described below.

(E) A process in which each money amount which is constant is accumulated independently of a number of bets each time betting is conducted.

(F) A process in which upon winning a jackpot, a money amount calculated by multiplying a money amount accumulated until then by a multiplying factor based on the number of bets is provided.

Since each constant money amount can be accumulated independently of the number of bets, a player can proceed with a game at ease without worrying about providing of a benefit awarded by a jackpot for other players.

In addition, the present embodiment includes: an operation device operated by a player; a display for displaying a plurality of video reels having a plurality of symbols arranged thereon, the plurality of symbols including a plurality of kinds of character symbols; and a processor for causing a slot game to proceed by rearranging the symbols on the display, the processor being programmed to execute processes (A-1) and (A-2) described below.

(A-1) A process in which each money amount which is constant is accumulated independently of a number of bets by using the operation device each time a predetermined number of bets is placed.

(A-2) A process in which upon winning a jackpot, a money amount based on a money amount calculated by multiplying a money amount accumulated until then by a multiplying factor based on the number of bets is provided.

Since the each constant money amount can be accumulated independently of the number of bets, a player can proceed with a game at ease without worrying about providing of a benefit awarded by a jackpot for other players.

Further, the present embodiment is characterized in that the (A-1) process includes processes (A-1-1) and (A-1-2) described below.

(A-1-1) A process in which when a predetermined number of bets is placed by using the operation device, a money amount is calculated as an accumulated money amount by dividing a bet money amount by the number of bets.

(A-1-2) A process in which each of the accumulated money amounts is stored so as to correspond to each of the plurality of character symbols, respectively.

Each constant money amount can be appropriately accumulated, thereby allowing a benefit awarded by a jackpot to be appropriately provided for a player.

Further, the present embodiment is characterized in that the (A-2) process includes processes (A-2-1) to (A-2-4) described below.

(A-2-1) A process in which winning the jackpot is determined when character symbols of one of the plurality of kinds of character symbols are rearranged on the display.

(A-2-2) A process in which upon winning the jackpot, a base money amount is calculated based on the number of bets.

(A-2-3) A process in which a money amount calculated by multiplying a sum of the accumulated money amount and the base money amount by a multiplying factor based on the number of bets is provided.

(A-2-4) A process in which the accumulated money amount corresponding to the one of the kinds of character symbols is initialized.

Since even after winning a jackpot by the character symbols of the one kind, it is likely that a jackpot is won by the other character symbols, a motivation to subsequently proceed with a game is provided for a player.

Further, the present embodiment is characterized in that the (A-2-3) process includes processes (A-2-3-1) and (A-2-3-2) described below.

(A-2-3-1) A process in which when the slot game is shifted from a base game to free games and after shifting to the free games, the jackpot is won for a first time, the money amount calculated by multiplying the sum of the accumulated money amount and the base money amount by the multiplying factor based on the number of bets is provided.

(A-2-3-2) A process in which when the slot game is shifted from the base game to the free games and after shifting to the free games, the jackpot is won for a second or subsequent time, the base money amount is provided.

In the free games, an appropriate benefit can be provided for a player.

As characters of the character symbols, there are animals and human figures.

In the present specification, the feature game and the bonus game are the same in meaning. In general, in some countries and manufactures, the feature game is referred to as the bonus game or vice versa.

Hence, according to the present invention, provided is a slot machine which realizes a new design for upgrading a plurality of video reel strips.

BRIEF DESCRIPTION OF THE DRAWINGS

FIG. 5 shows arrangements of symbols depicted on peripheries of base game reel strips in the slot machine according to the first embodiment of the present invention;

FIG. 6 shows arrangements of symbols depicted on the peripheries of the base game reel strips in the slot machine according to the first embodiment of the present invention;

FIG. 7 shows arrangements of symbols depicted on the peripheries of the base game reel strips in the slot machine according to the first embodiment of the present invention;

FIG. 8 shows arrangements of symbols depicted on the peripheries of the base game reel strips in the slot machine according to the first embodiment of the present invention;

FIG. 9 shows arrangements of symbols depicted on peripheries of free game reel strips in the slot machine according to the first embodiment of the present invention;

FIG. 10 shows arrangements of symbols depicted on the peripheries of the free game reel strips in the slot machine according to the first embodiment of the present invention;

FIG. 11 shows arrangements of symbols depicted on the peripheries of the free game reel strips in the slot machine according to the first embodiment of the present invention;

FIG. 12 shows arrangements of symbols depicted on the peripheries of the free game reel strips in the slot machine according to the first embodiment of the present invention;

FIG. 13 shows arrangements of symbols depicted on peripheries of the free game reel strips in the slot machine according to the first embodiment of the present invention;

FIG. 14 shows arrangements of symbols depicted on the peripheries of the free game reel strips in the slot machine according to the first embodiment of the present invention;

FIG. 15 shows arrangements of symbols depicted on the peripheries of the free game reel strips in the slot machine according to the first embodiment of the present invention;

FIG. 16 shows arrangements of symbols depicted on the peripheries of the free game reel strips in the slot machine according to the first embodiment of the present invention;

FIG. 17 shows arrangements of symbols depicted on the peripheries of the free game reel strips in the slot machine according to the first embodiment of the present invention;

FIG. 18 shows arrangements of symbols depicted on the peripheries of the free game reel strips in the slot machine according to the first embodiment of the present invention;

FIG. 19 shows arrangements of symbols depicted on the peripheries of the free game reel strips in the slot machine according to the first embodiment of the present invention;

FIG. 20 shows arrangements of symbols depicted on the peripheries of the free game reel strips in the slot machine according to the first embodiment of the present invention;

FIG. 21 shows arrangements of symbols depicted on the peripheries of the free game reel strips in the slot machine according to the first embodiment of the present invention;

FIG. 22 shows arrangements of symbols depicted on the peripheries of the free game reel strips in the slot machine according to the first embodiment of the present invention;

FIG. 23 shows arrangements of symbols depicted on the peripheries of the free game reel strips in the slot machine according to the first embodiment of the present invention;

FIG. 24 shows arrangements of symbols depicted on the peripheries of the free game reel strips in the slot machine according to the first embodiment of the present invention;

FIG. 25 shows arrangements of symbols depicted on the peripheries of the free game reel strips in the slot machine according to the first embodiment of the present invention;

FIG. 26 shows arrangements of symbols depicted on the peripheries of the free game reel strips in the slot machine according to the first embodiment of the present invention;

FIG. 27 shows arrangements of symbols depicted on the peripheries of the free game reel strips in the slot machine according to the first embodiment of the present invention;

FIG. 28 shows arrangements of symbols depicted on the peripheries of the free game reel strips in the slot machine according to the first embodiment of the present invention;

FIG. 30 shows a symbol combination table of the slot machine according to the first embodiment of the present invention;

FIG. 31 shows a symbol combination table of the slot machine according to the first embodiment of the present invention;

FIG. 61 is a diagram illustrating the presentation effects upon introducing the free games in the slot machine according to the first embodiment;

FIG. 73 is a diagram explaining the appeal rewriting upon starting the spinning during the free games in the slot machine according to the first embodiment of the present invention;

FIG. 74 is a diagram explaining the appeal rewriting upon starting the spinning during the free games in the slot machine according to the first embodiment of the present invention;

FIG. 86 is a diagram explaining the RESIDUAL GAMBLE in the slot machine according to the first embodiment of the present invention;

FIG. 90 is a diagram first explaining the HELP specification in the slot machine according to the embodiment of the present invention;

FIG. 93 is a diagram explaining the placement of the screen touch buttons in the slot machine according to the first embodiment of the present invention;

FIG. 99 is a diagram illustrating an outline of a slot machine according to a second embodiment;

FIG. 101A shows a table showing a relationship between each BET CONFIG;

FIG. 101B shows a table showing a relationship of each percentage for each BET/LINE;

FIG. 102 shows a table defining base money amounts;

DESCRIPTION OF THE PREFERRED EMBODIMENTS

First Embodiment

Figure 1:
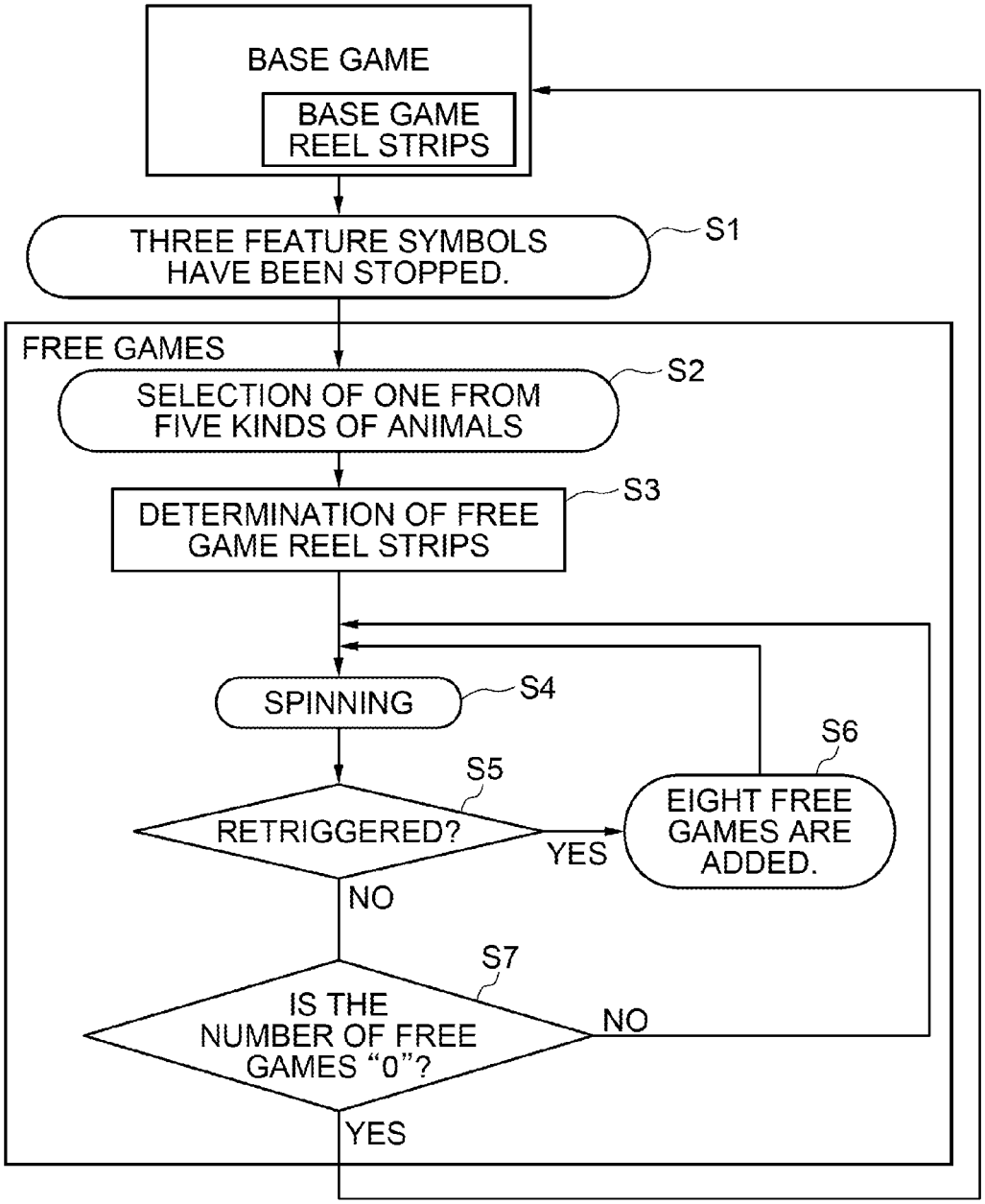
FIG. 1 is a diagram showing an outline of a game flow of a slot machine according to the first embodiment of the present invention.

Hereinafter, a first embodiment will be described with reference to the accompanying drawings. FIG. 1 shows a flowchart showing an outline of a game flow of a slot machine according to the first embodiment. As shown in FIG. 1, in the slot machine according to the first embodiment, a slot game including a base game and free games proceeds.

The slot game is of a line-type. On a first display (lower side image display panel), 50 paylines are set on a screen having a configuration consisting of 4 columns×5 rows. Further, in the slot game, video reels are used. The video reels are composed of five reels. In other words, a first reel, a second reel, a third reel, a fourth reel, and a fifth reel constitute the video reels.

Feature symbols are present on the second reel, the third reel, and the fourth reel. Wild symbols are present on the second reel, the third reel, the fourth reel, and the fifth reel. A plurality of animal symbols and the other symbols are present on all of the reels. The wild symbols, the plurality of animal symbols, and the other symbols are respectively arranged in succession. The plurality of animal symbols are symbols of lions (LION), tigers (TIGER), black leopards (BLEOPARD), white leopards (WLEOPARD), and cheetahs (CHEETAH) as described below.

During the base game, base game reel strips are used on the respective video reels. During the free games, free game reel strips are used on the respective video reels. On the free game video reel strips, only in a case of one kind of animal symbols, selected in a selection game proceeding immediately after the game is shifted from the base game to the free games, the selected kind of animal symbols whose number is further larger than the number of the selected kind of animal symbols arranged in the base game are arranged in succession. In other words, there are five kinds of the free game video reel strips, and only in the case of one kind of animal symbols selected in the selection game, each of the five kinds of the free game video strips, on which the larger number of the selected kind of animal symbols are arranged in succession is used in the free games.

In the base game, when three feature symbols have appeared (step S1), eight free games can be obtained. At this time, a free game payout table in which payouts for the five kinds of animal symbols are different from one another is displayed on a second display (upper side image display panel).

Immediately after shifting to the free games, one kind is selected by a player from the five kinds of animal symbols via a button or a touch panel (step S2). It is determined that only in a case of the selected one kind of animal symbols, the free game video reel strips on which the larger number of the selected one kind of animal symbols than in the base game are arranged in succession are used (step S3). At this time, a background image related to the one kind of animal symbols selected in the selection game is displayed on the first display (lower side image display panel) and the second display (upper side image display panel).

During the free games, after spinning (step S4), when three feature symbols have appeared again (step S5: YES), retriggering is conducted. Upon the occurrence of the retriggering, eight free games are added (step S6). Thereafter, the game returns to the above-mentioned step S4 and the spinning is conducted again. Accordingly, in the retriggering, newly selecting another one kind from the five kinds of animal symbols is not conducted. In other words, the free game video reel strips determined immediately after shifting to the free games are used until said free games are finished. Further, the number of times at which the retriggering is conducted has no limit. Accordingly, each time the retriggering occurs, eight free games are added (step S6).

In contrast to this, when the three feature symbols have not appeared again (step S5: NO), it is determined whether or not the remaining number of times at which the free game is conducted is zero (step 7). When the remaining number of times at which the free game is conducted is not zero (step S7: NO), the game returns to the above-mentioned step S4 and the free games are continued. On the other hand, when the remaining number of times at which the free game is conducted is zero (step S7: YES), the game returns to the base game.

Figure 40:
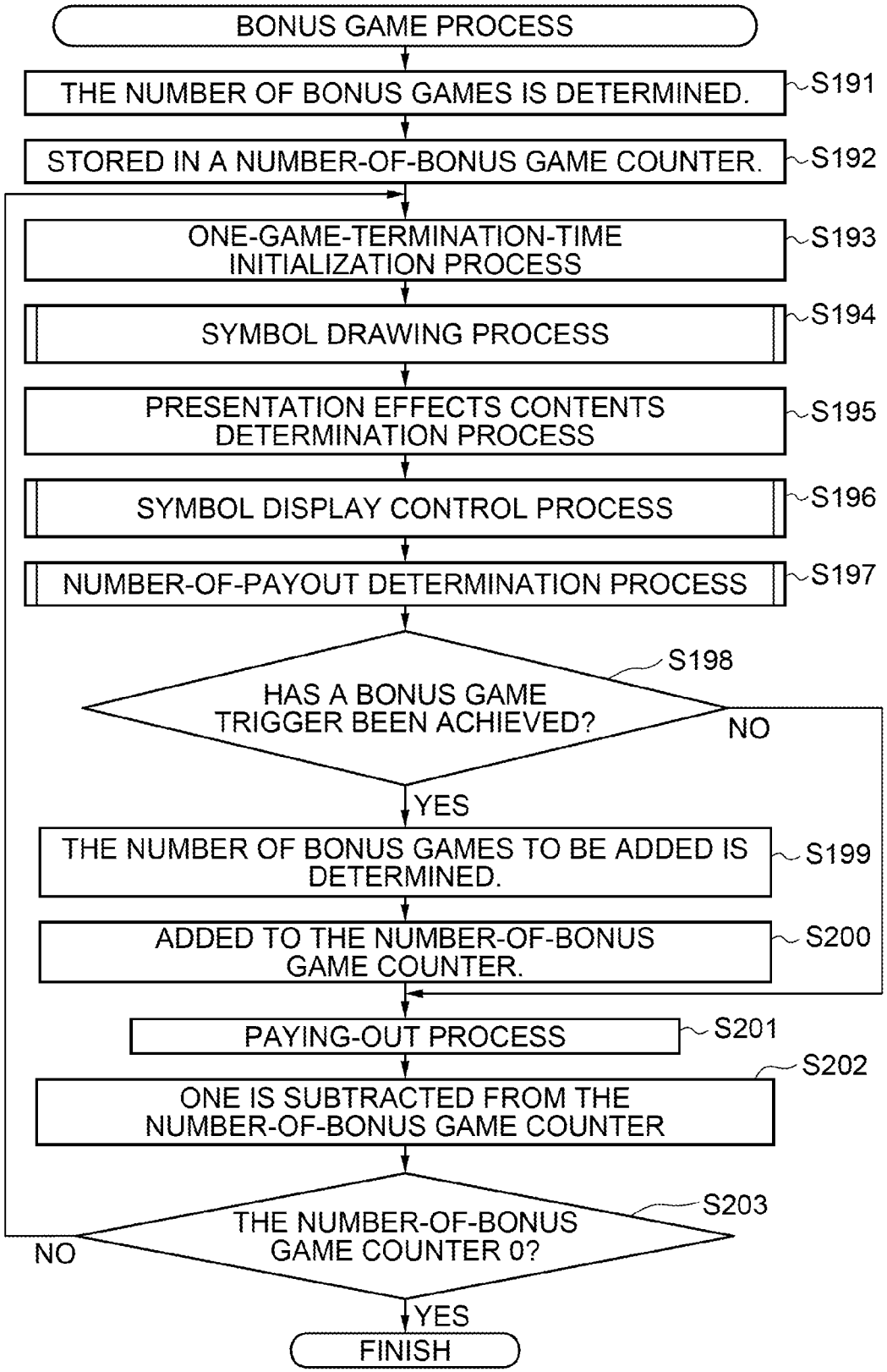
FIG. 40 shows a flowchart of a bonus game process in the slot machine according to the first embodiment of the present invention.

The flow shown in FIG. 1 is reflected in a bonus game process in FIG. 40 described below.

The slot machine has the above-described configuration, thereby causing the slot game including the base game and the free games to proceed on the first display (lower side image display panel). While the base game is proceeding, the base game reel strips are used. On the base game reel strips, on all of the five reels, symbols whose each kind is the same, other than the feature symbols, are arranged in succession, the symbols including the animal symbols of the five kinds and the kinds of the symbols being different from one another.

Immediately after shifting from the base game to the free games, the selection game in which a player selects one kind from the five kinds of animal symbols via the button or the touch panel proceeds (step S2).

While each of the free games is proceeding, the free game reel strips are used. On the free game reel strips, on all of the five reels, symbols whose each kind is the same, other than the feature symbols, are arranged in succession and in addition thereto, only in the case of the one kind of animal symbols selected in the selection game, the larger number of the animal symbols of the selected one kind are arranged in succession than on the base game video reel strips.

In other words, in the base game reel strips and the free game reel strips, the mode in which on all of the five reels, symbols whose each kind is the same, other than the feature symbols, are arranged in succession is common to each other. In addition, by the mode in which on the free game reel strips, only in the case of the one kind of animal symbols selected in the selection game, the larger number of the animal symbols of the selected kind are arranged in succession than on the base game video reel strips, the five video reel strips are upgraded.

Further, the slot machine has the above-described configuration, thereby displaying the free game payout table, in which the payouts for the five kinds of animal symbols are different from one another, on the second display (upper side image display panel) while each of the free games is proceeding and thereby displaying the background image related to the one kind of animal symbols selected in the selection game on the first display (lower side image display panel) and the second display (upper side image display panel).

In other words, the free game payout table, in which the payouts for the five kinds of animal symbols vary respectively, is displayed on the second display (upper side image display panel) displayed while each of the free games is proceeding, and the background image related to the one kind of animal symbols selected in the selection game is displayed. Further, on the first display (lower side image display panel), the background image related to the one kind of animal symbols selected in the selection game is displayed during the progress of free games in which used are the free game video reel strips in the mode in which only in the case of the one kind of animal symbols selected in the selection game, the larger number of the animal symbols of the selected one kind are arranged in succession than on the base game video reel strips.

Accordingly, the background image related to the animal symbols used upon upgrading the five video reel strips is displayed on the first display (lower side image display panel) and the second display (upper side image display panel) during the progress of the free games.

[Explanation of a Function Flow]

Figure 2:
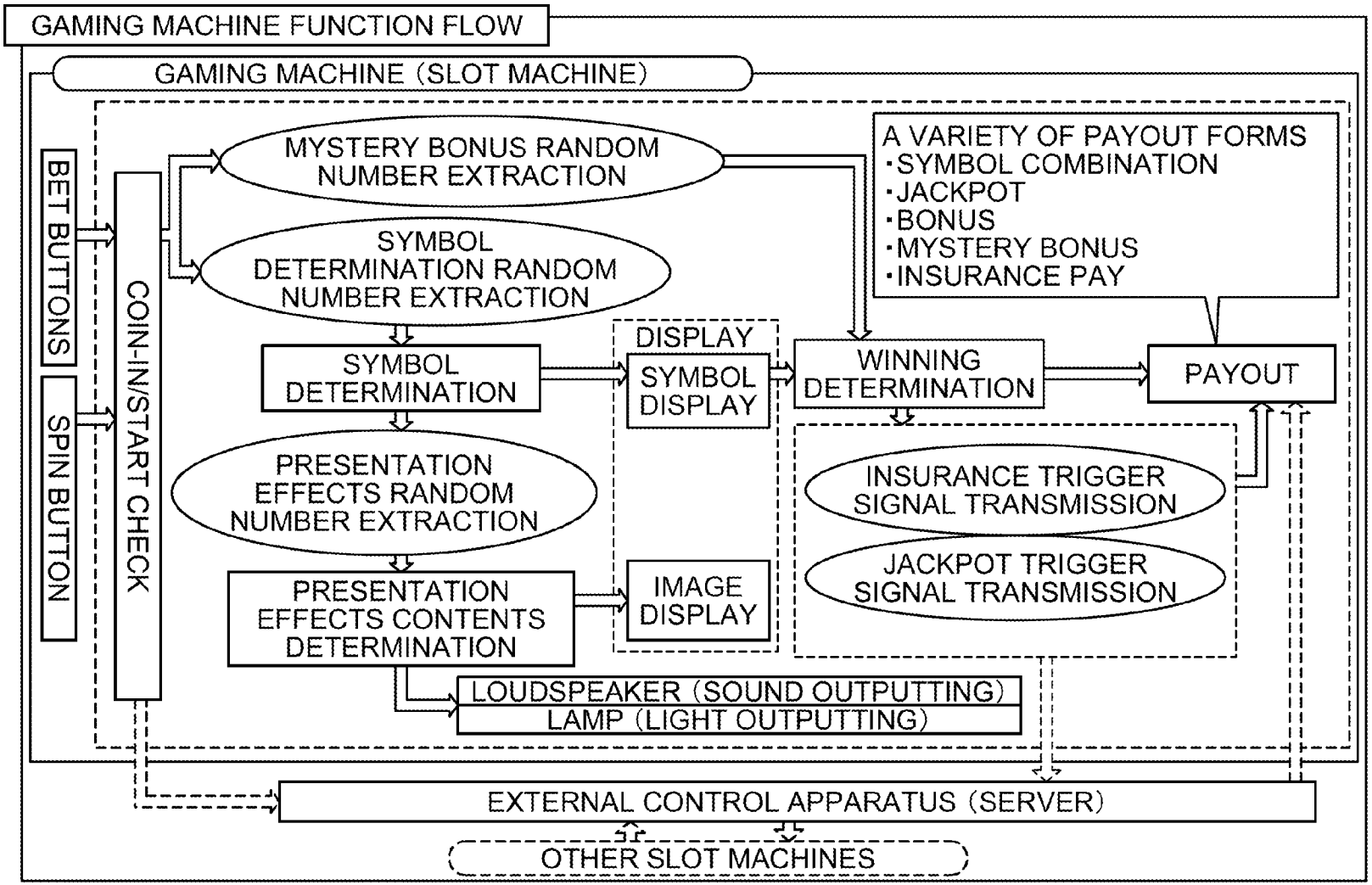
FIG. 2 is a diagram showing a function flow of the slot machine according to the first embodiment of the present invention.

With reference to FIG. 2, a basic function of the slot machine according to the first embodiment will be described. FIG. 2 is a diagram showing a function flow of the slot machine according to the first embodiment.

<Coin-in/Start-Check>

First, the slot machine checks whether or not any BET button is pressed by a player and subsequently checks whether or not a SPIN button is pressed by a player.

<Determination of Symbols>

Next, when the SPIN button is pressed by a player, the slot machine extracts random number values for determining symbols and determines symbols to be displayed to a player upon stopping of scrolling of symbol columns in accordance with the plurality of video reels displayed on the display.

<Display of Symbols>

Next, the slot machine starts the scrolling of the symbol columns of the respective video reels and stops the scrolling so as to display the determined symbols to a player.

<Winning Determination>

Next, upon stopping the scrolling of the symbol columns of the respective video reels, the slot machine determines whether or not a combination of the symbols displayed to a player is associated with a winning combination.

<Paying-Out>

Next, when the combination of the symbols displayed to a player is the winning combination, the slot machine awards a benefit in accordance with a kind of the combination of these symbols to a player. For example, when a combination of symbols related to a payout of coins is displayed, the slot machine pays out, to a player, coins whose number is in accordance with the combination of the symbols.

In addition, when a combination of symbols related to triggering of a bonus game is displayed, the slot machine initiates the bonus game. In the first embodiment of the present invention, as the bonus game, a game (free games) in which a drawing for determining the above-mentioned symbols to be stopped is conducted without consuming coins at a predetermined number of times is conducted.

In addition, when a combination of symbols related to triggering of a jackpot is displayed, the slot machine pays out coins corresponding to a jackpot amount to a player. The jackpot functions such that portions of coins consumed by a player on respective slot machines are accumulated as jackpot amounts and, when the triggering of a jackpot has been achieved on any slot machine, coins corresponding to the accumulated jackpot amounts are paid out to such a slot machine. The slot machine calculates an amount to be accumulated as the jackpot amount each time one game is played (cumulative amount) and transmits the calculated amount to an external control apparatus. The external control apparatus accumulates cumulative amounts transmitted from the respective slot machines as the jackpot amounts.

In addition, in the slot machine, besides the above-mentioned benefit, benefits such as a mystery bonus and insurance are provided. The mystery bonus is to pay out coins corresponding to a predetermined amount upon the occurrence of winning in a dedicated drawing. When the SPIN button is pressed, the slot machine extracts random number values for the mystery bonus and determines, through the drawing, whether or not the triggering of the mystery bonus is to be achieved.

The insurance is a function provided for the purpose of helping a player who is in the situation where any bonus game is not conducted for a long period of time. In the first embodiment of the present invention, whether or not the insurance is made active can be arbitrarily selected by a player. In exchange for a predetermined insurance purchase amount, the insurance is made active. When the insurance is made active, the slot machine starts counting of the number of times of games played. When without a large amount being paid out by the bonus game and the like, the counted number of times of the games played reaches a predetermined number of times, the slot machine pays out coins corresponding to an amount which has been set for the insurance.

<Determination of Presentation Effects>

The slot machine performs presentation effects through displaying of images using the display, outputting of light using a lamp, and outputting of sound using a loudspeaker. The slot machine extracts random number values for the presentation effects and based on symbols, determined through a drawing, and the like, determines contents of the presentation effects.

[The Whole of Game System]

Figure 3:
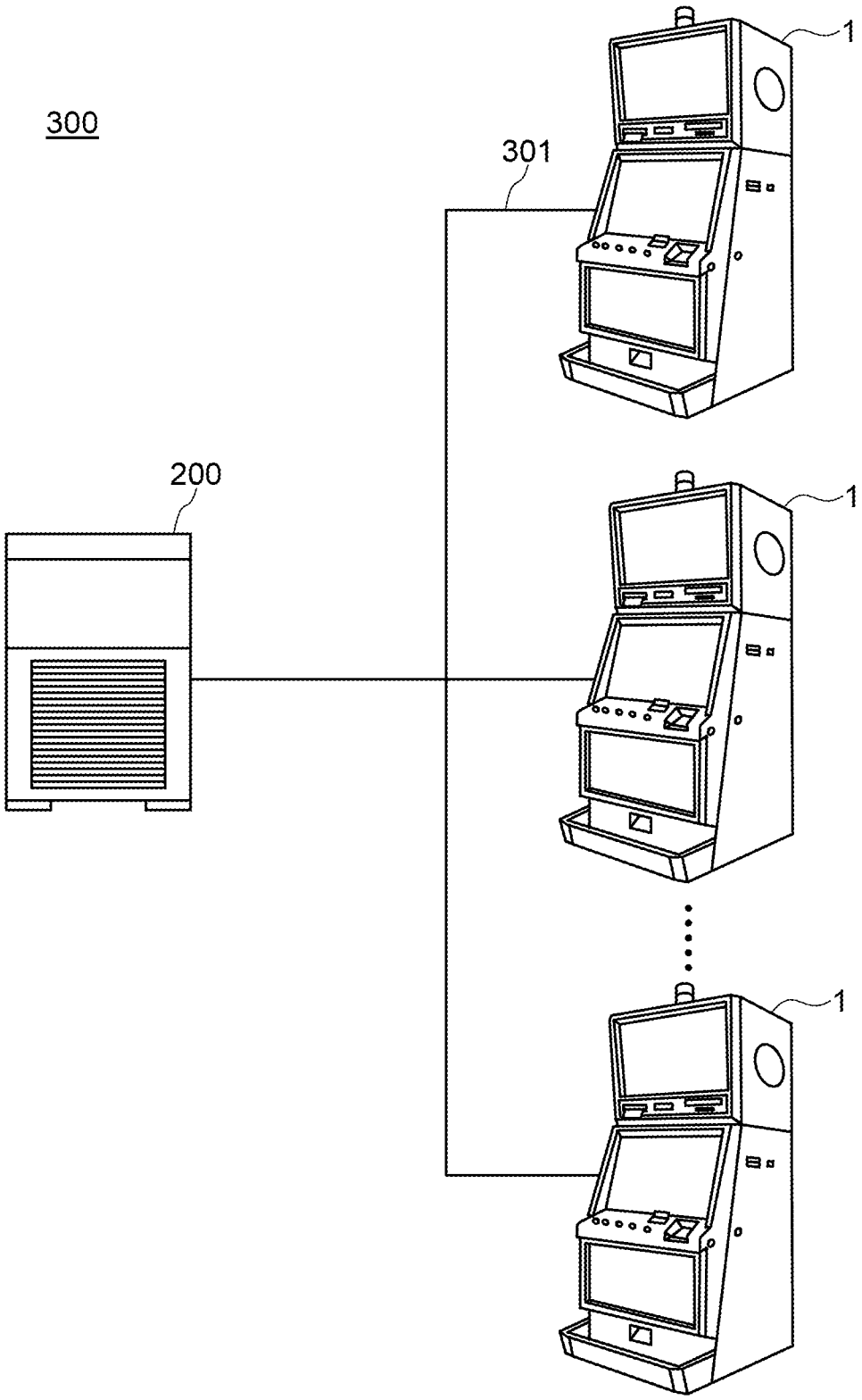
FIG. 3 is a diagram illustrating the game system including the slot machine according to the first embodiment of the present invention.

The basic function of the slot machine is as described above. Next, with reference to FIG. 3, a game system including the slot machines will be described. FIG. 3 is a diagram illustrating the game system including the slot machines according to the first embodiment of the present invention.

The game system 300 includes: a plurality of slot machines 1 and an external control apparatus 200 connected to the respective slot machines 1 via a communication line 301.

The external control apparatus 200 controls the plurality of slot machines 1. In the first embodiment of the present invention, the external control apparatus 200 is the so-called hall server installed in a gaming house having the plurality of slot machines 1. Each of the slot machines 1 is provided with a unique identification number, and the external control apparatus 200 identifies a source of data transmitted from each of the slot machines 1 using each of the identification numbers. In addition, also when data is transmitted from the external control apparatus 200 to each of the slot machines 1, each of the identification numbers is used to designate a destination.

The game system 300 may be structured in one gaming house such as a casino or may be structured among a plurality of gaming houses. In addition, when the game system 300 is structured in one gaming house, the game system 300 may be structured in each floor or section of the gaming house. The communication line 301 may be either wired or wireless, and a dedicated line, a switched line, or the like can be employed as the communication line.

[Overall Structure of Slot Machine]

Figure 4:
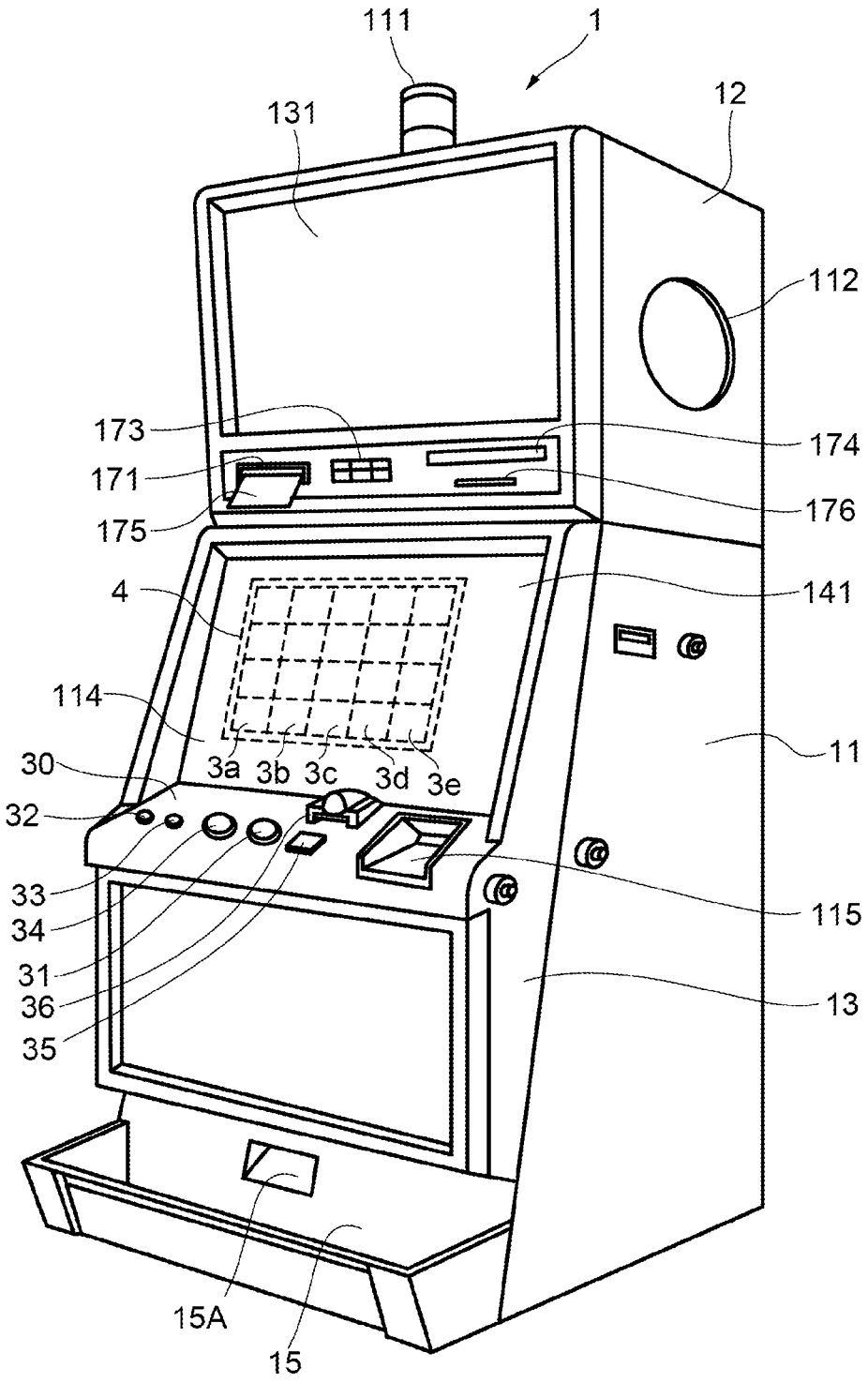
FIG. 4 is a diagram illustrating an overall structure of the slot machine according to the first embodiment of the present invention

The game system according to the first embodiment of the present invention is as described above. Next, with reference to FIG. 4, an overall structure of the slot machine 1 will be described. FIG. 4 is a drawing illustrating the overall structure of the slot machine according to the embodiment of the present invention.

On the slot machine 1, as gaming media, coins, bills, or electronic valuable information corresponding the coins or the bills is used. In addition, in the first embodiment of the present invention, the later-described ticket having a bar code is also used. The gaming media are not limited thereto, and for example, medals, tokens, and electronic money may be adopted.

The slot machine 1 includes: a cabinet 11; a top box 12 installed on an upper side of the cabinet 11; and a main door 13 provided on a front face of the cabinet 11.

In the central portion of the main door 13, a lower side image display panel 141 is provided. The lower side image display panel 141 is formed of a liquid crystal panel, constituting the display. The lower side image display panel 141 has a symbol display area 4. In the symbol display area 4, five video reels 3 (3*a*, 3*b*, 3*c*, 3*d*, and 3*e*) are displayed. In the embodiment of the present invention, the video reels are to represent, with images, motions of rotation and stoppage of mechanical reels whose peripheries have a plurality of symbols depicted thereon. Each of respective symbol columns composed of a predetermined plurality of symbols is assigned to each of the video reels 3 (refer to FIG. 5 later described).

In the symbol display area 4, the respective symbol columns assigned to the respective video reels 3 are each scrolled and after a predetermined lapse of time, are stopped. As a result, a part of each of the respective symbol columns (in the first embodiment of the present invention, four symbols) are displayed to a player. In the symbol display area 4, on each of the video reels 3, each one symbol is displayed in each of four areas in an upper row, a middle upper row, a middle lower row, and a lower row. In other words, in the symbol display area 4, 20 symbols, 4 symbols/column×5 symbols/row, are displayed.

In the first embodiment of the present invention, any of the above-mentioned four areas is selected in accordance with each of the respective video reels 3, and the respective selected areas are connected to form a line, which is defined as a payline. A specific form of the payline can be arbitrarily adopted. However, for example, besides a linear line formed by connecting the respective areas in the middle upper row in accordance with the respective video reels 3, a V-shaped line, a bent-shape line, and the like can be adopted. In addition, as to the number of paylines, although in the first embodiment of the present invention, the number of paylines are 50, as the number of paylines, for example, 30 and the like can be arbitrarily adopted.

In addition, in the lower side image display panel 141, a touch panel 114 is built-in. A player can input a variety of instructions by touching the lower side image display panel 141.

Below the lower side image display panel 141, a variety of buttons placed on a control panel 30 and a variety of devices to be operated by a player are located.

A SPIN button 31 is used upon starting the scrolling of the symbol columns of the respective video reels 3. A CHANGE button 32 is used upon requesting exchange from a gaming house employee. A CASHOUT button 33 is used upon paying out coins deposited inside the slot machine 1 to a coin tray 15.

A 1-BET button 34 and a MAX BET button 35 are to determine the number of coins (hereinafter, referred to as the number of BETs) used in gaming from coins deposited inside the slot machine 1. The 1-BET button 34 is used upon determining the above-mentioned number of BETs in a unit of one coin. The MAX BET button 35 is used upon selecting a predefined upper limit number as the above-mentioned number of BETs.

A coin receiving slot 36 is provided to receive coins. A bill validator 115 is provided to receive bills. A bill validator 115 identifies whether or not each bill is legitimate and receives legitimate bills into the cabinet 11. The bill validator 115 may be configured to be capable of reading the later-described ticket having a bar code 175.

On a front face of the top box 12, an upper side image display panel 131 is provided. The upper side image display panel 131 is composed of a liquid crystal panel, constituting the display. On the upper side image display panel 131, images related to the presentation effects and images which indicate introduction of contents of games and explanation of rules of the games are displayed. In addition, on the top box 12, a loudspeaker 112 and a lamp 111 are provided. On the slot machine 1, the presentation effects are conducted by displaying images, outputting sound, and outputting light.

Below the upper side image display panel 131, a ticket printer 171, a card slot 176, a data indicator 174, and a keypad 173 are provided.

The ticket printer 171 is to print onto a ticket a bar code in which data such as the number of credit, time and date, and an identification number of a slot machine 1 is coded and output the ticket as a ticket having a bar code 175. A player can cause the slot machine to read out the ticket having a bar code 175 to play a game and can exchange the ticket having a bar code 175 for bills and the like at a predetermined place of a gaming house (for example, a cashier within a casino), The card slot 176 is to insert a card having predetermined data stored thereon thereinto. For example, a card has stored thereon data for identifying a player and data related to a history of games played by a player. On the card inserted into the card slot 176, data reading and data writing are conducted by the later-described card reader 172. The card may have data corresponding to coins, bills, or a credit stored thereon.

The data indicator 174 is composed of a fluorescent display, an LED, or the like and is to display, for example, data read by the card reader 172 and data inputted by a player via the keypad 173. The keypad 173 is to input instructions and data related to issuance of a ticket and the like.

[Symbol Columns of Video Reels]

The overall structure of the slot machine 1 is as described above. Next, with reference to FIG. 5 to FIG. 28, a configuration of the symbol columns which the video reels 3 of the slot machine 1 have will be described. Each of FIG. 5 to FIG. 8 shows arrangements of symbols depicted on the peripheries of the base game reel strips in the slot machine according to the first embodiment of the present invention. Each of FIG. 9 to FIG. 28 shows arrangements of symbols depicted on the peripheries of the free game reel strips in the slot machine according to the first embodiment.

As shown in FIG. 5 to FIG. 8, to a first video reel ("Reel 1") 3*a* of the base game reel strips, symbol columns composed of 84 symbols corresponding to code Nos. "00" to "83" are assigned. To a second video reel ("Reel 2") 3*b* of the base game reel strips, symbol columns composed of 136 symbols corresponding to code Nos. "00" to "135" are assigned. To a third video reel ("Reel 3") 3*c* of the base game reel strips, symbol columns composed of 128 symbols corresponding to code Nos. "00" to "127" are assigned. To a fourth video reel ("Reel 4") 3*d* of the base game reel strips, symbol columns composed of 128 symbols corresponding to code Nos. "00" to "127" are assigned. To a fifth video reel ("Reel 5") 3*e* of the base game reel strips, symbol columns composed of 96 symbols corresponding to code Nos. "00" to "95" are as signed.

The free game video reel strips shown in FIG. 9 to FIG. 12 are used when lions (LION) are selected in the selection game proceeding immediately after shifting from the base game to the free games. To a first video reel ("Reel 1") 3*a* of the free game reel strips, symbol columns composed of 60 symbols corresponding to code Nos. "00" to "59" are assigned. To a second video reel ("Reel 2") 3*b* of the free game reel strips, symbol columns composed of 89 symbols corresponding to code Nos. "00" to "88" are assigned. To a third video reel ("Reel 3") 3*c* of the free game reel strips, symbol columns composed of 89 symbols corresponding to code Nos. "00" to "88" are assigned. To a fourth video reel ("Reel 4") 3*d* of the free game reel strips, symbol columns composed of 89 symbols corresponding to code Nos. "00" to "88" are assigned. To a fifth video reel ("Reel 5") 3*e* of the free game reel strips, symbol columns composed of 60 symbols corresponding to code Nos. "00" to "59" are assigned.

The free game video reel strips shown in FIG. 13 to FIG. 16 are used when tigers (TIGER) are selected in the selection game proceeding immediately after shifting from the base game to the free games. To the first video reel ("Reel 1") 3*a* of the free game reel strips, symbol columns composed of 60 symbols corresponding to code Nos. "00" to "59" are assigned. To the second video reel ("Reel 2") 3*b* of the free game reel strips, symbol columns composed of 89 symbols corresponding to code Nos. "00" to "88" are assigned. To the third video reel ("Reel 3") 3*c* of the free game reel strips, symbol columns composed of 89 symbols corresponding to code Nos. "00" to "88" are assigned. To the fourth video reel ("Reel 4") 3*d* of the free game reel strips, symbol columns composed of 89 symbols corresponding to code Nos. "00" to "88" are assigned. To the fifth video reel ("Reel 5") 3*e* of the free game reel strips, symbol columns composed of 60 symbols corresponding to code Nos. "00" to "59" are assigned.

The free game video reel strips shown in FIG. 17 to FIG. 20 are used when black leopards (BLEOPARD) are selected in the selection game proceeding immediately after shifting from the base game to the free games. To the first video reel ("Reel 1") 3*a* of the free game reel strips, symbol columns composed of 60 symbols corresponding to code Nos. "00" to "59" are assigned. To the second video reel ("Reel 2") 3*b* of the free game reel strips, symbol columns composed of 89 symbols corresponding to code Nos. "00" to "88" are assigned. To the third video reel ("Reel 3") 3*c* of the free game reel strips, symbol columns composed of 89 symbols corresponding to code Nos. "00" to "88" are assigned. To the fourth video reel ("Reel 4") 3*d* of the free game reel strips, symbol columns composed of 89 symbols corresponding to code Nos. "00" to "88" are assigned. To the fifth video reel ("Reel 5") 3*e* of the free game reel strips, symbol columns composed of 60 symbols corresponding to code Nos. "00" to "59" are as signed.

The free game video reel strips shown in FIG. 21 to FIG. 24 are used when white leopards (WLEOPARD) are selected in the selection game proceeding immediately after shifting from the base game to the free games. To the first video reel ("Reel 1") 3*a* of the free game reel strips, symbol columns composed of 60 symbols corresponding to code Nos. "00" to "59" are assigned. To the second video reel ("Reel 2") 3*b* of the free game reel strips, symbol columns composed of 89 symbols corresponding to code Nos. "00" to "88" are assigned. To the third video reel ("Reel 3") 3*c* of the free game reel strips, symbol columns composed of 89 symbols corresponding to code Nos. "00" to "88" are assigned. To the fourth video reel ("Reel 4") 3*d* of the free game reel strips, symbol columns composed of 89 symbols corresponding to code Nos. "00" to "88" are assigned. To the fifth video reel ("Reel 5") 3*e* of the free game reel strips, symbol columns composed of 60 symbols corresponding to code Nos. "00" to "59" are assigned.

The free game video reel strips shown in FIG. 25 to FIG. 28 are used when cheetahs (CHEETAH) are selected in the selection game proceeding immediately after shifting from the base game to the free games. To the first video reel ("Reel 1") 3*a* of the free game reel strips, symbol columns composed of 60 symbols corresponding to code Nos. "00" to "59" are assigned. To the second video reel ("Reel 2") 3*b* of the free game reel strips, symbol columns composed of 89 symbols corresponding to code Nos. "00" to "88" are assigned. To the third video reel ("Reel 3") 3*c* of the free game reel strips, symbol columns composed of 89 symbols corresponding to code Nos. "00" to "88" are assigned. To the fourth video reel ("Reel 4") 3*d* of the free game reel strips, symbol columns composed of 89 symbols corresponding to code Nos. "00" to "88" are assigned. To the fifth video reel ("Reel 5") 3*e* of the free game reel strips, symbol columns composed of 60 symbols corresponding to code Nos. "00" to "59" are assigned.

The noteworthy respect is that previously stored is reel strip data which sets a total number of symbols N on the video reel strips, including an increased number of symbols of any one kind among the plurality of kinds of character symbols of lions, tigers, black leopards, white leopards, and cheetahs so as to be the same number invariably even when symbols of any one kind of the plurality of kinds of character symbols are increased. In other words, in the present invention, the processor is configured such that in the process of setting the video reel strips in the free games executed by the processor, on the free game video reel strips associated with each of the plurality of kinds of character symbols, the increased number of the character symbols of any one of the plurality of kinds of character symbols is offset by reducing the numbers of the other symbols and all of the free game video reel strips have the same total number of symbols.

In addition, in the free game payout table, payouts awarded in accordance with respective winning combinations when any of the character symbols (lions, tiger, black leopards, white leopards, and cheetahs) selected in the selection game are displayed on the first display (lower side image display panel) and it is thereby determined that winning has occurred are different from one another depending on the plurality of kinds of character symbols. However, of course, the free game payout table may be configured such that all the payouts are the same as one another.

Further, when the free game payout table is configured such that the payouts are different from one another depending on the kinds of the character symbols, if a probability for the winning which involves character symbols with large payout is equal to a probability for winning which involves character symbols with small payout, then total payout amounts in the feature game are likely to be largely different from one another depending on a result of the selection.

In order to avoid the above-described situation, the processor sets data to perform control such that in the free games, a probability for the winning which involves character symbols with large payout is lower than a probability for winning which involves character symbols with small payout. A non-volatile memory of a memory card 54 has the above-described data stored therein, also thereby allowing setting of weighting of the kinds of character symbols to be displayed on the first display.

Data for changing the above-mentioned weighting is previously prepared, and it is also made possible for the processor to perform control such that the total payout amount per one feature game does not largely change depending on the selected kind of character symbol.

As shown in FIG. 5 to FIG. 8, as the kinds of the symbols of the base game video reel strips, the symbols "WILD", "LION", "TIGER", "BLEOPARD", "WLEOPARD", "CHEETAH", "ACE", "KING", "QUEEN", "JACK", "TEN", "NINE", and "FEATURE" are provided.

The symbols "FEATURE" are present on the second video reel ("Reel 2") 3*b*, the third video reel ("Reel 3") 3*c*, and the fourth video reel ("Reel 4") 3*d*. The symbols "WILD" are present on the second video reel ("Reel 2") 3*b*, the third video reel ("Reel 3") 3*c*, the fourth video reel ("Reel 4") 3*d*, and the fifth video reel ("Reel 5") 3*e*. The symbols of each of "LION", "TIGER", "BLEOPARD", WLEOPARD", "CHEETAH", "ACE", "KING", "QUEEN", "JACK", "TEN", and "NINE" are present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*.

In other words, the symbols of each of "LION", "TIGER", "BLEOPARD", WLEOPARD", "CHEETAH", "ACE", "KING", "QUEEN", "JACK", "TEN", and "NINE" are present on all of the video reels 3*a* to 3*e*. The symbols "WILD", "LION", "TIGER", "BLEOPARD", WLEOPARD", "CHEETAH", "ACE", "KING", "QUEEN", "JACK", "TEN", and "NINE" are arranged in succession. The symbols of "LION", "TIGER", "BLEOPARD", WLEOPARD", and "CHEETAH" are the animal symbols of lions, tigers, black leopards, white leopards, and cheetahs as described above.

As shown in FIG. 9 to FIG. 12, as the kinds of the symbols of the free game video reel strips used when the lion (LION) is selected in the selection game, the symbols "LION", "ACE", "KING", "QUEEN", "JACK", "TEN", "NINE", and "FEATURE" are provided.

The symbols "FEATURE" are present on the second video reel ("Reel 2") 3*b*, the third video reel ("Reel 3") 3*c*, and the fourth video reel ("Reel 4") 3*d*. The symbols "LION", "ACE", "KING", "QUEEN", "JACK", "TEN", and "NINE" are present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*.

In particular, to the first video reel ("Reel 1") 3*a* of the free game reel strips used when the lion (LION) is selected in the selection game, 36 symbols "LION" corresponding to code Nos. "00" to "35" are assigned. In other words, as compared with the first video reel ("Reel 1") 3*a* of the base game reel strips, a large number of the lion symbols "LION" selected in the selection game are arranged in succession. The same applies to the second video reel ("Reel 2") 3*b*, the third video reel ("Reel 3") 3*c*, the fourth video reel ("Reel 4") 3*d*, and the fifth video reel ("Reel 5") 3*e* of the free game reel strips.

As shown in FIG. 13 to FIG. 16, as the kinds of the symbols of the free game video reel strips used when the tiger (TIGER) is selected in the selection game, the symbols "TIGER", "ACE", "KING", "QUEEN", "JACK", "TEN", "NINE", and "FEATURE" are provided.

The symbols "FEATURE" are present on the second video reel ("Reel 2") 3*b*, the third video reel ("Reel 3") 3*c*, and the fourth video reel ("Reel 4") 3*d*. The symbols "TIGER", "ACE", "KING", "QUEEN", "JACK", "TEN", and "NINE" are present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*.

In particular, to the first video reel ("Reel 1") 3*a* of the free game reel strips used when the tiger (TIGER) is selected in the selection game, 36 symbols "TIGER" corresponding to code Nos. "00" to "35" are assigned. In other words, as compared with the first video reel ("Reel 1") 3*a* of the base game reel strips, a large number of the tiger symbols "TIGER" selected in the selection game are arranged in succession. The same applies to the second video reel ("Reel 2") 3*b*, the third video reel ("Reel 3") 3*c*, the fourth video reel ("Reel 4") 3*d*, and the fifth video reel ("Reel 5") 3*e* of the free game reel strips.

As shown in FIG. 17 to FIG. 20, as the kinds of the symbols of the free game video reel strips used when the black leopard (BLEOPARD) is selected in the selection game, the symbols "BLEOPARD", "ACE", "KING", "QUEEN", "JACK", "TEN", "NINE", and "FEATURE" are provided.

The symbols "FEATURE" are present on the second video reel ("Reel 2") 3*b*, the third video reel ("Reel 3") 3*c*, and the fourth video reel ("Reel 4") 3*d*. The symbols "BLEOPARD", "ACE", "KING", "QUEEN", "JACK", "TEN", and "NINE" are present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*.

In particular, to the first video reel ("Reel 1") 3*a* of the free game reel strips used when the black leopard (BLEOPARD) is selected in the selection game, 36 symbols "BLEOPARD" corresponding to code Nos. "00" to "35" are assigned. In other words, as compared with the first video reel ("Reel 1") 3*a* of the base game reel strips, a large number of the black leopard symbols "BLEOPARD" selected in the selection game are arranged in succession. The same applies to the second video reel ("Reel 2") 3*b*, the third video reel ("Reel 3")

3*c*, the fourth video reel ("Reel 4") 3*d*, and the fifth video reel ("Reel 5") 3*e* of the free game reel strips.

As shown in FIG. 21 to FIG. 24, as the kinds of the symbols of the free game video reel strips used when the white leopard (WLEOPARD) is selected in the selection game, the symbols "WLEOPARD", "ACE", "KING", "QUEEN", "JACK", "TEN", "NINE", and "FEATURE" are provided.

The symbols "FEATURE" are present on the second video reel ("Reel 2") 3*b*, the third video reel ("Reel 3") 3*c*, and the fourth video reel ("Reel 4") 3*d*. The symbols "WLEOPARD", "ACE", "KING", "QUEEN", "JACK", "TEN", and "NINE" are present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*.

In particular, to the first video reel ("Reel 1") 3*a* of the free game reel strips used when the white leopard (WLEOPARD) is selected in the selection game, 36 symbols "WLEOPARD" corresponding to code Nos. "00" to "35" are assigned. In other words, as compared with the first video reel ("Reel 1") 3*a* of the base game reel strips, a large number of the white leopards "WLEOPARD" selected in the selection game are arranged in succession. The same applies to the second video reel ("Reel 2") 3*b*, the third video reel ("Reel 3") 3*c*, the fourth video reel ("Reel 4") 3*d*, and the fifth video reel ("Reel 5") 3*e* of the free game reel strips.

As shown in FIG. 25 to FIG. 28, as the kinds of the symbols of the free game video reel strips used when the cheetah (CHEETAH) is selected in the selection game, the symbols "CHEETAH", "ACE", "KING", "QUEEN", "JACK", "TEN", "NINE", and "FEATURE" are provided.

The symbols "FEATURE" are present on the second video reel ("Reel 2") 3*b*, the third video reel ("Reel 3") 3*c*, and the fourth video reel ("Reel 4") 3*d*. The symbols "CHEETAH", "ACE", "KING", "QUEEN", "JACK", "TEN", and "NINE" are present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*.

In particular, to the first video reel ("Reel 1") 3*a* of the free game reel strips used when the cheetah (CHEETAH) is selected in the selection game, 36 symbols "CHEETAH" corresponding to code Nos. "00" to "35" are assigned. In other words, as compared with the first video reel ("Reel 1") 3*a* of the base game reel strips, a large number of the cheetah symbols "CHEETAH" selected in the selection game are arranged in succession. The same applies to the second video reel ("Reel 2") 3*b*, the third video reel ("Reel 3") 3*c*, the fourth video reel ("Reel 4") 3*d*, and the fifth video reel ("Reel 5") 3*e* of the free game reel strips.

[Configuration of Circuitry Included in Slot Machine]

Figure 29:
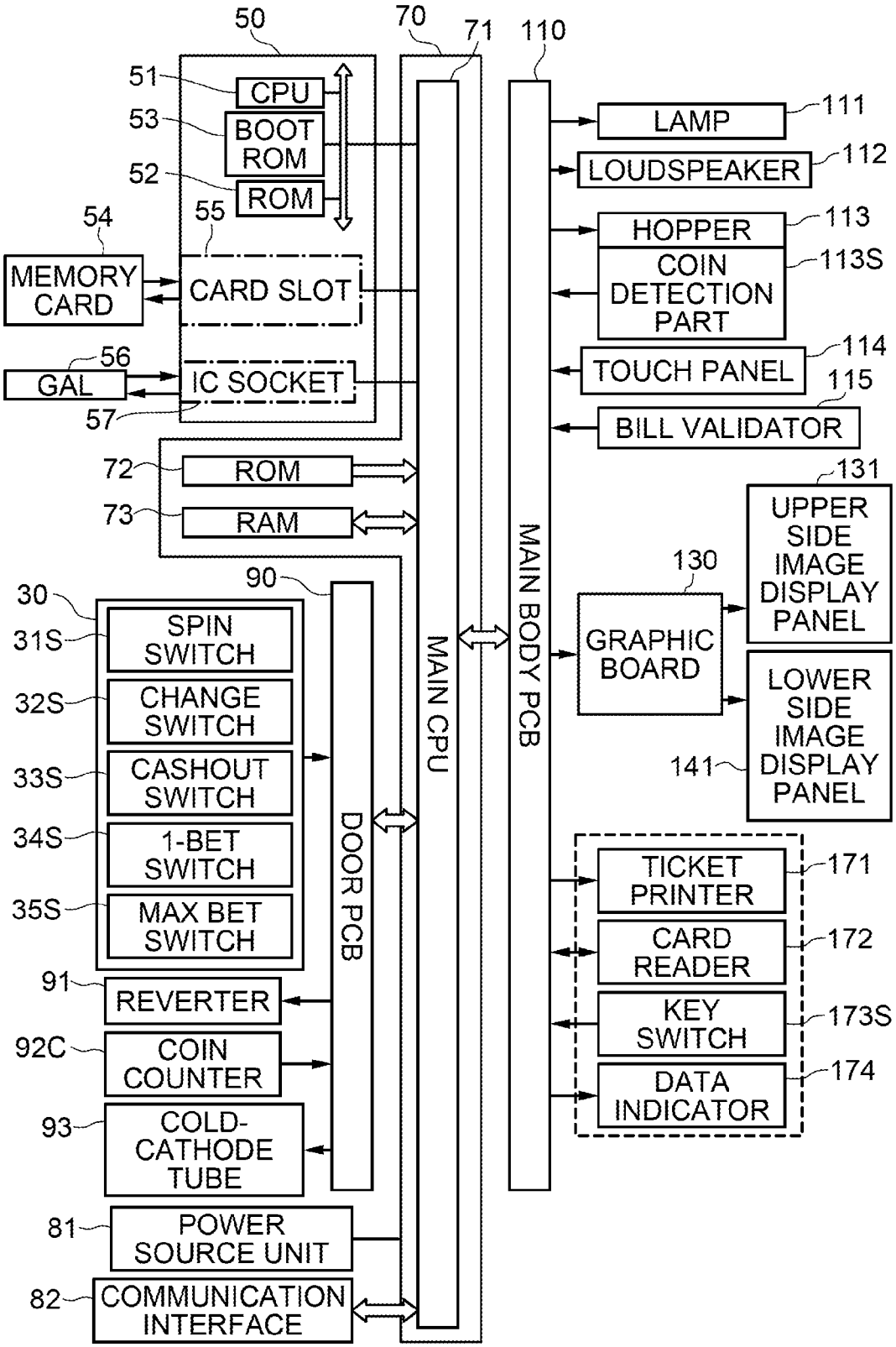
FIG. 29 is a block diagram illustrating an internal configuration of the slot machine according to the first embodiment of the present invention.

The configuration of the symbol columns which the video reels 3 of the slot machine 1 have is as described above. Next, with reference to FIG. 29, a configuration of circuitry which the slot machine 1 includes will be described. FIG. 29 is a block diagram illustrating an internal configuration of the slot machine according to the first embodiment of the present invention.

A gaming board 50 includes: a CPU 51, a ROM 52, and a boot ROM 53, which are connected to one another by an internal bus; a card slot 55 associated with a memory card 54; and an IC socket 57 associated with a GAL (Generic Array Logic) 56.

The memory card 54 is composed of a nonvolatile memory and has a game program and a game system program stored thereon. The game program includes a program related to game proceeding, a drawing program, and a program for executing presentation effects by images and sounds (for example, refer to FIG. 32 to FIG. 41 described later). In addition, the above-mentioned game program includes data (refer to FIG. 5 to FIG. 28) which defines the configuration of the symbol columns assigned to the respective video reels 3.

The drawing program is to determine symbols on the respective video reels 3, which are scheduled to be stopped, by a drawing. The data pertinent to the symbols scheduled to be stopped is data for determining four symbols displayed in the symbol display area 4 from the plurality of symbols constituting each of the symbol columns. The slot machine 1 according to the first embodiment of the present invention determines symbols displayed in predetermined areas (for example, the areas in the upper row) among the four areas associated with each of the video reels 3 as the symbols scheduled to be stopped.

The above-mentioned drawing program includes symbol determination data. The symbol determination data is to define random number values in accordance with each of the video reels 3 such that each of the plurality of symbols constituting each of the symbol columns is determined with an equal probability. For example, in a case of the first video reel ("Reel 1") 3*a* of the base game video reel strips, by using the symbol determination data, random number values are determined such that each of the 84 symbols (code Nos. "00" to "83") is determined with the equal probability (specifically, 1/84). However, since the numbers of the respective kinds of the symbols included in the 84 symbols are different, probabilities with which the respective kinds of the symbols are determined are different from one another (in other words, weights are yielded). For example, with reference to FIG. 5 to FIG. 8, the number of the symbols "GOLD" included in the symbol column of the first video reel ("Reel 1") 3*a* of the base game video reel strips is 12 whereas the number of the symbols "ACE" included in the symbol column of the first video reel ("Reel 1") 3*a* of the base game reel strips is 4. Accordingly, the former is determined with a probability of "12/84" whereas the latter is determined with a probability of "4/84".

In the first embodiment of the present invention, the data is defined such that the numbers of the kinds of the symbols constituting the respective symbol columns are different from one another in accordance with each of the video reels 3. However, the numbers of the kinds of the symbols constituting the respective symbol columns may be the same as one another. For example, each of all of the symbol columns of the video reels 3*a* to 3*e* of the base game video reel strips and the free game video reel strips may be configured so as to be formed of 22 symbols. Thus, a degree of freedom upon setting probabilities with which the respective kinds of symbols are determined in accordance with each of the video reels 3 is increased.

In addition, the card slot 55 is configured such that the memory card 54 can be inserted thereto and pulled out therefrom and is connected to a mother board 70 by an IDE bus.

The GAL 56 is a kind of a PLD (Programmable Logic Device) having a fixed OR array architecture. The GAL 56 includes a plurality of input ports and output ports and when each of the input ports has received a predetermined input, corresponding data is outputted from each of the output ports.

In addition, the IC socket 57 is configured such that the GAL 56 is detachable and is connected to the mother board 70 by a PCI bus. The memory card 54 is replaced with a memory card having another program written thereon or the program written on the memory card 54 is replaced with another program, thereby allowing the contents of a game played on each of the slot machines 1 to be changed.

The CPU 51, the ROM 52, and the boot ROM 53 connected to one another by the internal bus are connected to the mother board 70 by the PCI bus. The PCI bus transmits signals between the mother board 70 and the gaming board 50 and supplies power from the mother board 70 to the gaming board 50.

The ROM 52 has an authentication program stored thereon. The boot ROM 53 has stored thereon an auxiliary authentication program, a program (boot code) for allowing the CPU 51 to activate the auxiliary authentication program, and the like. The authentication program is a program (tampering check program) for authenticating the game program and the game system program. The auxiliary authentication program is a program for authenticating the above-mentioned authentication program. The authentication program and the auxiliary authentication program are written along a procedure (authentication procedure) for authenticating that a targeted program is not tampered.

The mother board 70 includes: a main CPU 71, a ROM 72, a RAM 73, and a communication interface 82.

The ROM 72 is composed of a memory device such as a flash memory and has stored thereon a program such as a BIOS (Basic Input/Output System) executed by the main CPU 71 and permanent data. When the BIOS is executed by the main CPU 71, an initialization process for predetermined peripheral devices is conducted. In addition, via the gaming board 50, a process for loading the game program and the game system program stored on the memory card 54 is started.

The processor in the present invention includes the above-mentioned main CPU 71, ROM 72, RAM 73, and the memory card 54 having stored thereon the game program and the game system program, and the CPU 71 executes the game program and the game system program, thereby controlling the slot machine. Needless to say, the configuration of said processor is not limited thereto, and a configuration in which instead of the memory card 54, the ROM 72 has stored thereon the game program and the game system program may be adopted.

The RAM 73 has stored thereon data and programs used when the main CPU 71 operates. For example, when the process for loading the above-described game program and game system program and the authentication program is conducted, these can be stored thereon. In addition, the RAM 73 is provided with working areas for executing each of the above-mentioned programs. For example, provided are an area for storing the number of games, the number of BETs, the number of payouts, the number of credits, and the like and an area for storing symbols (code Nos.) determined by a drawing.

A communication interface 82 is to communicate with the external control apparatus 200 such as a server via the communication line 301. In addition, connected to the mother board 70 by USBs are the later-described door PCB (Printed Circuit Board) 90 and main body PCB 110. Further, connected to the mother board 70 is a power source unit 81. When power is supplied from the power source unit 81 to the mother board 70, the main CPU 71 of the mother board 70 is activated and the power is supplied to the gaming board 50 via the PCI bus, thereby activating the CPU 51.

Connected to the door PCB 90 and the main body PCB 110 are input devices such as switches and sensors; and peripheral devices whose operations are controlled by the main CPU 71. Connected to the door PCB 90 are a control panel 30, a reverter 91, a coin counter 92C, and a cold-cathode tube 93.

The control panel 30 is provided with a SPIN switch 31S, a CHANGE switch 32S, a CASHOUT switch 33S, a 1-BET switch 34S, and a MAX BET switch 35S so as to correspond to the above-described respective buttons. Each of the switches detects that each of the corresponding buttons is pressed by a player and outputs a signal to the main CPU 71.

A coin counter 92C makes a selection to determine whether or not a material, a shape, and the like of each of the coins inputted into the coin receiving slot 36 are appropriate. Upon detecting each appropriate coin, the coin counter 92C outputs a signal to the main CPU 71. In addition, inappropriate coins are discharged from a coin payout opening 15A.

The reverter 91 operates based on a control signal outputted from the main CPU 71 and distributes the appropriate coins selected by the coin counter 92C to a hopper 113 or a cashbox (not shown). When the hopper 113 is not filled with the coins, the appropriate coins are distributed to the hopper 113 and when the hopper 113 is filled with the coins, the appropriate coins are distributed to the cashbox.

A cold-cathode tube 93 functions as a backlight installed on a side of back surfaces of the upper side image display panel 131 and the lower side image display panel 141 and lights up based on a control signal outputted from the main CPU 71.

Connected to the main body PCB 110 are the lamp 111, the loudspeaker 112, the hopper 113, a coin detection part 113S, the touch panel 114, the bill validator 115, a graphic board 130, the ticket printer 171, the card reader 172, a key switch 173S, and the data indicator 174.

The lamp 111 lights up based on a control signal outputted from the main CPU 71. The loudspeaker 112 outputs sound such as BGM based on a control signal outputted from the main CPU 71.

The hopper 113 operates based on a control signal outputted from the main CPU 71 and pays out coins, whose payout number is designated, from the coin payout opening 15A to the coin tray 15. The coin detection part 113S detects the coins provided by the hopper 113 and outputs a signal to the main CPU 71.

The touch panel 114 detects a position touched by a finger or the like of a player on the lower side image display panel and outputs a signal corresponding to the detected position to the main CPU 71. The bill validator 115, upon accepting each legitimate bill, outputs a signal in accordance with an amount of the accepted bill to the main CPU 71.

The graphic board 130 controls a display of images, performed by each of the upper side image display panel 131 and the lower image display panel 141, based on a control signal outputted from the main CPU 71. In the symbol display area 4 of the lower side image display panel 141, the five video reels 3 are displayed, and motions of the scrolling and the stoppage of the symbol columns which the respective video reels 3 have are displayed. The graphic board 130 includes a VDP for generating image data, a video RAM for storing the image data generated by the VDP, and the like.

In addition, the graphic board 130 includes the VDP (Video Display Processor) for generating image data based on a control signal outputted from the main CPU 71, the video RAM for temporarily storing the image data generated by the VDP, and the like. The image data used when the image data is generated by the VDP is included in the game program read out from the memory card 54 and stored in the RAM 73.

The ticket printer 171 prints onto a ticket a bar code, in which data such as the number of credits stored on the RAM 73, time and date, and an identification number of a slot machine 1 is coded, based on a control signal outputted from the main CPU 71 and outputs the ticket as a ticket having a bar code 175.

The card reader 172 reads out data stored on a card inserted into the card slot 176, transmits the data to the main CPU 71, and writes the data based on a control signal from the main CPU 71.

The key switch 173S is provided on the keypad 173 and, when the keypad 173 is operated by a player, outputs a predetermined signal to the main CPU 71.

The data indicator 174 displays the data read out by the card reader 172 and the data inputted by a player via the keypad 173, based on a control signal outputted from the main CPU 71.

[Configuration of Symbol Combination Table]

The configuration of the circuitry of the slot machine 1 is as described above. Next, with reference to FIG. 30 and FIG. 31, symbol combination tables will be described. FIG. 30 and FIG. 30 show symbol combination tables of the slot machine according to the first embodiment of the present invention.

The symbol combination tables define symbol combinations and the numbers of payouts associated with winning. On the slot machine 1, when the scrolling of the symbol columns of the respective video reels 3 is stopped and a combination of symbols displayed on a payline matches any combination of symbols defined in the symbol combination tables, winning occurs. In accordance with the winning, a player is provided with a benefit such as a payout of coins and initiation of a bonus game. When a combination of symbols displayed on a payline does not match any of the combinations of symbols defined in the symbol combination tables, no winning occurs (that is, losing occurs).

Basically, with respect to the respective kinds of the symbols "LION", "TIGER", "BLEOPARD", WLEOPARD", "CHEETAH", "ACE", "KING", "QUEEN", "JACK", "TEN", and "NINE", also when three, four, or five symbols of one kind among the above-mentioned kinds are displayed on a payline by the video reels 3, winning occurs. In addition, with respect to the kinds of the symbols "LION", "TIGER", "BLEOPARD", WLEOPARD", and "CHEETAH", two symbols of one kind among the above-mentioned kinds are displayed on a payline by the video reels 3, winning occurs. These wins are associated with LINE payouts, resulting in multiplication of BET PER LINE. The symbols of the kinds of "LION", "TIGER", "BLEOPARD", WLEOPARD", "CHEETAH", "ACE", "KING", "QUEEN", "JACK", "TEN", and "NINE" are substituted for the wild symbols.

For example, when in the base game and the free games, the symbols "LION" are displayed together on a payline by all of the video reels 3, "100" is determined as the number of a payout. This win is associated with a LINE payout, and a value of BET PER LINE is multiplied by this "100". Coins whose number is based on the result of the multiplication are paid out. The paying-out of the coins is conducted by actually discharging the coins from the coin payout opening 15A, by adding a value of the result of the multiplication to the number of credits, or by issuing a bar code ticket.

The symbols "LION", "TIGER", "BLEOPARD", WLEOPARD", and "CHEETAH" are the animal symbols of lions, tigers, black leopards, white leopards, and cheetahs as described above.

The symbols "FEATURE" are symbols related to the triggering of a bonus game. When three symbols "FEATURE" are displayed by the second video reel ("Reel 2") 3*b*, the third video reel ("Reel 3") 3*c*, and the fourth video reel ("Reel 4") 3*d*, "2" is determined as the number of a payout of a scatter pay. A value of TOTAL BET is multiplied by a value of this SCATTER payout. Starting from the next game, the bonus game (free games) is initiated. Also when a total of the number of the displayed symbols "FEATURE" and the number of the displayed symbols "WILD" is a predetermined number (for example, 3), "2" is determined as the number of a payout of the scatter pay. Starting from the next game, the bonus game (free games) is initiated. However, when the three symbols "FEATURE" are displayed, this winning is not that of the LINE payout for which a value of BET PER LINE is multiplied by the number of a payout. No winning of the LINE payout occurs in association with the symbols "FEATURE". In addition, no winning of the LINE payout occurs by replacing the symbols "WILD" with the symbols "FEATURE".

When a predetermined combination composed of symbols of any of the kinds of symbols "LION", "TIGER", "BLEOPARD", WLEOPARD", and "CHEETAH", "ACE", "KING", "QUEEN", "JACK", "TEN", and "NINE" is displayed on a payline, a jackpot trigger occurs and a jackpot amount is determined as the number of a payout.

[Contents of Programs]

The symbol combination tables are as described above. Next, with reference to FIG. 32 to FIG. 41, programs executed by the slot machine 1 will be described.

<Main Control Processes>

Figure 32:
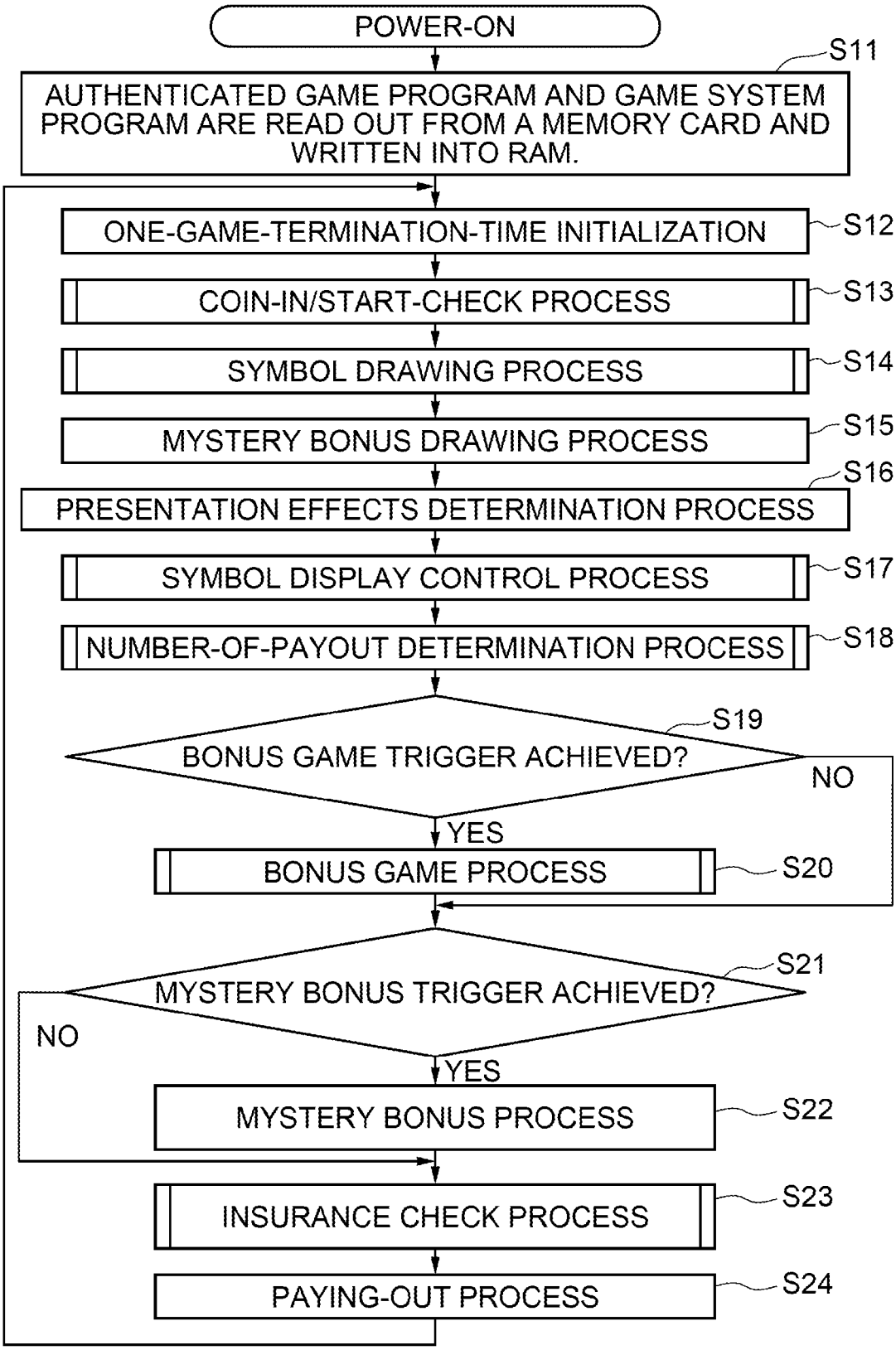
FIG. 32 shows a flowchart of a main control process in the slot machine according to the first embodiment of the present invention.

First, with reference to FIG. 32, main control processes will be described. FIG. 32 shows a flowchart of the main control processes of the slot machine according to the first embodiment of the present invention.

First, when the slot machine 1 is powered on, the main CPU 71 reads out an authenticated game program and an authenticated game system program from the memory card 54 via the gaming board 50 and writes the programs into the RAM 73 (step S11).

Next, the main CPU 71 conducts a one-game-termination-time initialization process (step S12). For example, data such as symbols determined by the number of BETs and a drawing, which becomes unnecessary in a work area of the RAM 73 upon the termination of each one game played, is cleared.

Figure 33:
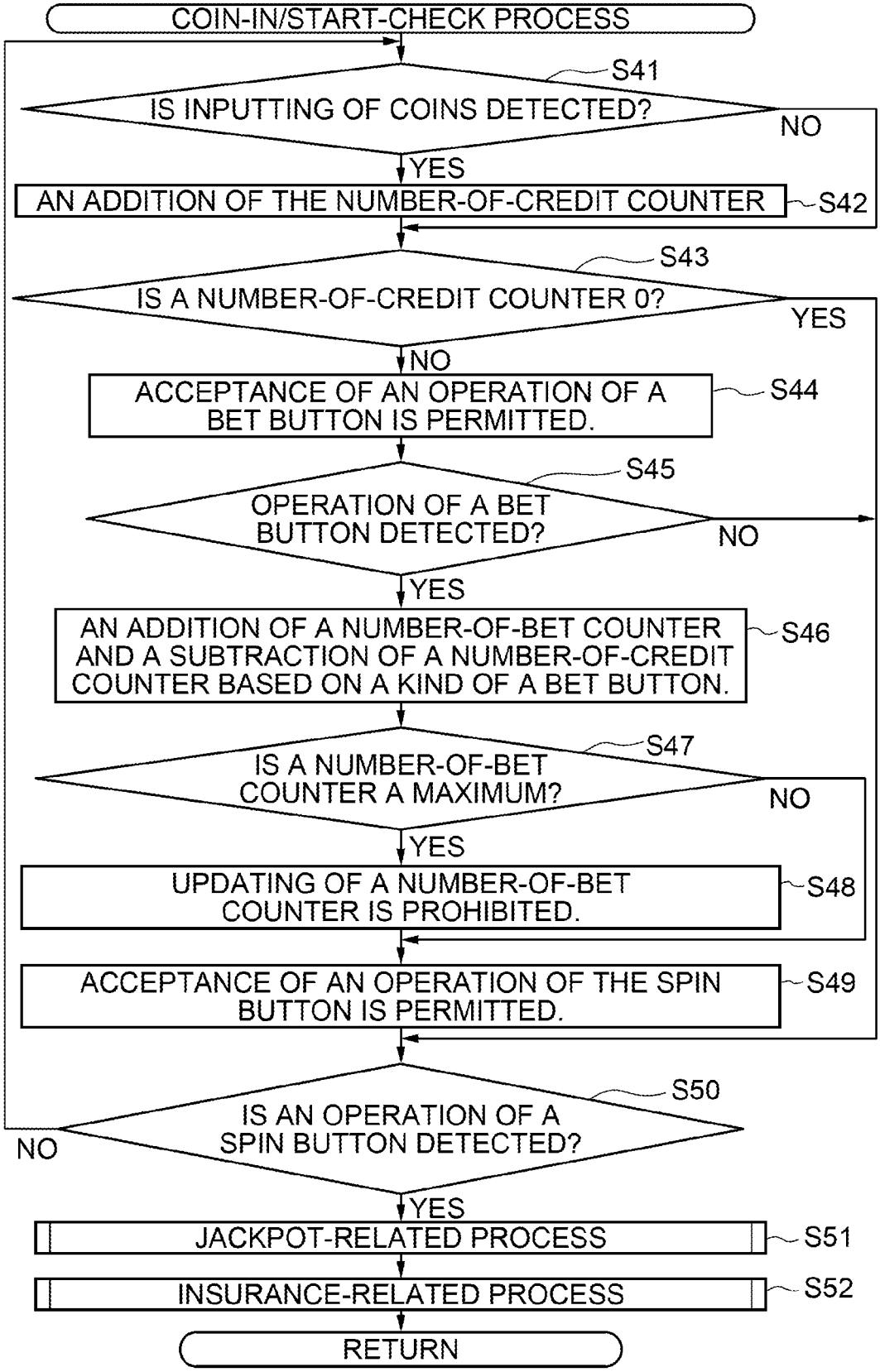
FIG. 33 shows a flowchart of a coin-in/start-check process in the slot machine according to the first embodiment of the present invention.

Next, the main CPU 71 conducts a coin-in/start-check process described later with reference to FIG. 33 (step S13). In this process, inputting of the BET switch and the SPIN switch is checked.

Figure 36:
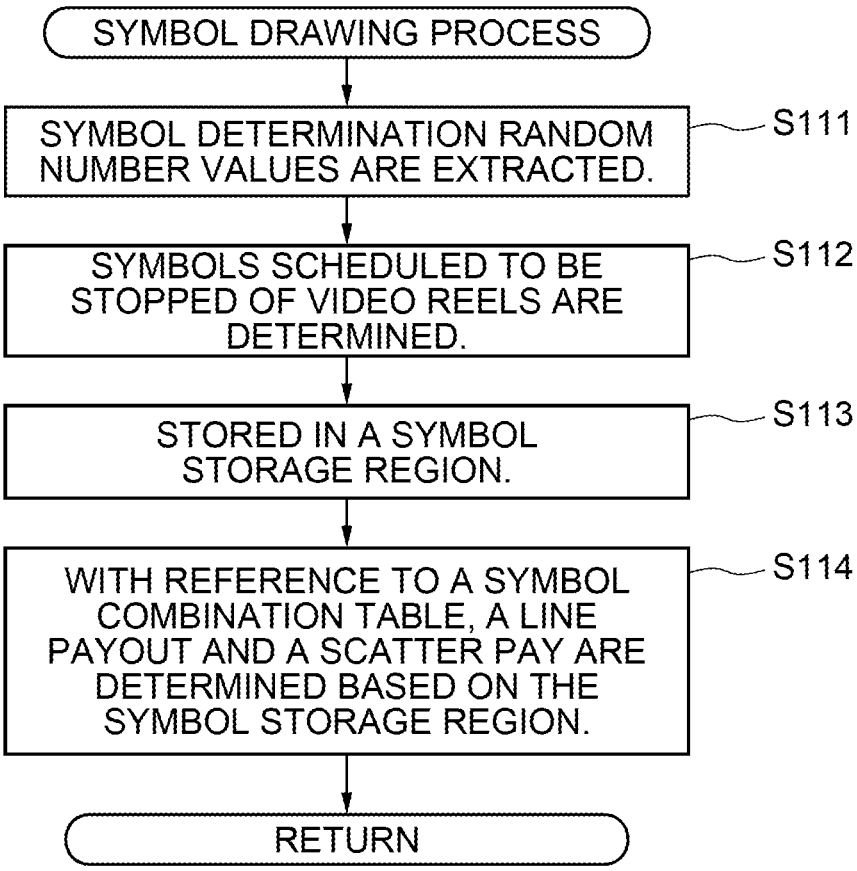
FIG. 36 shows a flowchart of a symbol drawing process in the slot machine according to the first embodiment of the present invention.

Next, the main CPU 71 conducts a symbol drawing process described later with reference to FIG. 36 (step S14). In this process, based on symbol determination random number values, symbols scheduled to be stopped are determined.

Next, the main CPU 71 conducts a mystery bonus drawing process (step S15). In this process, a drawing to determine whether or not a mystery bonus trigger is achieved is conducted. For example, the main CPU 71 extracts a mystery bonus random number value from a range of "0 to 99" and, when the extracted random number value is "0", it is determined that the mystery bonus trigger is achieved.

Next, the main CPU 71 conducts a presentation effects contents determination process (step S16). The main CPU 71 extracts a presentation effects random number value and determines any of a predetermined plurality of presentation effects contents by a drawing.

Figure 37:
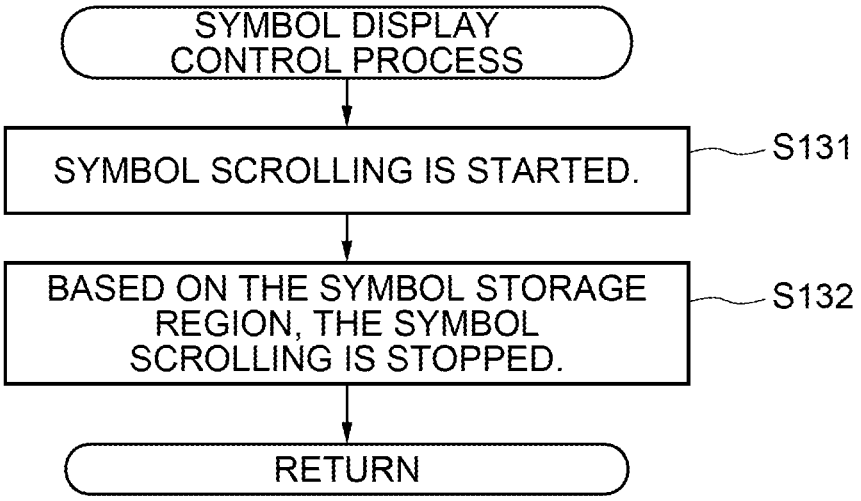
FIG. 37 shows a flowchart of a symbol display control process in the slot machine according to the first embodiment of the present invention.

Next, the main CPU 71 conducts a symbol display control process described later with reference to FIG. 37 (step S17). In this process, the scrolling of the symbol columns of the respective video reels 3 is started and the symbols scheduled to be stopped, which are determined in the symbol drawing process at step S14, are stopped in predetermined positions (for example, areas in the upper row of the symbol display area 4). In other words, four symbols including the symbol scheduled to be stopped are displayed in the symbol display area 4. For example, when the symbol scheduled to be stopped is a symbol associated with a code number "10" and is to be displayed in the upper row, symbols associated with code Nos. "11", "12", and "13" are displayed in the middle upper row, the middle lower row, and the lower row in the symbol display area 4.

Next, the main CPU 71 conducts a number-of-payout determination process described later with reference to FIG. 38 (step S18). In this process, based on a combination of symbols displayed on a payline, the number of a payout is determined and stored on a number-of-payout counter provided in the RAM 73.

Next, the main CPU 71 determines whether or not the bonus game trigger has been achieved (step S19). When determining that the bonus game trigger has been achieved, the main CPU 71 conducts a bonus game process described later with reference to FIG. 40 (step S20). In the embodiment of the present invention, the bonus game is the free games.

Next, after the process at step S20 or upon determining at step S19 that the bonus game trigger has not been achieved, the main CPU 71 determines whether or not a mystery bonus trigger has been achieved (step S21). When determining that the mystery bonus trigger has been achieved, the main CPU 71 conducts a mystery bonus process (step S22). In this process, the number of a payout (for example, 300) set for the mystery bonus is stored on the number-of-payout counter provided in the RAM 73.

Figure 41:
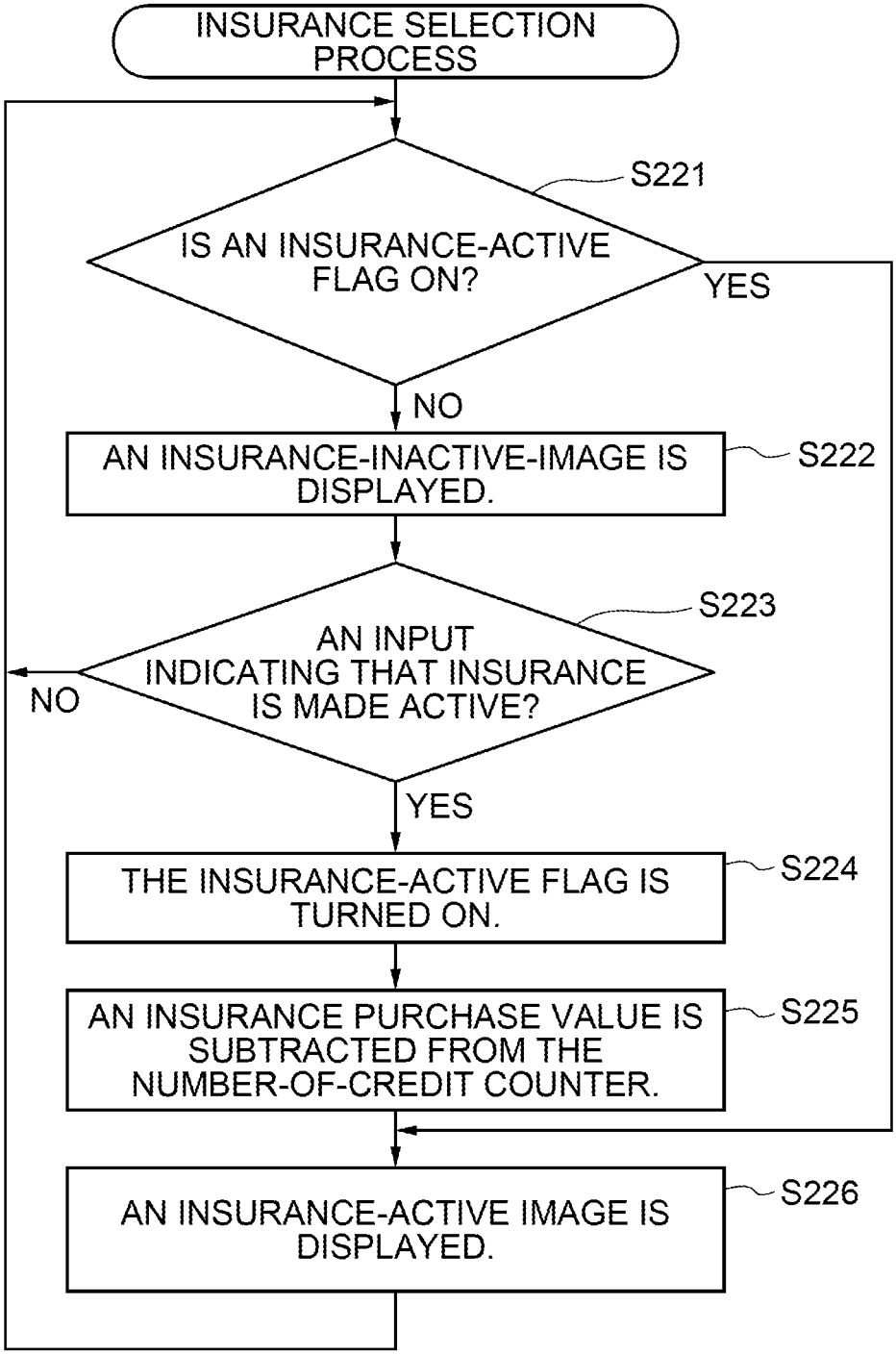
FIG. 41 shows a flowchart of an insurance selection process in the slot machine according to the first embodiment of the present invention.

After the process at step S22 or upon determining at step S21 that the mystery bonus trigger has not been achieved, the main CPU 71 conducts an insurance check process described later with reference to FIG. 41 (step S23). In this process, it is checked whether or not paying-out by the insurance is conducted.

Next, the main CPU 71 conducts a paying-out process (step S24). The main CPU 71 adds a value stored on the number-of-payout counter to a value stored on a number-of-credit counter provided in the RAM 73. Based on an input on the CASHOUT switch 33S, driving of the hopper 113 may be controlled, and coins in accordance with the value stored on the number-of-payout counter may be discharged from the coin payout opening 15A. In addition, driving of the ticket printer 171 may be controlled, and a ticket having a bar code having stored thereon the value stored on the number-of-payout counter may be issued. After having conducted this process, the main CPU 71 shifts to step S12.

<Coin-in/Start-Check Process>

Next, with reference to FIG. 33, the coin-in/start-check process will be described. FIG. 33 shows a flowchart of the coin-in/start-check process of the slot machine according to the first embodiment of the present invention.

First, the main CPU 71 determines whether or not the coin counter 92C has detected inputting of coins (step S41). When determining that inputting of the coins has been detected, the main CPU 71 performs an addition of a value of the number-of-credit counter (step S42). The main CPU 71 may determine whether or not the bill validator 115 has detected inputting of bills in addition to the inputting of the coins, and when determining that the inputting of bills has been detected, a value in accordance with the bills may be added to the value stored on the number-of-credit counter.

After step S42 or upon determining at step S41 that the inputting of the coins has not been detected, the main CPU 71 determines whether or not the value stored in the number-of-credit counter is 0 (step S43). When determining that the value stored on the number-of-credit counter is not 0, the main CPU 71 permits acceptance of an operation of any of the BET buttons (step S44).

Next, the main CPU 71 determines whether or not the operation of any of the BET buttons has been detected (step S45). When any of the BET switches detects that any of the BET buttons has been pressed by a player, based on a kind of the pressed BET button, the main CPU 71 performs an addition of a value stored on a number-of-BET counter provided in the RAM 73 and a subtraction of a value stored on the number-of-credit counter (step S46).

Next, the main CPU 71 determines whether or not the value stored on the number-of-BET counter is a maximum (step S47). When determining that the value stored in the number-of-BET counter is the maximum, the main CPU 71 prohibits updating of the value stored in the number-of-BET counter (step S48). After step S48 or upon determining at step S47 that the value stored in the number-of-BET counter is not the maximum, the main CPU 71 permits acceptance of an operation of the SPIN button (step S49).

After step S49, when determining at step S45 that the operation of any of the BET buttons has not been detected or when determining at step S43 that the value stored in the number-of-credit counter is 0, the main CPU 71 determines whether or not the operation of the SPIN button has been detected (step S50). When determining that the operation of the SPIN button has not been detected, the main CPU 71 shifts to step S41.

Figure 34:
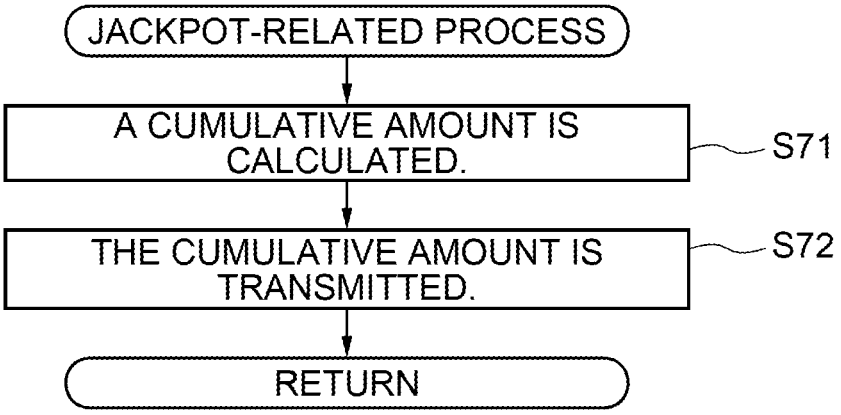
FIG. 34 shows a flowchart of a jackpot-related process in the slot machine according to the first embodiment of the present invention.

When determining that the operation of the SPIN button has been detected, the main CPU 71 conducts a jackpot-related process described later with reference to FIG. 34 (step S51). In this process, an amount accumulated in the jackpot amount is calculated and the calculated amount is transmitted to the external control apparatus 200.

Figure 35:
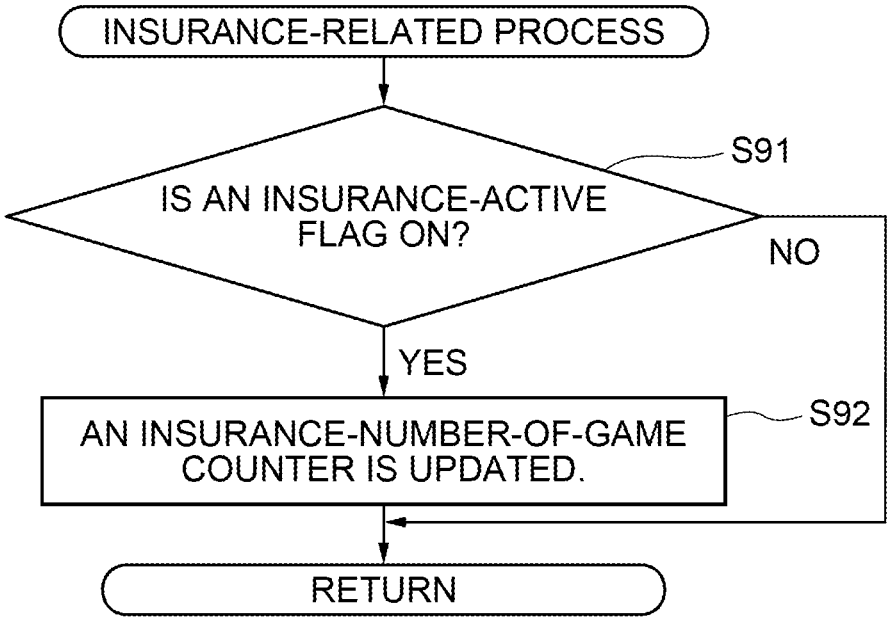
FIG. 35 is a flowchart of an insurance-related process in the slot machine according to the first embodiment of the present invention.

Next, main CPU 71 conducts an insurance-related process described later with reference to FIG. 35 (step S52). In this process, counting of the number of games played, which leads to the paying-out by the insurance, is conducted. After conducting this process, the coin-in/start-check process is finished.

<Jackpot-Related Process>

Next, with reference to FIG. 34, the jackpot-related process will be described. FIG. 34 shows a flowchart of the jackpot-related process of the slot machine according to the first embodiment of the present invention.

First, the main CPU 71 calculates a cumulative amount (step S71). The main CPU 71 calculates a product of a value stored in the number-of-BET counter and a cumulative rate, thereby obtaining the cumulative amount into the jackpot amount.

Next, the main CPU 71 transmits the calculated cumulative amount to the external control apparatus 200 (step S72). When receiving the cumulative amount, the external control apparatus 200 updates the jackpot amount. After conducting this process, the jackpot-related process is finished.

<Insurance-Related Process>

Next, with reference to FIG. 35, the insurance-related process will be described. FIG. 35 is a flowchart of the insurance-related process of the slot machine according to the first embodiment of the present invention.

First, the main CPU 71 determines whether or not an insurance-active flag is on (step S91). The insurance-active flag is set to be on in an insurance selection process described later with reference to FIG. 41 when a player inputs an instruction which makes the insurance active.

When determining that the insurance-active flag is not on, the main CPU 71 finishes the insurance-related process. On the other hand, when determining that the insurance-active flag is on, the main CPU 71 updates a value stored on an insurance-number-of-game counter provided in the RAM 73 (step S92). The insurance-number-of-game counter is a region for storing the number of games played until the paying-out by the insurance is conducted. In the process at step S92, the main CPU 71 adds one to the value stored in the insurance-number-of-game counter. After conducting this process, the insurance-related process is finished.

<Symbol Drawing Process>

Next, with reference to FIG. 36, the symbol drawing process will be described. FIG. 36 shows a flowchart of the symbol drawing process of the slot machine according to the first embodiment of the present invention.

First, the main CPU 71 extracts symbol determination random number values (step S111). Next, the main CPU 71 determines symbols scheduled to be stopped of the respective video reels 3 by drawings (step S112). The main CPU 71 conducts the drawings in accordance with the respective video reels 3 and determines any of pluralities of symbols as the symbols scheduled to be stopped. At this time, the respective pluralities of symbols are determined with probabilities which are equal to one another.

Next, the main CPU 71 stores the determined symbols scheduled to be stopped of the respective video reels 3 in a symbol storage region provided in the RAM 73 (step S113). Next, with reference to the symbol combination tables (in FIG. 30 and FIG. 31), the main CPU 71 determines a LINE payout and a scatter pay based on the symbol storage region (step S114). The main CPU 71 determines whether or not a combination of the symbols displayed on payline by the respective video reels 3 matches any combination of symbols of combinations defined in the symbol combination tables and determines the LINE payout. When three symbols "FEATURE" are displayed in the symbol display area 4, the main CPU 71 determines "2" as the number of a payout of the scatter pay. After conducting this process, the symbol drawing process is finished.

<Symbol Display Control Process>

Next, with reference to FIG. 37, the symbol display control process will be described. FIG. 37 shows a flowchart of the symbol display control process of the slot machine according to the first embodiment of the present invention.

First, the main CPU 71 starts the scrolling of the symbol columns of the respective video reels 3 displayed in the symbol display area 4 of the lower side image display panel 141 (step S131). Next, the main CPU 71 stops the scrolling of the symbol columns of the respective video reels 3 based on the above-described symbol storage region (step S132). After conducting this process, the symbol display control process is finished.

<Number-of-Payout Determination Process>

Next, with reference to FIG. 38, the number-of-payout determination process will be described. FIG. 38 shows a flowchart of the number-of-payout determination process of the slot machine according to the first embodiment of the present invention.

First, the main CPU 71 determines whether or not a combination of symbols is associated with a jackpot (step S151). When determining that the combination of symbols is not associated with the jackpot, the main CPU 71 determines the numbers of payouts corresponding to a LINE payout and a scatter pay (step S152). When losing occurs, "0" is determined as the number of a payout. Next, the main CPU 71 stores the determined numbers of payouts in the number-of-payout counter (step S153). After conducting this process, the number-of-payout determination process is finished.

When determining that the combination of symbols is associated with the jackpot, the main CPU 71 notifies the external control apparatus 200 that the jackpot has occurred (step S154). When having received the notification, the external control apparatus 200 transmits to the slot machine 1 the jackpot amount which has been updated until then. At this time, a portion of the jackpot amount (for example, 80%) may be targeted to be paid out, and the remaining thereof (for example, 20%) may be carried over in preparation for the achievement of the next jackpot trigger.

Next, the main CPU 71 receives the jackpot amount from the external control apparatus 200 (step S155). Next, the main CPU 71 stores the received jackpot amount on the number-of-payout counter (step S156). After conducting this process, the number-of-payout determination process is finished.

<Insurance Check Process>

Figure 39:
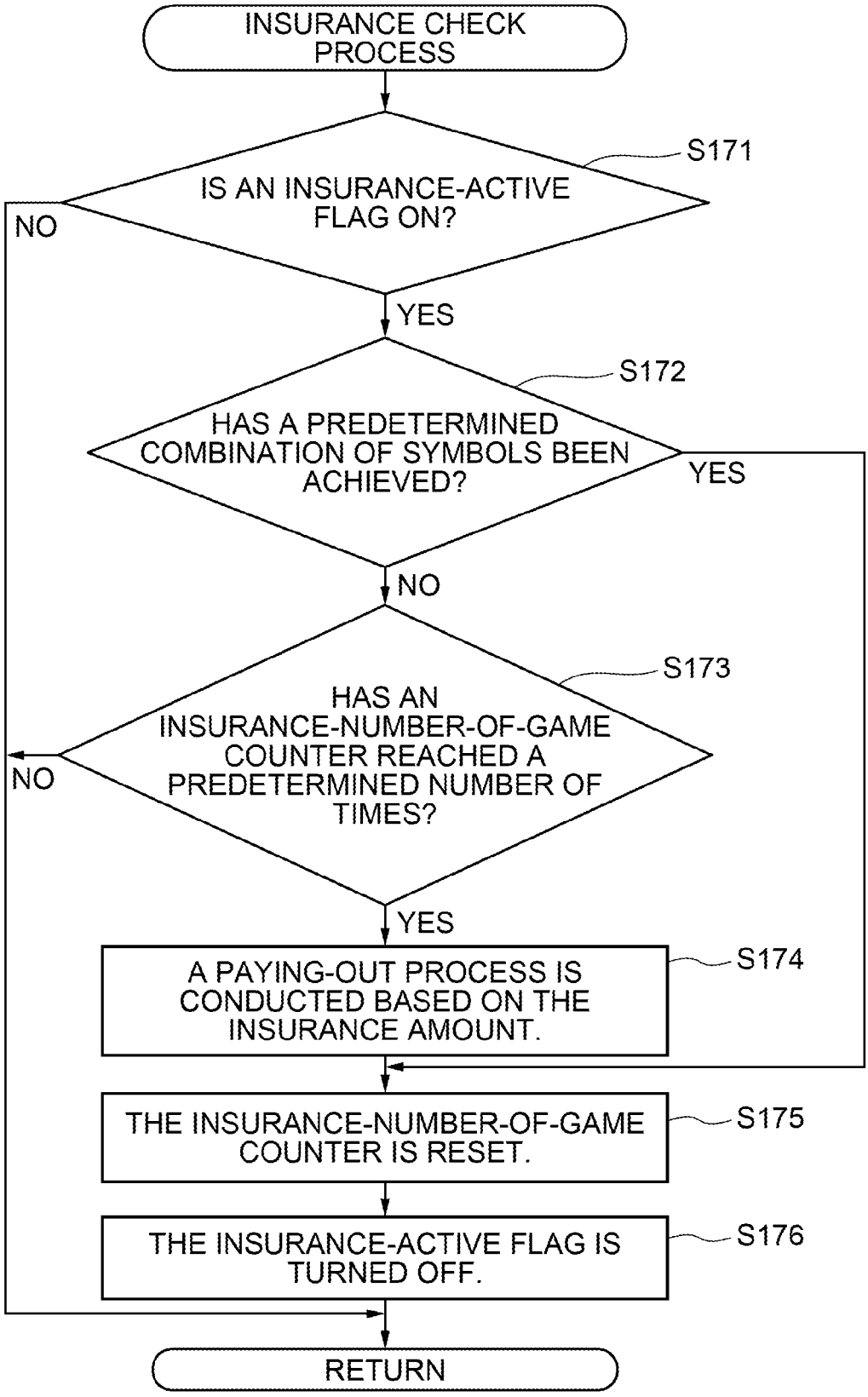
FIG. 39 shows a flowchart of an insurance check process in the slot machine according to the first embodiment of the present invention.

Next, with reference to FIG. 39, the insurance check process will be described. FIG. 39 shows a flowchart of the insurance check process of the slot machine according to the embodiment of the present invention.

First, the main CPU 71 determines whether or not the insurance-active flag is on (step S171). When determining that the insurance-active flag is not on, the main CPU 71 finishes the insurance check process.

When determining that the insurance-active flag is on, the main CPU 71 determines whether or not a predetermined combination of symbols has been achieved (step S172). In the first embodiment of the present invention, the predetermined combination of symbols is targeted for the "bonus game trigger", the "jackpot", and the "mystery bonus".

When determining that the predetermined combination of symbols has not been achieved, the main CPU 71 determines whether or not a value stored in the insurance-number-of-game counter has reached a predetermined number of times (for example, 300) (step S173). When determining that the value stored in the insurance-number-of-game counter has not reached the predetermined number of times, the main CPU 71 finishes the insurance check process.

When determining that the value stored in the insurance-number-of-game counter has reached the predetermined number of times, the main CPU 71 conducts the paying-out process based on the insurance amount (step S174). The main CPU 71 adds a predetermined amount (for example, 200) as the insurance amount to a value stored on the number-of-credit counter.

After step S174 or upon determining at step S172 that the predetermined combination of symbols has been achieved, the main CPU 71 resets the value stored on the insurance-number-of-game counter (step S175). Next, the main CPU 71 turns off the insurance-active flag (step S176). After conducting this process, the insurance check process is finished.

<Bonus Game Process>

Next, with reference to FIG. 40, the bonus game process will be described. FIG. 40 shows a flowchart of the bonus game process of the slot machine according to the first embodiment of the present invention.

First, the main CPU 71 determines the number of bonus games (step S191). The main CPU 71 uniformly determines "8" as the number of bonus games. However, the main CPU 71 may extract random number values for determining the number of bonus games, and determines any of a plurality of the numbers of bonus games, for example "50", "70", and "100", by a drawing.

Next, the main CPU 71 stores the determined number of bonus games on a number-of-bonus game counter provided in the RAM 73 (step S192).

Next, as in the process at step S12 described with reference to FIG. 32, the main CPU 71 conducts the one-game-termination-time initialization process (step S193). Next, the main CPU 71 conducts the symbol drawing process described with reference to FIG. 36 (step S194). Next, as in the process at step S16 described with reference to FIG. 32, the main CPU 71 conducts the presentation effects contents determination process (step S195). Next, the main CPU 71 conducts the symbol display control process described with reference to FIG. 37 (step S196). Next, the main CPU 71 conducts the number-of-payout determination process described with reference to FIG. 38 (step S197).

Next, the main CPU 71 determines whether or not a bonus game trigger has been achieved (step S198). When determining that the bonus game trigger has been achieved, the main CPU 71 determines the number of bonus games to be added (step S199). As in the above-described process at step S191, the number of bonus games is determined. Next, the main CPU 71 adds the determined number of bonus games to a value stored on the number-of-bonus game counter (step S200).

After the process at step S200 or upon determining at step S198 that the bonus game trigger has not been achieved, the main CPU 71 conducts the paying-out process (step S201). In this paying-out process, the main CPU 71 adds the value stored on the number-of-payout counter in the above-described number-of-payout determination process at step S197 to a value stored on a bonus-number-of-payout counter. The bonus-number-of-payout counter is a region for storing the total of the number of payouts determined during the bonus games. Upon finishing the bonus game process, the main CPU 71 adds the value stored on the bonus-number-of-payout counter in the paying-out process, at step S24 described with reference to FIG. 32, to a value stored on the number-of-credit counter provided in the RAM 73. In other words, the total of the number of payouts determined in the bonus games is paid out. Coins may be discharged from the coin payout opening 15A and a ticket having a bar code may be issued.

Next, the main CPU 71 subtracts one from the value stored on the number-of-bonus game counter (step S202). Next, the main CPU 71 determines whether or not the value stored in the number-of-bonus game counter is zero (step S203). When determining that the value stored in the number-of-bonus game counter is not zero, the main CPU 71 shifts to the process at step S193. On the other hand, when determining that the value stored in the number-of-bonus game counter is zero, the main CPU 71 finishes the bonus game process. Upon finishing the bonus game process, the main CPU 71 shifts to the process at step S21 described with reference to FIG. 32.

<Insurance Selection Process>

Next, with reference to FIG. 41, the insurance selection process will be described. FIG. 41 shows a flowchart of the insurance selection process of the slot machine according to the first embodiment of the present invention.

First, the main CPU 71 determines whether or not the insurance-active flag is on (step S221). When determining that the insurance-active flag is not on, the main CPU 71 displays an insurance-inactive-image (step S222). The main CPU 71 transmits an instruction to display the insurance-inactive-image to the graphic board 130. Based on the instruction, the graphic board 130 generates the insurance-inactive-image and displays the insurance-inactive-image on the lower side image display panel 141. As the insurance-inactive-image, for example, an image indicating "INSURANCE BET $1.00 TOUCH TO BET" is displayed. This image is to prompt a player to make a selection on whether or not the insurance is made active and to notify a player of an amount required to make the insurance active. By touching a predetermined portion on the touch panel 114, a player can input an instruction indicating that the insurance is made active.

Subsequently, the main CPU 71 determines whether or not there is the input indicating that the insurance is made active (step S223). When determining that there is no input indicating that the insurance is made active, the main CPU 71, with the insurance-active flag being kept off, shifts to step S221. On the other hand, when determining that there is the input indicating that the insurance is made active, the main CPU 71 turns on the insurance-active flag (step S224).

Next, the main CPU 71 subtracts an insurance purchase value from a value stored on the number-of-credit counter (step S225). In the first embodiment of the present invention, for example, a value corresponding to one dollar is subtracted from the value stored on the number-of-credit counter. After step S225 or upon determining at step S221 that the insurance-active flag is on, the main CPU 71 displays an insurance-active image (step S226). As the insurance-active image, for example, an image indicating "INSURANCE-CONTINUING WIN 200 CREDIT" is displayed. This image is to notify a player that the insurance is active and that upon satisfying an insurance condition, a value of "200" is added to a value stored on the number-of-credit counter. After conducting this process, the main CPU 71 shifts to step S221.

[Screen Display Specification]

The programs executed by the slot machine 1 are as described above. Next, with reference to FIG. 42 and FIG. 43, a screen display specification will be described.

<Screen Display Specification During Base Game>

Figure 42:
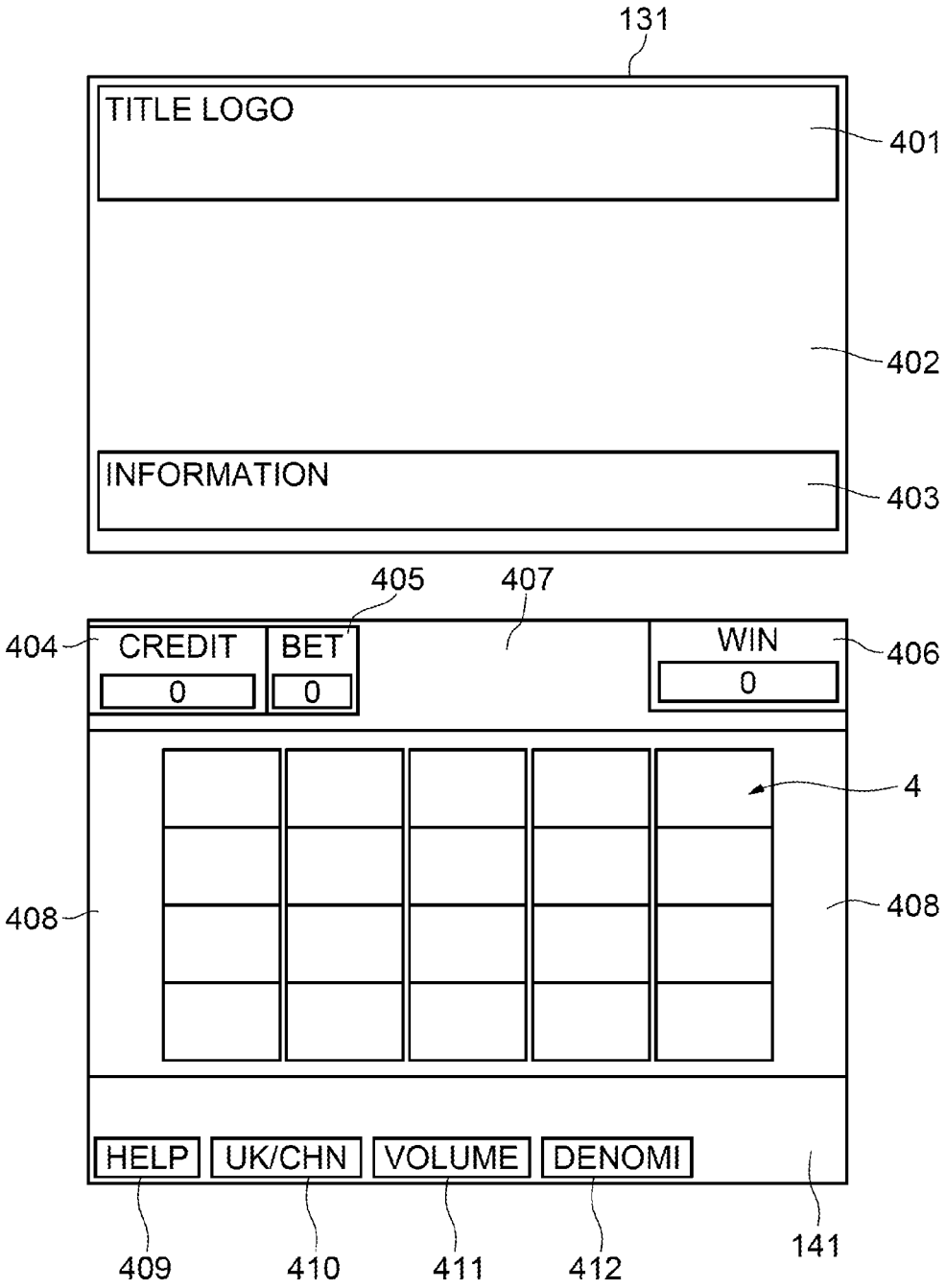
FIG. 42 is a diagram illustrating a screen display specification in the slot machine according to the first embodiment of the present invention during a base game.

First, with reference to FIG. 42, a screen display specification during the base game will be described. FIG. 42 is a diagram illustrating the screen display specification of the slot machine according to the embodiment of the present invention during the base game.

As shown in FIG. 42, on the upper side image display panel 131 during the base game, a title logo area 401, an image 402, and an information area 403 are provided. In the title logo area 401, a game title logo is displayed. Accordingly, during each of the free games, the game tile log is switched to a display of a name of each of the free games. When a display language is switched to English or Chinese, a title in the switched language is displayed. In the image 402, a main image of a game is displayed. During the free games, a background is changed to be displayed. In the information area 403, a brief explanation of game rules is displayed. Accordingly, during the base game and the free games, display contents are changed. Loop-display of words and sentences of each of the display contents is conducted at 10-second intervals.

On the lower side image display panel 141 during the base game, in addition to the above-described symbol display area 4, a CREDIT meter 404, a BET meter 405, a WIN meter 406, a display area 407 for displaying BET information and a game state, a display area 408 for displaying LINE Nos., a HELP touch button 409, a language switch touch button 410, a sound volume switch touch button 411, and a DENOMI display area 412 are provided. In the CREDIT meter 404, the number of remaining credits is displayed. An initial value is "0". In other words, the number of credits stored in the RAM 73 is displayed. In the BET meter 405, the total BET number of a current game (or a final game) is displayed. In the WIN meter 406, the TOTAL credit number of WIN and a breakdown of WIN are displayed. As each of the WIN credit numbers displayed in the WIN meter 406, the number of credit which is actually obtained by the multiplication by the number of BET PER LINE is displayed.

In the display area 407 for displaying the BET information and the game state, the BET information pertinent to a current game (or a final game) is displayed. On the first line, the number of BET PER LINE is displayed. In this display, singular or plural words are displayed depending on the number of BET(s). For example, when the number of BET PER LINE is "1", "1 CREDIT PER LINE" is displayed with the singular word of "CREDIT". When the number of BET PER LINE is "2", "2 CREDITS PER LINE" is displayed with the plural word of "CREDITS". The plural word of "CREDITS" is displayed also when the number of BET PER LINE is "3" or more. Further, in the display area 407 for displaying the BET information and the game state, a state of the current game is displayed. When the current game is being played, no message is displayed. When the current game is over, "GAME OVER" is displayed. When the state of the current game is a state of GAMBLE waiting, "PLAY ON, GAMBLE or TAKE WIN" is displayed.

In the display area 408 for displaying the LINE Nos., the LINE Nos. of 50 paylines are displayed. In the embodiment of the present invention, because of a full-line-limited game, there is no mid-stage. The HELP touch button 409, when touched by a player, displays the first page of a HELP screen on the lower side image display panel 141. The HELP touch button 409 becomes dark while being deactivated, for example, while the video reels 3 are rotating.

The language switch touch button 410, when touched by a player, switches the display language to English or Chinese. The language switch touch button 410 is activated only during advertising and becomes dark while being deactivated, for example, while the video reels 3 are rotating. Further, the language switch touch button 410 changes a national flag display to be "UK/CHN" or "US/CHN" by making a setting on an AUDIT MENU. In addition, when the language switch is in a state of "DISABLE", the language switch touch button 410 becomes a PAYTABLE button, thereby being changed to be a button for displaying a payout table on the HELP screen.

The sound volume switch touch button 411 changes a game sound volume in three phases. Each time a player touches the sound volume switch touch button 411, the game sound volume is changed in the order of a small sound volume→a middle sound volume,→a large sound volume→a small sound volume→a middle sound volume . . . . In the DENOMI display area 412, a current denomination is displayed.

<HELP Screen Display Specification in Normal Time>

Figure 43:
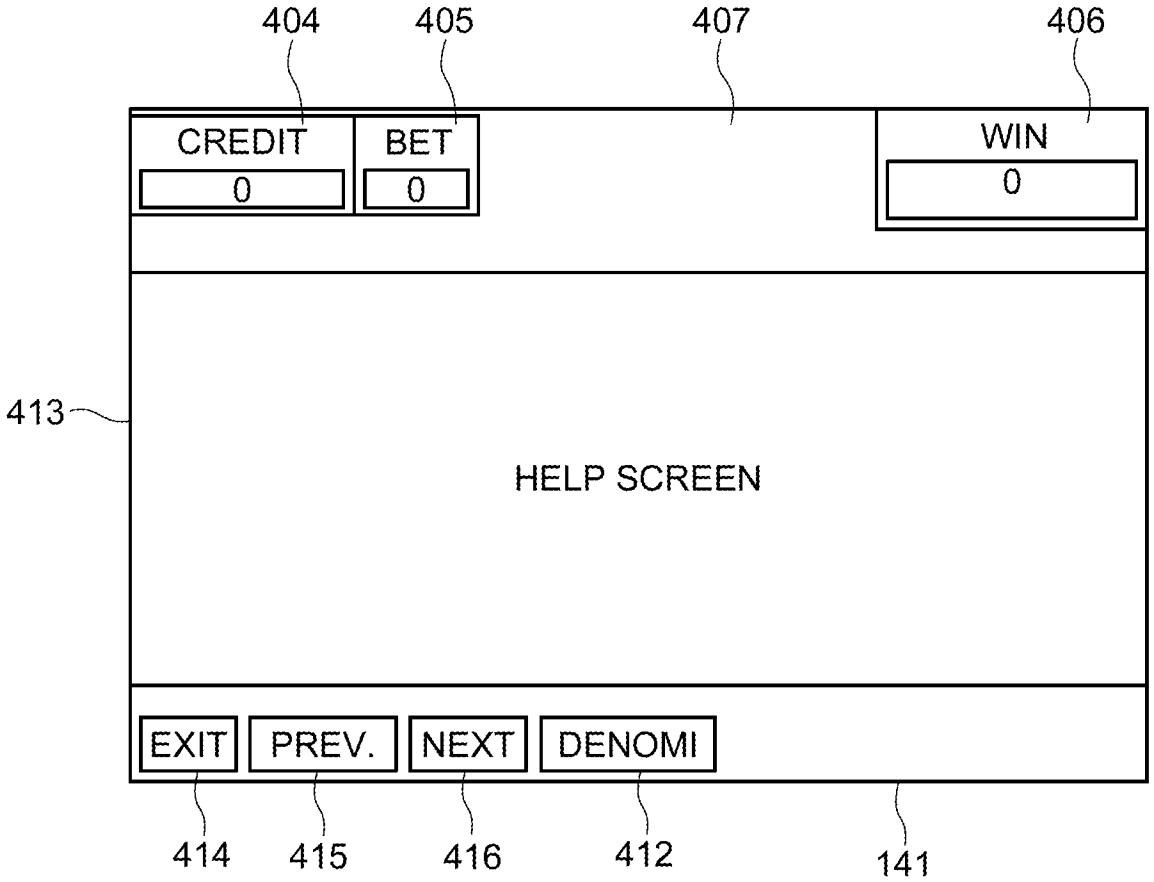
FIG. 43 is a diagram illustrating a HELP screen display specification in the slot machine according to the first embodiment of the present invention during the base game.

Next, with reference to FIG. 43 a screen display specification during the base game will be described. FIG. 43 is a diagram illustrating the HELP screen display specification of the slot machine according to the first embodiment of the present invention during the base game.

As shown on the lower side image display panel 141 shown in FIG. 43, in the HELP screen display specification during the base game, the above-described CREDIT meter 404, BET meter 405, WIN meter 406, BET information, display area 407 for displaying the game state, and DENOMI display area 412 are displayed. Further, on the lower side image display panel 141, a HELP screen 413 is allocated and an EXIT touch button 414, a PREV. touch button 415, and a NEXT touch button 416 are provided.

The EXIT touch button 414, when touched by a player, causes the lower side image display panel 141 to exit from the HELP screen 413 and to be returned to a base game screen (refer to FIG. 42). The PREV. touch button 415, when touched by a player, causes the HELP screen 413 to be returned to a previous page by one page. The NEXT touch button 416, when touched by a player, causes the HELP screen 413 to proceed to the next page by one page.

[WIN Presentation Effects]

The screen display specification of the slot machine 1 is as described above. Next, with reference to FIG. 44 to FIG. 54C, WIN presentation effects of the slot machine 1 will be described.

WIN presentation effects are presentation effect performed when any WIN has occurred during the base game and the free games. In the first embodiment of the present invention, unlike the conventional type of the free games, character animation on the upper side image display panel 131 and animation above the symbol display area 4 of the lower side image display panel 141 are not conducted. In the WIN presentation effects, only animation of symbols, WIN incrementing, a WIN signboard display on the upper side image display panel 131 are conducted.

<Flow of WIN Presentation Effects>

Here, with reference to FIG. 44 to FIG. 49, a flow of WIN presentation effects will be described. Each of FIG. 44 to FIG. 49 is a diagram illustrating the flow of the WIN presentation effects of the slot machine according to the first embodiment of the present invention.

Figure 44:
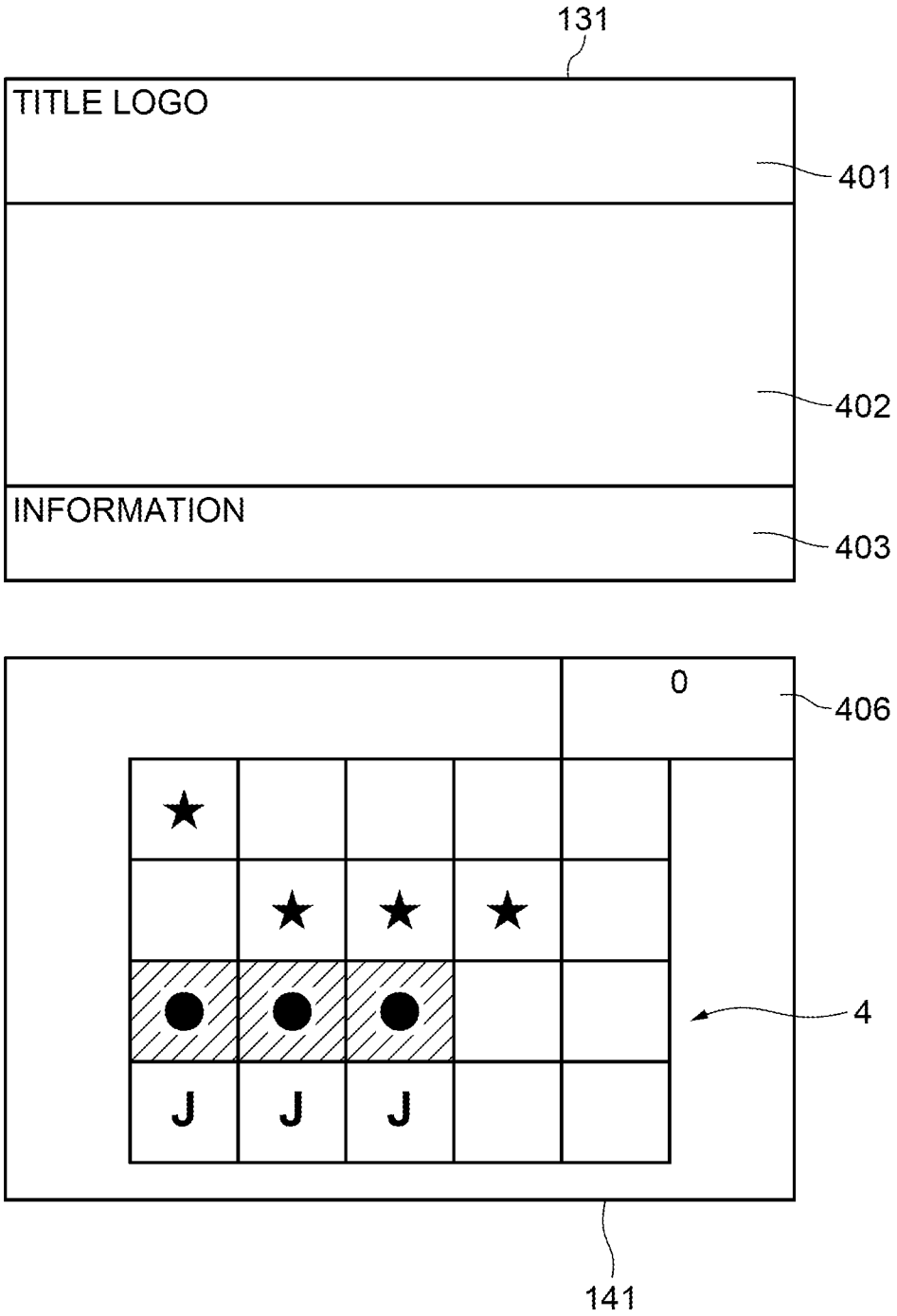
FIG. 44 is a diagram illustrating a flow of WIN presentation effects in the slot machine according to the first embodiment of the present invention.
Figure 45:
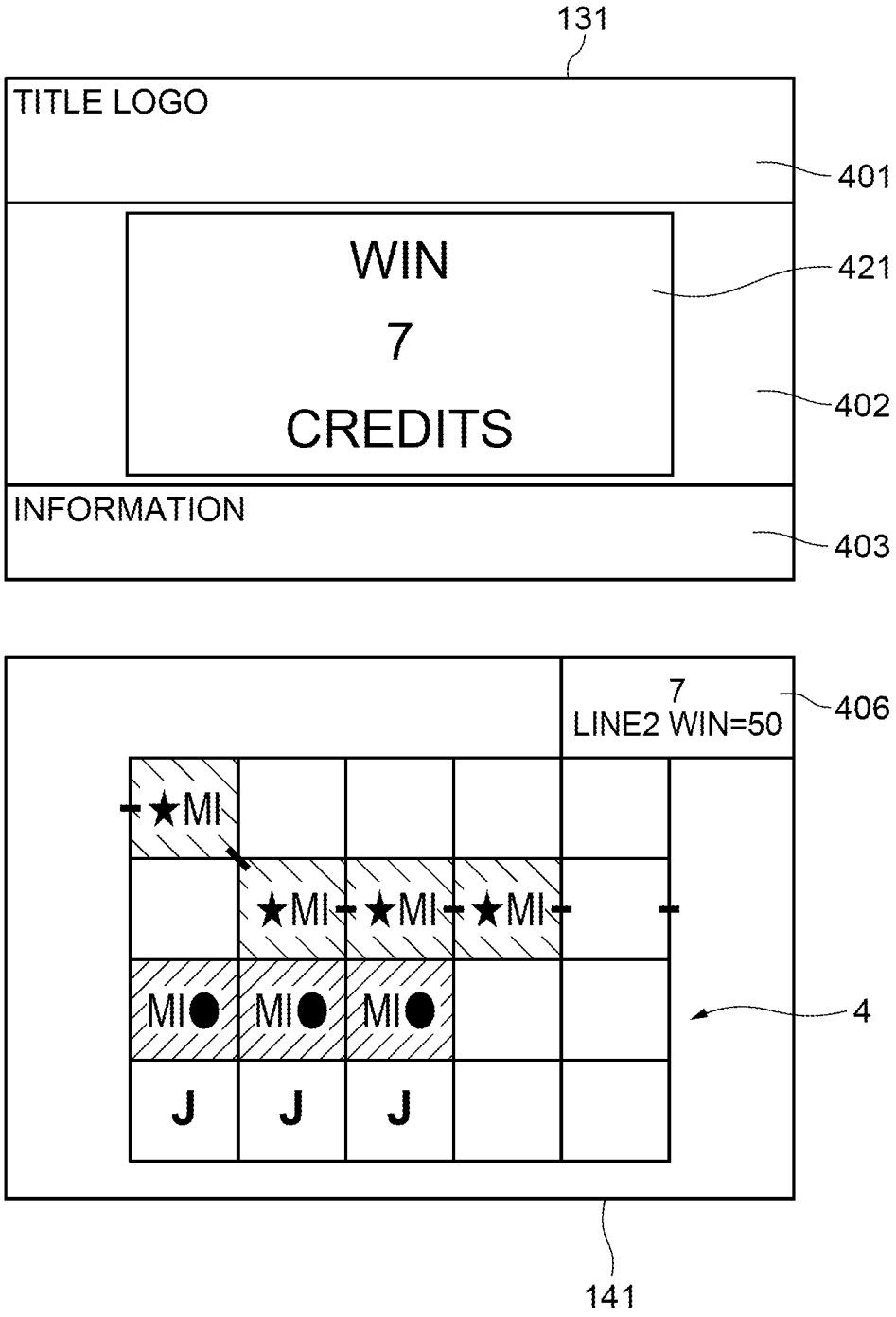
FIG. 45 is a diagram illustrating the flow of the WIN presentation effects in the slot machine according to the first embodiment of the present invention.

First, as shown in FIG. 44, in the symbol display area 4 of the lower side image display panel 141, all of the reels are stopped. When all of the reels have been stopped, as shown in FIG. 45, in the image 402 on the upper side image display panel 131, a WIN signboard 421 is displayed. On the WIN signboard 421, a won credit is displayed in an incremented manner. The increment display of the won credit on the WIN signboard 421 is linked with the display in the WIN meter 406 on the lower side image display panel 141.

On the lower side image display panel 141, with respect to the achieved winning, WIN presentation effects are performed. First, with respect to a scatter pay, the WIN presentation effects are performed, and next, with respect to a LINE payout, the WIN presentation effects are performed. With respect to the LINE payout, the WIN presentation effects are performed in ascending order of the LINE Nos. At this time, with respect to symbols for which WIN animation is prepared, irrespective of the LINE Nos., presentation effects using the animation are performed. In contrast to this, with respect to symbols for which WIN animation is not prepared (symbols for which the WIN presentation effects blink), only when winning of a LINE payout to which the above-mentioned symbols correspond occurs, the WIN presentation effects blink.

In the WIN meter 406 on the lower side image display panel 141, a WIN gross amount upon starting the incrementing is displayed in an upper row. In a lower row in which a breakdown is displayed, a WIN LINE payout for which WIN LINE lights up (in FIG. 45, LINE 2 WIN=50) is displayed. "TOTAL WIN" is not displayed.

Figure 46:
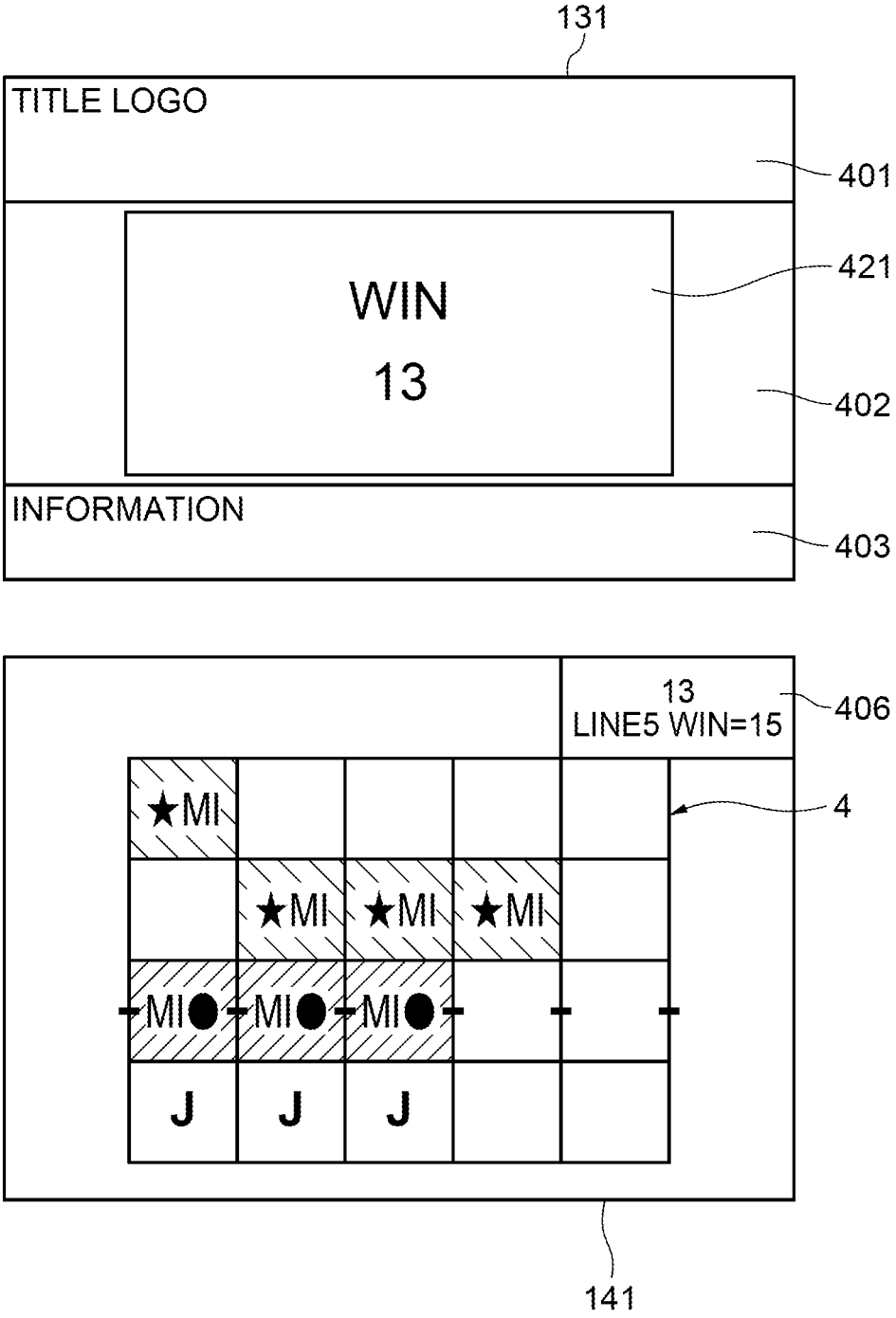
FIG. 46 is a diagram illustrating the flow of the WIN presentation effects in the slot machine according to the first embodiment of the present invention.

Next, as shown in FIG. 46, on the WIN signboard 421 of the image 402 on the upper side image display panel 131, the increment display of the won credit is continued. On the lower side image display panel 141, the order of displaying the WIN LINE is caused to proceed. Here, the order of displaying the WIN LINE with respect to symbols marked with stars and black dots proceeds. In addition, with respect to both of the symbols marked with the stars and the symbols marked with black dots, since the WIN animation is prepared, irrespective of the LINE Nos., the presentation effects by using the animation are performed. In contrast to this, with respect to symbols marked with "J", since the order of displaying the WIN LINE does not proceed and the WIN animation is not prepared, these symbols remain stopped. With respect to the symbols marked with the starts in the order of displaying the WIN LINE (the second-smallest LINE No.), the WIN LINE lights up.

In the WIN meter 406 on the lower side image display panel 141, the increment display of the WIN gross amount is continued in the upper row. In the lower row in which the breakdown is displayed, a payout (in FIG. 46, LINE 5 WIN=15) of the WIN LINE for which the WIN LINE is currently lighting up is displayed. The TOTAL WIN is not displayed.

Figure 47:
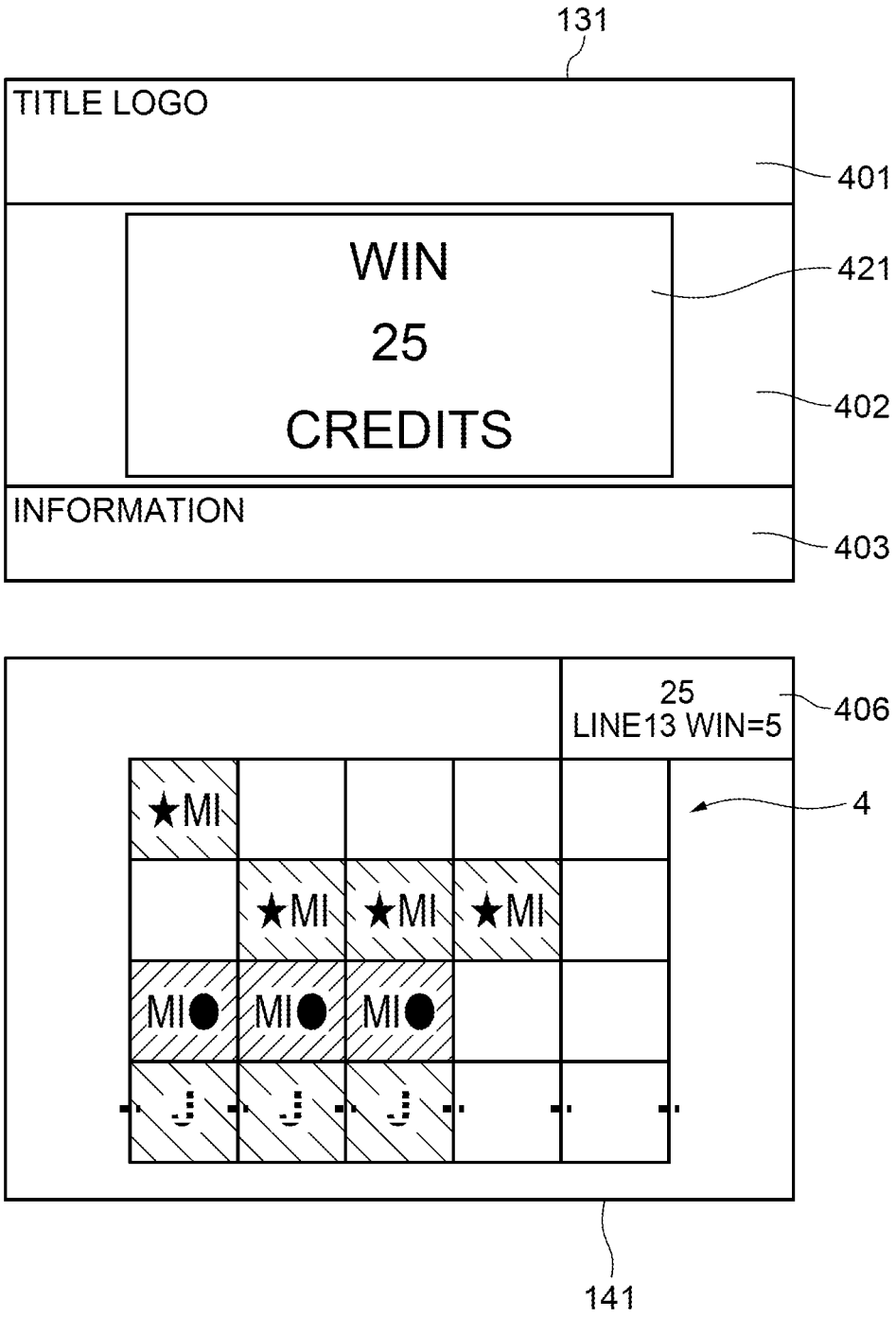
FIG. 47 is a diagram illustrating the flow of the WIN presentation effects in the slot machine according to the first embodiment of the present invention.

Next, as shown in FIG. 47, in the image 402 on the upper side image display panel 131, the WIN signboard 421 is displayed. On the WIN signboard 421, the increment display of the won credit is continued. The increment display of the won credit on the WIN signboard 421 is linked with the display in the WIN meter 406 on the lower side image display panel 141.

On the lower side image display panel 141, the order of displaying the WIN LINE is caused to proceed. Here, with respect to the symbols marked with "J", starting from the symbols marked with the black dots, the order of displaying the WIN LINE proceeds. In addition, with respect to both of the symbols marked with the stars and the symbols marked with black dots, since the WIN animation is prepared, irrespective of the LINE Nos., the presentation effects by using the animation are performed. In contrast to this, symbols marked with "J", since the order of displaying the WIN LINE proceeds but the WIN animation is not prepared, the WIN LINE is caused to blink. With respect to the symbols marked with "J" in the order of displaying the WIN LINE (the third smallest LINE No.), the WIN LINE lights up.

In the WIN meter 406 on the lower side image display panel 141, the increment display of the WIN gross amount is continued in the upper row. In the lower row in which the breakdown is displayed, a payout (in FIG. 47, LINE 13 WIN=5) of the WIN LINE for which the WIN LINE is currently lighting up is displayed. The TOTAL WIN is not displayed.

Figure 48:
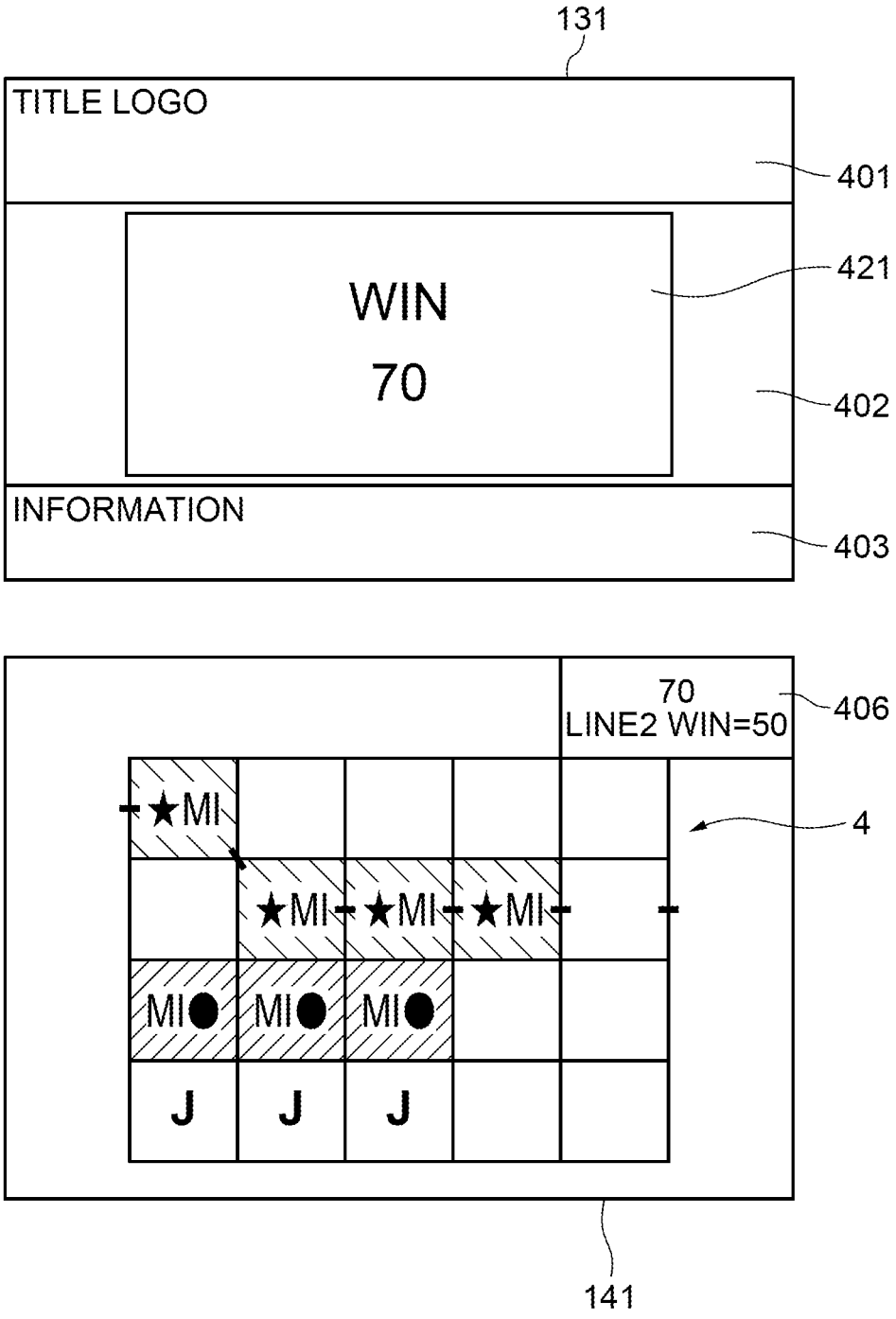
FIG. 48 is a diagram illustrating the flow of the WIN presentation effects in the slot machine according to the first embodiment of the present invention.

Next, as shown in FIG. 48, on the WIN signboard 421 displayed in the image 402 on the upper side image display panel 131, a total WIN amount is displayed. The increment display of the won credit is finished. On the lower side image display panel 141, since one round of displaying won symbols have been finished, the loop display is conducted in ascending order of the LINE Nos.

In the WIN meter 406 on the lower side image display panel 141, the increment display of the WIN gross amount in the upper row is finished. Also in the upper row, the total WIN amount is displayed. In the lower row in which the breakdown is displayed, since one round of displaying won symbols have been finished, the loop display is conducted in ascending order of the LINE Nos. In FIG. 48, "LINE 2 WIN=50" is displayed again.

Figure 49:
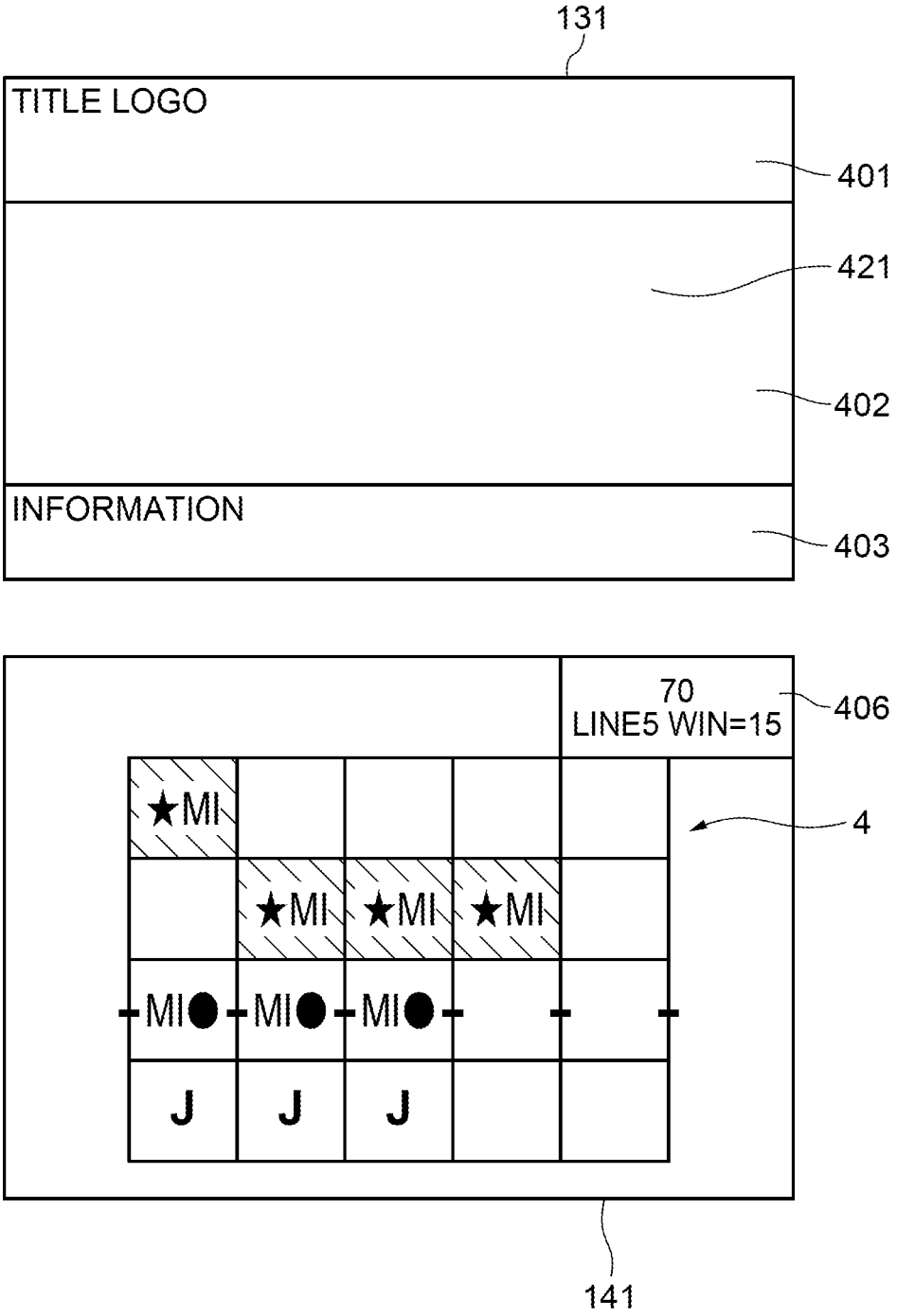
FIG. 49 is a diagram illustrating the flow of the WIN presentation effects in the slot machine according to the first embodiment of the present invention.

Thereafter, the display mode shifts from that shown in FIG. 48 to that shown in FIG. 49. However, when GAMBLE is ON, upon finishing GAMBLE or after TAKE WIN, and when GAMBLE is OFF, 5 seconds after finishing the increment display of the WIN gross amount, the display mode shifts from that shown in FIG. 48 to that shown in FIG. 49.

As shown in FIG. 48, in the image 402 on the upper side image display panel 131, the WIN signboard 421 is erased. On the lower side image display panel 141, the loop display is continued to be conducted in ascending order of the LINE Nos. In the WIN meter 406 on the lower side image display panel 141, the total WIN amount is continued to be displayed. In the lower row in which the breakdown is displayed, the loop display is continued to be conducted in ascending order of the LINE Nos. In FIG. 49, "LINE 5 WIN=15" is displayed again.

<WIN Signboard>

Figure 50A:
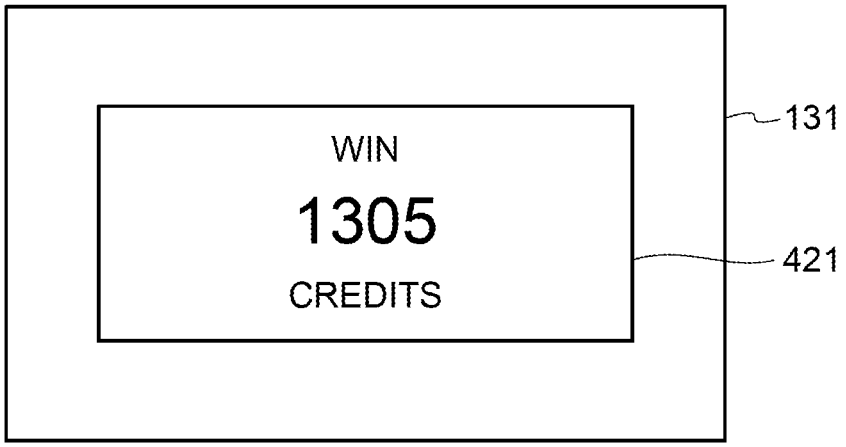
FIG. 50A is a diagram illustrating a WIN signboard in the slot machine according to the first embodiment of the present invention.
Figure 50B:
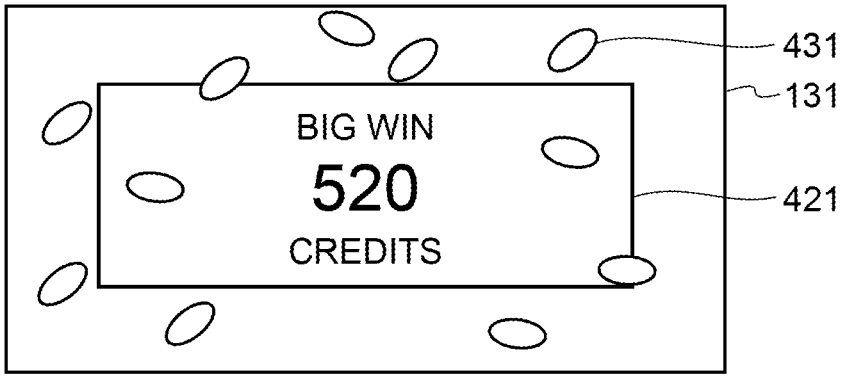
FIG. 50B is a diagram illustrating a WIN signboard in the slot machine according to the first embodiment of the present invention.
Figure 50C:
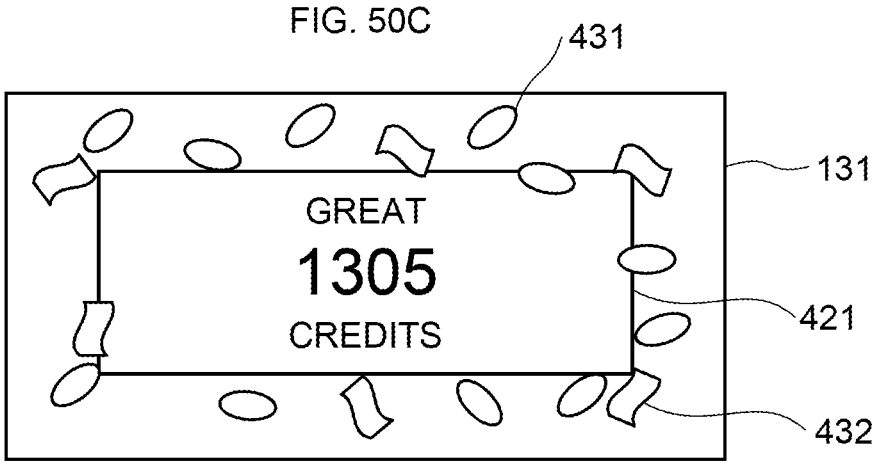
FIG. 50C is a diagram illustrating a WIN signboard in the slot machine according to the first embodiment of the present invention.

Here, with reference to FIGS. 50A to 50C, the WIN signboard will be described. FIGS. 50A to 50C are diagrams illustrating the WIN signboard of the slot machine according to the first embodiment of the present invention.

In the first embodiment of the present invention, as shown in FIGS. 50A to 50C, there are three kinds of WIN signboards 421, which are displayed on the upper side image display panel 131. However, since for each of the three kinds, another version for 1-credit payout is prepared, there are actually six kinds. Because symbols associated with the 1-credit payout are present, only when the display language is English, it is required that the WIN signboards 421 be used differently in a case where the TOTAL WIN amount is one and in a case where the TOTAL WIN amount is two or more.

On a silver signboard 421 shown in FIG. 50A, when a TOTAL WIN amount of that spinning is less than 15 times the BET amount, the TOTAL WIN amount is displayed on the upper side image display panel 131.

On a first gold signboard 421 shown in FIG. 50B, when a TOTAL WIN amount of that spinning is greater than or equal to 15 times and less than 50 times the BET amount, the TOTAL WIN amount is displayed on the upper side image display panel 131. On the first gold signboard 421, presentation effects in which coins 431 are falling are performed.

In contrast to this, when the increment amount exceeds 50 times the BET amount, on the upper side image display panel 131, the first gold signboard 421 shown in FIG. 50B is changed to a second gold signboard 421 shown in FIG. 50C. On the second gold signboard 421, presentation effects in which coins 431 and bills 432 are falling are performed. In other words, on the upper side image display panel 131, the presentation effects in which the coins 431 are falling are first performed on the first gold signboard 421. In accordance with the increment display in the WIN meter 406, the won credit is incremented on the first gold signboard 421. Further, at the time point at which the increment amount exceeds 50 times the BET amount, the first gold signboard 421 shown in FIG. 50B is rewritten to the second gold signboard 421 shown in FIG. 50C. On the second gold signboard 421, the presentation effects in which the coins 431 and the bills 432 are falling are performed.

<Sound Effects Upon Appearance of Three Feature Symbols>

Here, with reference to FIG. 51 to FIG. 53, sound effects upon the appearance of the three feature symbols will be described. Each of FIG. 51 to FIG. 53 is a diagram explaining the sound effects upon the appearance of the three feature symbols of the slot machine according to the first embodiment of the present invention.

Upon the appearance of the three feature symbols, dedicated ring-ring sound is reproduced. As the timing thereof, for three seconds from when 30 frames have passed through after the stoppage of all of the reels up to when the increment is started, the sound is reproduced. During the reproduction of the ring-ring sound, the display of symbol animation and LINE WIN and the increment display are halted. Upon retriggering during each of the free games, the same applied thereto. However, after the retriggering has been conducted during that free game, waiting of the 30 frames and the reproduction of the ring-ring sound are not conducted.

Figure 51:
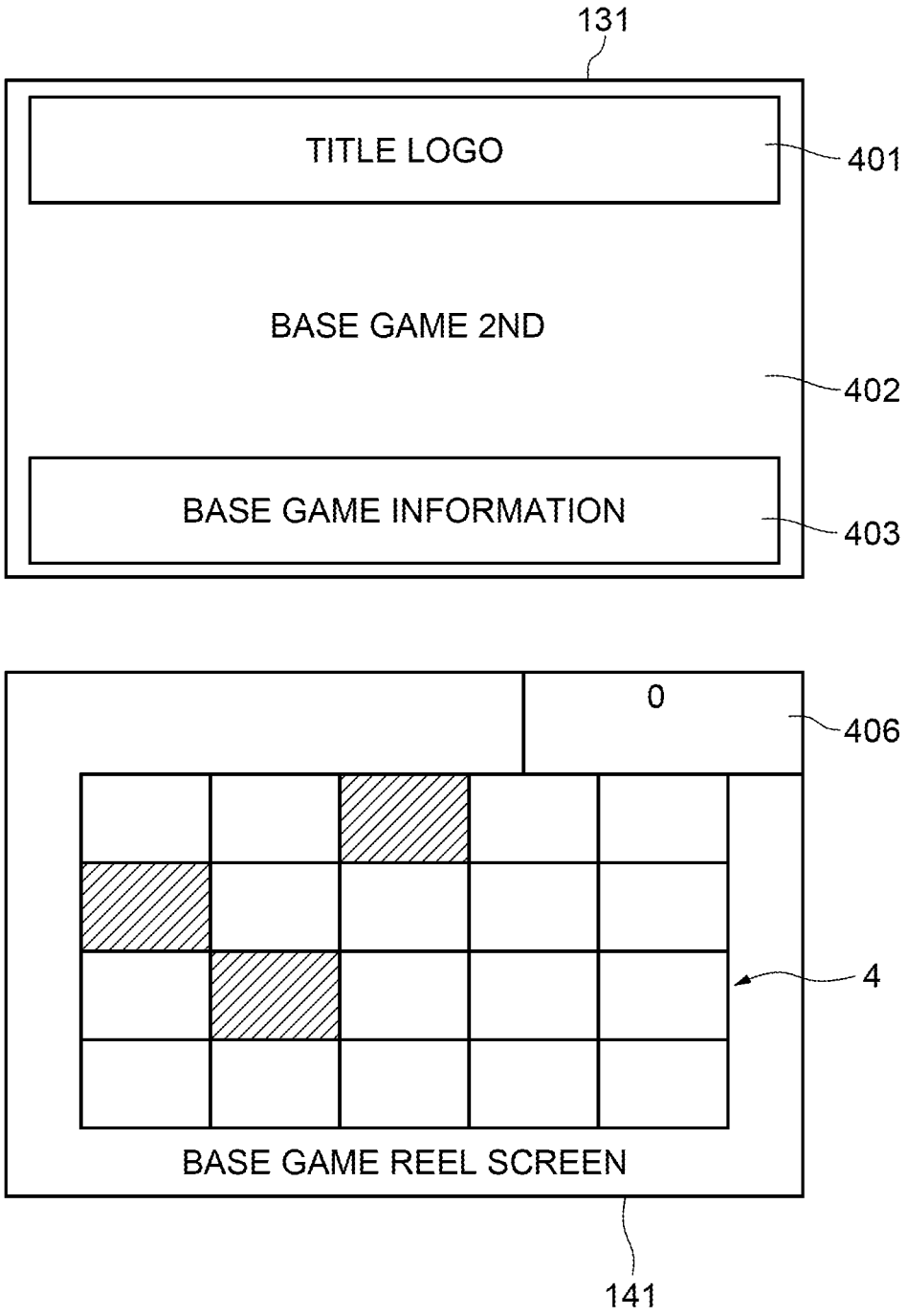
FIG. 51 is a diagram explaining sound effects upon the appearance of three feature symbols in the slot machine according to the first embodiment of the present invention.
Figure 52:
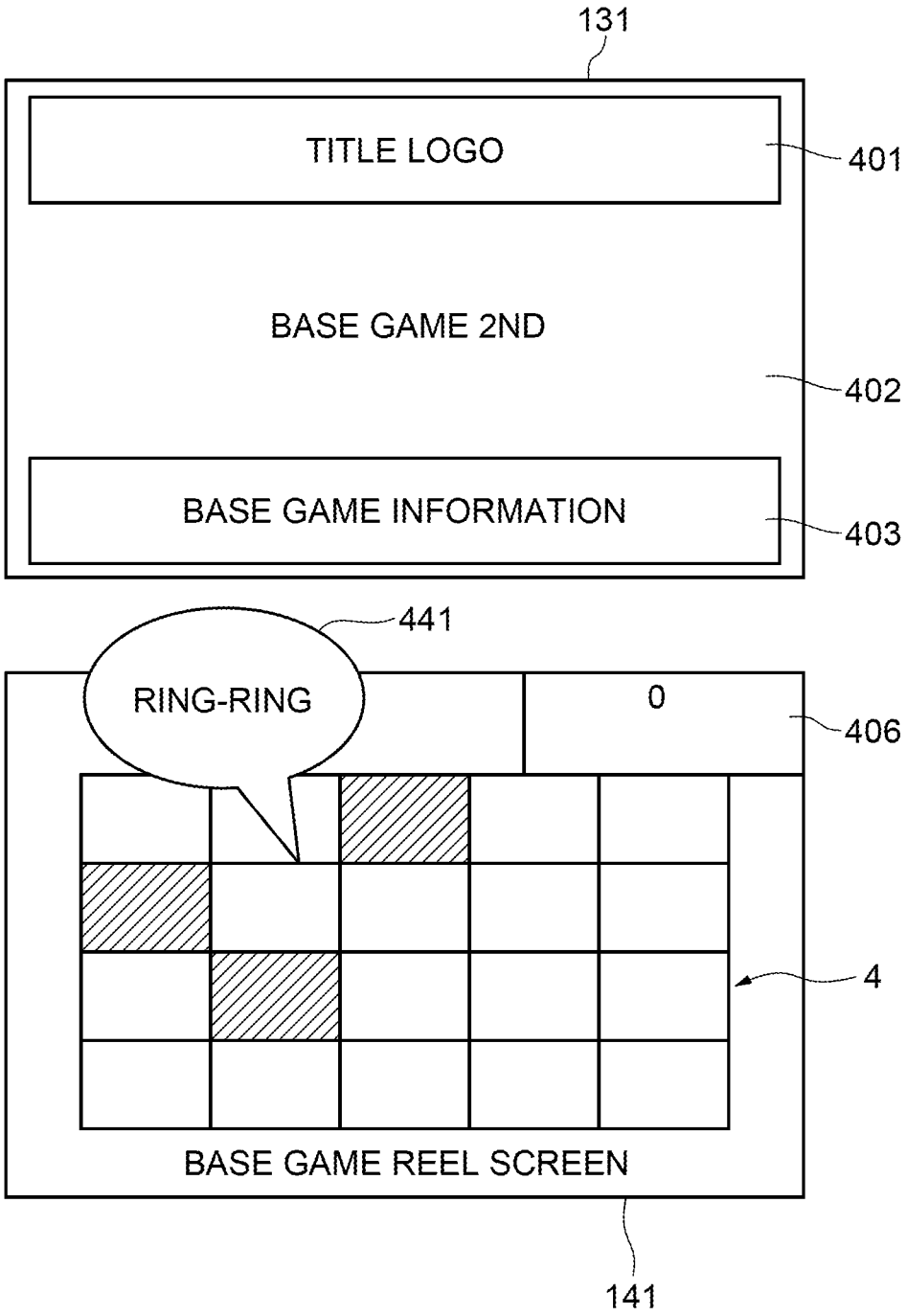
FIG. 52 is a diagram explaining the sound effects upon the appearance of three feature symbols in the slot machine according to the first embodiment of the present invention.

In the first embodiment of the present invention, as shown in FIG. 51, when in the symbol display area 4 on the lower side image display panel 141, the three feature symbols have appeared upon the stoppage of all of the reels, the waiting time of the 30 frames from then is set. When the waiting time of the 30 frames has passed, as shown in FIG. 52, as the sound effects upon the appearance of the three feature symbols, as indicated by a balloon 441, the ring-ring sound is reproduced for three seconds.

Figure 53:
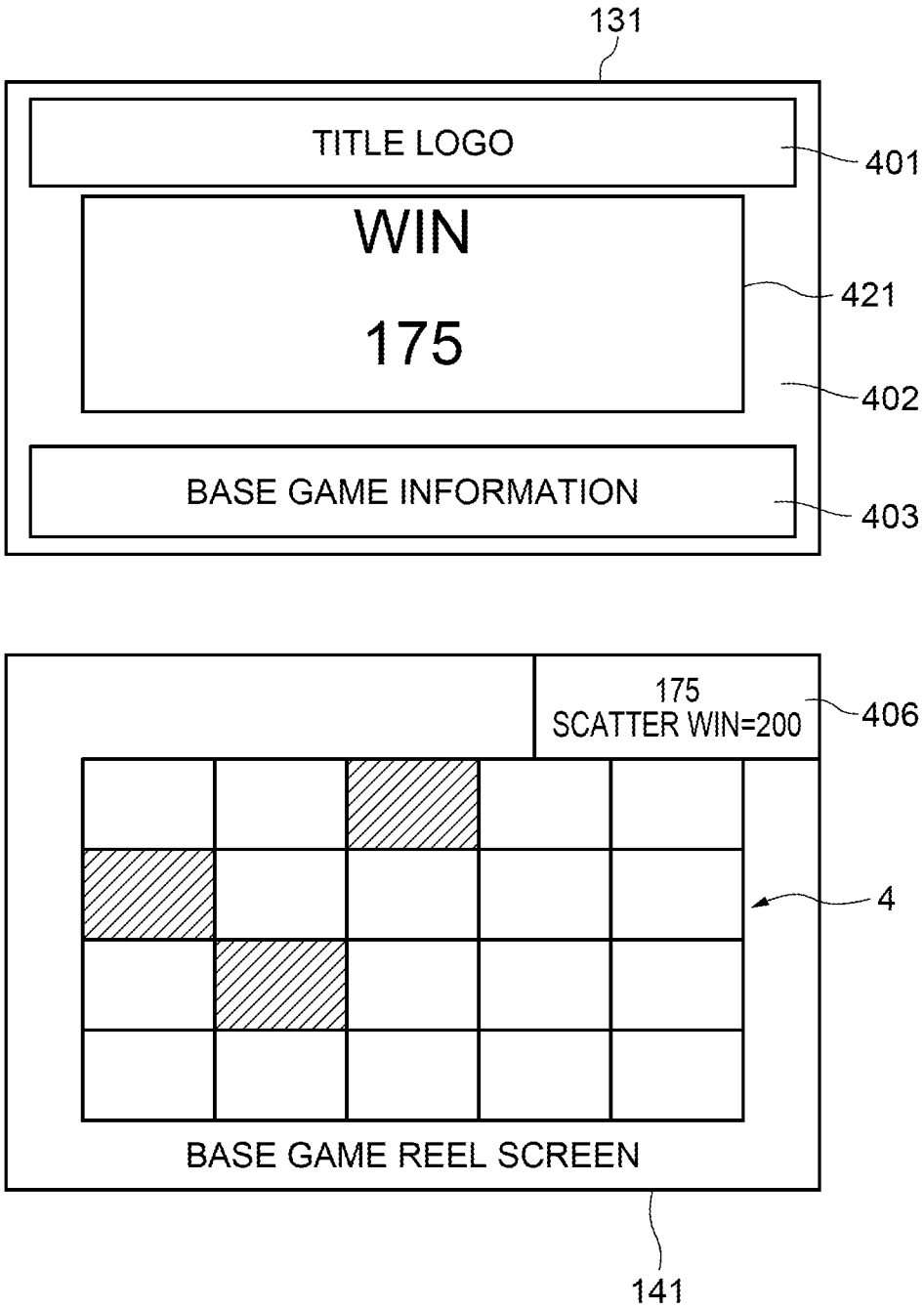
FIG. 53 is a diagram explaining the sound effects upon the appearance of three feature symbols in the slot machine according to the first embodiment of the present invention.

When these three seconds have passed, as shown in FIG. 53, in the symbol display area 4 on the lower side image display panel 141, the presentation effects of the LINE WIN is started and the symbol animation is started. In addition, in the image 402 on the upper side image display panel 131, the WIN signboard 421 is displayed. On the WIN signboard 421, the increment display is started. Concurrently, also in the WIN meter 406 on the lower side image display panel 141, the increment display is started. Further, increment sound is started. Thereafter, the processing shifts to the flow of the above-described WIN presentation effects.

<TOTAL WIN Signboard after Free Games>

Figure 54A:
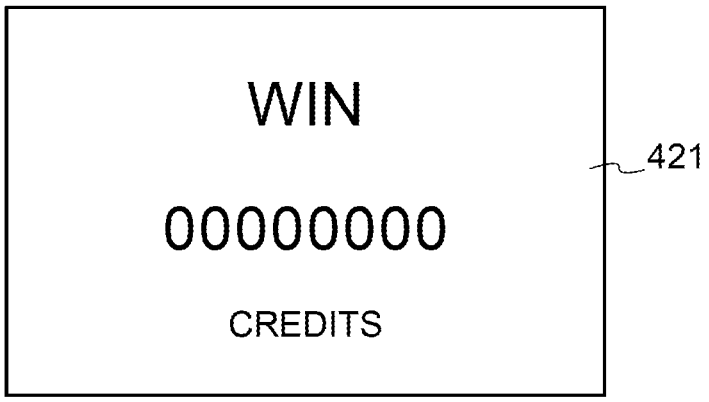
FIG. 54A is a diagram illustrating a TOTAL WIN signboard after free games in the slot machine according to the first embodiment of the present invention.
Figure 54B:
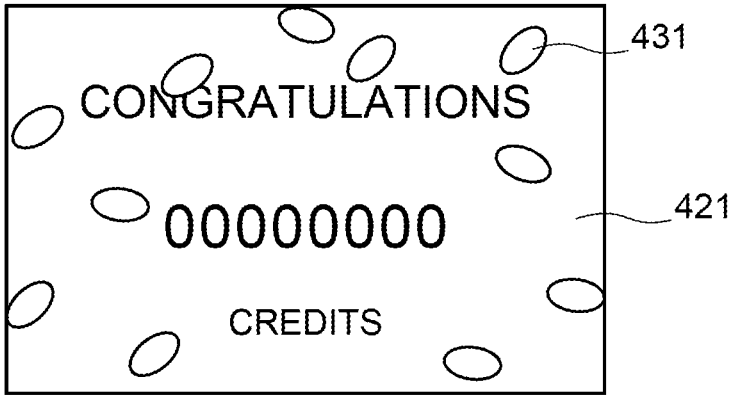
FIG. 54B is a diagram illustrating a TOTAL WIN signboard after free games in the slot machine according to the first embodiment of the present invention.
Figure 54C:
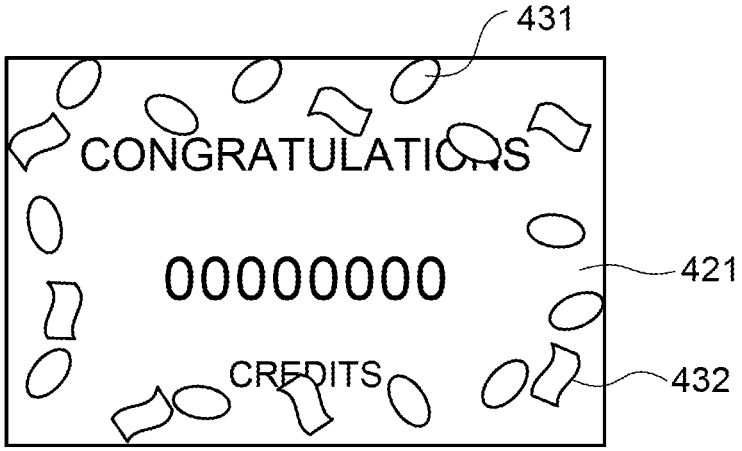
FIG. 54C is a diagram illustrating a TOTAL WIN signboard after free games in the slot machine according to the first embodiment of the present invention.

Here, with reference to FIGS. 54A to 54C, a TOTAL WIN signboard after the free games will be described. FIGS. 54A to 54C are diagrams illustrating the TOTAL WIN signboard after the free games of the slot machine according to the first embodiment of the present invention.

After finishing the free games, TOTAL won credits are displayed on the lower side image display panel 141. Depending on an amount of the won credits (by how many times the TOTAL BET is), three kinds of presentation effects are used so as to be associated therewith.

When a value of the TOTAL won credits is less than 20 times as the value of the TOTAL BET, the silver signboard 421 shown in FIG. 50A is displayed on the lower side image display panel 141 for 3.6 seconds. When a value of the TOTAL won credits is greater than or equal to 20 times and less than 50 times the value of the TOTAL BET, the first gold signboard 421 shown in FIG. 50B is displayed on the lower side image display panel 141 for 6 seconds. On the first gold signboard 421, the presentation effects in which the coins 431 are falling are performed. When a value of the TOTAL won credits is greater than or equal to 50 times the value of the TOTAL BET, the second gold signboard 421 shown in FIG. 50C is displayed on the lower side image display panel 141 for 10 seconds. On the second gold signboard 421, the presentation effects in which the coins 431 and the bills 432 are falling are performed.

[Free Game Presentation Effects]

The WIN presentation effects of the slot machine 1 are as described above. Next, with reference to FIG. 55 to FIG. 74, free game presentation effects of the slot machine 1 will be described.

<Presentation Effects Upon Introduction of Free Games>

Here, with reference to FIG. 55 to FIG. 63, presentation effects upon the introduction of the free games will be described. Each of FIG. 55 to FIG. 63 is a diagram illustrating the presentation effects upon the introduction of the free games of the slot machine according to the first embodiment of the present invention.

Figure 55:
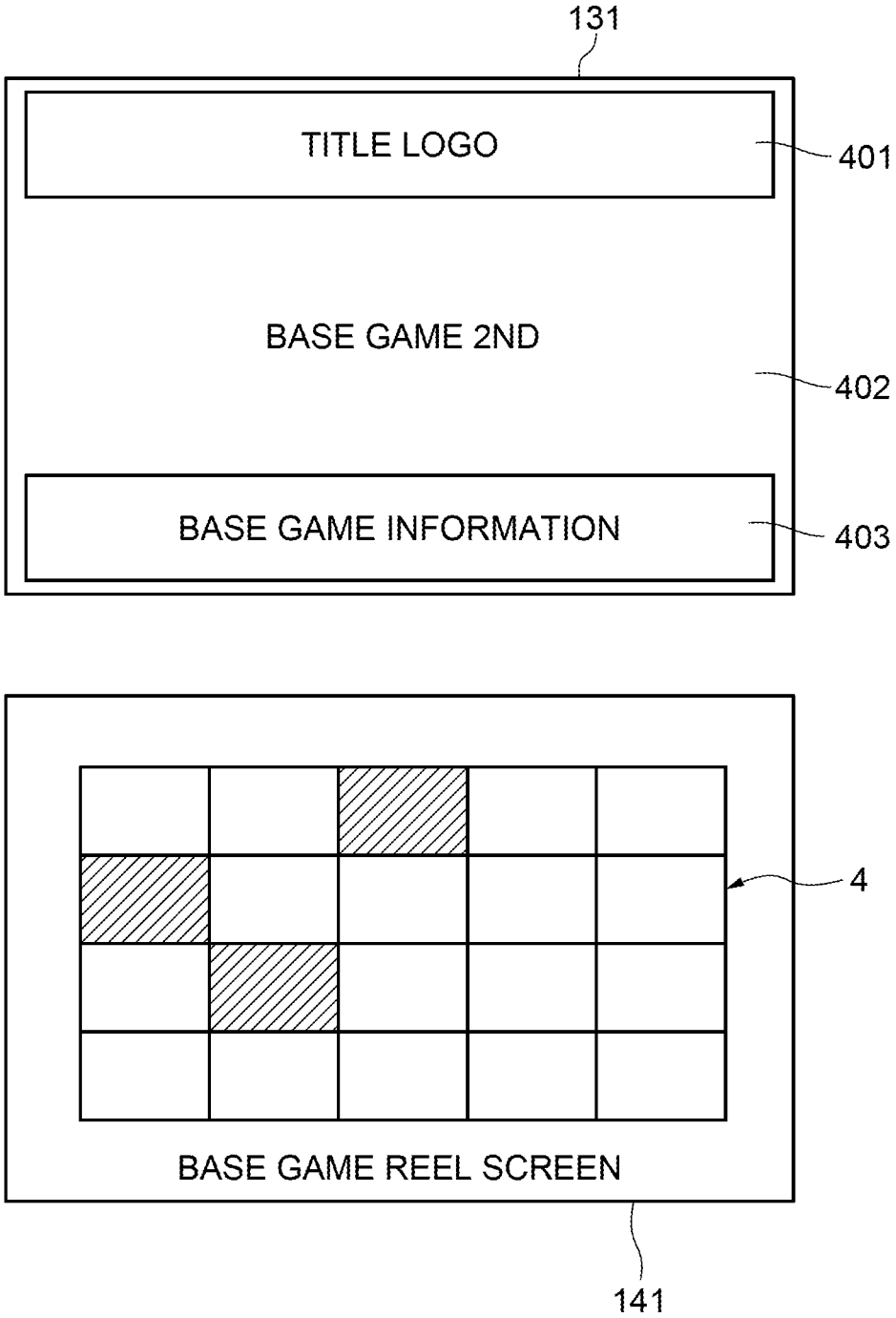
FIG. 55 is a diagram illustrating presentation effects upon the introduction of the free games in the slot machine according to the first embodiment of the present invention.
Figure 56:
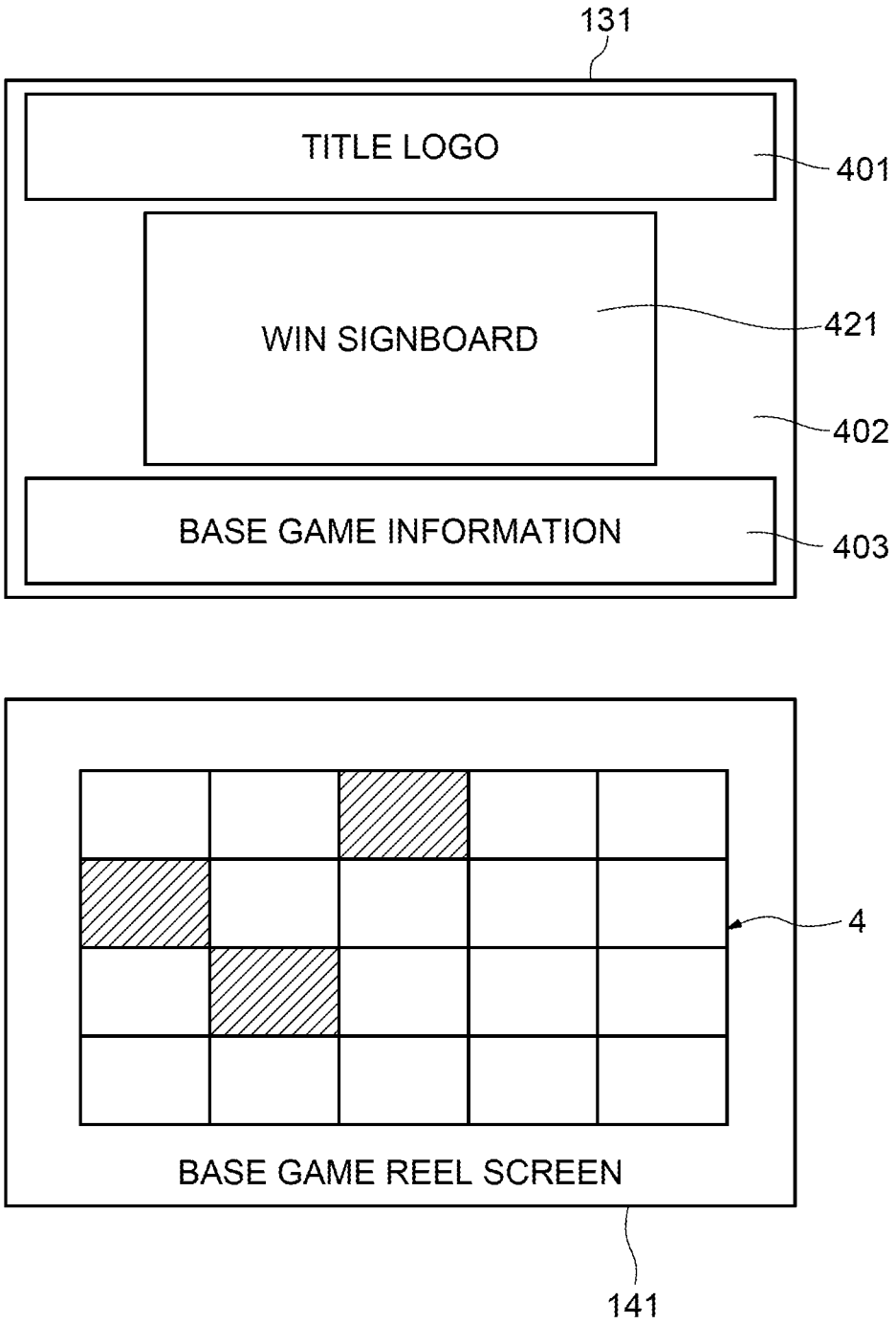
FIG. 56 is a diagram illustrating the presentation effects upon the introduction of the free games in the slot machine according to the first embodiment of the present invention.

As shown in FIG. 55, when the three feature symbols (indicated by shaded areas) have appeared in the symbol display area 4 on the lower side image display panel 141, as described above, the ring-ring sound as the sound effects is reproduced. Next, as shown in FIG. 56, the WIN signboard 421 is displayed in the image 402 on the upper side image display panel 131. On the WIN signboard 421, the increment display is conducted.

Figure 57:
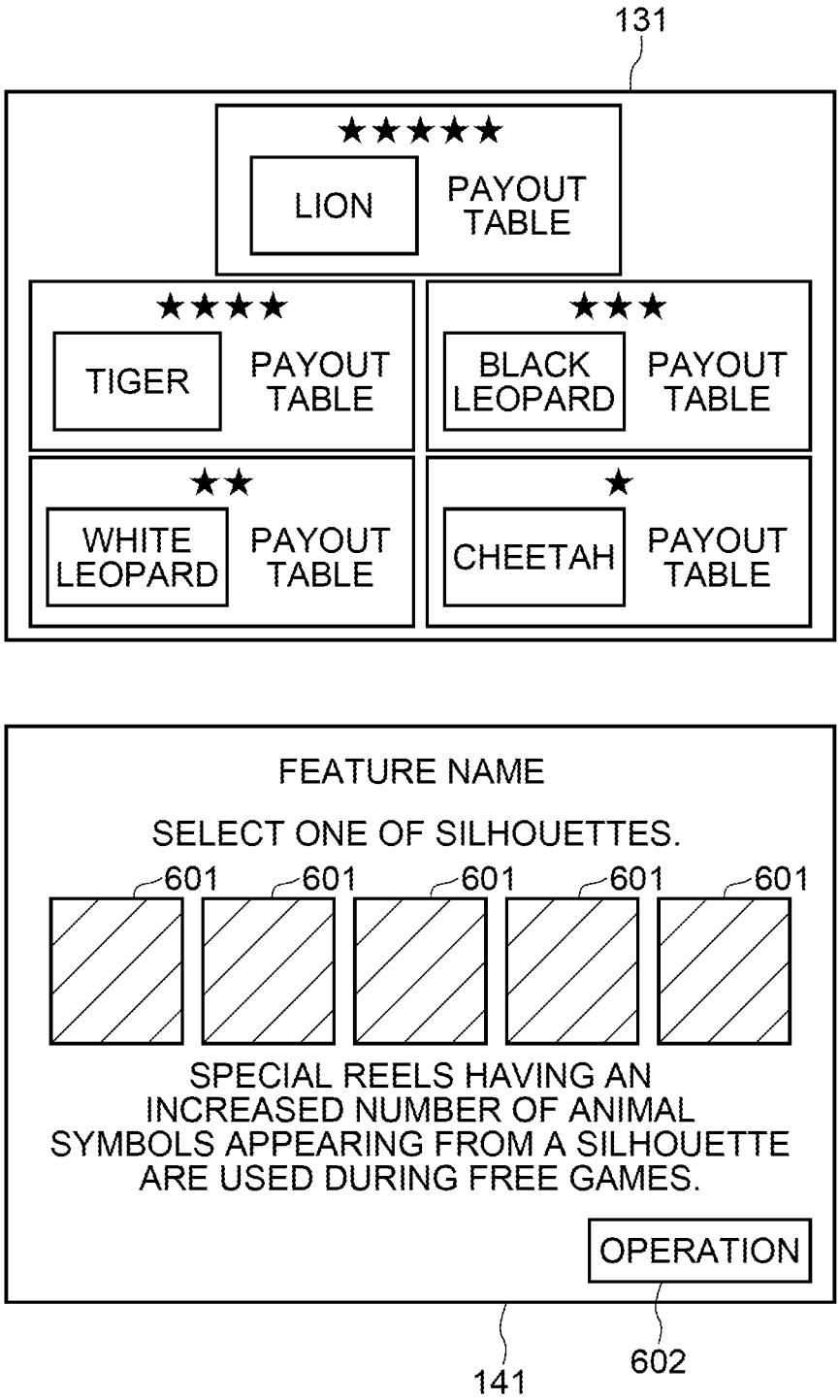
FIG. 57 is a diagram illustrating the presentation effects upon the introduction of the free games in the slot machine according to the first embodiment of the present invention.

After the increment display has been finished or skipped, on the upper side image display panel 131 and the lower side image display panel 141, the screen fades and shifts to a pick game screen (hereinafter, referred to as a "selection game screen") as shown in FIG. 57. On the upper side image display panel 131, payout tables and degrees of expectation of the respective animal symbols are shown (refer to FIG. 59). In each of the payout tables of the respective animal symbols, a payout amount is changed in accordance with a current BET amount. The payout amount is displayed in a four-digit numerical font. The degrees of expectation of the respective animal symbols are displayed with the numbers of stars. On the lower side image display panel 141, five silhouettes 601, each explanatory sentence, and a control panel operation navigator 602 are displayed.

Figure 59:
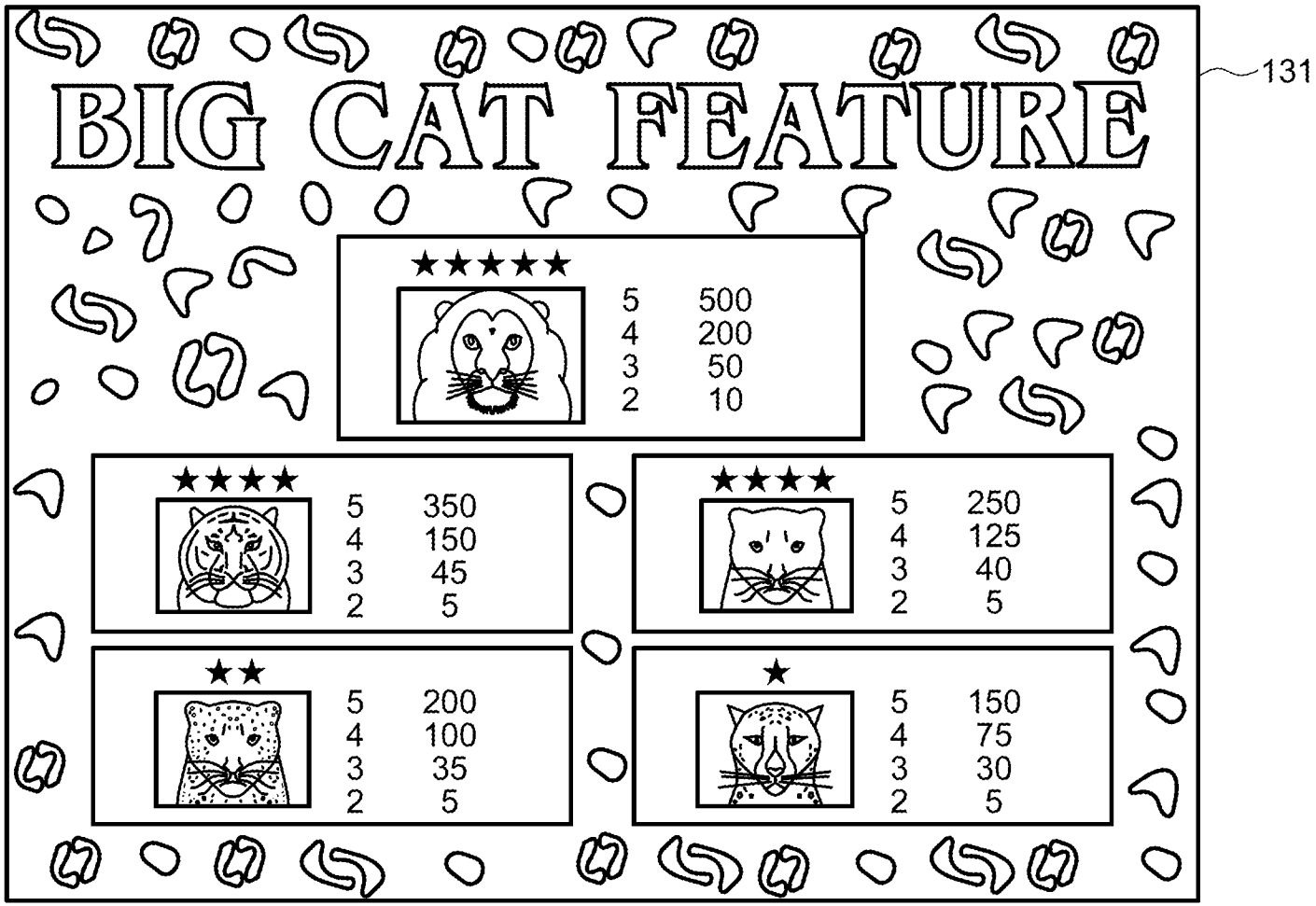
FIG. 59 is a diagram illustrating the presentation effects upon the introduction of the free games in the slot machine according to the first embodiment of the present invention.

In order to award each payout in accordance with each correspondence table of each of the respective animal symbols shown in FIG. 59, the memory (for example, a nonvolatile memory of the memory card 54) has stored therein payout table data corresponding to each payout table of each of the respective animal symbols, with the same number of kinds of pieces of the payout table data as the number of kinds of the plurality of the animal symbols. The nonvolatile memory of the memory card 54 has the payout table data stored therein.

Figure 58:
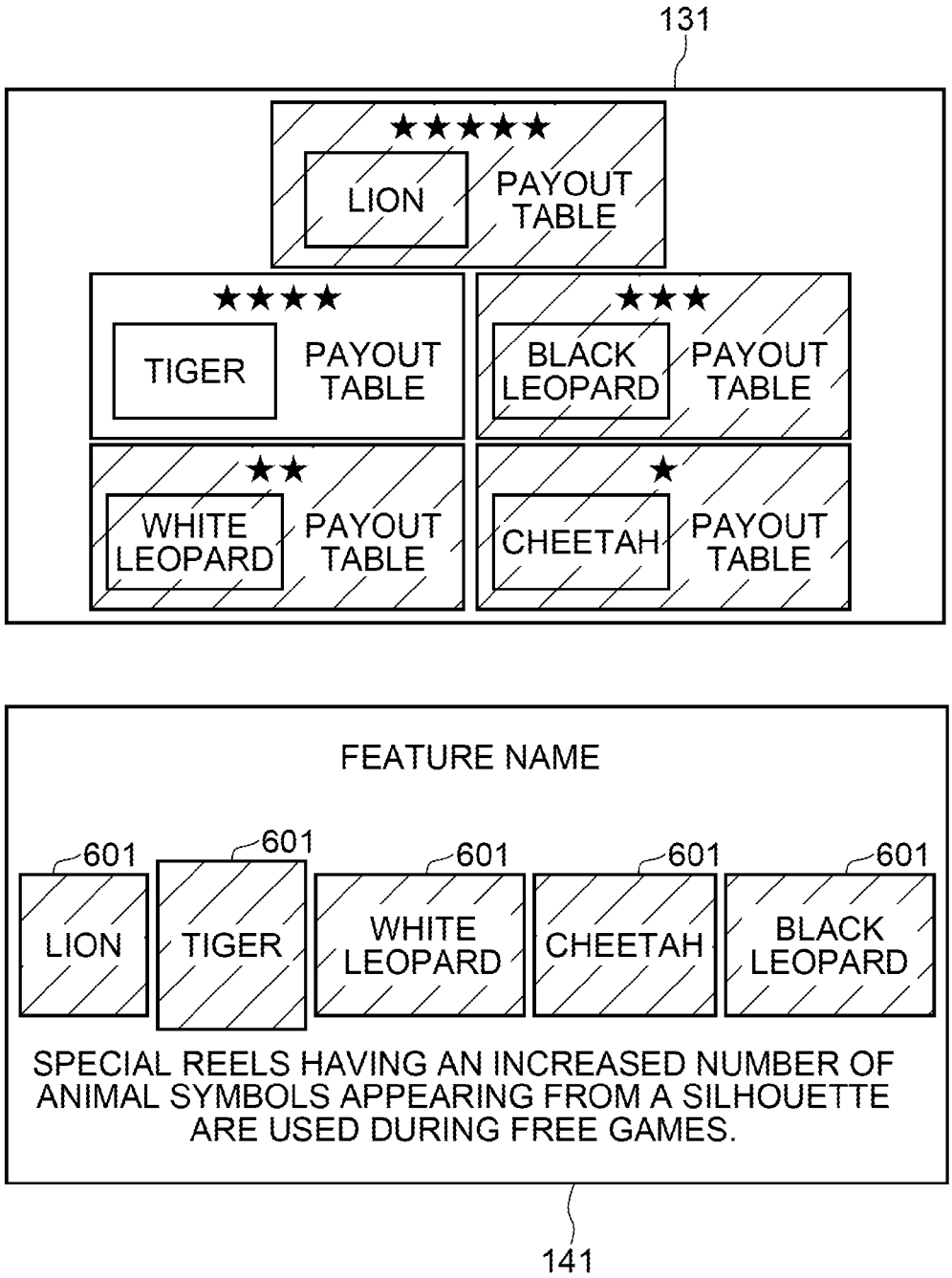
FIG. 58 is a diagram illustrating the presentation effects upon the introduction of the free games in the slot machine according to the first embodiment of the present invention.

When a player touches any of the five silhouettes 601 or operates any of the buttons and thereby finishes the selection of one of the silhouettes 601, on the upper side image display panel 131 and the lower side image display panel 141, screens shown in FIG. 58 appear.

The operation of the buttons by a player is conducted as described below. Since upon shifting to the selection game screen, no cursor is displayed on the lower side image display panel 141, the selection is conducted only by a player's touch via a touch panel 114 on the lower side image display panel 141. Upon pressing down the BET button on a left side or the BET button on a right side located on the control panel 30, on the selection game screen on the lower side image display panel 141, a cursor appears on one of the silhouettes 601 which is located on a leftmost side. Upon pressing down the BET button on the left side with the cursor being displayed, the cursor moves to the next one of the silhouettes 601 which is located on the left of the above mentioned one of the silhouettes 601 which is located on the leftmost side. On the other hand, upon pressing down the BET button on the right side with the cursor being displayed, the cursor moves to one of the silhouettes 601 which is located on the right. On the selection game screen on the lower side image display panel 141, the one of the silhouettes 601 located on the leftmost side and one of the silhouettes 601 located on the rightmost side are connected, and a cursor display is shifted in a looped manner. By pressing down the SPIN button 31 located on the control panel 30, one of the silhouettes 601 on which the cursor is currently located is selected. At this time, even with the cursor being displayed on the selection game screen on the lower side image display panel 141, it is also possible to select any of the silhouettes 601 by using the touch panel 114 on the lower side image display panel 141.

When on the lower side image display panel 141, the screen shown in FIG. 58 appears, first, the content (animal) of the selected one of the silhouettes 601 is displayed in an enlarged manner. Next, the contents (animals) of the four silhouettes 601 not selected are displayed. Thus, answer-checking in the selection game is conducted. The display on the lower side image display panel 141 is switched to a post-selection explanation message. Thereafter, a state of START FEATURE button waiting sets in.

When on the upper side image display panel 131, the screen shown in FIG. 58 is displayed, the payout tables of the animal symbols not selected become dark. In FIG. 58, since the tiger is selected in the selection game, the payout tables of the lion, the black leopard, the white leopard, and the cheetah which are not selected are made dark. At this time, on the upper side image display panel 131, a background image related to the tiger selected in the selection game is displayed.

In the first embodiment, as the background image, a skin design of the animal selected in the selection game is displayed. Specifically, on the upper side image display panel 131 shown in FIG. 59, a skin design of the white leopard which is the animal selected in the selection game is displayed as the background image.

Figure 60:
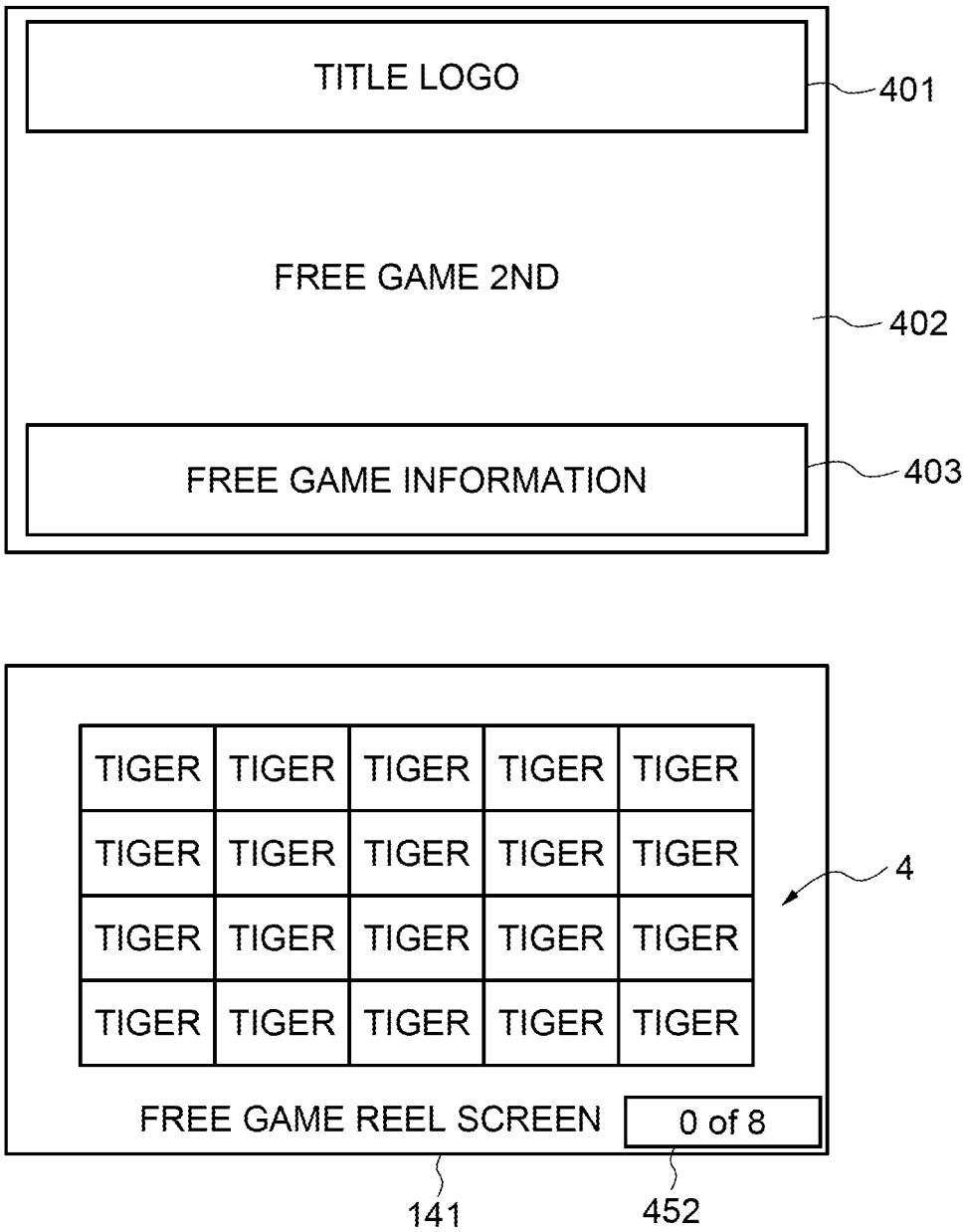
FIG. 60 is a diagram illustrating presentation effects upon introducing free games in the slot machine according to the first embodiment.

Next, the upper side image display panel 131 and the lower side image display panel 141 become screens shown in FIG. 60. On the lower side image display panel 141, the symbol display region 4 and a free game counter 452 are displayed. In addition, on the lower side image display panel 141, as on the upper side image display panel 131, a background image (here, the skin design of the selected animal) related to the animal selected in the selection game is displayed.

Further, in the symbol display region 4 on the lower side image display panel 141, in accordance with a table shown in FIG. 61, reel positions upon starting the free games are determined. In the table shown in FIG. 61, code Nos. are set so as to display the symbols of the animal selected in the selection game in all areas of the symbol display region 4 on the lower side image display panel 141 (refer to FIG. 9 to FIG. 28). Accordingly, in all the display areas of the symbol display region 4 on the lower side image display panel 141 shown in FIG. 60, the symbols of the tiger which is the animal selected in the selection game are displayed upon staring the free games.

Figure 62:
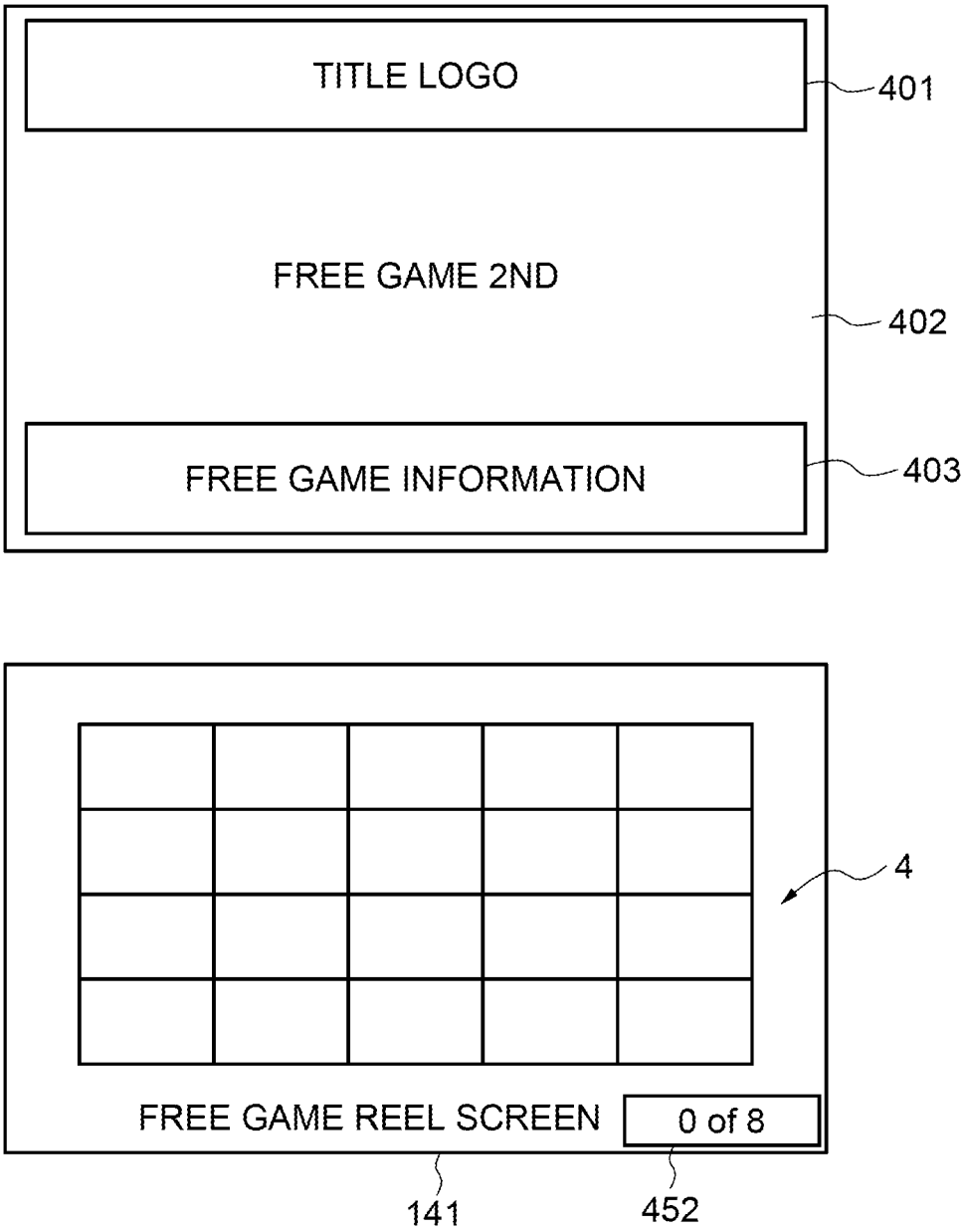
FIG. 62 is a diagram illustrating the presentation effects upon introducing the free games in the slot machine according to the first embodiment.
Figure 63:
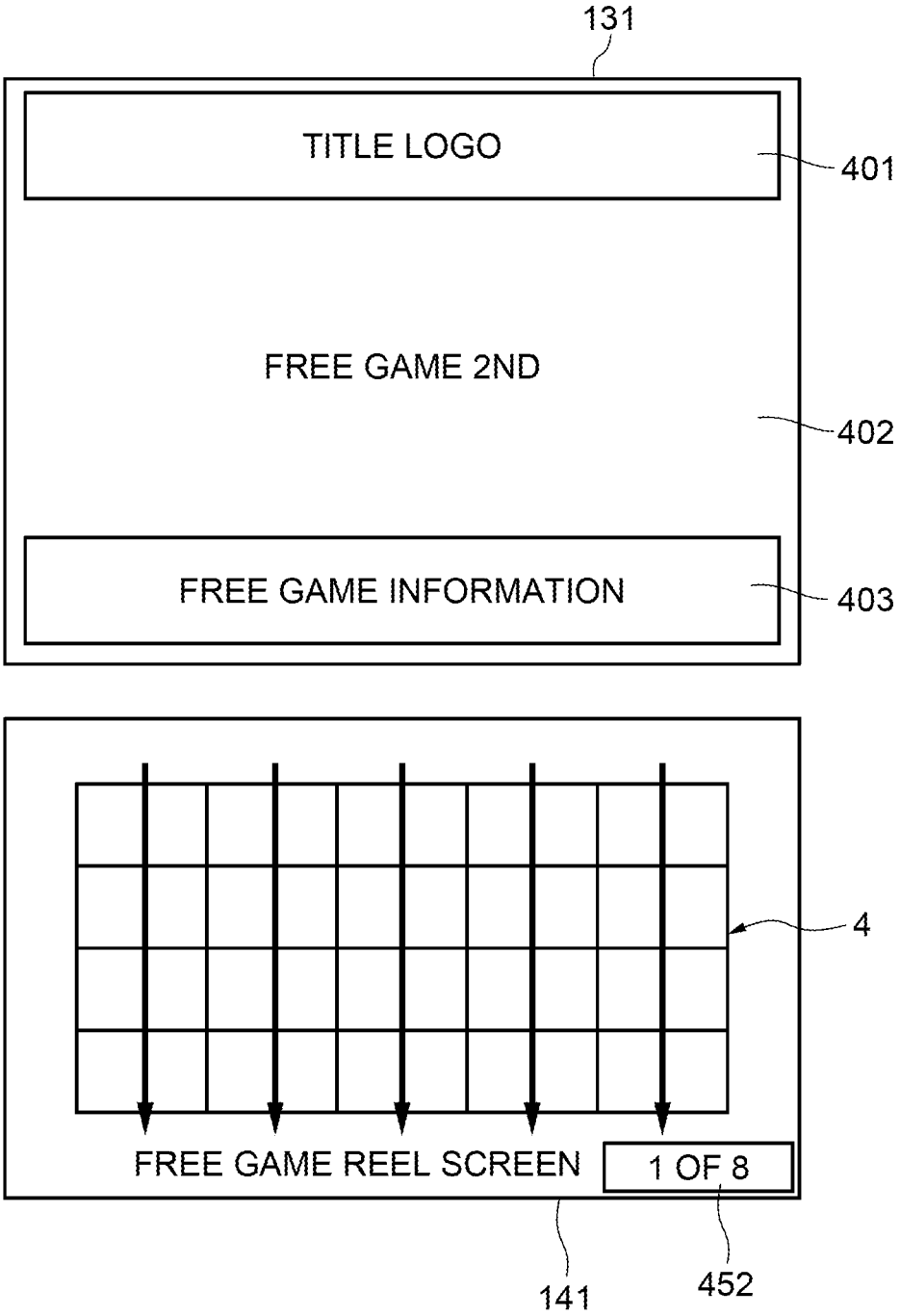
FIG. 63 is a diagram illustrating the presentation effects upon introducing the free games in the slot machine according to the first embodiment.

Upon pressing down the START FEATURE button, the lower side image display panel 141 and the upper side image display panel 131 are switched to screens used during the free games as shown in FIG. 62. The information area 403 on the upper side image display panel 131 is switched to a free game information area. Below the symbol display region 4 on the lower side image display panel 141, the free game counter 452 is displayed. Further, as shown in FIG. 63, in the symbol display region 4 on the lower side image display panel 141, the rotation of all of the reels is started. On the free game counter 452 on the lower side image display panel 141, "1 of 8" indicating that the first one of the free games is started is displayed.

<Presentation Effects Upon Finishing Free Games>

Figure 64:
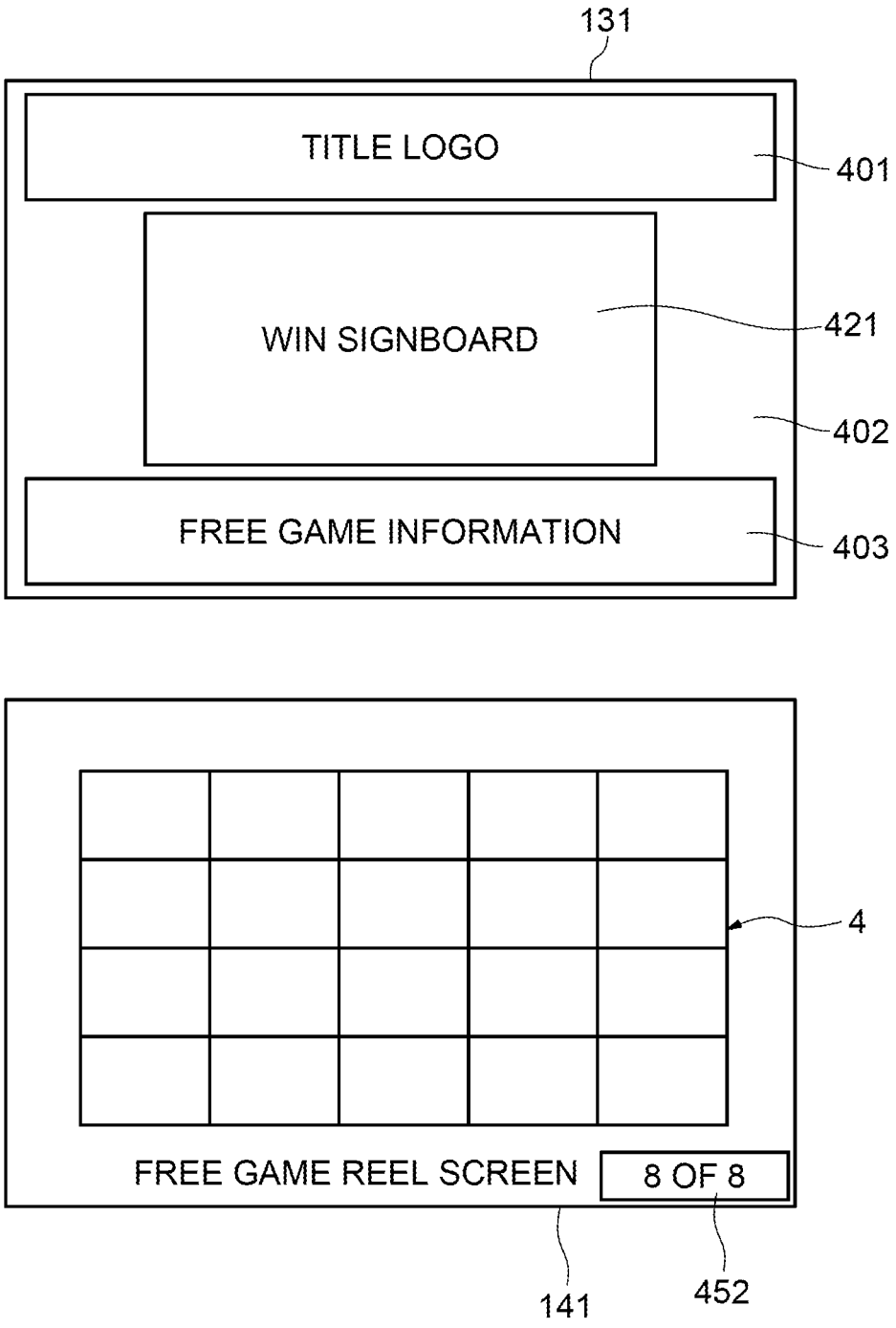
FIG. 64 is a diagram illustrating presentation effects upon finishing the free games in the slot machine according to the first embodiment of the present invention.
Figure 65:
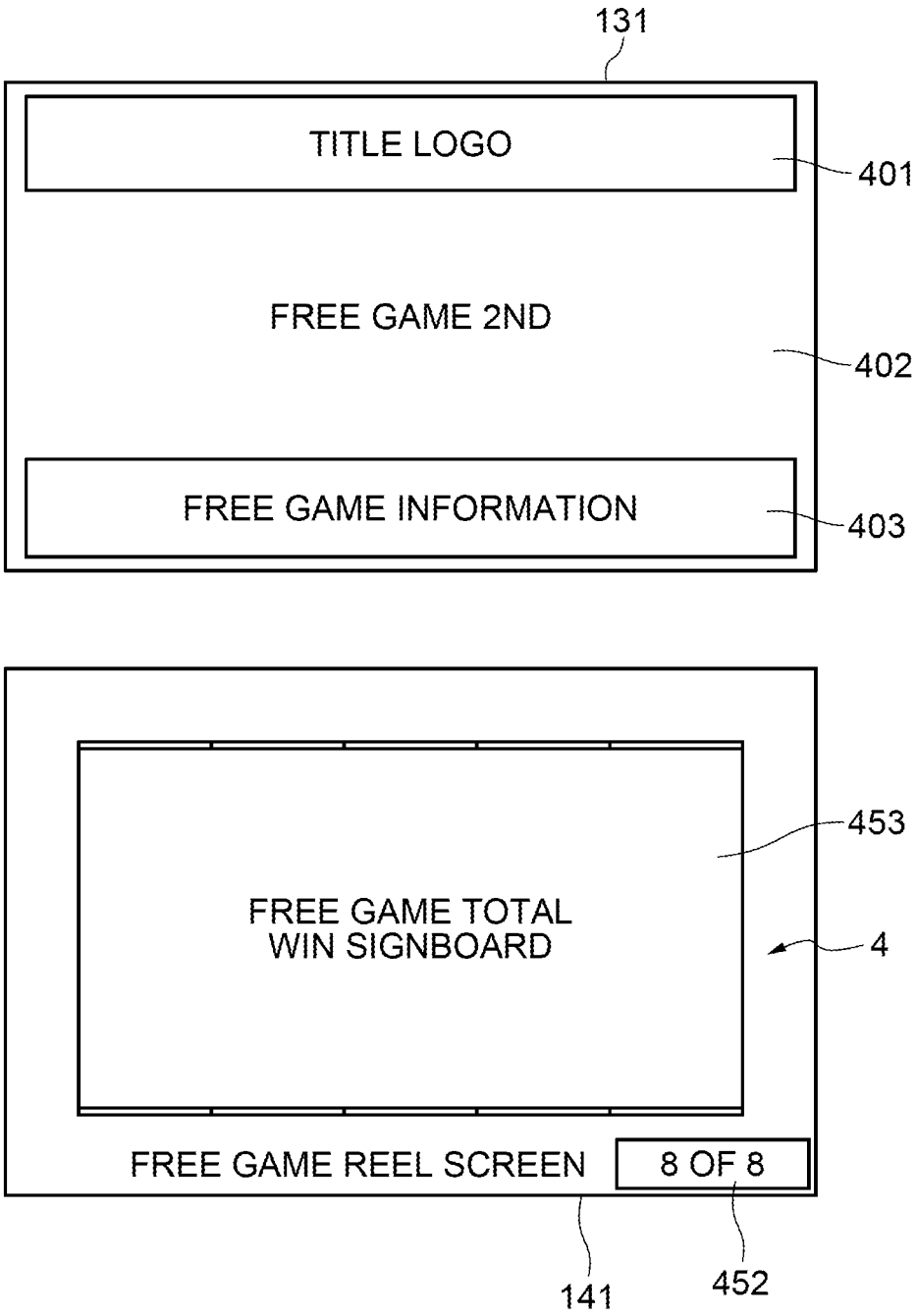
FIG. 65 is a diagram illustrating the presentation effects upon finishing the free games in the slot machine according to the first embodiment of the present invention.
Figure 66:
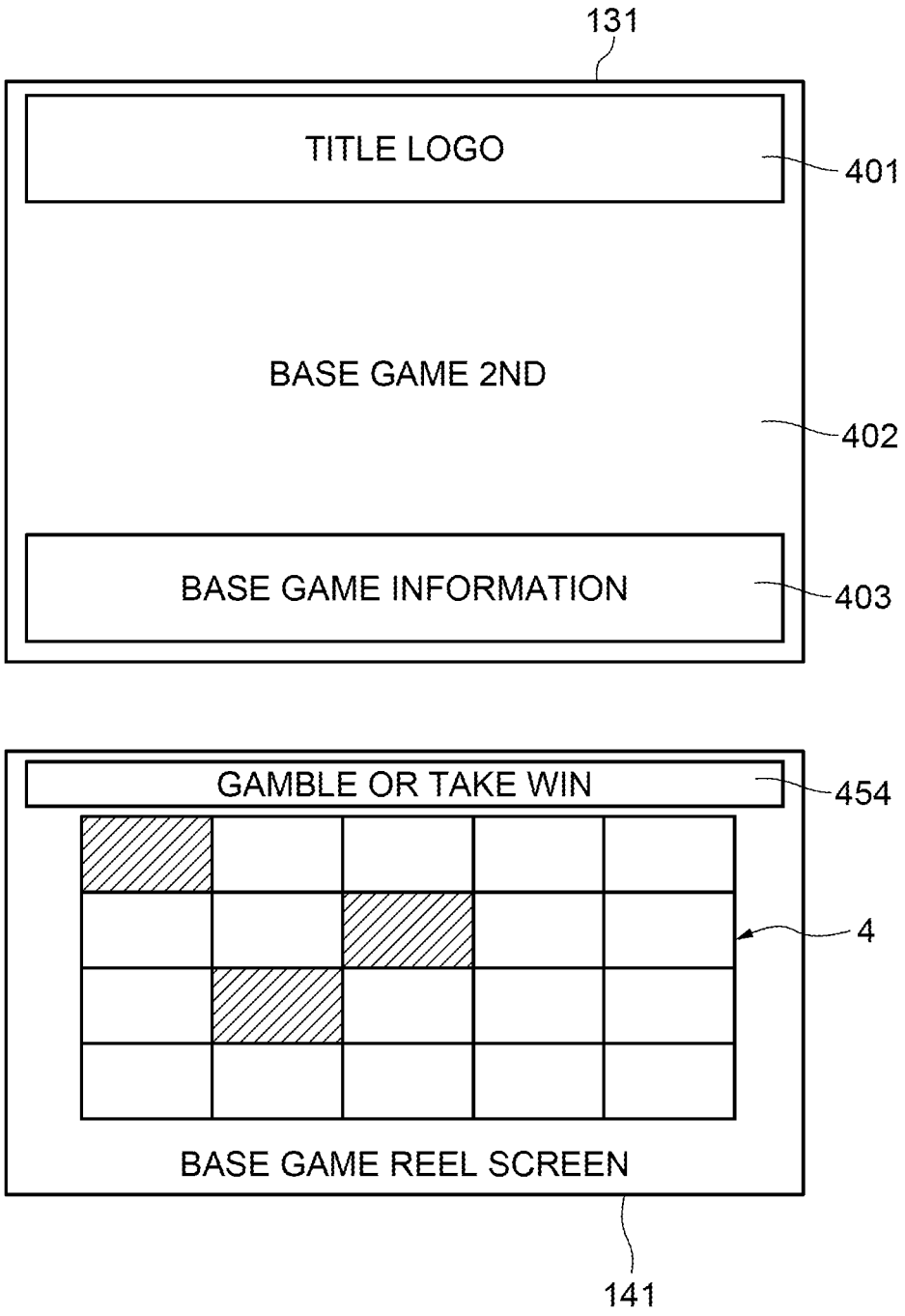
FIG. 66 is a diagram illustrating the presentation effects upon finishing the free games in the slot machine according to the first embodiment of the present invention.

Here, with reference to FIG. 64 to FIG. 66, presentation effects upon finishing the free games will be described. Each of FIG. 64 to FIG. 66 is a diagram illustrating the presentation effects upon finishing the free games of the slot machine according to the first embodiment of the present invention.

As shown in FIG. 64, when in the symbol display area 4 on the lower side image display panel 141, the final spinning has been finished, on the free game counter 452 on the lower side image display panel 141, "8 of 8" indicating that the free games have been finished is displayed. In the image 402 on the upper side image display panel 131, the WIN signboard 421 is displayed. However, when a value of the won credits is zero, the WIN signboard 421 is not displayed.

When the WIN signboard 421 has disappeared from the image 402 on the upper side image display panel 131, as shown in FIG. 65, in the symbol display area 4 on the lower side image display panel 141, a free game total WIN signboard 453 is displayed. On the free game total WIN signboard 453, the won credits in the free games are displayed. However, when a value of the won credits in the free games is zero, the free game total WIN signboard 453 is not displayed.

When the free game total WIN signboard 453 has disappeared from the symbol display area 4 on the lower side image display panel 141, as shown in FIG. 66, the upper side image display panel 131 and the lower side image display panel 141 are switched to the base game screens. At this time, the video reels 3 are changed to the video reel strips for the base game. A state of the changed video reel strips for the base game is returned to the state upon triggering the free games. In addition, above the symbol display area 4 on the lower side image display panel 141, a display frame 454 in which "GAMBLE OR TAKE WIN" is displayed is provided. When in the symbol display area 4 on the lower side image display panel 141 shown in FIG. 65, the free game total WIN signboard 453 is not displayed, after a lapse of two seconds from when the final spinning was finished, as shown in FIG. 66, the upper side image display panel 131 and the lower side image display panel 141 are switched to the base game screens.

<Presentation Effects Upon Retriggering>

Here, with reference to FIG. 67 to FIG. 70, presentation effects upon retriggering will be described. Each of FIG. 67 to FIG. 70 is a diagram illustrating the presentation effects upon the retriggering in the slot machine according to the embodiment of the present invention.

Figure 67:
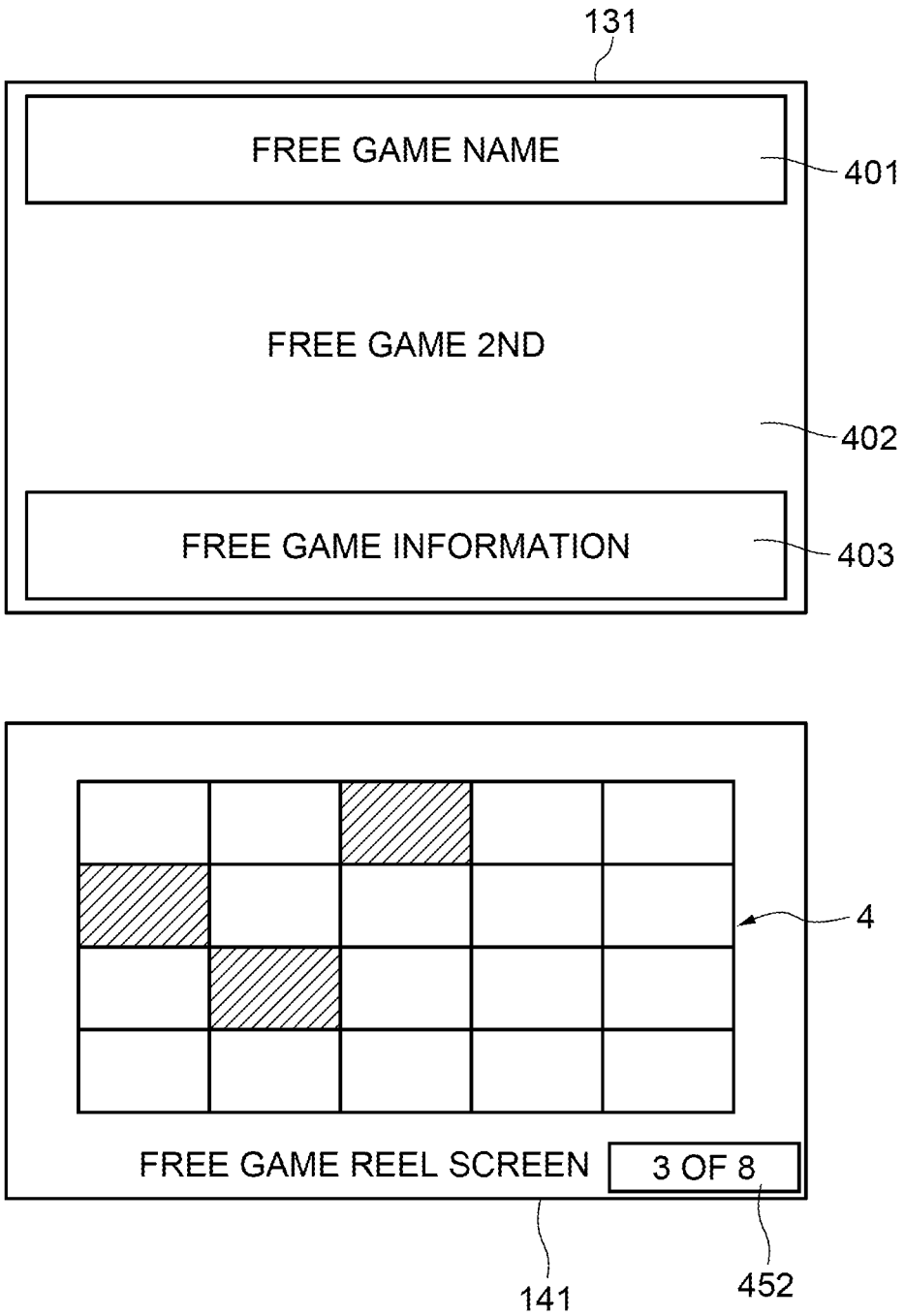
FIG. 67 is a diagram illustrating presentation effects upon the retriggering in the slot machine according to the first embodiment of the present invention.

As shown in FIG. 67, when in the symbol display area 4 on the lower side image display panel 141, the three feature symbols (indicated by shaded areas) have appeared, as described above, the ring-ring sound as the sound effects is reproduced. In FIG. 67, since on the free game counter 452 on the lower side image display panel 141, "3 of 8" is displayed, the three feature symbols (indicated by the shaded areas) have appeared in the third one of the free games.

Figure 68:
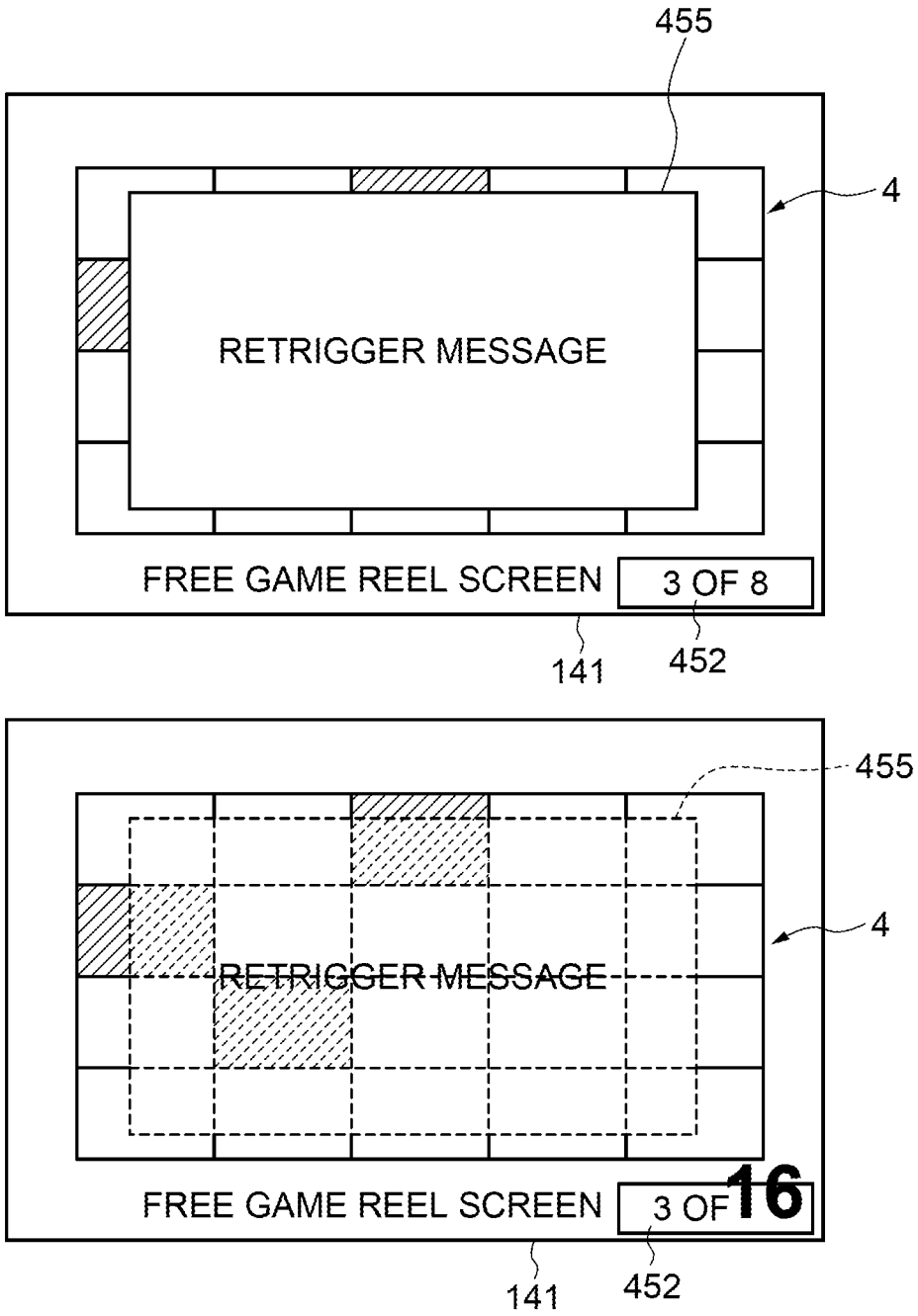
FIG. 68 is a diagram illustrating the presentation effects upon the retriggering in the slot machine according to the first embodiment of the present invention.
Figure 69:
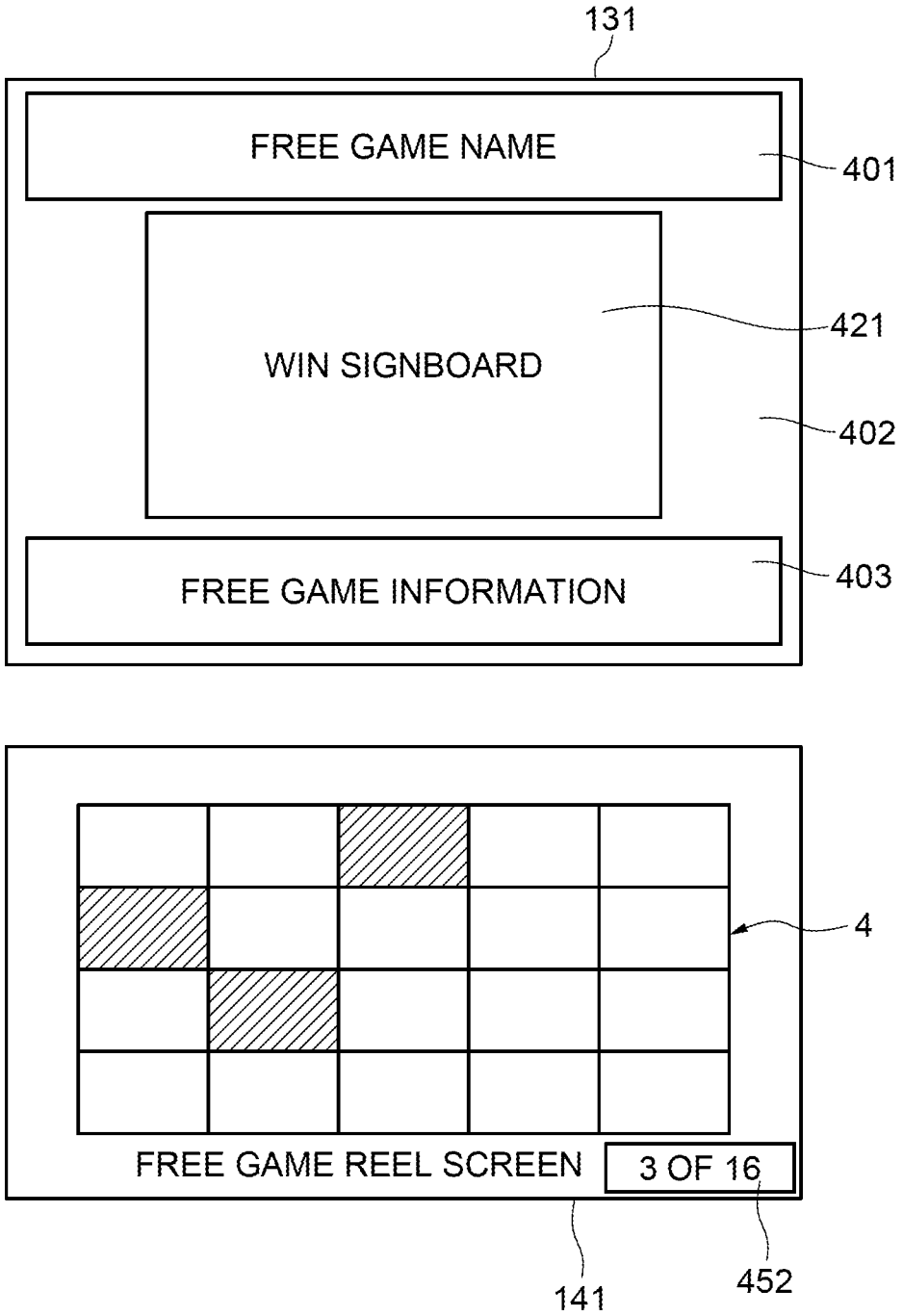
FIG. 69 is a diagram illustrating the presentation effects upon the retriggering in the slot machine according to the first embodiment of the present invention.

Next, as shown in the upper row in FIG. 68, in the symbol display area 4 on the lower side image display panel 141, a retrigger message board 455 is displayed. On the retrigger message board 455, a message related to the retriggering is displayed. When the message has disappeared or a button skip is conducted, as shown in a lower area in FIG. 68, the retrigger message board 455 is erased from the symbol display area 4 on the lower side image display panel 141. Added to the total count of the free game counter is "8". In other words, on the free game counter 452 on the lower side image display panel 141, "3 of 16" is displayed. When the lower side image display panel 141 is displayed as shown in an upper area or the lower area in FIG. 68, a state in which the upper side image display panel 131 is as shown in FIG. 67 is maintained.

Figure 70:
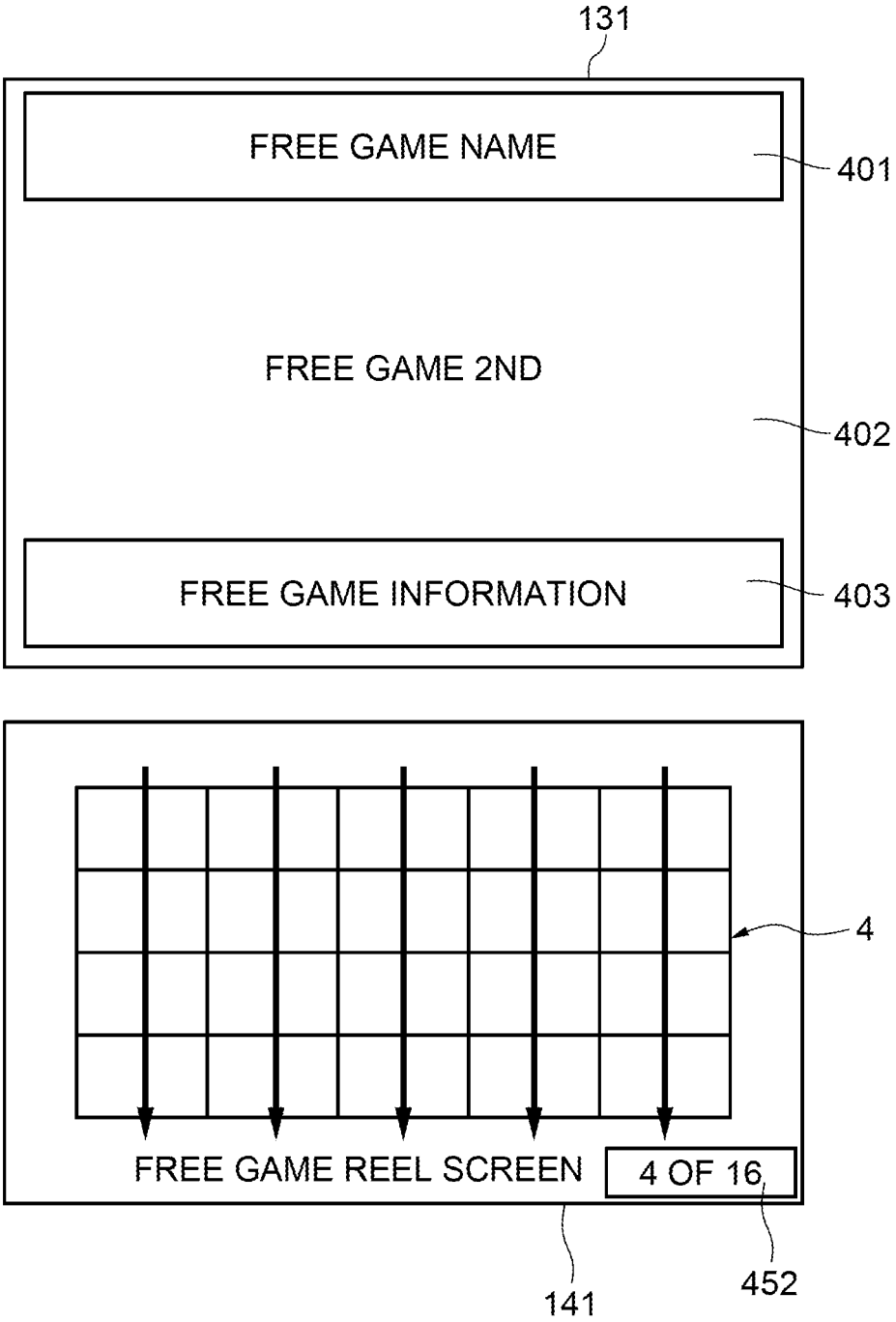
FIG. 70 is a diagram illustrating the presentation effects upon the retriggering in the slot machine according to the first embodiment of the present invention.

As shown in FIG. 70, in the image 402 on the upper side image display panel 131, the WIN signboard 421 is displayed. When the increment display on the WIN signboard 421 has been finished or the button skip is conducted, as shown in FIG. 70, the rotation of all of the reels is started in the symbol display area 4 on the lower side image display panel 141. On the free game counter 452 on the lower side image display panel 141, "4 of 16" indicating that the fourth one of the free games is started is displayed.

<Screen During Free Games>

Figure 71:
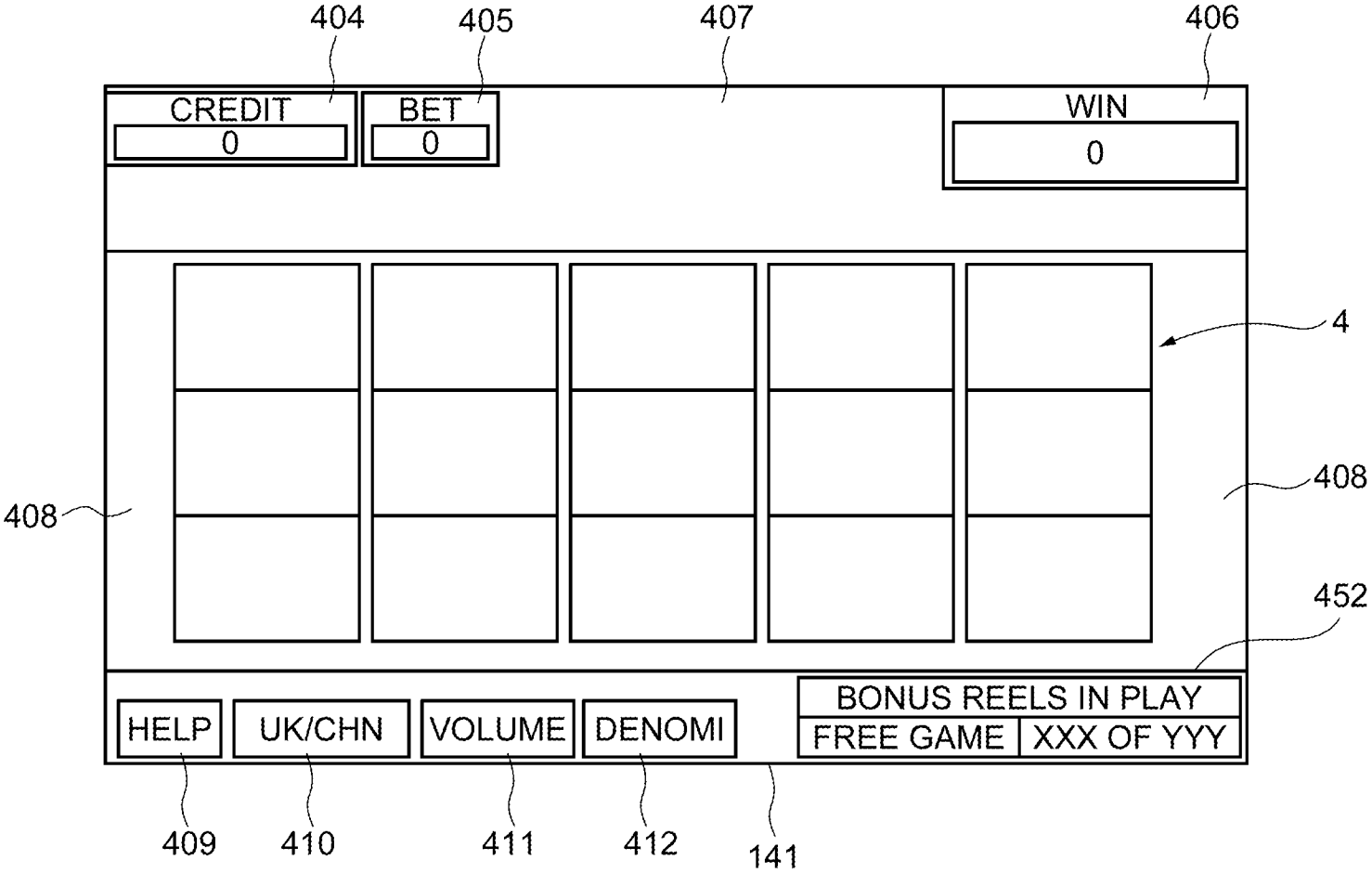
FIG. 71 is a diagram illustrating a screen during the free games in the slot machine according to the first embodiment of the present invention.

Here, with reference to FIG. 71, a screen during the free games will be described. FIG. 71 is a diagram illustrating the screen during the free games in the slot machine according to the embodiment of the present invention.

As shown in FIG. 71, as on the lower side image display panel 141 in the base game time shown in FIG. 42, on the lower side image display panel 141 in the free games, in addition to the symbol display area 4, the CREDIT meter 404, the BET meter 405, the WIN meter 406, the display area 407 for displaying the BET information and the game state, the display area 408 for indicating the LINE Nos. the HELP touch button 409, the language switch touch button 410, the sound volume switch touch button 411, and the DENOMI display area 412 are provided.

Further, immediately after the introduction of the free games, in the lower right portion of the symbol display area 4 on the lower side image display panel 141, the free game counter 452 is displayed. On the free game counter 452, words "BONUS REELS IN PLAY" are displayed. In the free games, since the video reel strips which are different from those used in the base game are used, the words "BONUS REELS IN PLAY" are displayed. The words "BONUS REELS IN PLAY" may be hidden by the free game counter 452 or the symbol animation.

On the free game counter 452, a word "FREE" is also displayed. The word "FREE" indicates that each of the free games is being played and, upon starting the spinning in the symbol display area 4 on the lower side image display panel 141, is concurrently expanded to be displayed.

On the free game counter 452, words "xxx OF yyy" are also displayed. On the free game counter 452, a total number of free games and a number of free games which have been currently played are displayed. Upon starting the spinning in the symbol display area 4 on the lower side image display panel 141, the portion of "xxx" is concurrently expanded to be displayed. Further, the portion of "xxx" notifies a player that each of the free games is played on a one-by-one basis. Prior to starting the free games, in the portion of "xxx", "0" is displayed. Concurrently with the starting of the rotation of the reels in the symbol display area 4 on the lower side image display panel 141, in the portion of "xxx", "+1" is counted and, concurrently with outputting of a voice, the number is expanded to be displayed. In a portion of "yyy", the total number of free games is displayed. A maximum number of digits displayed in each of "x" and "y" is one.

On the lower side image display panel 141 during the free games, as performed during the base game, the WIN presentation effects upon the occurrence of any WIN, the increment process, and the LINE presentation effects are performed. With respect to the LINE and BET during the free games, the LINE number and the BET number upon the occurrence of the free games are carried over. A value of the WINs during the free games is added to a value in the WIN meter in an upper right portion of the lower side image display panel 141.

<Appeal Rewriting Upon Starting Spinning During Free Games>

Here, with reference to FIG. 72 to FIG. 74, appeal rewriting upon starting the spinning during the free games will be described. Each of FIG. 72 to FIG. 74 is a diagram explaining the appeal rewriting upon starting the spinning during the free games in the slot machine according to the first embodiment of the present invention.

Figure 72:
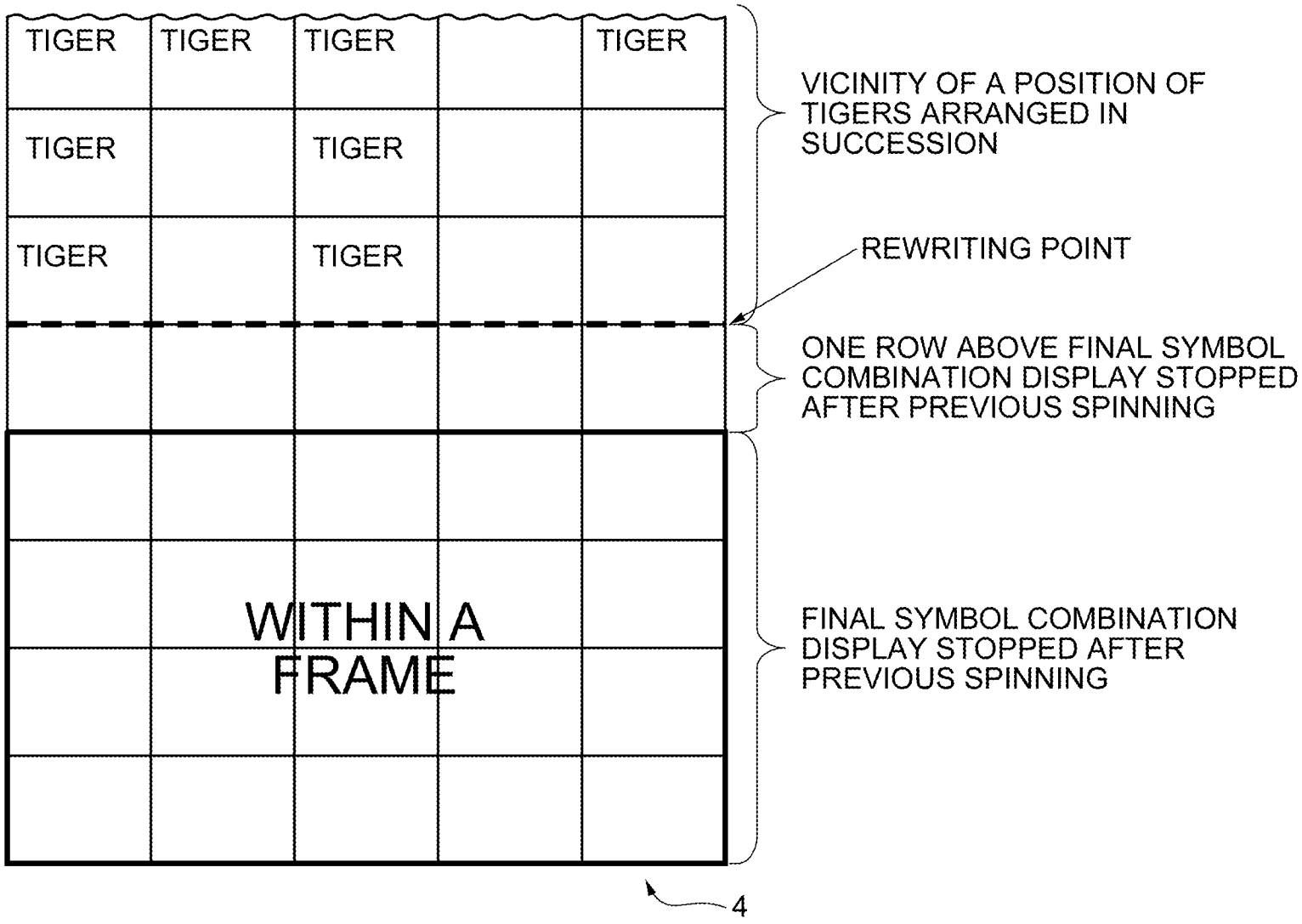
FIG. 72 is a diagram explaining appeal rewriting upon starting spinning during the free games in the slot machine according to the first embodiment of the present invention.

In the first embodiment, as shown in FIG. 72, during the free games, it is appealed that displayed are advantageous reel strips in which only in a case of the symbols of the one animal selected in the selection game, on the video reel strips, the larger number of symbols of the one animal selected in the selection game are arranged in succession than on the base game video reel strips. In order to appeal, a mechanism in which the symbols of the one animal selected in the selection game are displayed upon starting the rotation of the reels in the symbol display region 4 is adopted.

Hereinafter, the description will be made assuming that the tiger is selected in the selection game. However, even when an animal other than the tiger is selected, the same applies thereto. With respect to each of the Reel 1 to Reel 5, a drawing for appeal rewriting is individually conducted, and any reel which has won in the drawing is started in the vicinity of the clusters of the symbols "TIGER" in the frames in the symbol display area 4 upon starting the rotation. Here, the reason why the word "vicinity" of the clusters is used is that in order to avoid arranging the clusters in a straight line each time, a position at which the rewriting is conducted is randomly selected from three positions in the vicinity of the beginnings of the symbols "TIGER" arranged in succession. However, since the drawing for the rewriting is individually conducted with respect to each of the 1 to 5 reels, in reality, there is also some reel which is not started in the vicinity of the symbols "TIGER". FIG. 73 shows start positions after rewriting upon the winning in the drawing for the appeal rewriting. FIG. 74 shows presence or absence of the appeal rewriting and drawings for the rewriting positions. In FIG. 74, on all of the reels, there is no appeal rewriting.

[Button Look-Ahead Specification]

Figure 75:
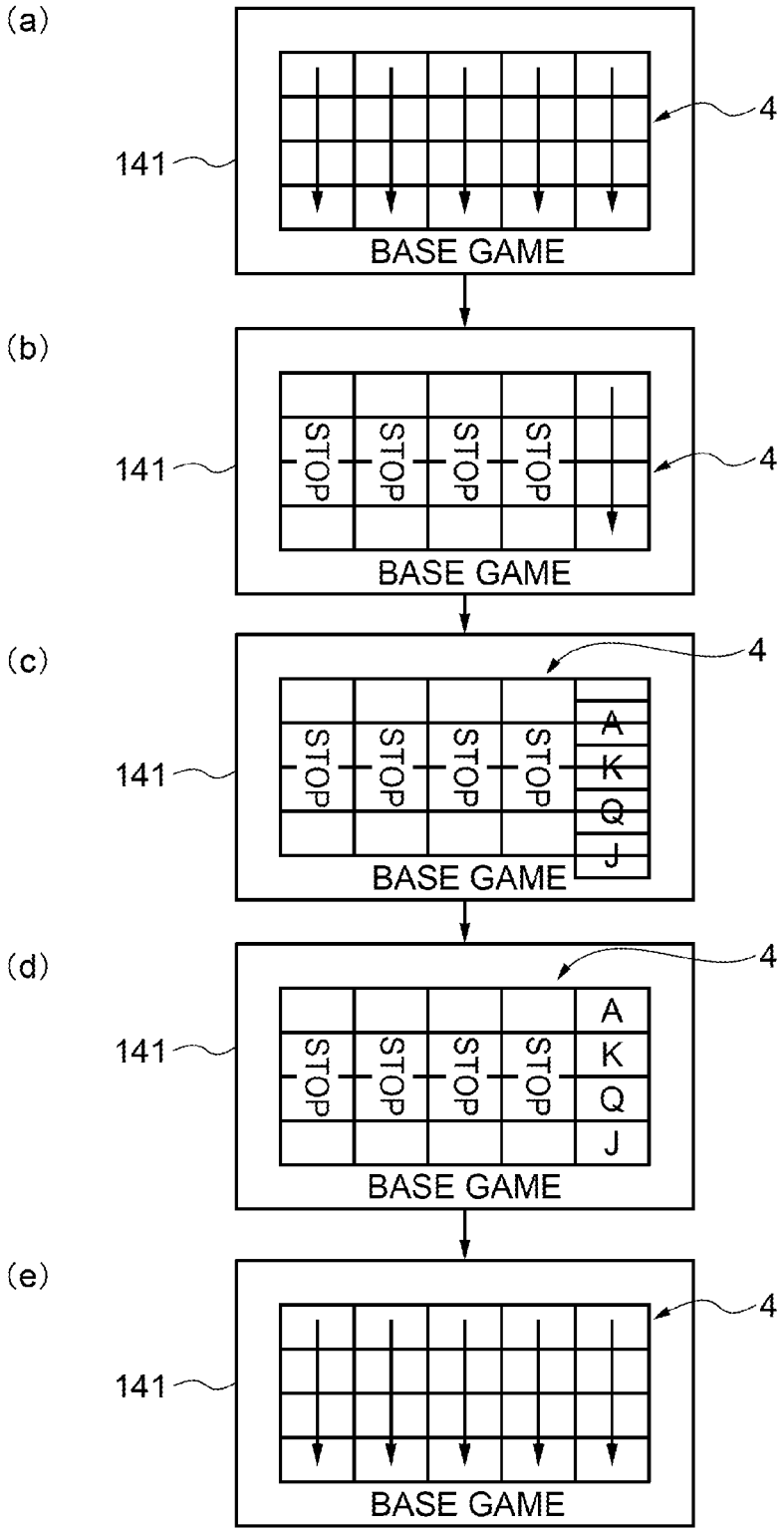
FIG. 75 is a diagram explaining a button look-ahead specification in the slot machine according to the first embodiment of the present invention.

The free game presentation effects in the slot machine 1 are as described above. Next, with reference to FIG. 75, a button look-ahead specification in the slot machine 1 will be described. FIG. 75 is a diagram explaining the button look-ahead specification in the slot machine according to the first embodiment of the present invention. The button look-ahead specification is a specification related to a function with which during the base game, inputting of the SPIN or the MAX BET buttons for the next game is accepted immediately before the finishing of the rotation of the reels, thereby enabling the next game to be smoothly started.

In the button look-ahead function, the symbol display area 4 on the lower side image display panel 141 is changed in manners shown in part (a) to (e) of FIG. 75. First, as shown in part (a) of FIG. 75, all of the reels are rotated in the symbol display area 4 on the lower side image display panel 141. Then, as shown in part (b) of FIG. 75, while all of the reels are being rotated, the four reels of all of the reels are stopped in the symbol display area 4 on the lower side image display panel 141. Next, as shown in part (c) FIG. 75, it is assumed that, in a period of time from when the fifth reel was completely sunk down up to when the spinning was finished in the symbol display area 4 on the lower side image display panel 141, the SPIN button or the MAX BET button is pressed by a player. Then, at the time point at which as shown in part (d) of FIG. 75, the fifth reel was stopped in the symbol display area 4 on the lower side image display panel 141, as shown in part (e) of FIG. 75, the spinning of all of the reels is started at the fastest speed for the next game in the symbol display area 4 on the lower side image display panel 141. In the base game, only in the game in which no WIN occurs, the button look-ahead function is made active. In addition, by making a setting on the AUDIT MENU, whether the button look-ahead function is active or inactive is changed.

[WIN Meter Information Display]

Figure 76:
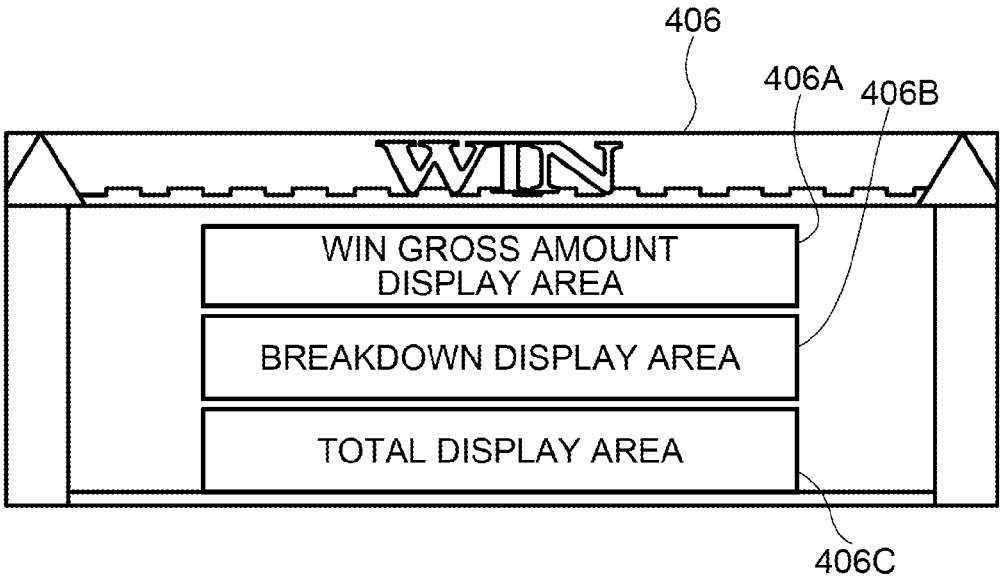
FIG. 76 is a diagram explaining a WIN meter information display in the slot machine according to the first embodiment of the present invention.

The button look-ahead specification in the slot machine 1 is as described above. Next, with reference to FIG. 76, a WIN meter information display in the slot machine 1 will be described. FIG. 76 is a diagram explaining the WIN meter information display in the slot machine according to the first embodiment of the present invention.

As shown in FIG. 76, on the WIN meter 406, a WIN gross amount display area 406A, a breakdown display area 406B, and a total display area 406C are provided.

In the WIN gross amount display area 406A, a WIN credit and a money amount are displayed. When the increment is displayed, such increment complies with criteria in a win increment speed sheet. In other words, in the WIN gross amount display area 406A, the number of credits won during the current game cycle (or the previous game cycle) is displayed. When a plurality of credits are won during one game cycle, the credits are sequentially added. For example, when the triggering of the free games occurs during the base game and a player obtains LINE WIN 20 and SCATTER WIN 100, an increment display is conducted from "0" to "120". Thereafter, when a player obtains a payout of "200" during the free games, the increment display is conducted from "120" to "320". When the next game cycle is started or losing in the GAMBLE occurs, "0" is displayed. On the other hand, when winning occurs in the GAMBLE, the increment display is not conducted and a doubled amount is instantaneously displayed.

The breakdown display area 406B is related to WIN during the base game and the free games. After the fifth REEL has been stopped, the No. of WIN LINE and a WIN credit are displayed. When a plurality of LINE payouts concurrently occur, displaying is conducted by changing every 0.5 second. The LINE payout is displayed in ascending order of the LINE Nos. and after the LINE payout having the largest WIN LINE No. has been displayed, the LINE payout is displayed again in ascending order of the LINE Nos. In other words, in the breakdown display area 406, a breakdown of the credits won in the spinning conducted this time is displayed. When there are a plurality of elements (different lines or SCATTER), displaying is conducted by changing the display time unit to a unit of 0.5 second. The order of changing the display time unit is from the SCATTER payout to the LINE payout (in ascending order of the LINE Nos.).

In the total display area 406C, upon the completion of the increment in the WIN gross amount display area 406A, a total in the breakdown display area 406B is displayed. However, until after the completion of the increment in the WIN gross amount display area 406A, no value is displayed in the total display area 406C. In other words, in the total display area 406C, the total of the credits won in the spinning conducted this time is displayed. After having finishing the increment in the WIN gross amount display area 406A, a total value is displayed therein.

[One Example of Control Panel]

Figure 77:
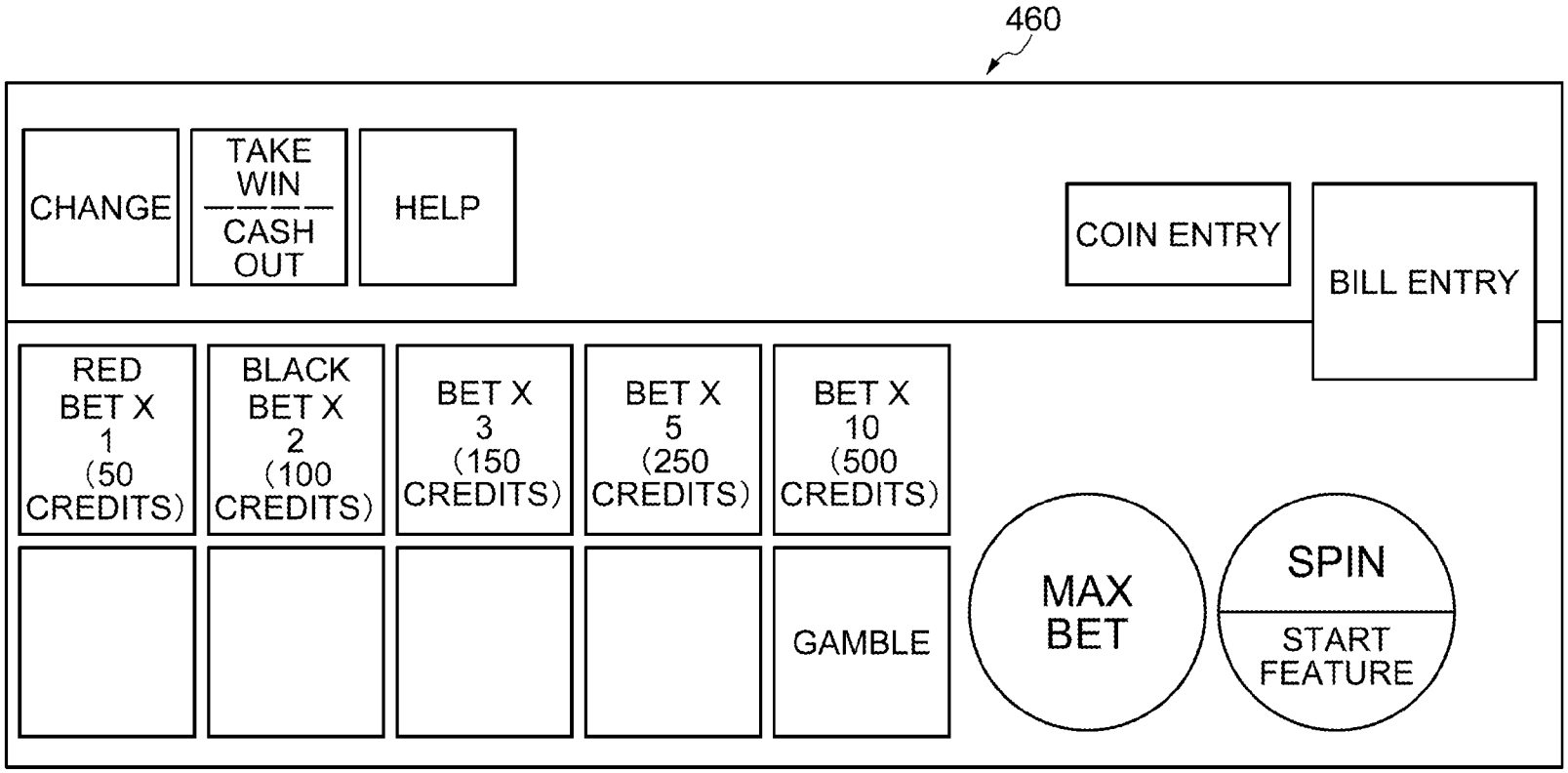
FIG. 77 is a diagram illustrating one example of a control panel specification in the slot machine according to the first embodiment of the present invention.

The WIN meter information display in the slot machine 1 is as described above. Next, with reference to FIG. 77, one example of a control panel specification in the slot machine 1 will be described. FIG. 77 is a diagram illustrating the one example of the control panel specification in the slot machine according to the first embodiment of the present invention. In the slot machine according to the embodiment of the present invention 1, instead of the control panel shown in FIG. 4, a control panel 460 shown in FIG. 77 may be provided.

[GAMBLE Specification]

The one example of the control panel specification in the slot machine 1 is as described above. Next, with reference to FIGS. 78 to 84, a GAMBLE specification in the slot machine 1 will be described. FIGS. 78 to 84 are diagrams explaining the GAMBLE specification in the slot machine according to the first embodiment of the present invention.

Figure 78:
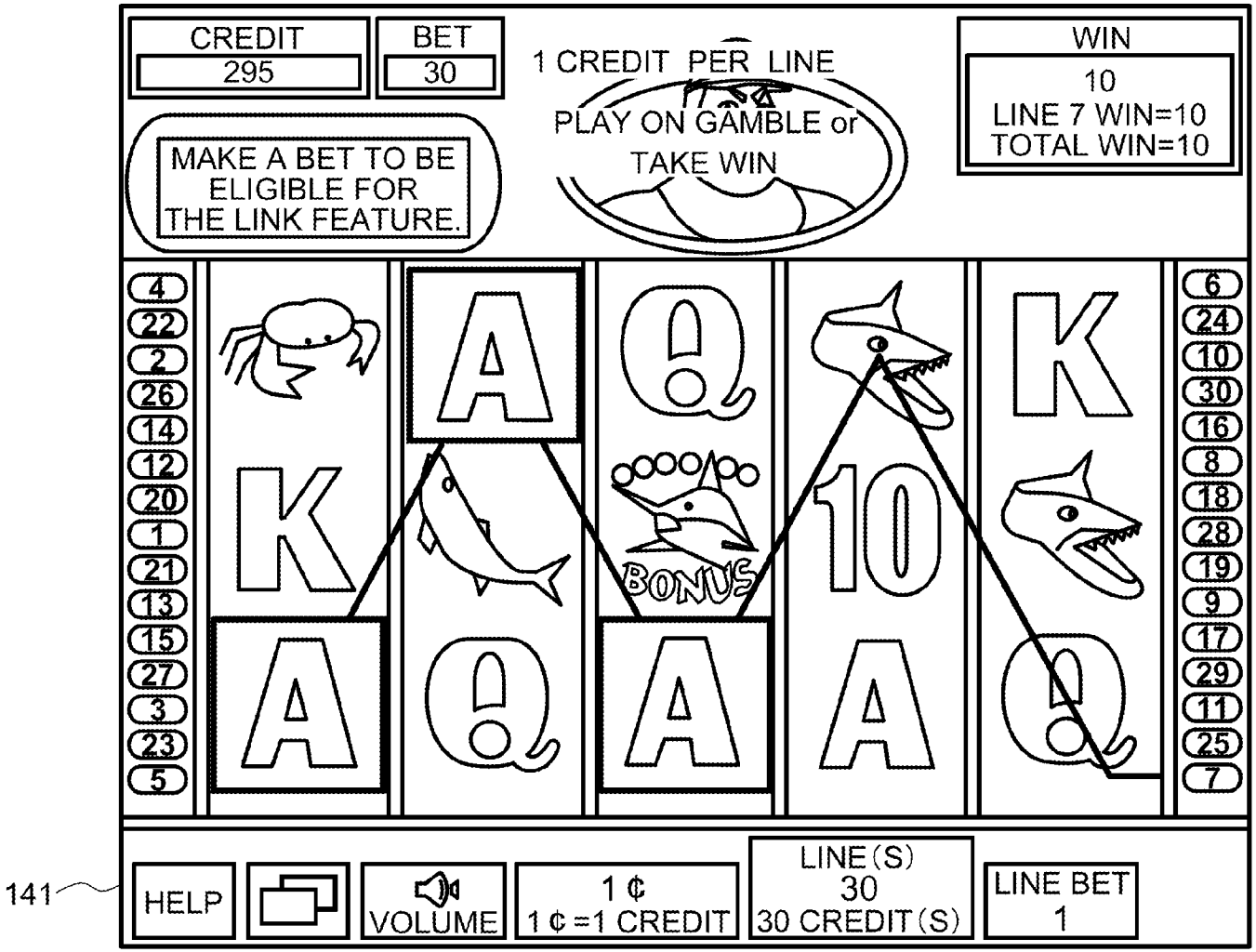
FIG. 78 is a diagram explaining a GAMBLE specification in the slot machine according to the first embodiment of the present invention.
Figure 79:
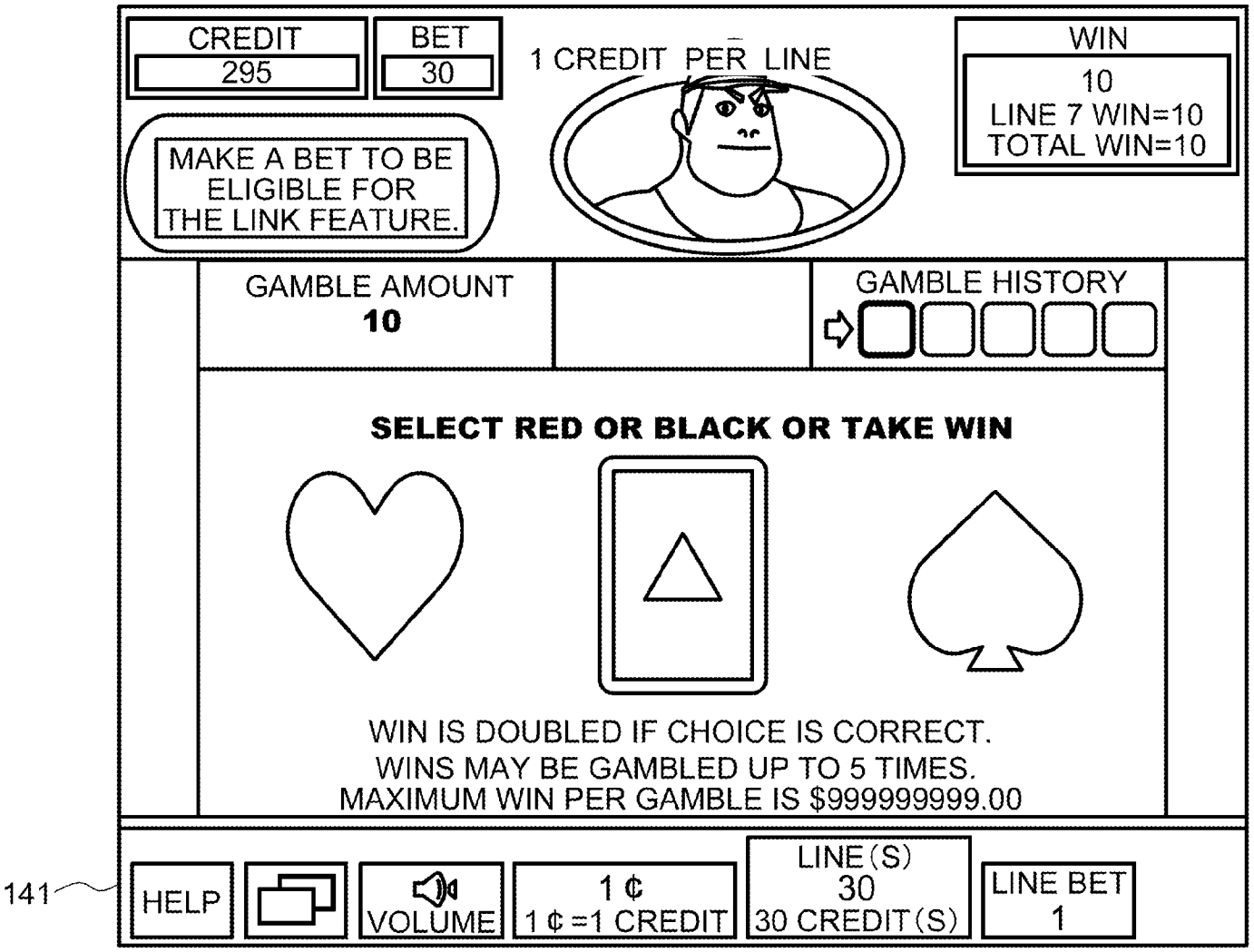
FIG. 79 is a diagram explaining a GAMBLE specification in the slot machine according to the first embodiment of the present invention.

First, when WIN occurs, the lower side image display panel 141 shown in FIG. 78 is changed to the lower side image display panel 141 shown in FIG. 79. In other words, a GAMBLE screen is displayed, and a message "PLAY ON, GAMBLE or TAKE WIN" is erased. On the other hand, a message "SELECT RED OR BLACK OR TAKE WIN is displayed on the lower side image display panel 141.

Figure 80:
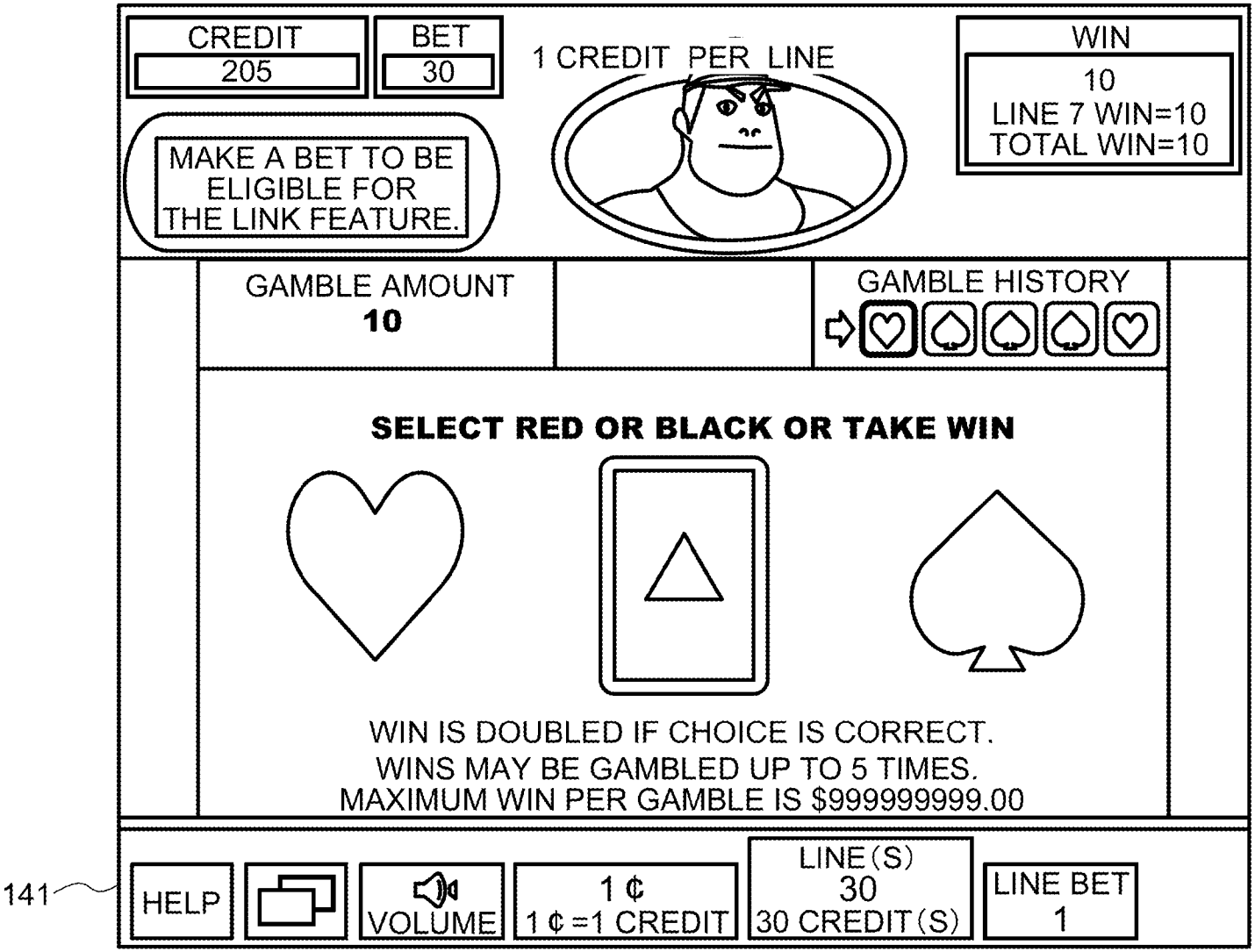
FIG. 80 is a diagram explaining the GAMBLE specification in the slot machine according to the first embodiment of the present invention.

Next, on the lower side image display panel 141 shown in FIG. 80, a bet amount as a "GAMBLE AMOUNT" is displayed on the lower side image display panel 141. Here, a player selects "RED" or "BLACK". When this selection is successful, the lower side image display panel 141 is changed to the lower side image display panel 141 shown in FIG. 83 described later. In contrast to this, when this selection is unsuccessful, the lower side image display panel 141 is changed to the lower side image display panel 141 shown in FIG. 81. When a player selects "TAKE WIN", on the lower side image display panel 141, a WIN value is immediately added to the credit, and an idling state returns.

Figure 81:
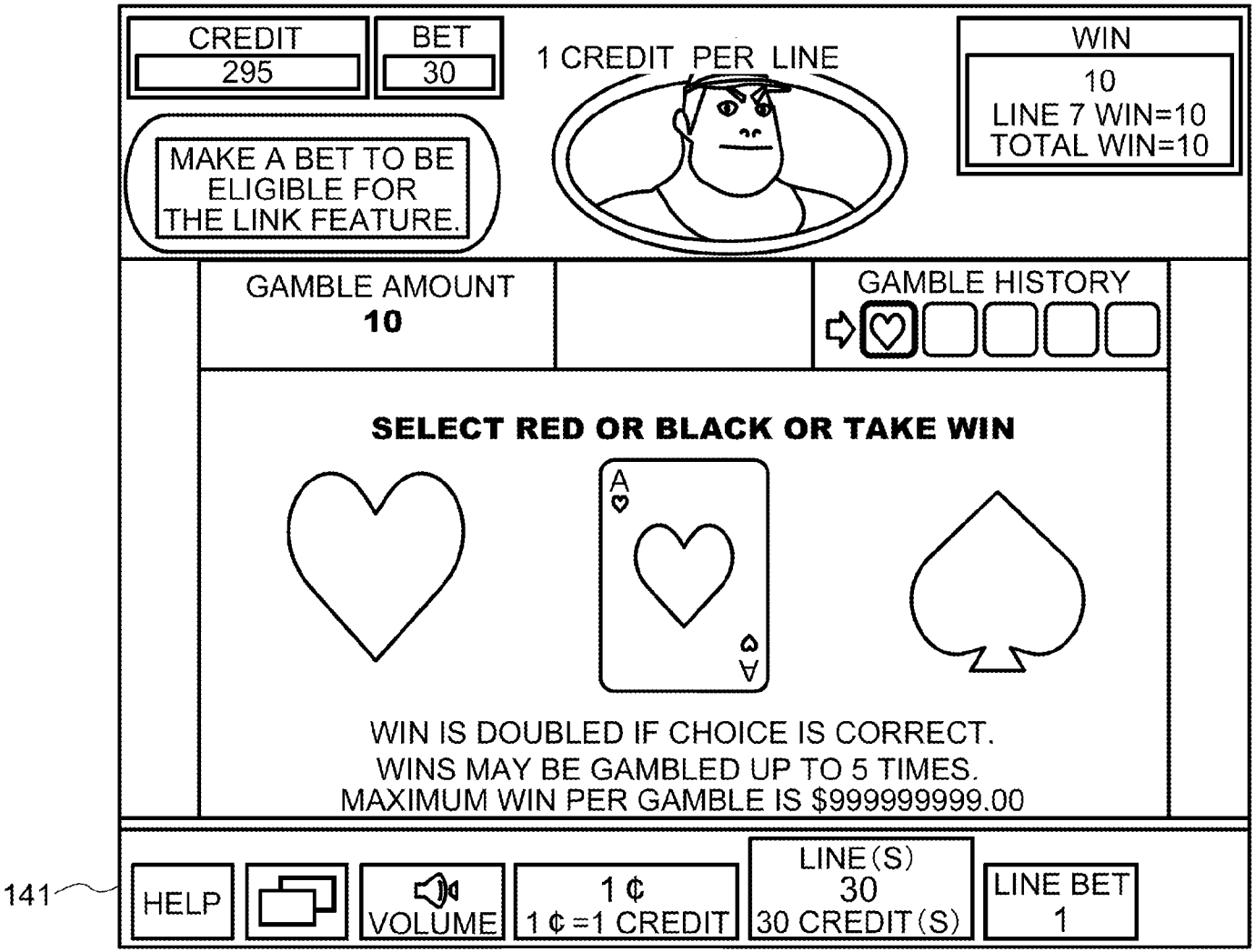
FIG. 81 is a diagram explaining the GAMBLE specification in the slot machine according to the first embodiment of the present invention.
Figure 82:
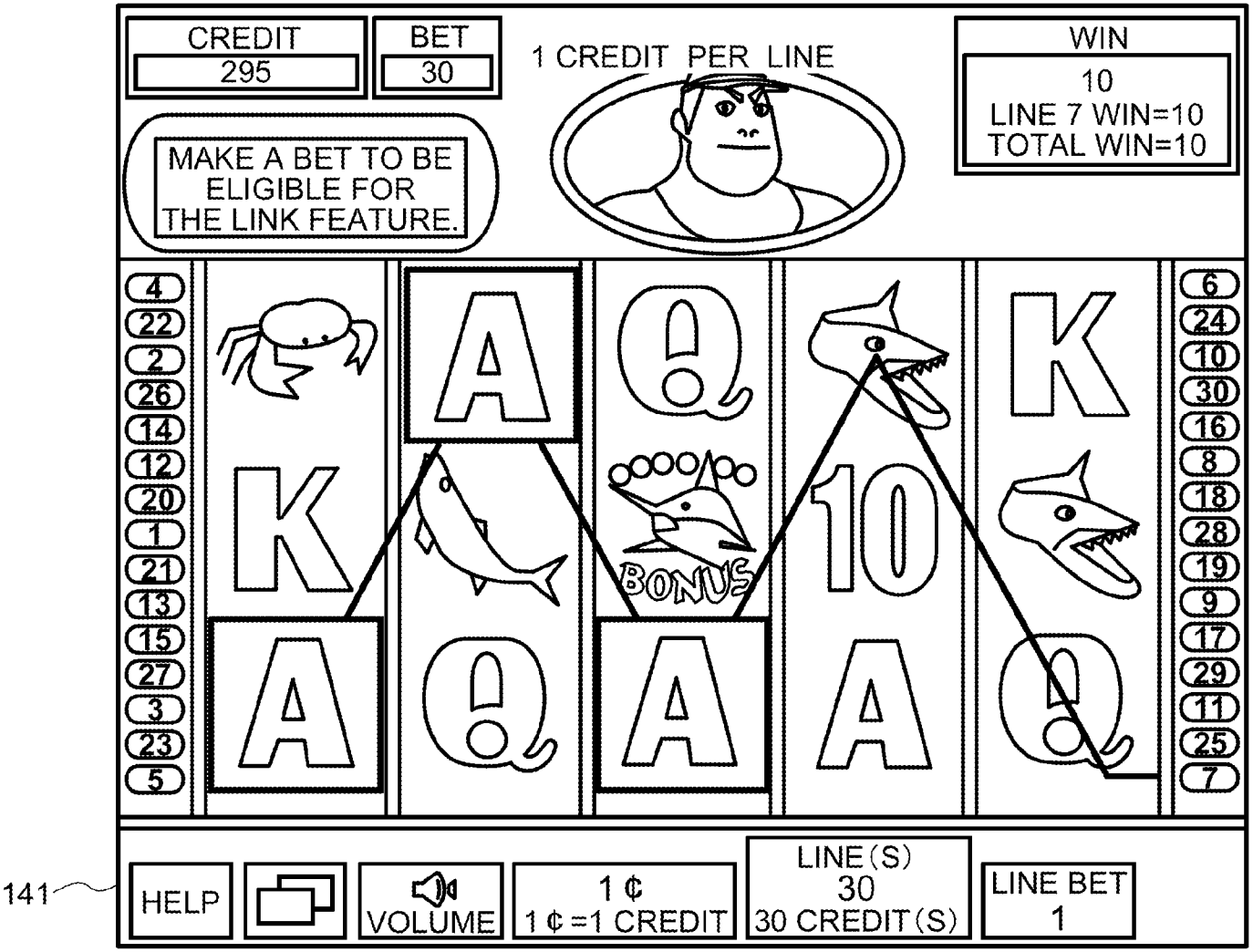
FIG. 82 is a diagram explaining the GAMBLE specification in the slot machine according to the first embodiment of the present invention.

When the player's selection is unsuccessful, on the lower side image display panel 141 shown in FIG. 81, a selection choice ("RED" or "BLACK") which has not been selected becomes dark. In addition, on the lower side image display panel 141 shown in FIG. 81, on a leftmost portion of a "GAMBLE HISTORY" section, a history of the selected card is immediately displayed. When there is a history of the previously selected card, the history of the previously selected card is shifted to the right by one space to be displayed. For a trajectory of this shifting, the display is conducted with no animation, and rewriting is immediately conducted. Further, a result of the central card is immediately displayed. At this time point, however, the WIN meter and the GAMBLE AMOUNT meter do not change. Thereafter, chagrin sound is outputted, and 1.2 second after the outputting of the chagrin sound, as shown in FIG. 82, the lower side image display panel 141 is switched to a MAIN GAME screen. Upon switching to the MAIN GAME screen, concurrently, "0 is displayed in the WIN meter.

Figure 83:
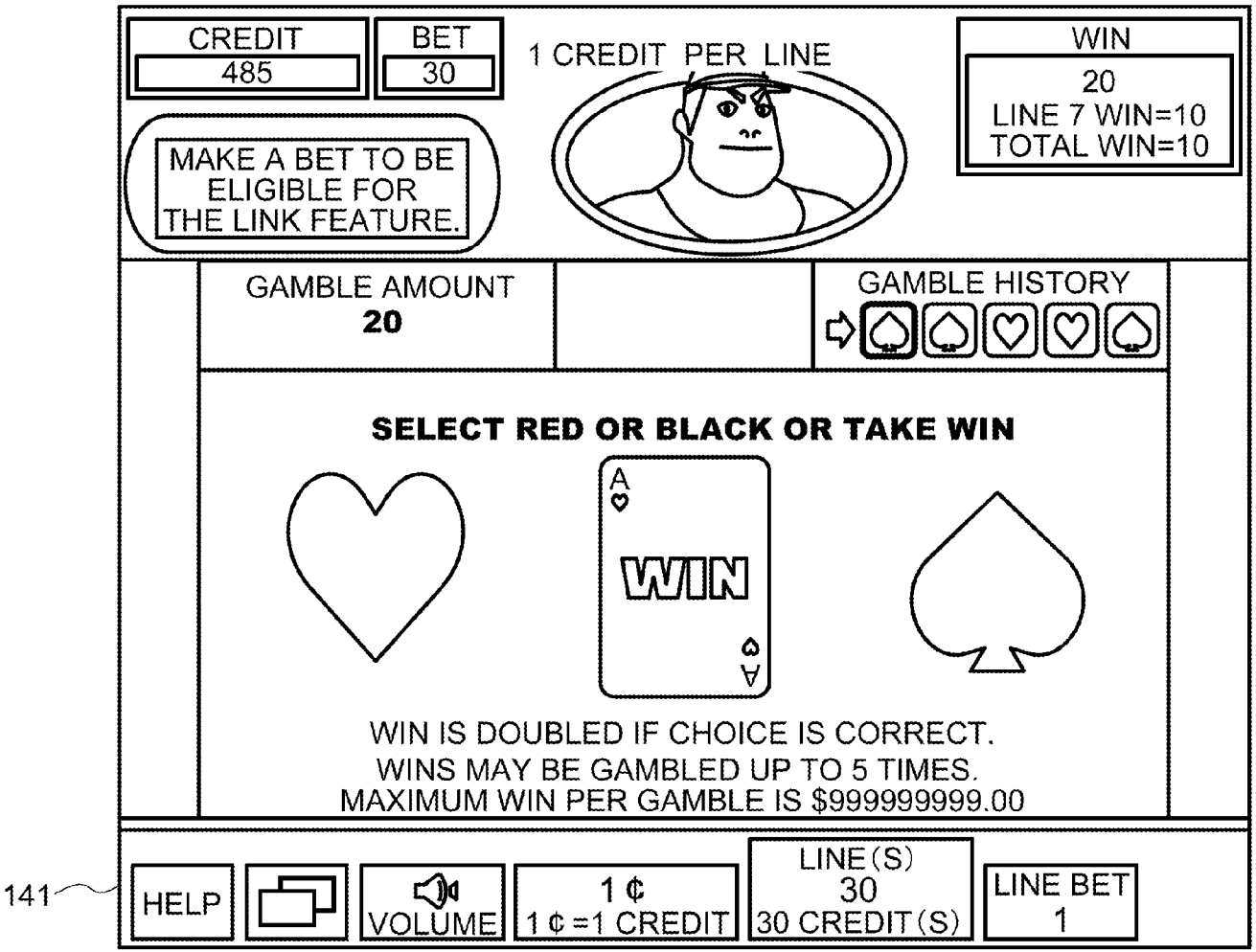
FIG. 83 is a diagram explaining the GAMBLE specification in the slot machine according to the first embodiment of the present invention.
Figure 84:
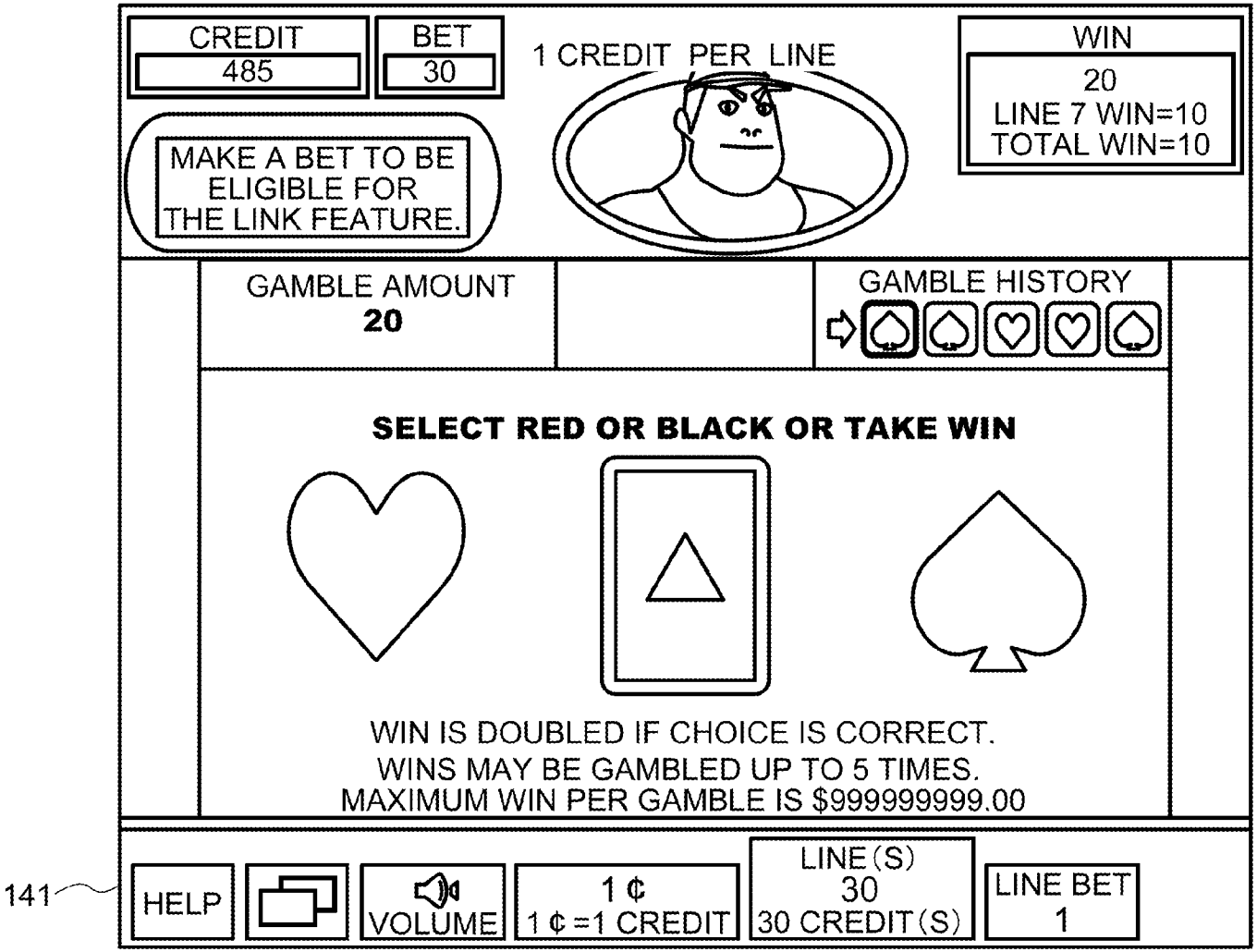
FIG. 84 is a diagram explaining the GAMBLE specification in the slot machine according to the first embodiment of the present invention.

When the player's selection is successful, on the lower side image display panel 141 shown in FIG. 83, a selection choice ("RED" or "BLACK") which has not been selected becomes dark. In addition, on the lower side image display panel 141 shown in FIG. 83, on a leftmost portion of a "GAMBLE HISTORY" section, a history of the selected card is immediately displayed. When there is a history of the previously selected card, the history of the previously selected card is shifted to the right by one space to be displayed. For a trajectory of this shifting, the display is conducted with no animation, and rewriting is immediately conducted. Further, as a central card, a normal card and a card having a word WIN are alternately displayed on a one frame-by-one frame basis, and success sound is outputted for 1.2 second. On the WIN meter, a value increased by the GAMBLE result is immediately added. At this point, however, the GAMBLE AMOUNT meter does not change.

Here, when the GAMBLE has been played at the upper limit number of times, a WIN value is immediately added to the credit, and the idling state returns. In contrast to this, when the GAMBLE has not been played at the upper limit number of times, the lower side image display panel 141 is changed to the lower side image display panel 141 shown in FIG. 84. On the lower side image display panel 141 shown in FIG. 84, the central card is displayed face down. Thereafter, the lower side image display panel 141 is changed to the lower side image display panel 141 shown in FIG. 80.

On the MAIN GAME screen on the lower side image display panel 141 shown in FIG. 78 and FIG. 82, to facilitate understanding, symbols which are different from the above-described symbols are also displayed.

[RESIDUAL GAMBLE]

Figure 85:
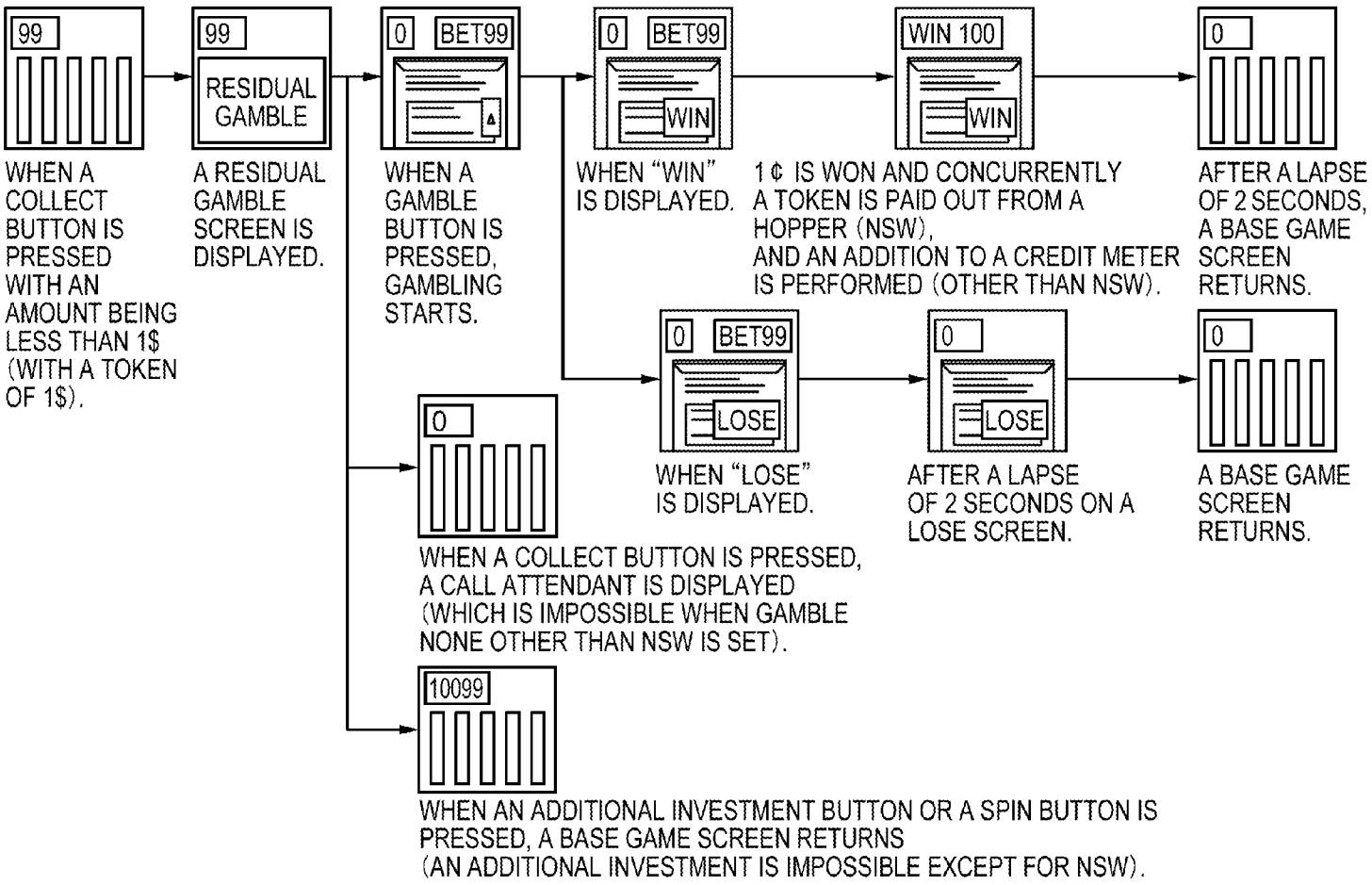
FIG. 85 is a diagram explaining RESIDUAL GAMBLE in the slot machine according to the first embodiment of the present invention.
Figure 87:
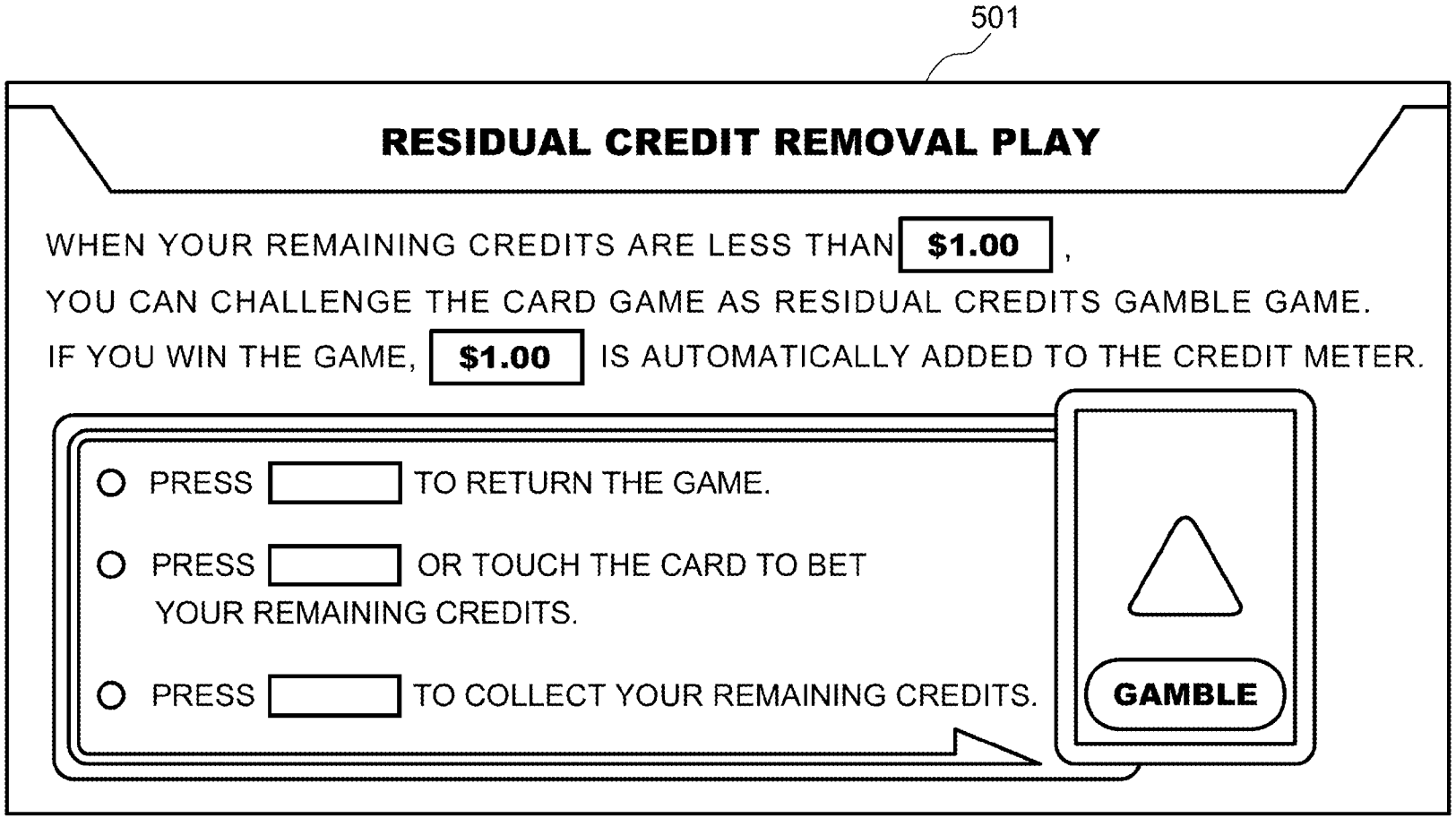
FIG. 87 is a diagram explaining the RESIDUAL GAMBLE in the slot machine according to the first embodiment of the present invention.

The GAMBLE specification in the slot machine 1 is as described above. Next, with reference to FIG. 85 to FIG. 87, RESIDUAL GAMBLE in the slot machine 1 will be described. Each of FIG. 85 to FIG. 87 is a diagram explaining the RESIDUAL GAMBLE in the slot machine according to the first embodiment of the present invention. The RESIDUAL GAMBLE is conducted along a flow shown in FIG. 85 by using a table shown in FIG. 86. At this time, in one scene of the RESIDUAL GAMBLE, on the lower side image display panel 141, an image 501 shown in FIG. 87 is displayed.

[System Font Display Area]

Figure 88:
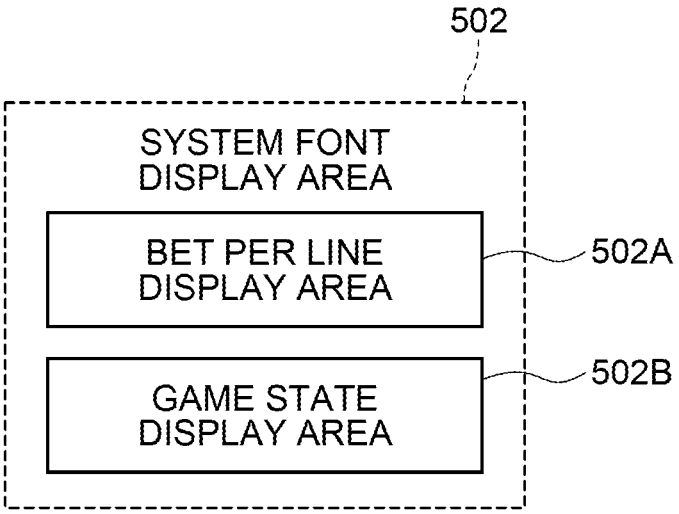
FIG. 88 is a diagram illustrating a system font display area in the slot machine according to the first embodiment of the present invention.

The RESIDUAL GAMBLE in the slot machine 1 is as described above. Next, with reference to FIG. 88, a system font display area in the slot machine 1 will be described. FIG. 88 is a diagram illustrating the system font display area in the slot machine according to the first embodiment of the present invention. In the system font display area 502 shown in FIG.

88, a display area 502A of BET PER LINE and a display area 502B of a GAME state are provided. The system font display area 502 is allocated in the display area 407 for displaying the BET information and the game state on the lower side image display panel 141 (refer to FIG. 42).

[HELP Specification]

Figure 89:
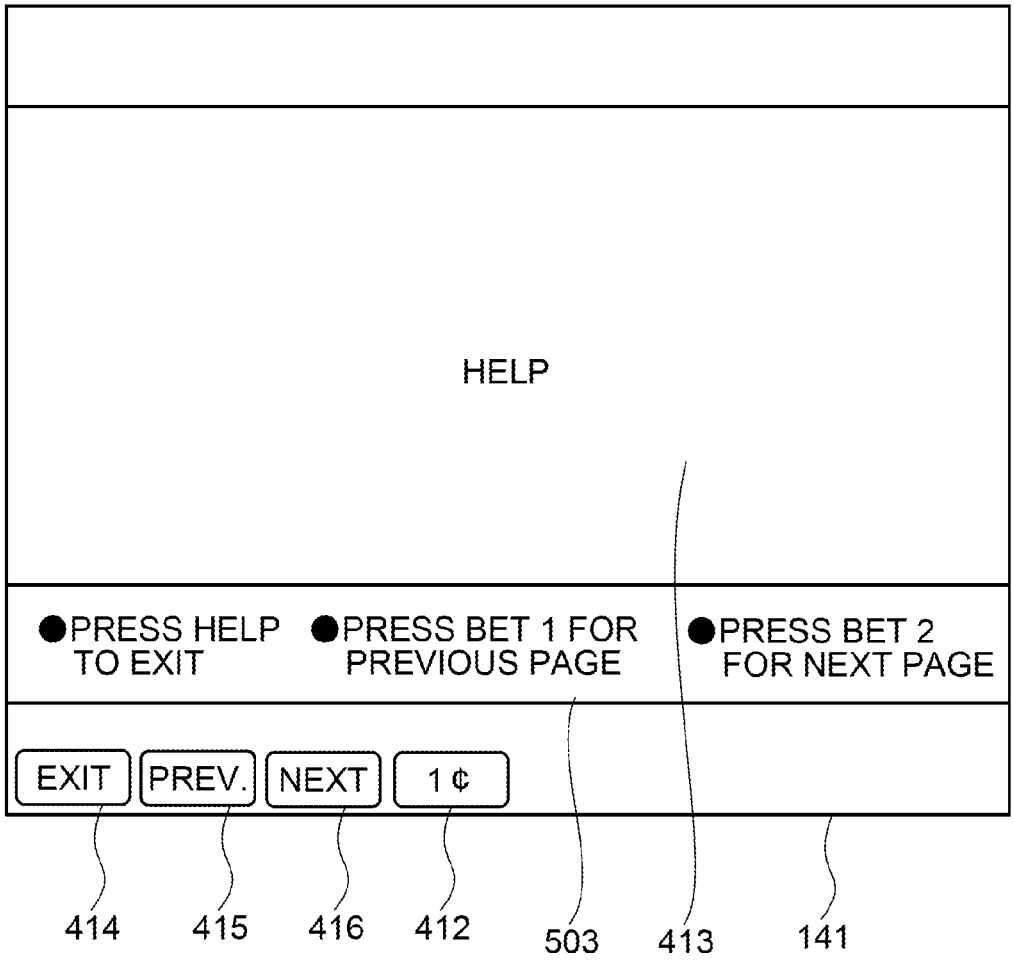
FIG. 89 is a diagram first explaining a HELP specification in the slot machine according to the embodiment of the present invention.

The system font display area in the slot machine 1 is as described above. Next, with reference to FIG. 89 and FIG. 90, a HELP specification in the slot machine 1 will be described. Each of FIG. 89 and FIG. 90 is a diagram explaining the HELP specification in the slot machine according to the first embodiment of the present invention. As shown in FIG. 89, on the lower side image display panel 141 in the HELP specification, the HELP screen 413 and a message area 503 are secured, and the EXIT touch button 414, the PREV. touch button 415, the NEXT touch button 416, and the DENOMI display area 412 are displayed.

In the message area 503, the display is conducted in the system font. In addition, the message area 503 is linked with the control panel 30 or the control panel 460. Accordingly, even when bet patterns are changed and values are changed, switching to appropriate displays in accordance therewith is conducted.

As shown in the table in FIG. 90, when a player touches or presses down the EXIT touch button 414 or the HELP button on the control panel, the lower side image display panel 141 in the HELP specification shifts to the base game screen. When a player touches or presses down the PREV. touch button 415 or a BET×1 button on the control panel, the lower side image display panel 141 in the HELP specification shifts to the previous HELP page. When a player touches or presses down the NEXT touch button 416 or a BET×2 button on the control panel, the lower side image display panel 141 in the HELP specification shifts to the next HELP page.

[Placement of Screen Touch Buttons]

The HELP specification in the slot machine 1 is as described above. Next, with reference to FIG. 91A to FIG. 93, placement of the screen touch buttons in the slot machine 1 will be described. Each of FIG. 91A to FIG. 93 is a diagram explaining the placement of the screen touch buttons in the slot machine according to the first embodiment of the present invention.

Figure 91A:
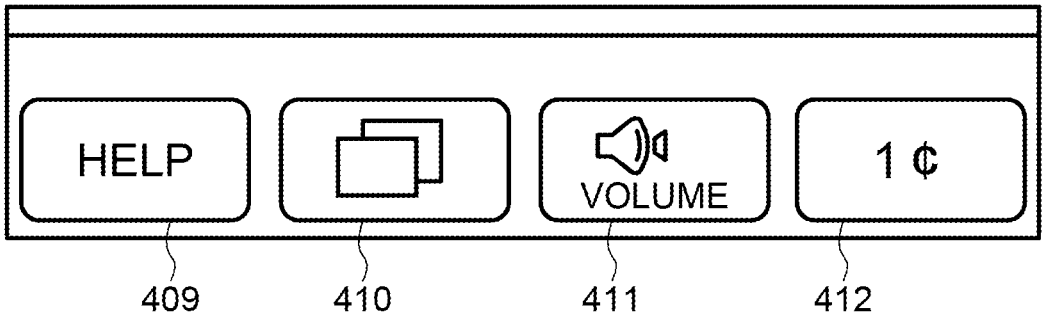
FIG. 91A is a diagram first explaining the placement of screen touch buttons in the slot machine according to the first embodiment of the present invention.
Figure 91B:
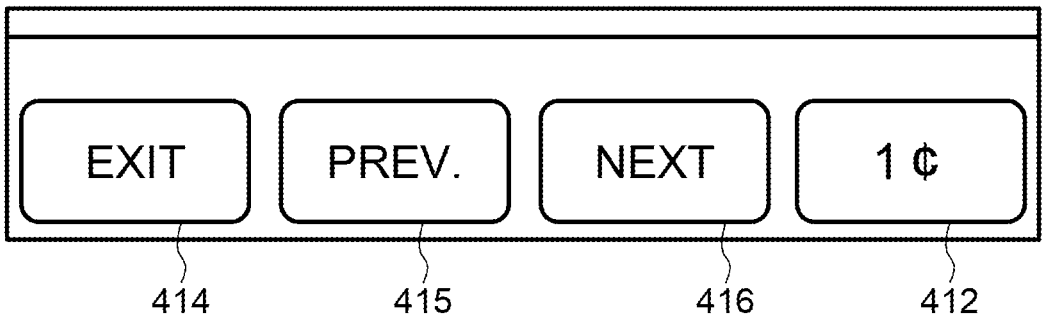
FIG. 91B is a diagram first explaining the placement of screen touch buttons in the slot machine according to the first embodiment of the present invention.
Figure 91C:
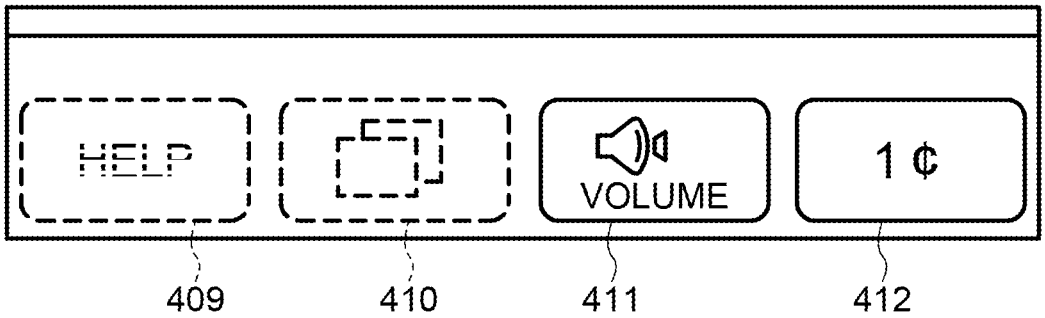
FIG. 91C is a diagram first explaining the placement of screen touch buttons in the slot machine according to the first embodiment of the present invention.
Figure 91D:
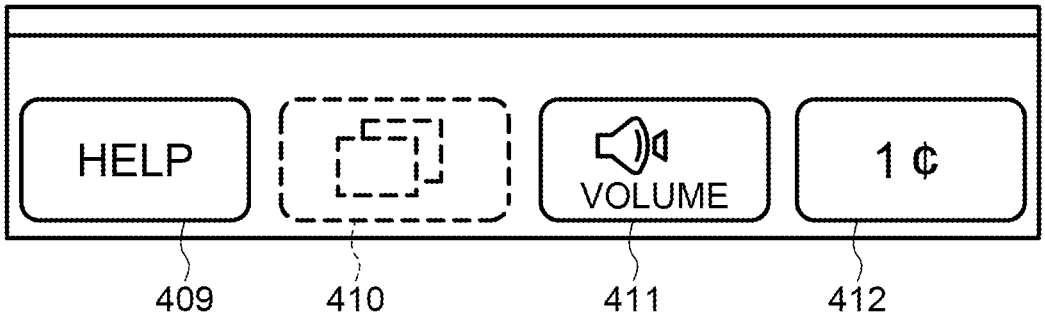
FIG. 91D is a diagram first explaining the placement of screen touch buttons in the slot machine according to the first embodiment of the present invention.
Figure 92A:
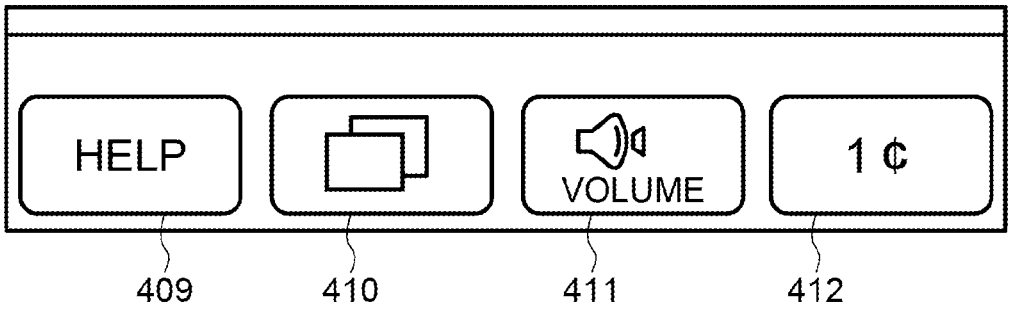
FIG. 92A is a diagram explaining the placement of the screen touch buttons in the slot machine according to the first embodiment of the present invention.
Figure 92B:
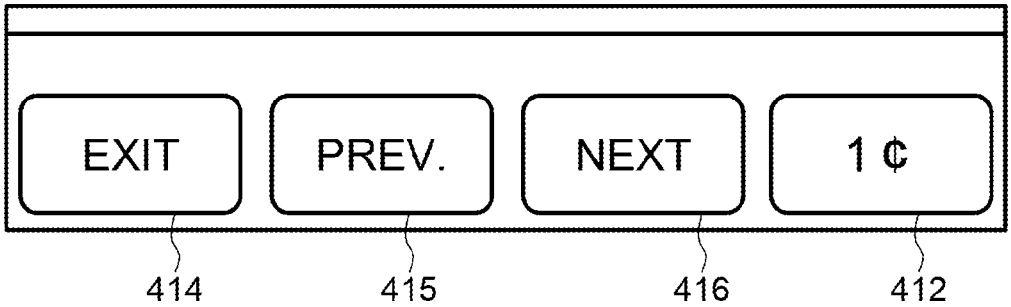
FIG. 92B is a diagram explaining the placement of the screen touch buttons in the slot machine according to the first embodiment of the present invention.
Figure 92C:
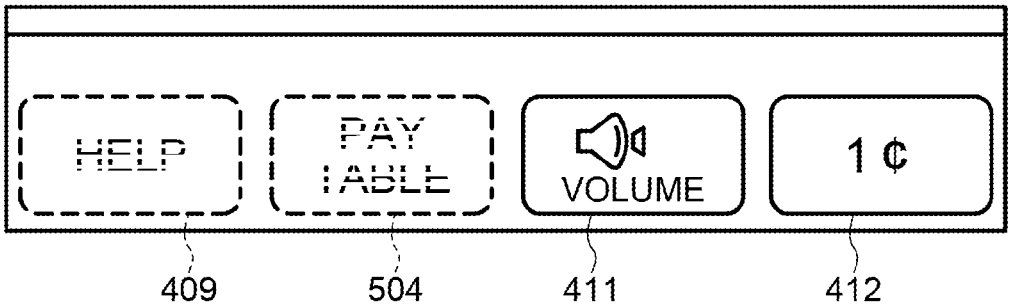
FIG. 92C is a diagram explaining the placement of the screen touch buttons in the slot machine according to the first embodiment of the present invention.
Figure 92D:
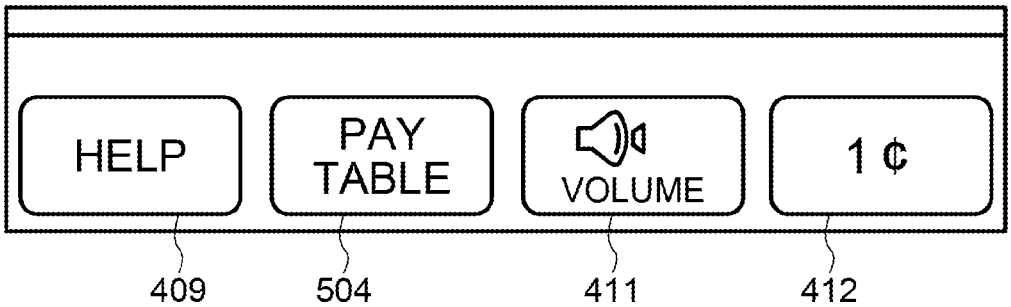
FIG. 92D is a diagram explaining the placement of the screen touch buttons in the slot machine according to the first embodiment of the present invention.

FIG. 91A shows the placement of the screen touch buttons during IDLE. FIG. 91B shows the placement of the screen touch buttons during HELP. FIG. 91C shows the placement of the screen touch buttons during a game. FIG. 91D shows the placement of the screen touch buttons in a state of GAMBLE or TAKE WIN. FIG. 92A shows the placement of the screen touch buttons during IDLE (with the language switch being inactive). FIG. 92B shows the placement of the screen touch buttons during HELP (with the language switch being inactive). FIG. 92C shows the placement of the screen touch buttons during a game (with the language switch being inactive). FIG. 92D shows the placement of the screen touch buttons in a state of GAMBLE or TAKE WIN (the state in which the language switch is inactive).

In the placement of the screen touch buttons in the slot machine 1, the HELP touch button 409, the language switch touch button 410, the sound volume switch touch button 411, the DENOMI display area 412, the EXIT touch button 414, the PREV. touch button 415, and the NEXT touch button 416 are placed. In particular, in the state in which the language switch is inactive, during the game or in the state of GAMBLE or TAKE WIN, as shown in FIGS. 92A and 92D, a PAY TABLE touch button 504 is placed. As shown in FIG. 93, these touch buttons are active when being lit up and inactive when lit down.

[Sound Volume Switch Touch Button]

Figure 94:
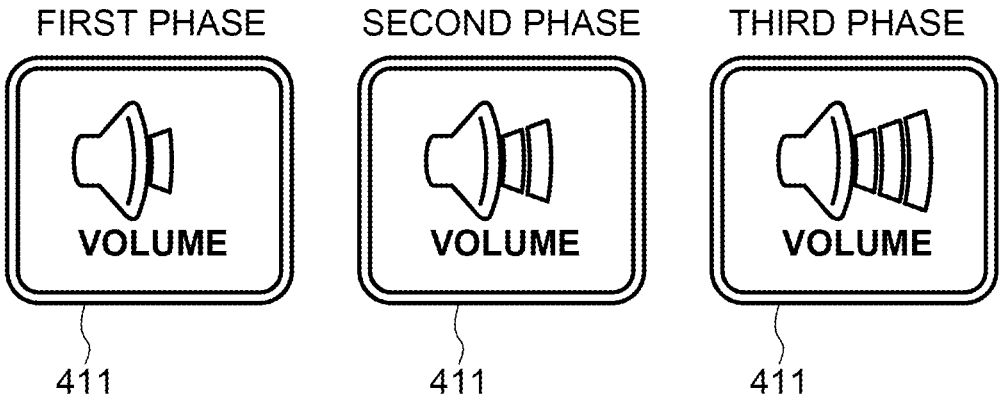
FIG. 94 is a diagram explaining a sound volume switch touch button in the slot machine according to the first embodiment of the present invention.
Figure 95:
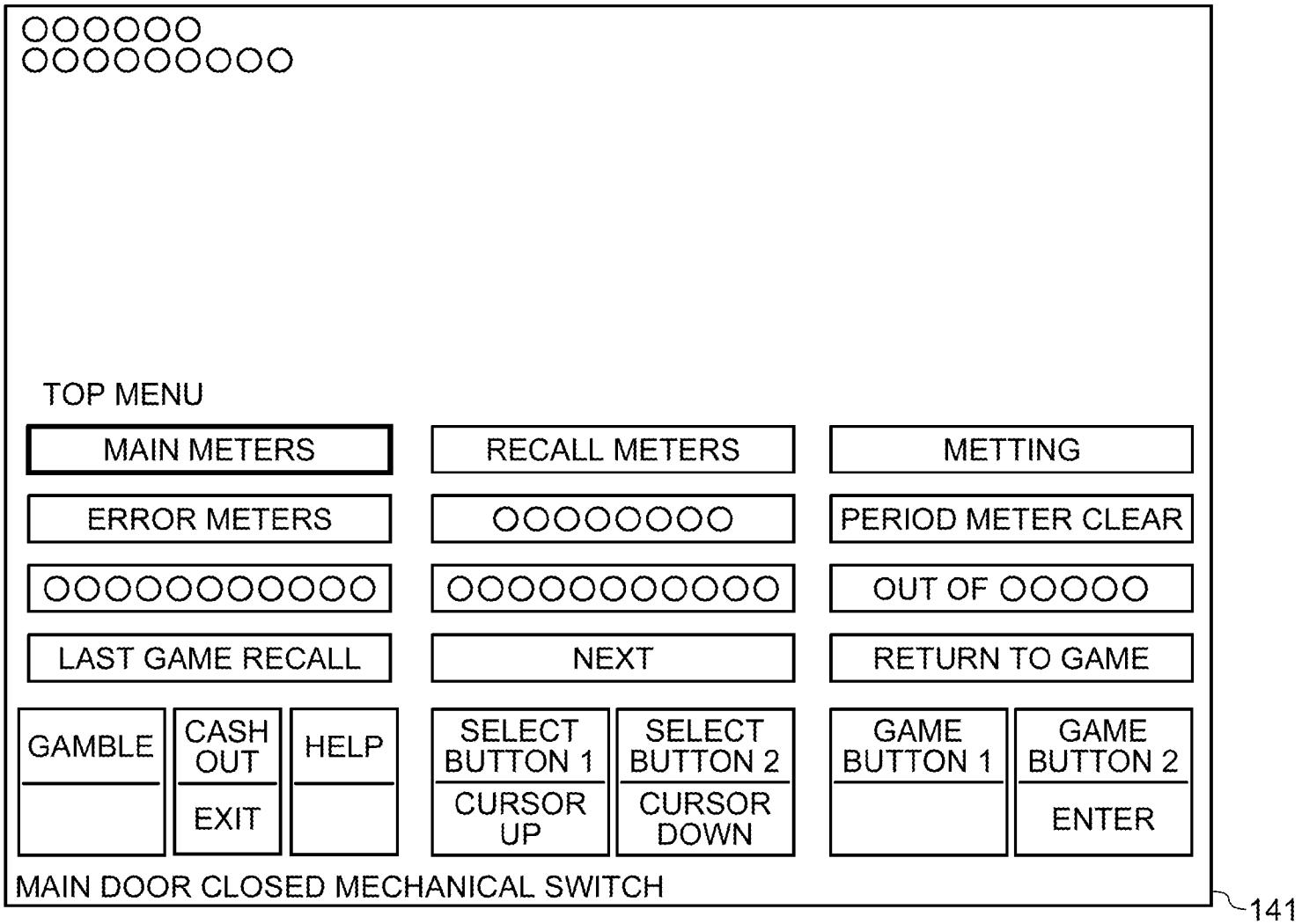
FIG. 95 is a diagram explaining an AUDIT national flag switch setting specification in the slot machine according to the first embodiment of the present invention.
Figure 96:
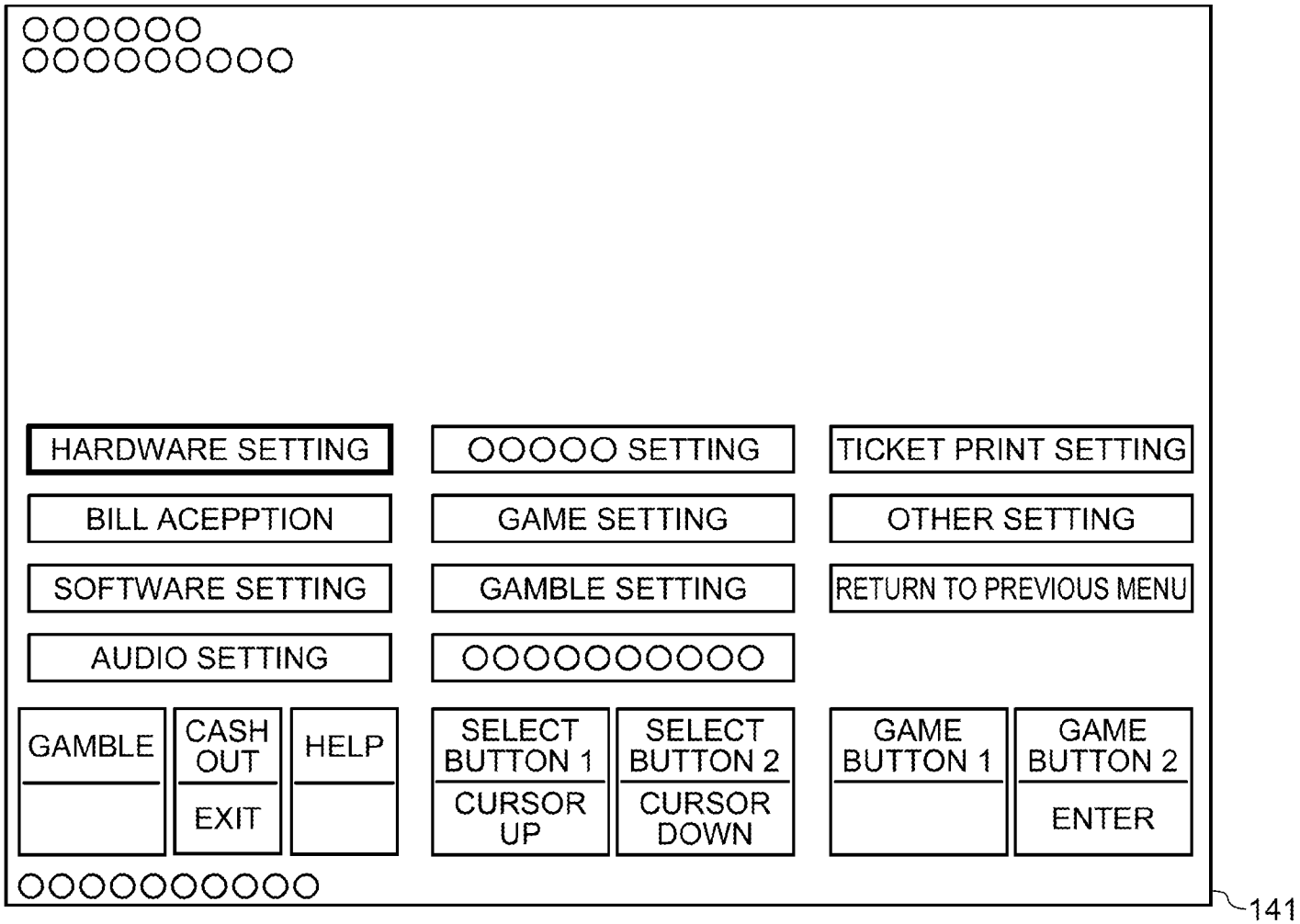
FIG. 96 is a diagram explaining the AUDIT national flag switch setting specification in the slot machine according to the first embodiment of the present invention.
Figure 97:
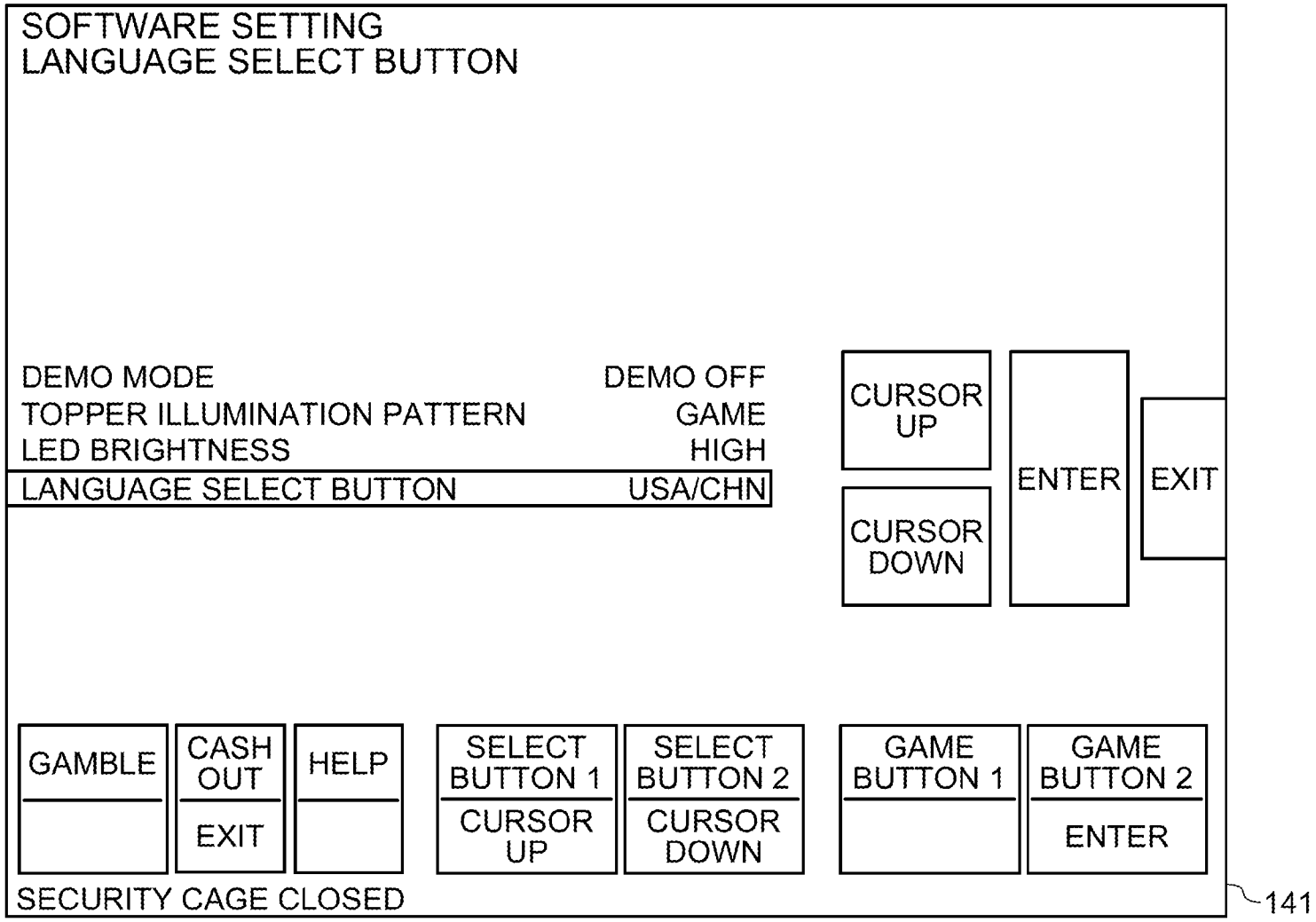
FIG. 97 is a diagram explaining the AUDIT national flag switch setting specification in the slot machine according to the first embodiment of the present invention.
Figure 98:
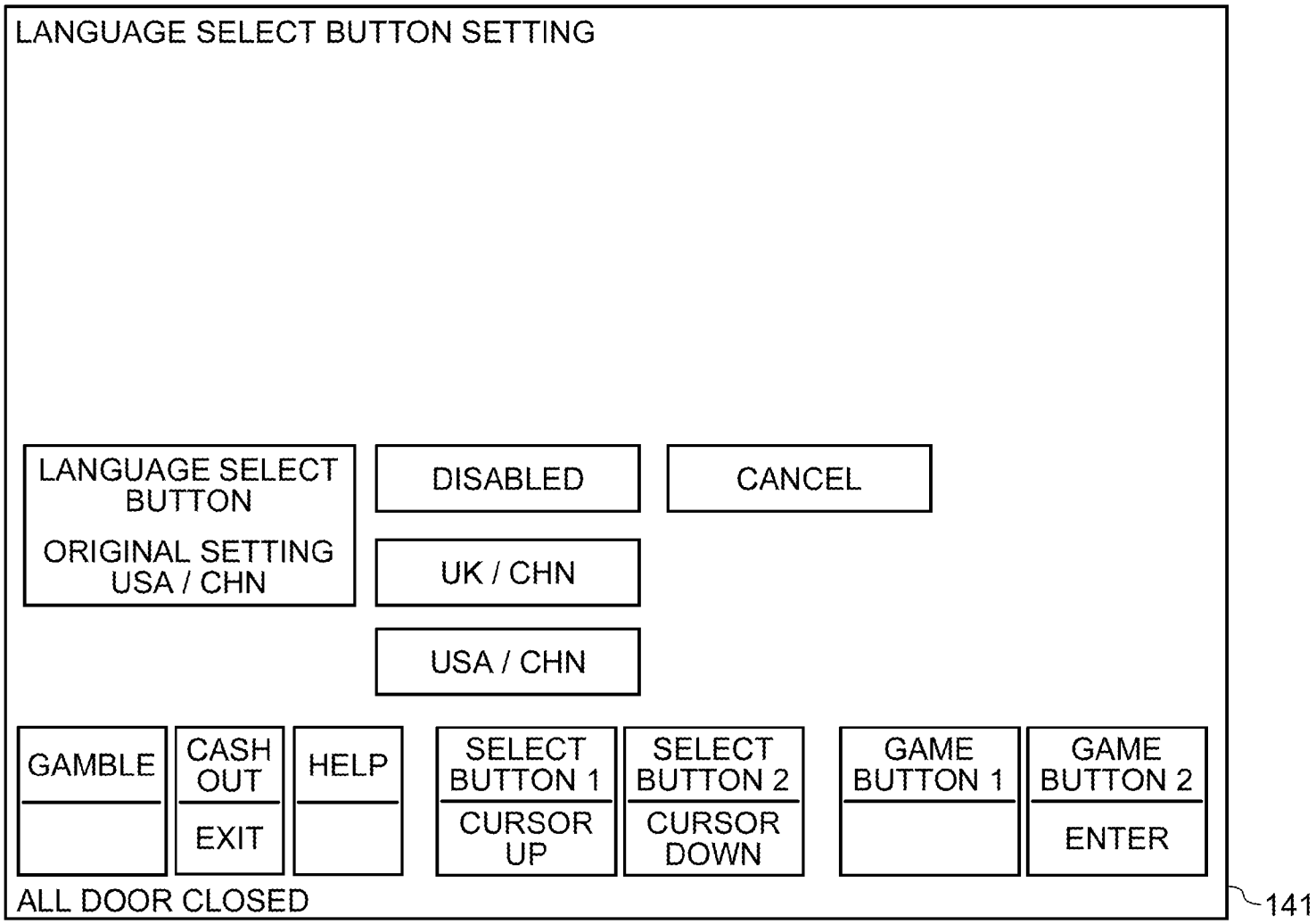
FIG. 98 is a diagram explaining the AUDIT national flag switch setting specification in the slot machine according to the first embodiment of the present invention.

The placement of the screen touch buttons in the slot machine 1 is as described above. Next, with reference to FIG. 94, the sound volume switch touch button 411 in the slot machine 1 will be described. FIG. 94 is a diagram explaining the volume switch touch button in the slot machine according to the first embodiment of the present invention. As shown in FIG. 94, the sound volume switch touch button 411 has three adjustment phases: in the first phase, a minimum sound volume is applied; in the second phase, a middle sound volume is applied; and in the third phase, a maximum sound volume is applied. A default setting among the phases is the minimum sound volume in the first phase. Each of the phases is shifted in a looped manner such that each time a player touches the sound volume switch touch button 411, the middle sound volume in the second phase is applied; then, the maximum sound volume in the third phase is applied; then, the minimum sound volume in the first phase is applied; then, the middle sound volume in the second phase is applied.

[AUDIT National Flag Switch Setting Specification]

The sound volume switch touch button in the slot machine 1 is as described above. Next, with reference to FIG. 95 to FIG. 98, an AUDIT national flag switch setting specification in the slot machine 1 will be described. Each of FIG. 95 to FIG. 98 is a diagram explaining the AUDIT national flag switch setting specification in the slot machine according to the first embodiment of the present invention. In the AUDIT national flag switch setting specification in the slot machine according to the first embodiment of the present invention, the designation of "national flag" displayed on the language switch touch button 410 upon switching a language can be conducted by making a setting on the AUDIT MENU on the lower side image display panel 141 shown in FIG. 95 to FIG. 98. As the "national flag" displayed on the language switch touch button 410, there are national flags of US, UK, and CHN.

Second Embodiment

A second embodiment relates to a gaming machine (slot machine) having a jackpot function. The second embodiment has a configuration common to that of the first embodiment other than a part of the configuration described below, and processes common to those in the first embodiment other than a part of the processes described below are executed.

In the second embodiment, a jackpot is the so-called stand-alone progressive jackpot. In other words, each accumulated money amount (increment value) is individually set for each of the plurality of gaming machine. Accordingly, it is not necessary to manage the occurrence of a jackpot and each accumulated money amount by using a management device such as the external control apparatus 200 via the communication line 301. However, each accumulated money amount accumulated in each of the plurality of gaming machines, the occurrence of a jackpot, and the like, which are related to a jackpot, may be managed in a centralized manner by using a management device such as the external control apparatus 200. Thus, the management can be made easy and the detection of fraudulent acts can be made easy.

In the conventional gaming machine, a money amount based on the number of BETs (BET amount) placed each time is defined as an accumulated money amount for a jackpot. In other words, the larger the number of BETs is, the higher a money amount is accumulated. Therefore, a money amount to be accumulated is calculated based on the number of BETs placed each time and is stored as the accumulated money amount. For example, the calculation of the accumulated money amount is performed each time betting is conducted as follows: accumulated money amount←accumulated money amount+the number of BETs×the number of winning lines targeted for betting×denomination×percentage, and the accumulated money amount is stored.

For example, when the number of BETs is one, 0.5 dollar×1.0%=0.005 dollar is accumulated each time betting is conducted. In this example, the calculation is performed as follows: the number of BETs×the number of winning lines targeted for betting×denomination=0.5 dollar.

When the number of BETs is two, 1 dollar×1.0%=0.01 dollar is accumulated each time betting is conducted. In this example, the calculation is performed as follows: the number of BETs×the number of winning lines targeted for betting×denomination=1 dollar.

When the number of BETs is three, 1.5 dollars×1.0%=0.015 dollar is accumulated each time betting is conducted. In this example, the calculation is performed as follows: the number of BETs×the number of winning lines targeted for betting×denomination=1.5 dollars.

When the number of BETs is five, 2.5 dollars×1.0%=0.025 dollar is accumulated each time betting is conducted. In this example, the calculation is performed as follows: the number of BETs×the number of winning lines targeted for betting×denomination=2.5 dollars.

When the number of BETs is 10, 5.0 dollars×1.0%=0.05 dollar is accumulated each time betting is conducted. In this example, the calculation is performed as follows: the number of BETs×the number of winning lines targeted for betting×denomination=5.0 dollars.

As shown in the above-described examples, in the conventional gaming machine, each time betting is conducted, when the number of BETs is large, the accumulation is conducted with an accumulated money amount being high, and when the number of BETs is small, the accumulation is conducted with an accumulated money amount being low.

Further, when winning of a jackpot occurs, in addition to the accumulated money amount, a base money amount is added thereto, thereby conducting a payout. In the conventional gaming machine, upon winning a jackpot, the base money amount is also multiplied by the number of BETs, and the resultant is added to the accumulated money amount, thereby conducting a payout.

For example, when the number of BETs is one, the multiplication of a base money amount is performed as follows: 100 dollar (=100 dollar×1); when the number of BETs is two, the multiplication of the base money amount is performed as follows: 200 dollar (=100 dollar×2); when the number of BETs is three, the multiplication of the base money amount is performed as follows: 300 dollar (=100 dollar×3); when the number of BETs is five, the multiplication of the base money amount is performed as follows: 500 dollar (=100 dollar×5); and when the number of BETs is ten, the multiplication of the base money amount is performed as follows: 1000 dollar (=100 dollar×10).

Accordingly, when 12.5 dollars is accumulated at the time point when a jackpot is won in the conventional gaming machine and the number of BETs is one, 12.5 dollars+100 dollars=112.5 dollars is paid out. Similarly, when the number of BETs is two, 12.5 dollars+200 dollars=212.5 dollars is paid out; when the number of BETs is three, 12.5 dollars+300 dollars=312.5 dollars is paid out; when the number of BETs is five, 12.5 dollars+500 dollars=512.5 dollars is paid out; and when the number of BETs is 10, 12.5 dollars+1000 dollars=1012.5 dollars is paid out. As described above, the payout is conducted such that the larger the number of BETs is, the higher both of the accumulated money amount and the base money amount are, and the smaller the number of BETs is, the lower the both of the accumulated money amount and the base money amount are.

In the conventional gaming machine, each money amount based on the number of BETs each time betting is conducted is accumulated and made an accumulated money amount, and upon winning a jackpot, the calculation with respect to a base money amount is also performed based on the number of BETs to obtain a money amount to be paid out, thereby conducting a payout.

It is preferable that a player is provided with a benefit in accordance with an investment made by the player by paying out a large amount of a jackpot to a player who is proceeding with a game by placing a large number of BETs and by paying out a small amount of a jackpot to a player who is proceeding with a game by placing a small number of BETs.

However, in the conventional gaming machine, when a player who has continued to make an investment in the expectation of winning a jackpot does not win a jackpot while playing a game, despite the investment made until then, no benefit can be provided for the player. Furthermore, it is likely to provide a benefit awarded by a jackpot for another player who thereafter starts a game. Therefore, unfairness may result between a player who has made an investment and a player who has not made an investment.

Further, in the conventional gaming machine, since each money amount accumulated by using the number of BETs each time betting is conducted is added and stored, a complicated process is executed.

In consideration of the conventional gaming machine described above, the gaming machine according to the second embodiment was made. In the gaming machine according to the second embodiment, each accumulated money amount is the same money amount independent of the number of BETs placed by a BET operation (part (a) of FIG. 99).

In part (a) of FIG. 99, each of AAA, BBB, CCC, DDD, and EEE is a numerical value indicating a money amount and shows a total sum of money amounts accumulated until then. As shown in part (a) of FIG. 99, for each of a lion, a tiger, a panther, a leopard, and a cheetah, the same accumulated money amounts with respect to 1 BET, 2 BETs, 3 BETs, 5 BETs, and 10 BETs, are accumulated. Part (a) of FIG. 99 is a diagram conceptually illustrating the accumulated money amounts stored in the RAM 73. Each of these respective accumulated money amounts is updated each time betting is conducted.

Upon the occurrence of a jackpot (part (b) of FIG. 99), a player can obtain a money amount calculated by multiplying a total sum of a gross amount (progressive money amount) of the accumulated money amounts accumulated until then and a jackpot money amount by the number of BETs (part (c) of FIG. 99). In the gaming machine according to the second embodiment, symbols of one of the kinds of the character symbols are rearranged on the display, and at this timing, a jackpot occurs (part (b) of FIG. 99).

As described above, upon winning a jackpot, based on the number of BETs, the accumulated money amount and the base money amount are calculated together, thereby allowing the process to be made easy. In addition, each of the respective accumulated money amounts is the same independently of the number of BETs placed by the BET operation, whereby the unfairness which may result between a player who has made an investment and a player who has not made an investment can be made small.

In the second embodiment, BET/LINE, that is, the number of BETs per payline is referred to as the number of BETs. Accordingly, a total number of BETs is a number calculated multiplying the numbers of the paylines by the numbers of BETs. For example, a player can start a slot game by selecting any of numbers 1, 2, 3, 4, or 5 as the number of BETs in each unit game. For example, when 4 is selected as the number of BETs, the number of credits, which is 4, is bet per payline. Accordingly, the total number of BETs is a number calculated by multiplying the numbers of paylines by 4.

In addition, in the second embodiment, all of the paylines are targeted for betting. For example, there are 50 paylines and these 50 paylines are invariably targeted for betting. Accordingly, when 3 is selected as the number of BETs, the number of BETs per payline is 3. In this unit game, 50×3=150 is bet as the total numbers of BETs, and a unit game is started.

In the second embodiment, a money amount, as a money amount for accumulating, which is smaller than a money amount corresponding to a minimum number of BETs is previously set. This money amount is constant even when the number of BETs per line is large or even when the number of BETs per line is small, accumulation and addition of the money amount are performed each time a player operates any of BET buttons.

In other words, although the money amount which is accumulated each time betting is conducted is the same irrespective of the number of BETs, an accumulated money amount which is finally awarded by a jackpot becomes a money amount in accordance with the number of BETs. Accordingly, the larger the number of BETs is, the larger the finally paid-out accumulated money amount is, and the smaller the number of BETs is, the smaller the finally paid-out accumulated money amount is.

<<Setting of BET CONFIG.>>

In the gaming machine according to the second embodiment, BET CONFIG. can be set. The BET CONFIG. is to set BET/LINE combinations. For example, in a first BET CONFIG., a combination of BET/LINE is a combination of 1, 2, 3, 4, and 5. In a second BET CONFIG, a combination of BET/LINE is a combination of 1, 2, 3, 5, and 10. In a third BET CONFIG., a combination of BET/LINE is a combination of 1, 2, 5, 10, and 15. In a fourth BET CONFIG., a combination of BET/LINE is a combination of 1, 2, 5, 10, and 20.

For example, when the third BET CONFIG is set, a player selects any one of 1, 2, 5, 10, or 15 as the number of BETs and can start a unit game.

The BET CONFIG. is set by an operation conducted by an employee of a gaming arcade such as a casino. For example, upon activating a gaming machine or the like, an employee of a casino or the like sets the BET CONFIG. Setting of the BET CONFIG. can be made by operating a variety of buttons located on the control panel 30.

The BET CONFIG. can also be set by a management device such as the external control apparatus 200. A gaming machine is communicably connected to the management device such as the external control apparatus 200 via a network. By using the management device to set the BET CONFIG., the setting can be made collectively and easily.

Figure 100:
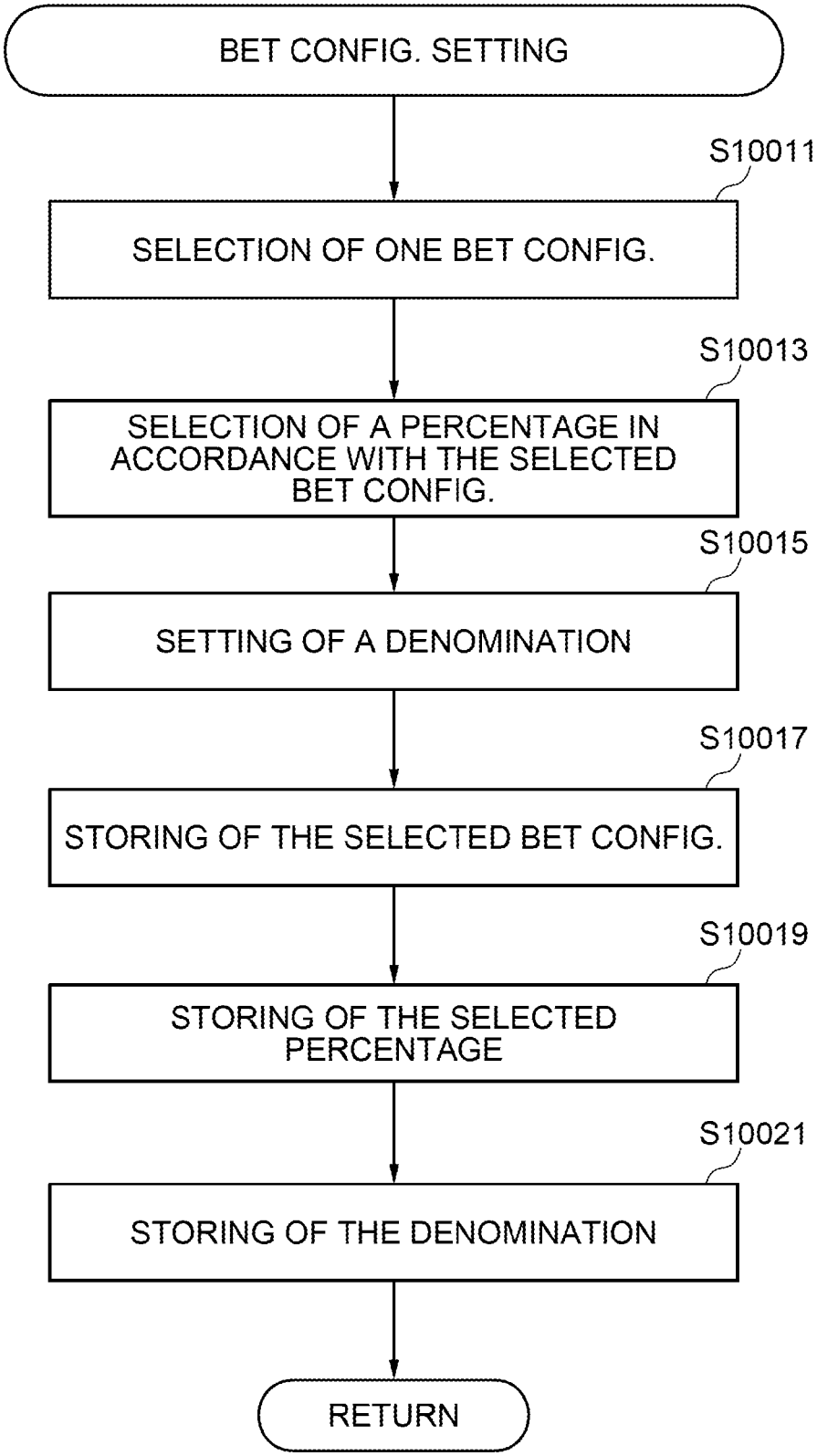
FIG. 100 is a flowchart showing a procedure of a process related to the BET CONFIG.

FIG. 100 is a flowchart showing a procedure of a process related to the BET CONFIG. In this process, an operation conducted by an employee of a gaming arcade is partly included. However, since all thereof can be processed by the management device such as the external control apparatus 200, the gaming machine, or the like, the procedure of the process is shown as a serial flowchart.

First, one BET CONFIG. is selected (step S10011). As described above, one BET CONFIG. is selected by the operation conducted by an employee of a gaming arcade such as a casino, or by using the management device such as the external control apparatus 200, or the like. In the gaming machine according to the second embodiment, one BET CONFIG. is selected from among the above-mentioned first BET CONFIG. to the fourth BET CONFIG.

Next, in accordance with the selected BET CONFIG., a percentage is determined (step S10013). In the second embodiment, an increment percentage of a jackpot is referred to the percentage. Each money amount in accordance with this percentage is accumulated each time betting is conducted. As described above, each of the accumulated money amounts is independent of the number of BETs. The further details will be described in the description of a process shown in FIG. 103.

In the second embodiment, each percentage can be determined in accordance with the BET CONFIG. FIG. 101A is a table showing a relationship between each BET CONFIG. and each selectable percentage. When the first BET CONFIG. (1, 2, 3, 4, and 5) is selected, only 0.6% and 1.2% can be selected. When the second BET CONFIG. (1, 2, 3, 5, and 10) is selected, all of 0.3%, 0.6%, 0.9%, and 1.2% can be selected. When the third BET CONFIG. (1, 2, 5, 10, and 15) is selected, all of 0.3%, 0.6%, 0.9%, and 1.2% can be selected. When the fourth BET CONFIG. (1, 2, 5, 10, and 20) is selected, only 0.6% and 1.2% can be selected.

The selection of each percentage is also set by an operation conducted by an employee of a gaming arcade such as a casino. For example, upon activating the gaming machine, the employee of a casino sets each percentage together with the setting of the BET CONFIG.

As with the BET CONFIG., each percentage can also be set by using the management device such as the external control apparatus 200. By using the management device to set each percentage, the setting can be made collectively and easily.

FIG. 101B is a table showing a relationship of each percentage per BET/LINE. For example, when a percentage is 0.6% and a maximum number of BETs in the BET CONFIG. is 5, a percentage per BET/LINE is 0.6/5=0.12.

A percentage which cannot be selected (each cell indicated by a x mark) in FIG. 101A is a value of a percentage per BET/LINE whose number of digits after the decimal point cannot fall within two digits. Specifically, in FIG. 101B, when a percentage is 0.3% and a maximum number of BETs in the BET CONFIG. is 4 or 20 (0.075 or 0.015) or when a percentage is 0.9% and a maximum number of BETs in the BET CONFIG. is 4 or 20 (0.225 or 0.045), the number of digits after the decimal point cannot fall within the two digits. As described above, each percentage which cannot be selected is determined, thereby preventing a likelihood with which errors may be caused and allowing a disadvantage depending on BET/LINE not to be brought about.

Next, a denomination is set (step S10015). In the second embodiment, a money amount per coin (per credit) is referred to as the denomination. For example, the denomination can be set within a range of 0.01 dollar to 10.00 dollars.

The denomination also is set by an operation conducted by an employee of a gaming arcade such as a casino. For example, upon activating the gaming machine, the employee of a casino sets the denomination together with the setting of the BET CONFIG.

As with the BET CONFIG., the denomination can also be set by using the management device such as the external control apparatus 200. By using the management device to set the denomination, the setting can be made collectively and easily.

The BET CONFIG. selected in the process at step S10011 is stored in a predetermined region of the RAM 73 (step S10017).

Next, the percentage selected in the process at step S10013 is stored in a predetermined region of the RAM 73 (step S10019).

Next, the denomination set in the process at step S10015 is stored in a predetermined region of the RAM 73 (step S10021).

In the above-described example, a case where the BET CONFIG., the percentage, and the denomination are set by an employee of a gaming arcade such as a casino or by using the management device such as the external control apparatus 200 is described. However, the settings may be made by a player, thereby allowing a player to play a game under his or her desired conditions.

<<Jackpot-Related Process>>

Figure 103:
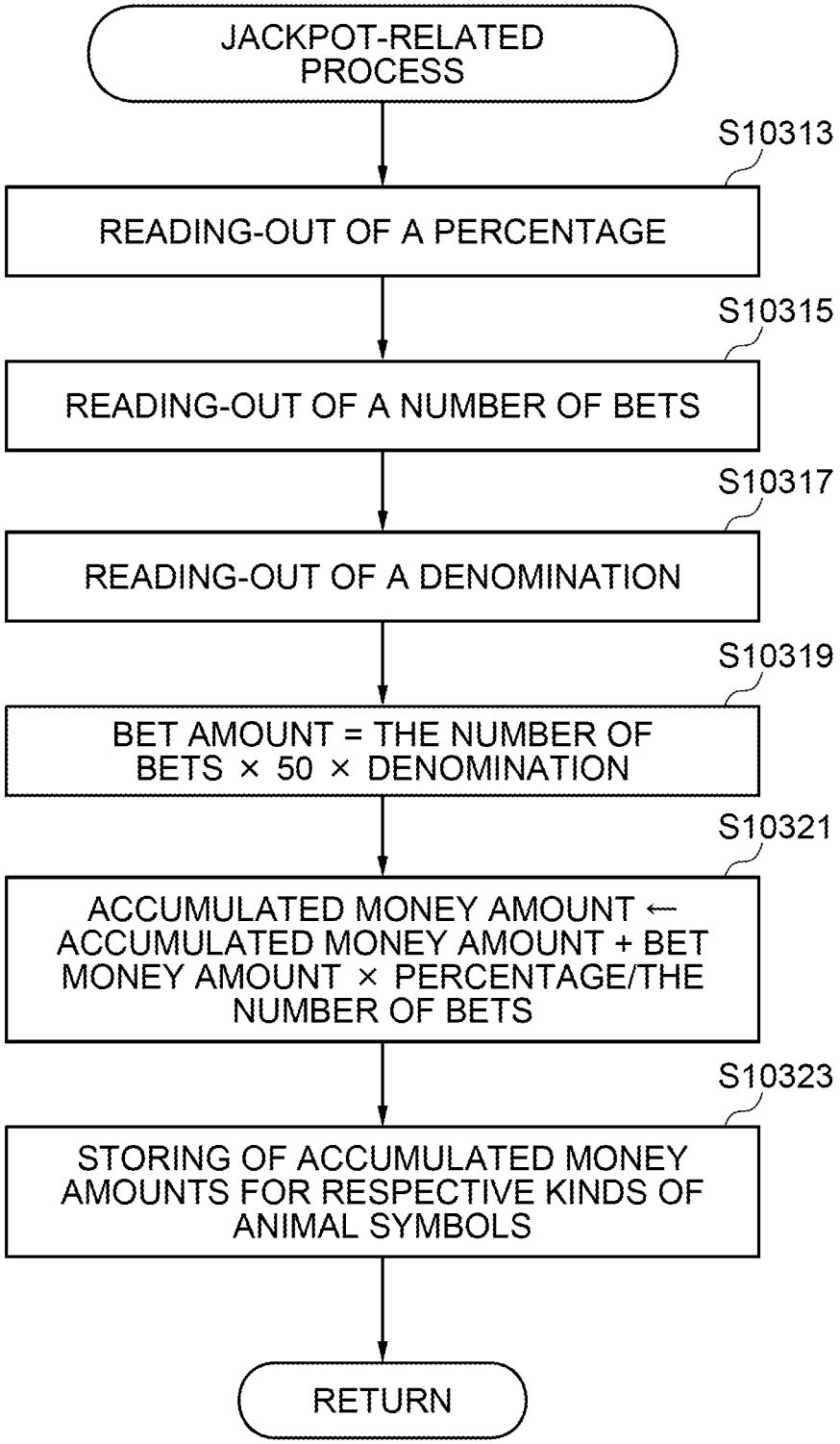
FIG. 103 is a flowchart showing a jackpot-related process.

FIG. 103 is a flowchart showing a jackpot-related process. The jackpot-related process is called up at step S51 in the flowchart shown in FIG. 33 and is executed. Accordingly, each time the bet operation is performed, this jackpot-related process is executed. Therefore, when the base game of the slot game is played, the jackpot-related process is invariably executed. However, as shown in FIG. 40, when the free games of the slot game are played, the jackpot-related process is not called up and not executed.

First, the percentage stored in the RAM 73 is read out (step S10313). This percentage has been stored in the RAM 73 by the process at step S10019 in FIG. 100.

Next, the main CPU 71 reads out a value stored in a number-of-BET counter (step S10315). This allows the number of BETs to be obtained.

Next, the main CPU 71 reads out a denomination (step S10317). This allows the number of BETs to be obtained. This denomination has been stored in the RAM 73 by the process at step S10021 in FIG. 100.

Next, the main CPU 71 calculates a BET money amount (step S10319). The BET money amount can be calculated as follows: BET money amount=the number of BETs×the number of paylines targeted for betting×denomination. As described above, in the second embodiment, the paylines targeted for betting are all of the paylines and specifically, the number thereof is 50 lines. Accordingly, the calculation can be made as follows: BET money amount=the number of BETs×50×denomination.

Next, the main CPU 71 accumulates the accumulated money amount (step S10321). The accumulated money amount can be accumulated as follows: accumulated money amount←accumulated money amount+BET money amount×percentage/the number of BETs. As described above, when the accumulated money amount is accumulated, since the division by the number of BETs is performed, a constant money amount can be accumulated as the accumulated money amount independent of the number of BETs.

In the second embodiment, BET money amount×percentage/the number of BETs is referred to as a progressive money amount. Specifically, the progressive money amount is a value calculated as follows: "the number of paylines×the number of BETs×denomination×percentage/the number of BETs".

For example, when the number of BETs is one, that is, when the number of BETs (BET/LINE) per payline is one, a percentage is 0.6%, and a denomination is 1 cent, a progressive money amount is calculated as follows: 50 (lines)×1 (the number of BETs)×1 (cent)×0.006 (percentage)/1 (the number of BETs)=0.3 cent. This 0.3 cent is accumulated each time betting is conducted.

In addition, when the number of BETs is 10, that is, when the number of BETs (BET/LINE) per payline is 10, a percentage is 0.6%, and a denomination is 1 cent, a progressive money amount is calculated as follows: 50 (lines)×10 (the number of BETs)×1 (cent)×0.006 (percentage)/10 (the number of BETs)=0.3 cent. This 0.3 cent is accumulated each time betting is conducted.

As described above, even when the number of BETs is one and even when the number of BETs is 10, the same amount 0.3 cent is each accumulated. In this way, in the second embodiment, since an amount obtained by the division by the number of BETs is defined as the progressive money amount, a constant money amount can be each accumulated independently of the number of BETs.

In the above-described example, the case in which the BET money amount is calculated at step S10319 and the accumulated money amount is each accumulated at step S10321 is described. However, the accumulated money amount may be accumulated at once. For example, the accumulated money amount may be as follows: the accumulated money amount←accumulated money amount+the number of paylines targeted for betting×denomination×percentage. As described above, in the expression: the number of paylines targeted for betting×denomination×percentage, the number of BETs is not included, and the accumulated money amount is constant and is a money amount accumulated each time betting is conducted.

Next, the main CPU 71 stores each of the accumulated money amounts accumulated at step S10321 for each of the kinds of the animals in the RAM 73 (step S10323) and finishes this subroutine.

As described later, in the second embodiment, at the timing when the symbols of one of the kinds of animals are rearranged in all of the areas of the symbol display region 4, a jackpot is won. In the second embodiment, there are the five kinds of symbols of animals: a lion, a tiger, a panther, a leopard, and a cheetah. For example, at the timing when the symbols of the lion are rearranged in all of the areas of the symbol display region 4 (refer to FIG. 106A), a jackpot is won.

In the second embodiment, in addition thereto, at the timing when the symbols of the tiger are rearranged in all of the areas of the symbol display region 4, a tiger jackpot is won; at the timing when the symbols of the panther are rearranged in all of the areas of the symbol display region 4, a panther jackpot is won; at the timing when the symbols of the leopard are rearranged in all of the areas of the symbol display region 4, a leopard jackpot is won; and at the timing when the symbols of the panther are rearranged in all of the areas of the symbol display region 4, a panther jackpot is won; at the timing when the symbols of the cheetah are rearranged in all of the areas of the symbol display region 4, a cheetah jackpot is won.

As described above, even after a jackpot has won by the symbols of one of the kinds of animals, a likelihood with which a jackpot is won by the symbols of another of the kinds of animals remains. Therefore, an incentive to continuously proceed with a game can be provided for a player.

As described above, in the second embodiment, a jackpot is generated for each of the kinds of animals. In the process at step S10323, the accumulated money amount for each of the kinds of animals is stored. In other words, a storage area in the RAM 73 is allocated for each of the kinds of animals, and each accumulated money amount is stored in each storage area, respectively (refer to part (a) of FIG. 99).

As described above, part (a) of FIG. 99 is a diagram conceptually showing each accumulated money amount stored in the RAM 73. In the second embodiment, with respect to 1 BET, 2 BETs, 3 BETs, 5 BETs, and 10 BETs, the same accumulated money amount is accumulated independently of the number of BETs, with each storage area being individually allocated. Accordingly, one storage area for each of the kinds of animals may be allocated, and each accumulated money amount of each of the kinds of animals may be stored in the RAM 73.

As described above, in the gaming machine 1, the upper side image display panel 131 is provided. In the process at step S10323, each accumulated money amount is stored in the RAM 73, and concurrently therewith, on the upper side image display panel 131, each accumulated money amount may be displayed. In this case, it is preferable that with respect to each of the lion, the tiger, the panther, the leopard, and the cheetah, each accumulated money amount is displayed, respectively. At that time point, a player can visually recognize an animal whose accumulated money amount is large and the accumulated money amount of that animal. Thus, a player is allowed to have expectations of the occurrence of a jackpot, thereby allowing a motivation to continue a game to be provided for a player.

<<Jackpot-Occurrence-Time Process>>

Figure 104:
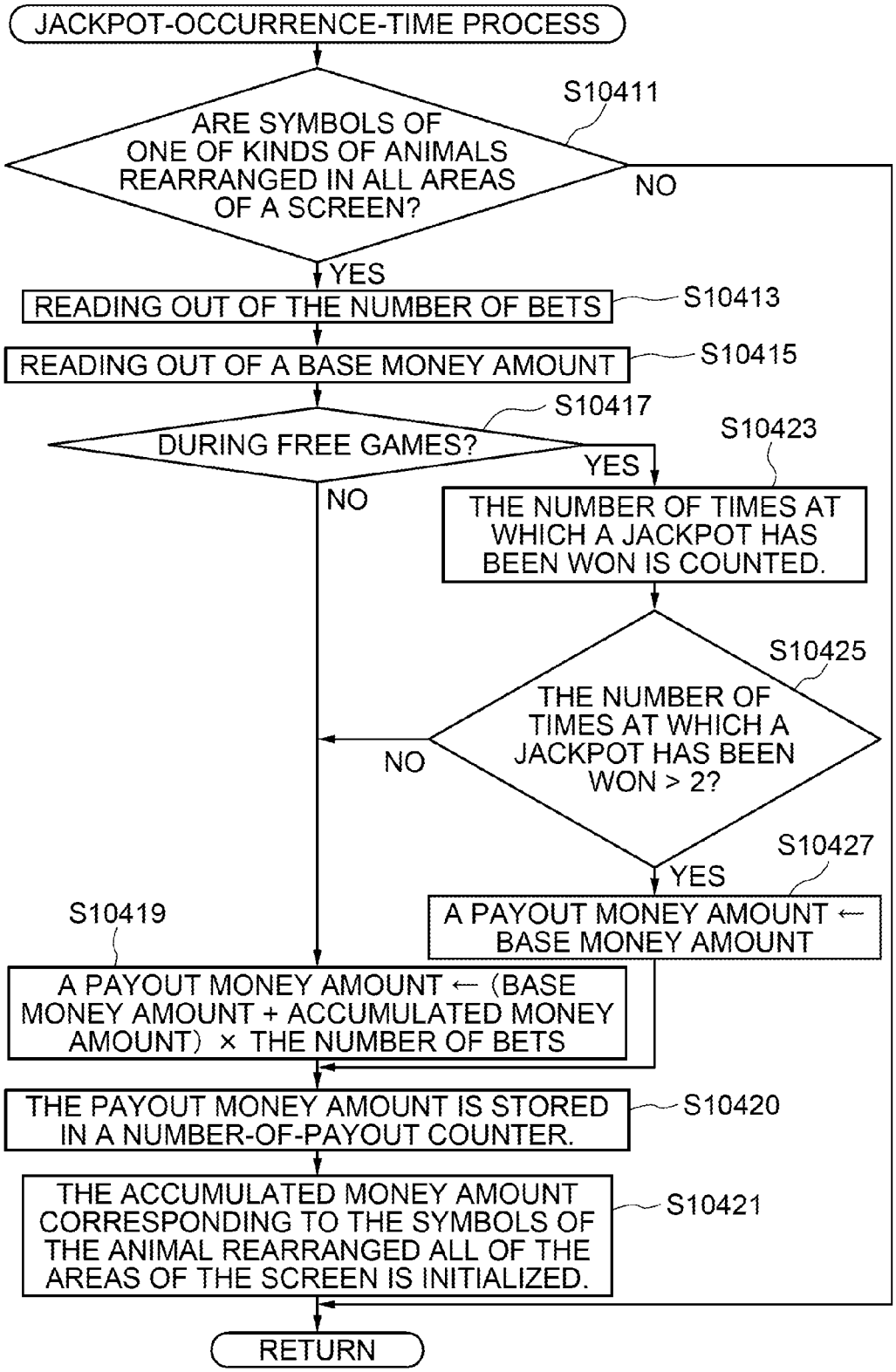
FIG. 104 is a flowchart showing a jackpot-occurrence-time process.

FIG. 104 is a flowchart showing a jackpot-occurrence-time process. The jackpot-occurrence-time process shown in FIG. 104 is called up in a process at step S254 in a number-of-payout determination process shown in FIG. 105 and is executed.

Figure 38:
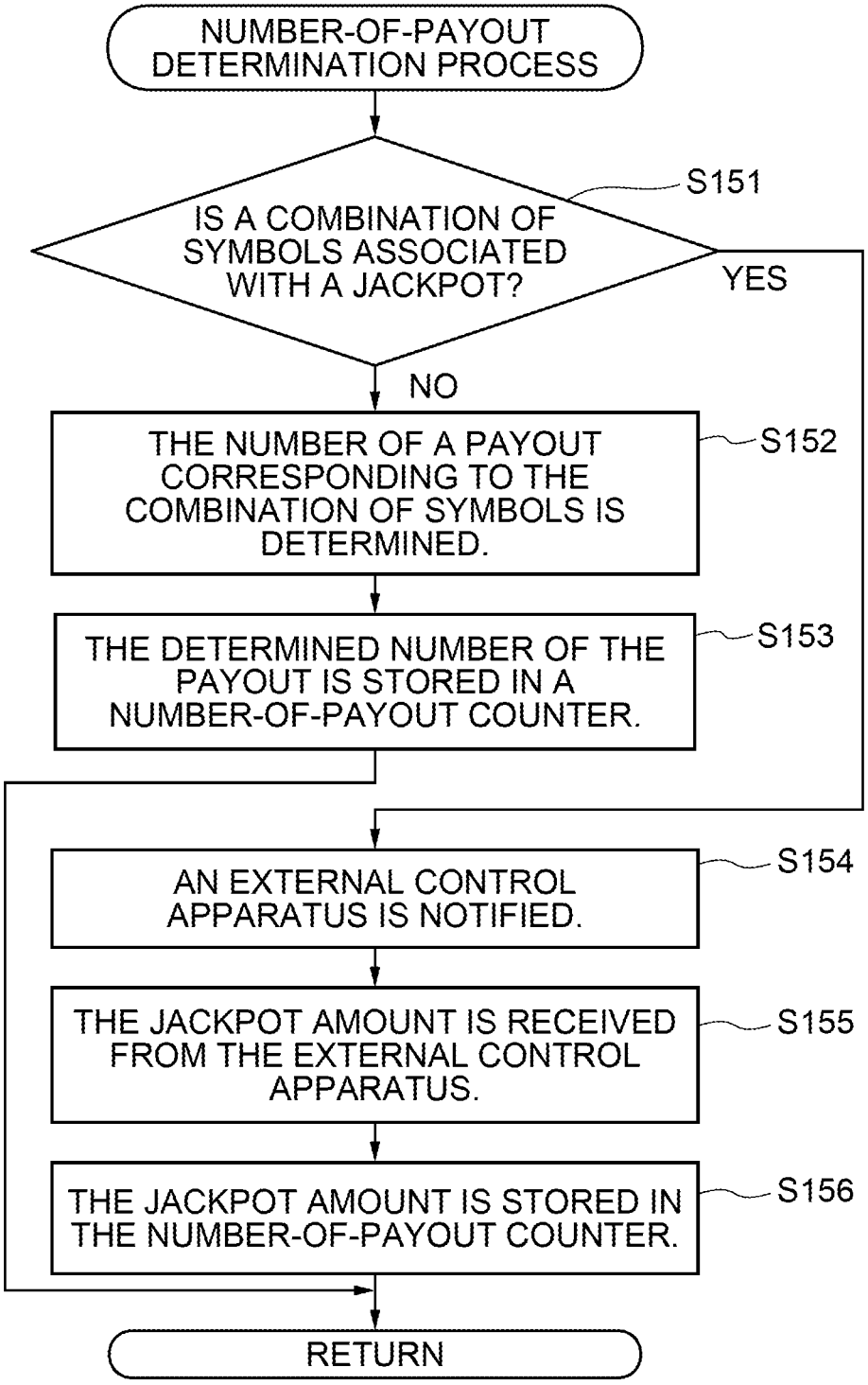
FIG. 38 shows a flowchart of a number-of-payout determination process in the slot machine according to the first embodiment of the present invention.
Figure 105:
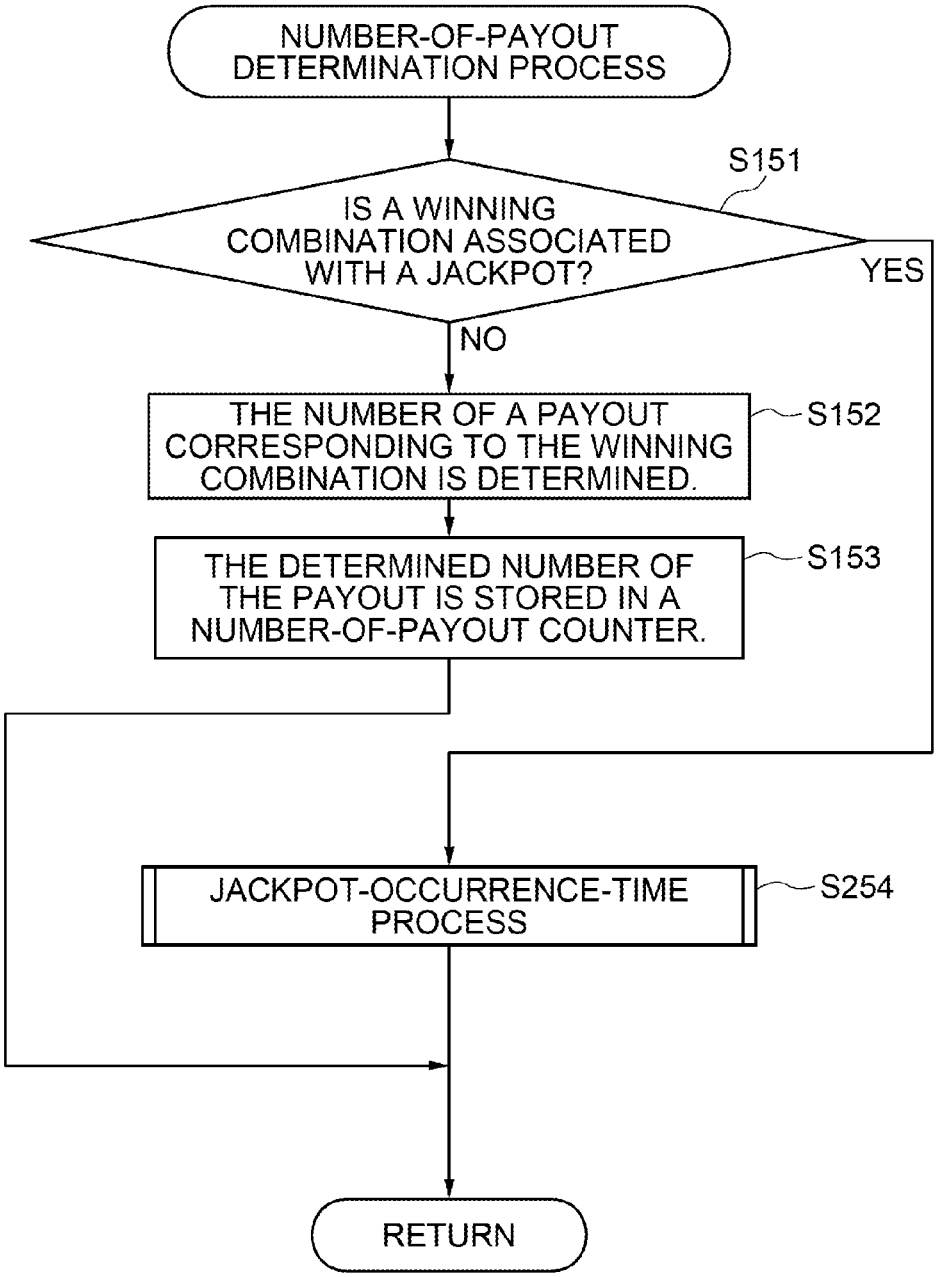
FIG. 105 is a flowchart showing a number-of-payout determination process.

The number-of-payout determination process shown in FIG. 105 is similar to the number-of-payout determination process shown in FIG. 38 in the first embodiment. The steps which are the same as those in the number-of-payout determination process shown in FIG. 38 are denoted with the same reference numerals.

When determining in a determination process at step S151 in FIG. 105 that a jackpot has occurred (YES), the main CPU 71 reads out and executes the jackpot-occurrence-time process shown in FIG. 104 (step S254). Next, the main CPU 71 finishes this subroutine. In addition, as at step S154 in FIG. 38, information pertinent to the jackpot may be transmitted to the management device such as the external control apparatus 200. Thus, the accumulated money amount accumulated on each of the gaming machines, the occurrence of a jackpot, and the like can be managed by the management device such as the external control apparatus 200.

In the second embodiment, in the determination process at step S151 in FIG. 105, it is determined whether or not symbols of one of the kinds of animals are rearranged in all of the areas of the symbol display region 4. When the symbols of one of the kinds of animals are rearranged in all of the areas of the symbol display region 4, it is determined that the jackpot has been won, whereby the jackpot occurs. Thus, a player can obtain the jackpot.

In the second embodiment, a jackpot occurs independently of the number of BETs, and a probability with which a jackpot occurs is constant. In the second embodiment, at the timing when symbols of one of the kinds of animals are rearranged in all of the areas of the symbol display region 4, a jackpot is won. In other words, a probability with which symbols of one of the kinds of animals are rearranged in all of the areas of the symbol display region 4 is constant independently of the number of BETs.

In the second embodiment, there are the five kinds of animals: the lion, the tiger, the panther, the leopard and the cheetah. Accordingly, a probability with which symbols of one of the lion, the tiger, the panther, the leopard and the cheetah are rearranged in all of the areas of the symbol display region 4 is constant independently of the number of BETs.

Probabilities, with each of which symbols of one of the lion, the tiger, the panther, the leopard and the cheetah are rearranged in all of the areas of the symbol display region 4, can be made different from one another in accordance with the kinds of animals. For example, a probability with which the symbols of the lion are rearranged in all of the areas of the symbol display region 4 can be made the lowest; a probability with which the symbols of the tiger are rearranged in all of the areas of the symbol display region 4 can be made the second lowest; a probability with which the symbols of the panther are rearranged in all of the areas of the symbol display region 4 can be made the third lowest; a probability with which the symbols of the leopard are rearranged in all of the areas of the symbol display region 4 can be made the fourth lowest; and a probability with which the symbols of the cheetah are rearranged in all of the areas of the symbol display region 4 can be made the highest. Thus, the probability with which the symbols of the cheetah are rearranged in all of the areas of the symbol display region 4 and a jackpot thereby occurs can be made the highest, and the probability with which the symbols of the lion are rearranged in all of the areas of the symbol display region 4 and a jackpot thereby occurs can be made the lowest.

For example, in the second embodiment, as shown in FIG. 102, each base money amount is defined so as to correspond to each of the kinds of animals. As shown in FIG. 102, the base money amount of the lion is the highest; the base money amount of the tiger is the second highest; the base money amount of the panther is the third highest; the base money amount of the leopard is the fourth highest; and the base money amount of the cheetah is the lowest. Accordingly, the rearrangement of the symbols of the lion whose base money amount is the highest is made difficult, thereby allowing the winning of the lion jackpot to be made difficult. In addition, the rearrangement of the symbols of the cheetah whose base money amount is the lowest is made easy, thereby allowing the winning of the cheetah jackpot to be made easy.

This can impart variations to winning of a jackpot, and thus, a player is allowed to have expectations of the occurrence of a jackpot, thereby allowing a motivation to continue a game to be provided for a player.

First, the main CPU 71 determines whether or not symbols of one of the lion, the tiger, the panther, the leopard and the cheetah are rearranged in all of the areas of the symbol display region 4 (step S10411). In other words, the main CPU 71 determines whether or not a jackpot is won.

Figure 106A:
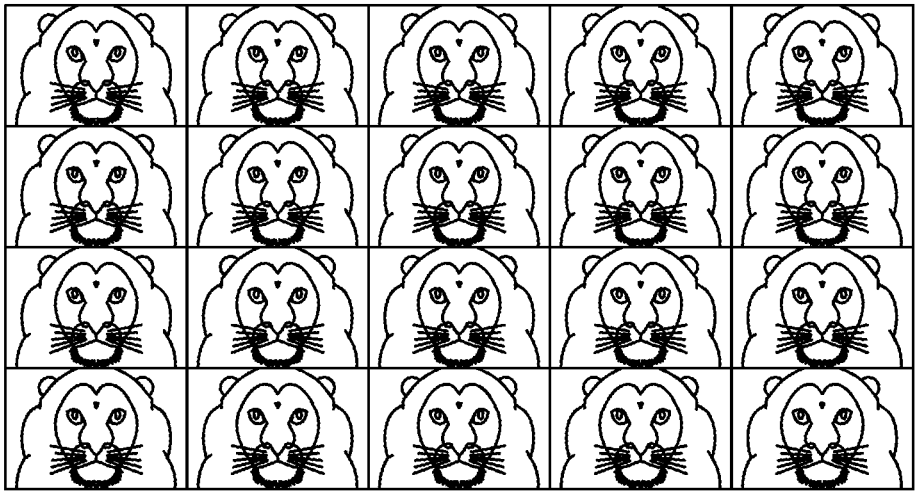
FIG. 106A shows a diagram illustrating a case where symbols of a lion are rearranged in all areas of a screen.

For example, as shown in FIG. 106A, when the symbols of the lion are rearranged in all of the areas of the symbol display region 4, a jackpot occurs. In the second embodiment, there are four stop positions along each of the five reels. When symbols of one of the kinds of animals are stopped and displayed in all of the 20 stop positions, a jackpot occurs. In other words, when upon rearranging symbols, symbols of only one of the kinds of animals are rearranged, a jackpot occurs.

Figure 106B:
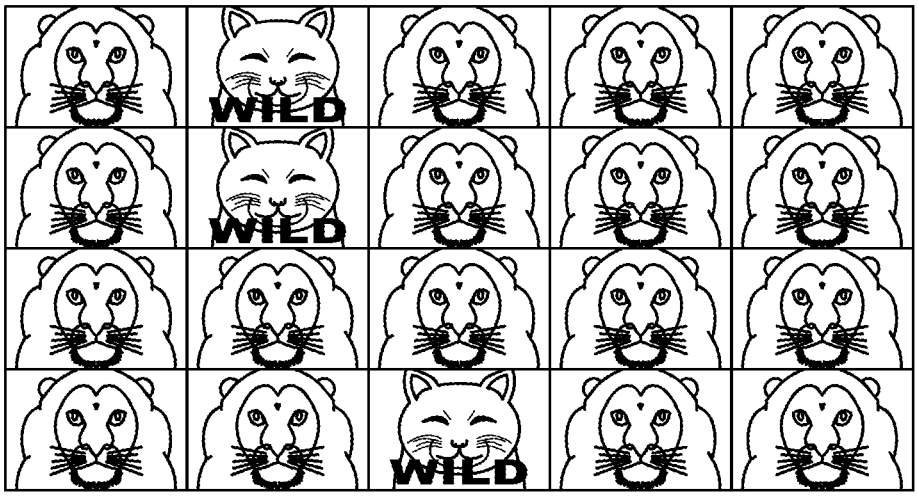
FIG. 106B shows a diagram illustrating a case where at least one wild symbol is included.

In addition, as shown in FIG. 106B, upon rearranging symbols, at least one wild symbol may be included. The at least one wild symbol is replaced with the same symbol as those of one of the kinds of animals, and only the symbols of one of the kinds of animals can be displayed, thereby allowing a jackpot to occur.

When determining that symbols of one of the kinds of animals are not rearranged in all of the areas of the symbol display region 4 (NO), the main CPU 71 immediately finishes this subroutine.

Next, the main CPU 71 reads out a value stored in the number-of-BET counter (step S10413). Thus, the number of BETs can be obtained.

Next, the main CPU 71 reads out a base money amount (step S10415). FIG. 102 is a table defining base money amounts. In FIG. 102, respective base money amounts defined so as to correspond to each maximum number of BETs in the BET CONFIG. and each of the kinds of animals are shown.

Specifically, a maximum number of BETs in the first BET CONFIG. (1, 2, 3, 4, and 5) is 5. A maximum number of BETs in the second BET CONFIG. (1, 2, 3, 5, and 10) is 10. A maximum number of BETs in the third BET CONFIG. (1, 2, 5, 10, and 15) is 15. A maximum number of BETs in the fourth BET CONFIG. (1, 2, 5, 10, and 20) is 20.

In the second embodiment, each base money amount is defined as follows: (maximum number of BETs)×(number of paylines)×(payout when five symbols of an animal targeted for betting are rearranged). In a case of the lion, each of the base money amount is defined to be doubled as follows: (maximum number of BETs)×(number of paylines)×(payout awarded when five symbols of an animal targeted for betting are rearranged)×2.

Next, the main CPU 71 determines whether or not the slot game is the free games (step S10417). When determining that the slot game is not the free games (NO), that is, when the slot game is the base game, the main CPU 71 calculates a payout money amount (step S10419). Subsequently, the main CPU 71 stores the payout money amount in the number-of-payout counter (step S10420). The process at this step S10420 is the same as the process at step S156 in FIG. 38.

In the process at step S10419, the payout money amount can be calculated as follows: (base money amount+accumulated money amount)×the number of BETs. Here, the accumulated money amount is the money amount calculated at step S10321 in FIG. 103 and stored at step S10323 in FIG. 103. As described above, the number of BETs is BET/LINE.

Here, the number of BETs is the number of BETs placed in a unit game played when a jackpot has been won. In other words, the number of BETs here is the number of BETs placed to initiate the unit game causing the jackpot to occur. Accordingly, a large payout amount can be provided for a player who has placed a large number of BETs in the unit game to play the game.

In the second embodiment, the occurrence of a jackpot is determined by a symbol drawing process at step S14 in FIG. 32. As described above, in the second embodiment, the probability of winning a jackpot is constant independently of the number of BETs. In other words, probabilities, with each of which symbols of one of the lion, the tiger, the panther, the leopard and the cheetah are rearranged in all of the areas of the symbol display region 4, are constant independently of the number of BETs. At step S14 in FIG. 32, with the probability of winning a jackpot being constant independently of the number of BETs, the symbol drawing process is executed.

Accordingly, a player cannot adjust easiness of winning of a jackpot by differentiating the numbers of BETs. However, as in the description for step S10419, the payout money amount is the money amount calculated by the multiplication by the number of BETs. Accordingly, in order for a player to try to assuredly obtain a large benefit by winning of a jackpot, it is required for a player to place a large number of BETs. By employing the above-described configuration, a motivation to invariably place a large number of BETs can be provided for a player, thereby bringing about a likelihood that a shop such as a casino can ensure a profit. In addition, upon winning a jackpot by placing a large number of BETs, a money amount paid out to a player can be made large through the multiplication by the large number of BETs, thereby allowing also a player's benefit to be ensured. As described above, a balance between the profit of a shop and the benefit of a player can be attained.

In the above-described example, the case where as the number of BETs for determining the payout money amount of a jackpot, the number of BETs placed in the unit game upon winning the jackpot is used is described. However, without using the above-mentioned number of BETs, an average value of the numbers of BETs may be used. The average value of the numbers of BETs placed each time betting is conducted is calculated and stored in the RAM 73. Upon winning a jackpot, the average value of the numbers of BETs may be read out from the RAM 73 and used. In order to make a average value of the numbers of BETs large, it is required to initiate a unit game by placing a large number of BETs. Accordingly, even in the case where the average value of the numbers of BETs is used, a motivation to invariably place a large number of BETs can be provided for a player.

Next, the main CPU 71 initializes the accumulated money amount corresponding to the animal which has caused the winning of a jackpot (step S10421) and finishes this subroutine. Accordingly, starting from when a next betting operation is performed, for the accumulated money amount corresponding to the animal which has caused the winning of the jackpot, accumulation is newly started.

On the other hand, each accumulated money amount corresponding to each of the animals which have not caused any winning of a jackpot is not initialized. Accordingly, each accumulated money amount corresponding to each of the animals which have not caused any winning of a jackpot remains as it is, and accumulation is subsequently conducted in a carried-over manner each time betting is conducted. By employing this configuration, a likelihood with which each of the animals which have not caused any winning of a jackpot this time is likely to cause winning of a jackpot and bring about a benefit in the near future can be sustained, thereby allowing a motivation to subsequently play a game to be provided for a player.

In the determination process at step S10417, when determining that the slot game is the free games (YES), the main CPU 71 counts the number of times at which a jackpot has been won in the free games (step S10423).

Next, the main CPU 71 determines whether or not the number of times at which a jackpot has been won in the free games is larger than two (step S10425). When determining that the number of times at which a jackpot has been won in the free games is not larger than two (NO), that is, when determining that the number of times at which a jackpot has been won in the free games is less than or equal to one, the main CPU 71 shifts the process to the above-described step S10419.

As described above, when the number of times at which a jackpot has been won in the free games is less than or equal to one, a payout money amount is calculated as follows: (base money amount+accumulated money amount)×the number of BETs. In other words, the same money amount as in the base game is calculated. In this case, the number of BETs is the number of BETs placed in a unit game which has caused a shift to the free games. Since each of the free games is a game which can be initiated without betting, the number of BETs cannot be determined. Therefore, upon first winning a jackpot during the free games, the number of BETs in the unit game which has caused the shift to the free games is used. As described above, even during the free games, upon first winning a jackpot, the same benefit as in the base game is provided for a player. By employing this configuration, a benefit can be provided for a player who has continued an investment in the base game before starting the free games.

In the determination process at step S10425, when determining that the number of times at which a jackpot has been won in the free games is larger than two (YES), the main CPU 71 determines only the base money amount as a payout money amount (step S10427) and shifts the process to step S10420.

Since each of the free games is a game which can be initiated without betting, a player can proceed with a game without consuming coins (credits). In other words, since no investment is made during the free games, when the number of times at which a jackpot has been won in the free games is greater than or equal to two, the addition of the accumulated money amount and the multiplication by the number of BETs are not performed, and only the base money amount is determined as the payout money amount. By employing this configuration, excessively providing a benefit for a player can be prevented, thereby also preventing a disadvantage for a shop such as a casino.

[Others]

The present invention is not limited to the above-described embodiments, and numerous other modifications and variations can be devised without departing from the scope of the invention.

For example, instead of the animal symbols, symbols of human images may be used. In this case, as a background image related to each character symbol, clothing which a human of an image selected in the selection game wears may be displayed.

REFERENCE SIGNS LIST

1: slot machine
3: video reels
3*a*: first video reel ("Reel 1")
3*b*: second video reel ("Reel 2")
3*c*: third video reel ("Reel 3")
3*d*: fourth video reel ("Reel 4")
3*e*: fifth video reel ("Reel 5")
4: symbol display area
141: lower side image display panel

What is claimed is:

1. A slot machine comprising:

a symbol display device having symbol display regions for displaying a part of reel strips on which a plurality of kinds of symbols including particular symbols are arranged;

a processor for causing a game to proceed by displaying the reel strips in a scrolling manner and by arranging a plurality of symbols in the symbol display regions of the symbol display device for each unit game in a viewable manner;

a value-addition mechanism by which credits to be bet can be added to the slot machine and credited to a credit meter;

a bet-placing mechanism by which a player can bet an amount of credits on an outcome of the game to be played; and a pay-out mechanism by which credits can be paid out to the player or credited to the credit meter under control of the processor and in accordance with a final outcome of the game, the processor being programmed to execute, as a result of the player having bet credits, processes (1) and (2) described below;

(1) A process in which in regions outside the symbol display regions, a plurality of the particular symbols are arranged in succession, the process being executed for each unit game;

(2) A process in which after the particular symbols have been arranged in succession by the process (1), scrolling of the reel strips is started and the particular symbols are caused to be viewable in the symbol display regions.

2. The slot machine according to claim 1, wherein the processor for executing the game executes a base game and a separate game including a plural number of games, to which the game shifts when a particular trigger occurs in the base game, and further, when the processor executes the process (1) for each execution of the separate game, the processor is previously set to arrange the particular symbols in succession such that a number of the particular symbols to be arranged in succession is large, as compared with a number of the particular symbols to be arranged in succession on the reel strips used in the base game.

3. The slot machine according to claim 2, further comprising a memory for storing symbols to be arranged on the reel strips used in the base game and on the reel strips used in the separate game.

4. The slot machine according to claim 1, wherein the particular symbols are arranged in succession in a direction opposite to a scrolling direction with a starting point being a position adjacent to the symbol display regions.

5. The slot machine according to claim 4, wherein the starting point is a position being separated from the symbol display regions by a predetermined number of symbols.

6. The slot machine according to claim 5, wherein the predetermined number of symbols is more than or equal to zero and is less than or equal to a number of symbols to be arranged in the symbol display regions along the reel strips in a viewable manner.

7. The slot machine according to claim 4, wherein the processor determines by a drawing process: whether or not to arrange the particular symbols whose number is made larger than the number of the particular symbols to be arranged in succession; and the starting point.

8. The slot machine according to claim 1, wherein the particular symbols are distinct from wild symbols.

* * * * *